US007985520B2

(12) United States Patent
Li et al.

(10) Patent No.: US 7,985,520 B2
(45) Date of Patent: Jul. 26, 2011

(54) PHOTORECEPTOR, IMAGE FORMATION METHOD, IMAGE FORMING APPARATUS AND PROCESS CARTRIDGE

(75) Inventors: Hongguo Li, Numazu (JP); Kazukiyo Nagai, Numazu (JP); Kyohji Okada, Fuji (JP); Tamotsu Horiuchi, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 385 days.

(21) Appl. No.: 12/315,090

(22) Filed: Nov. 26, 2008

(65) Prior Publication Data

US 2009/0162763 A1 Jun. 25, 2009

(30) Foreign Application Priority Data

Nov. 29, 2007 (JP) ..... 2007-308988

(51) Int. Cl.
*G03G 5/07* (2006.01)

(52) U.S. Cl. ..... 430/58.7; 430/66

(58) Field of Classification Search ..... 430/58.7, 430/66

See application file for complete search history.

(56) References Cited

U.S. PATENT DOCUMENTS

| | | | |
|---|---|---|---|
| 5,998,072 | A | 12/1999 | Mochizuki et al. |
| 6,899,983 | B2 | 5/2005 | Tamoto et al. |
| 6,939,651 | B2 | 9/2005 | Li et al. |
| 7,416,823 | B2 | 8/2008 | Yanagawa et al. |
| 2005/0221210 | A1 | 10/2005 | Suzuki et al. |
| 2006/0014093 | A1 | 1/2006 | Li et al. |
| 2006/0160003 | A1 | 7/2006 | Nagai et al. |
| 2006/0292480 | A1* | 12/2006 | Niimi ..... 430/124 |
| 2007/0117033 | A1 | 5/2007 | Sugino et al. |
| 2007/0196750 | A1* | 8/2007 | Fujiwara et al. ..... 430/58.7 |
| 2007/0231720 | A1 | 10/2007 | Mori et al. |
| 2007/0268354 | A1* | 11/2007 | Inaba et al. ..... 347/144 |
| 2007/0269729 | A1 | 11/2007 | Ikuno et al. |
| 2007/0292780 | A1 | 12/2007 | Nagai et al. |
| 2008/0138725 | A1 | 6/2008 | Fujiwara et al. |

FOREIGN PATENT DOCUMENTS

| | | |
|---|---|---|
| JP | 56-048637 | 5/1981 |
| JP | 60-177349 | 9/1985 |
| JP | 63-065449 | 3/1988 |
| JP | 64-001728 | 1/1989 |
| JP | 02-143257 | 6/1990 |
| JP | 02-144550 | 6/1990 |
| JP | 04-281461 | 10/1992 |
| JP | 07-128872 | 5/1995 |
| JP | 07-295248 | 11/1995 |
| JP | 07-301936 | 11/1995 |
| JP | 08-082940 | 3/1996 |

(Continued)

OTHER PUBLICATIONS

U.S. Appl. No. 11/938,006.

*Primary Examiner* — Hoa V Le
(74) *Attorney, Agent, or Firm* — Cooper & Dunham LLP

(57) ABSTRACT

A photoreceptor including an electroconductive substrate and a photosensitive layer located overlying the electroconductive substrate, the photosensitive layer including a cross-linking surface layer including a cross-linked copolymer of a radical polymerizable monomer (I) having at least three functional groups without a charge transport structure and a radical polymerizable monomer (II) having a charge transport structure, and a polysiloxane-acryl block copolymer having a charge transport property.

7 Claims, 7 Drawing Sheets

FOREIGN PATENT DOCUMENTS

| | | |
|---|---|---|
| JP | 08-190213 | 7/1996 |
| JP | 10-254160 | 9/1998 |
| JP | 2000-010322 | 1/2000 |
| JP | 2000-066425 | 3/2000 |
| JP | 3194392 | 6/2002 |
| JP | 3262488 | 12/2002 |
| JP | 2005-208112 | 8/2005 |
| JP | 2006-047949 | 2/2006 |

* cited by examiner

PHOTORECEPTOR, IMAGE FORMATION METHOD, IMAGE FORMING APPARATUS AND PROCESS CARTRIDGE

BACKGROUND OF THE INVENTION

1. Field of the Invention

The present invention relates to a photoreceptor and an image formation method, an image forming apparatus and a process cartridge using the photoreceptor.

2. Discussion of the Background

Recently, organic photoconductors (photoreceptors) have been used in place of inorganic photoreceptors for a photocopier, a facsimile machine, a laser printer and a multifunctional device thereof in light of performances and advantages, such as, (a) optical characteristics, for example, width of the range of optical absorption wavelength and size of the amount of absorption of light; (b) electric characteristics, for example, high sensitivity and stable chargeability; (c) a wide selection of materials; (d) ease of manufacturing; (e) inexpensiveness cost; and (f) toxic-free property.

In addition, demand for the size reduction of an image forming apparatus accelerates the size reduction of an image bearing member (photoreceptor). Also, high speed performance and maintenance-free performance have been demanded. Therefore, an image bearing member having high durability has been desired. From this point of view, an organic photoconductor is soft in general and easy to wear down because the surface layer thereof is mainly made of a low molecular weight charge transport material and an inert polymer. When such an organic photoconductor is repetitively used in the electrophotography process, the organic photoconductor tends to be abraded under mechanical stress by a developing system or a cleaning system. In addition, in accordance with demand for the size reduction of toner particles to improve the quality of images, the rubber of a cleaning blade is hardened and the contact pressure between an image bearing member and a cleaning blade is increased to improve the cleaning performance. This accelerates the abrasion of an image bearing member. Such abrasion of an image bearing member causes deterioration of electric characteristics, for example, the sensitivity and the chargeability, resulting in abnormal images, for example, deterioration of image density and the background fouling. When an image bearing member is locally damaged by abrasion, the damaged portion causes streaks on an image resulting from bad cleaning performance on the image bearing member. Currently, this abrasion or damage is a controlling factor of the lifetime of an image bearing member and once an image bearing member has such abrasion or damage, the image bearing member must be replaced immediately to sustain image quality and performance.

Reducing the amount of abrasion described above is desired to obtain an organic photoconductor having a high durability. This is an imminent issue to be solved in this field.

As a technology to improve the anti-abrasion property of an image bearing member, for example, (1): unexamined published Japanese patent application No. (hereinafter referred to as JOP) S56-48637 describes a technology in which a curing binder is used for a surface layer; (2): JOP S64-1728 describes a technology in which a polymer charge transport material is used; and (3) JOP H4-281461 describes a technology in which an inorganic filler is dispersed in a surface layer. Among these technologies, with regard to the curing binder of (1), the residual voltage tends to rise due to bad compatibility between the curing binder and a charge transport material and remaining impurities, for example, a polymerization initiator or non-reacted groups, which results in reduction in image density. The polymer charge transport material of (2) or the dispersed inorganic filler of (3) improves the anti-abrasion property of an organic photoconductor in some degree but not sufficiently to the level required for an organic photoconductor. Furthermore, the residual voltage rises due to the trap present on the surface of the inorganic filler in the case of (3), which tends to cause a decrease in image density. Consequently, the technologies of (1) to (3) do not sufficiently satisfy the total durability including electric durability and mechanical durability required for an organic photoconductor.

Furthermore, to improve the anti-abrasion property and anti-damage property of the organic photoconductor described in (1), Japanese Patent No. (hereinafter referred to as JP) 3262488 describes an organic photoconductor containing an acrylate monomer cured compound having multiple functional groups. Although there is a description that the surface layer provided on the photosensitive layer contains the acrylate monomer cured compound, there is no specific description about a charge transport material but just a description that a charge transport material can be contained in the surface layer. In addition, when a charge transport material having a low molecular weight is simply contained, a problem of the compatibility between the cured compound and the charge transport material arises. This problem causes precipitation of a transport material having a low molecular weight and white turbidity phenomenon, which may result in deterioration of the mechanical strength of the organic photoconductor.

Furthermore, this organic photoconductor is manufactured by reacting the monomer in the state in which a polymer binder is contained so that the curing reaction is not sufficiently conducted. In addition, the compatibility between the cured material and the binder resin is bad and therefore, the phase separation tends to occur during the curing reaction and lead to formation of a rough surface, which leads to bad cleaning performance.

As the anti-abrasion technology for a photosensitive layer in place of these technologies, for example, JP 3194392 describes a charge transport layer manufactured by using a liquid application formed by a monomer having a carbon-carbon double bond, a charge transport material having a carbon-carbon double bond and a binder resin. The binder resin contains a binder resin having a carbon-carbon double bond and a binder resin having no carbon-carbon double bond. That is, the binder resin having a carbon-carbon double bond reacts with the charge transport material but the binder resin having no carbon-carbon double bond does not react with the charge transport material. It is notable that this organic photoconductor has an anti-abrasion property and electric characteristics in a good combination. However, there is a tendency that when the binder non-reactive with the charge transport material is used, the compatibility between the binder resin and the cured material obtained by the reaction between the monomer mentioned above and the charge transport material is bad and therefore, phase separation tends to occur during cross-linking and leads to formation of a rough surface, which results in bad cleaning performance.

In addition, as described above, the binder resin prevents curing of the monomer and since the monomers specified in JP 3194392 have only two functional groups, the density of the cross-linking is not sufficient. Therefore, the anti-abrasion property obtained in this case is still insufficient.

In addition, even when the binder is reactive with the transport material, the number of the functional groups contained in the monomer and the binder resin is small. Therefore, it is difficult to have a good combination of the combined amount of the charge transport material and the cross-linking density and thus, the electric characteristics and anti-abrasion property are not sufficient.

For example, JOP 2000-66425 describes a photosensitive layer containing a compound cured from a positive hole transport material having at least two chain reaction polymerizable functional groups in a molecule.

However, this photosensitive layer contains the bulky positive hole transport material having at least two chain reaction polymerizable functional groups so that the cured compound has distortion and thus the internal stress is strong. Therefore, the surface of the photosensitive layer tends to be rough and cracking easily occurs over time, meaning that the surface does not have a sufficient durability.

In addition, when an anti-abrasion property of a photoreceptor is improved but causes bad cleaning performance, production of abnormal images with image blur, etc. and image quality deterioration, it can hardly be said that the photoreceptor has a good durability. Especially, when a polymerization or spherical toner which is popular in this technology field is removed from a photoreceptor having a high surface energy (or a high friction index), the toner revolves and remains between the photoreceptor and the cleaning blade and slips therethrough, resulting in bad cleaning performance.

Methods of adding various kinds of lubricants to the surface layer of a photoreceptor have been used and known to reduce the surface energy and the friction index of the surface of the photoreceptor. For example, a method is known in which a lubricant such as a fluorine modified silicone oil is contained in a surface layer. This method is effective to improve cleanability and remove impurities by reducing the surface energy of a photoreceptor. However, this fluorine modified silicone oil moves close to the surface in the process of forming the protective layer and therefore is lost from the surface layer during repeated use. Resultantly, the effect is lost in the early stage due to an extremely small amount of abrasion of the surface layer. Thus, actually, the technology does not sufficiently improve the durability of a photoreceptor.

Various kinds of methods have been tried to add lubricant particulates to the surface layer of a photoreceptor. For example, silicon resin particulates, fluorine containing resin particulates (for example, JOP S63-65449) or melamine resin particulates (JOP S60-177349) can be added. Furthermore, there are methods which describe containing particulates or powder such as polyethylene powder fluorine containing resin powder (JOP H02-143257), fluorine resin (JOP H02-144550), silicone particulates (JOPs H07-128872 and H10-254160) or cross-linking type organic particulates (JOP 2000-010322 and U.S. Pat. No. 5,998,0772) in the surface layer.

Additionally, there is a method of containing methyl siloxane resin particulates in a surface layer (JOP H08-190213). The methods in which these lubricant particulates are dispersed in the surface layer of a photoreceptor are effective in terms of increasing stability of the effect in comparison with the method of adding silicone oil.

However, since the lubricant is contained in the charge transport layer having an insufficient abrasion property, the effect of restraining the attachment of various kinds of materials at initial stage does not continue for an extended period of time.

Furthermore, a method in which acryl modified polyorganosiloxane having compatibility with a binder resin is contained in the surface layer (JOPs 2005-208112 and 2006-17949) is proposed and effective in terms of reduction in the surface energy, improvement on the anti-abrasion property and cleaning property and restraint of occurrence of image blur. However, the cleaning blade is continuously made in touch with the photoreceptor and tends to be broken prior to the photoreceptor, which has an adverse impact on the working life of a process cartridge.

As described above, currently the typical photoreceptors having a cross-linking photosensitive layer containing a lubricant do not have sufficient property in total.

SUMMARY OF THE INVENTION

Because of these reasons, the present inventors recognize that a need exists for a photoreceptor which has an excellent cleaning property for a polymerization toner, stable and excellent anti-abrasion property and excellent electric characteristics to produce quality images for an extended period of time and an image formation method, an image forming apparatus and a process cartridge using such a photoreceptor.

Accordingly, an object of the present invention is to provide a photoreceptor which has an excellent cleaning property for a polymerization toner, stable and excellent anti-abrasion property and excellent electric characteristics to produce quality images for an extended period of time and an image formation method, an image forming apparatus and a process cartridge using such a photoreceptor.

Briefly this object and other objects of the present invention as hereinafter described will become more readily apparent and can be attained, either individually or in combination thereof, by a photoreceptor including an electroconductive substrate and a photosensitive layer located overlying the electroconductive substrate, the photosensitive layer including a cross-linking surface layer including a cross-linked copolymer of a radical polymerizable monomer (I) having at least three functional groups without a charge transport structure and a radical polymerizable monomer (II) having a charge transport structure, and a polysiloxane-acryl block copolymer having a charge transport property.

It is preferred that, in the photoreceptor mentioned above, the polysiloxane-acryl block copolymer is formed by using a radical polymerizable monomer (III) having a charge transport structure represented by the following chemical structure (1) or (2):

Chemical Structure (1)

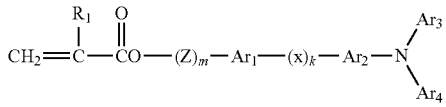

Chemical structure (2)

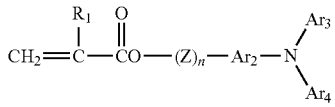

where $R_1$ represents hydrogen atom, a halogen atom, a substituted or non-substituted alkyl group, a substituted or non-substituted aralkyl group, a substituted or non-substituted aryl group, cyano group, nitro group or an alkoxy group, or —$COOR_7$ ($R_7$ represents hydrogen atom, a substituted or non-substituted alkyl group, a substituted or non-substituted aralkyl group, or a substituted or non-substituted aryl group); a halogenated carbonyl group or $CONR_8R_9$ ($R_8$ and $R_9$ each, independently, represent hydrogen atom, a halogen atom, a substituted or non-substituted alkyl group, a substituted or non-substituted aralkyl group, or a substituted or non-substituted aryl group); $Ar_1$ and $Ar_2$ each, independently, represent an arylene group; $Ar_3$ and $Ar_4$ each, independently, represent a substituted or unsubstituted aryl group; X represents an alkylene group, a cycloalkylene group, an alkylene ether group, oxygen atom, sulfur atom, or vinylene group; Z represents an alkylene group, an alkylene ether group, an alkyleneoxy carbonyl group or a phenyl alkylene group; k represents 0 or 1 and m and n each, independently, represent 0 or an integer of from 1 to 3.

It is still further preferred that, in the photoreceptor mentioned above, the polysiloxane-acryl block copolymer is formed by using a radical polymerizable monomer (IV) having a charge transport structure represented by the following chemical structure (3):

Chemical structure (3)

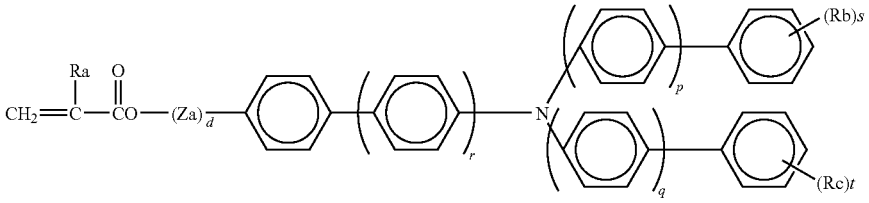

where d, r, p, q each, independently, represent 0 or 1, s and t each, independently, represent 0 or an integer of from 1 to 3, Ra represents hydrogen atom or methyl group, Rb and Rc each, independently, represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

It is still further preferred that, in the photoreceptor mentioned above, the photosensitive layer has a laminar structure including a charge generation layer, a charge transport layer and the surface layer from the electroconductive substrate side.

As another aspect of the present invention, an image formation method is provided which includes forming a latent electrostatic image on the photoreceptor mentioned above, developing the latent electrostatic image with toner to form a visualized image, transferring the visualized image to a recording medium and fixing the visualized image on the recording medium.

As another aspect of the present invention, an image forming apparatus is provided which includes the photoreceptor mentioned above, a latent electrostatic image formation device to form a latent electrostatic image on the photoreceptor, a development device to develop the latent electrostatic image with toner to form a visualized image, a transfer device to transfer the visualized image to a recording medium and a fixing device to fix the visualized image on the recording medium.

As another aspect of the present invention, a process cartridge is provided which includes the photoreceptor mentioned above and at least one devices selected from the group consisting of a charging device, a development device, a transfer device, a cleaning device, and a discharging device, wherein the process cartridge is detachably attachable to an image forming apparatus.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
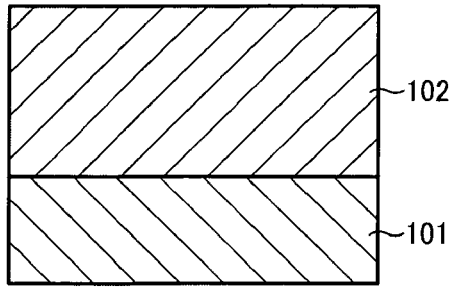
FIG. 1 is a diagram illustrating a cross section of an example of the photoreceptor of the present invention which has a single-layered structure including a photosensitive layer having the charge generation function and the charge transport function simultaneously on an electroconductive substrate and in which the entire photosensitive layer is a cross-linking surface layer.

The present invention will be described below in detail with reference to several embodiments and accompanying drawings.

The photoreceptor of the present invention includes a photosensitive layer on an electroconductive substrate and a polysiloxane-acryl block copolymer having a charge transport property is dispersed in the surface layer of the photosensitive layer. The surface layer is a cross-linking resin layer formed by curing a radical polymerizable monomer (II) having a charge transport structure and a radical polymerizable monomer (I) having at least three functional groups without a charge transport structure. The photoreceptor has an excellent cleaning property and a high durability to stably produce quality images for an extended period of time.

The mechanism is as follows:

Since the cross-linking surface layer for use in the present invention includes a polysiloxane-acryl block copolymer having a charge transport property, foreign objects such as discharge products, external additives to toner and paper dust on the surface of a photoreceptor are easily removed so that the surface energy of the photoreceptor decreases and the release property improves. Furthermore, since the polysiloxane-acryl block copolymer has a charge transport structure and thus a good compatibility with the radical polymerizable monomer (II) having a charge transport property in the cross-linking surface layer, dispersability before the cross-linking reaction is good and the phase separation during the reaction hardly occurs. Dispersability and sustainability of low friction after cross-linking reaction are significantly improved. Therefore, the surface smoothness of a photoreceptor extremely ameliorates so that the anti-abrasion property and a low surface energy thereof are in good combination. Since the polysiloxane-acryl block copolymer has an excellent compatibility and charge transport property, when the polysiloxane-acryl-block copolymer is added to the cross-linking surface layer in a relatively large amount, the cross-linking reaction with the radical polymerizable monomer (II) is not easily inhibited and in addition the side effect to the electric characteristics such that the residual voltage is high hardly occurs. That is, a photoreceptor simultaneously having a high durability and a high sensitivity is obtained.

Since a siloxane unit and an acryl unit are simultaneously present in the molecular chain of the polysiloxane-acryl block copolymer, the compatibility with a binder resin is improved. Resultantly, a stable surface layer which maintains the surface energy low can be provided.

Furthermore, the photoreceptor of the present invention has a surface layer (the most outer layer) cured by using a radical polymerizable monomer. Consequently, a stereo network structure is developed, resulting in a highly hard cross-linking surface layer having an extremely high cross-linking degree (i.e., great durability against abrasion). Among such radical polymerizable monomers, a radical polymerizable monomer (I) having at least three functional groups without a charge transport structure is preferably used to have a strong stereo network structure. Using a radical polymerizable monomer (II) having a charge transport structure in combination with the radical polymerizable monomer (I) is effective to produce quality images.

Since the surface layer of the photoreceptor of the present invention is a cross-linking resin layer obtained by dispersing a polysiloxane-acryl block copolymer having a charge transport property in radical polymerizable monomers (I) and (II) for curing, the photoreceptor maintains a low surface energy and a good anti-abrasion property. Thus, the photoreceptor has a good surface smoothness and excellent electric characteristics.

As a result, foreign objects such as discharge products, external additives to toner and paper dust, which tend to be attracted to the surface of a photoreceptor, are hardly attracted thereto or even when such foreign objects are attached to the surface, the foreign objects are easily removed therefrom. Furthermore, this effect is significantly stabilized, which has a good impact on, for example, limiting the occurrence of image blur, improving the transfer ratio, the cleaning property and the anti-abrasion property, and restraining the occurrence of filming and production of abnormal images due to the attachment of foreign objects to obtain high durability and quality images.

Surface Layer (Cross Linking Surface Layer)

Next, material compositions of liquid application for forming the cross-linking surface layer of the present invention are described.

The polysiloxane-acryl block copolymer having a charge transport property for use in the photoreceptor of the present invention is described first.

Any block polymer having a charge transport component, a polysiloxane component and an acryl component can be used as the polysiloxane-acryl block copolymer having a charge transport property for use in the photoreceptor of the present invention. Preferred block copolymers are represented by the following chemical structures (I) and (II) in terms of the balance among polymerization property, electric characteristics, and low surface free energy. The number average molecular weight of such block copolymers is preferably from 5,000 to 50,000.

In the chemical structures (4) and (5), $R_1$ represents hydrogen atom, a halogen atom, a substituted or non-substituted alkyl group, a substituted or non-substituted aralkyl group, a substituted or non-substituted aryl group, cyano group, nitro group, an alkoxy group, or —$COOR_7$ ($R_7$ represents hydrogen atom, a substituted or non-substituted alkyl group, a substituted or non-substituted aralkyl group, or a substituted or non-substituted aryl group); a halogenated carbonyl group or $CONR_8R_9$ ($R_8$ and $R_9$ each, independently, represent hydrogen atom, a halogen atom, a substituted or non-substituted alkyl group, a substituted or non-substituted. Aralkyl group, or a substituted or non-substituted aryl group); $Ar_1$ and $Ar_2$ each, independently, represent an arylene group; $Ar_3$ and $Ar_4$ each, independently, represent an aryl group; X represents an alkylene group, a cycloalkylene group, an alkylene ether group, oxygen atom, sulfur atom, or vinylene group; Z represents an alkylene group, an alkylene ether group or an alkyleneoxy carbonyl group; $R_2$ represents an alkyl group, an alkoxy group substituted alkyl group, a cycloalkyl group or an aryl group; and a represents 0 or 1, m and n each, independently, represent 0 or an integer of from 1 to 3 and p represents an integer of from 10 to 300.

The polysiloxane-acryl block copolymer having a charge transport property is synthesized by a living polymerization method, a polymerization initiator method, a polymer chain reaction moving method, etc. Industrially speaking, the polymerization initiator method is preferred.

In the polymerization initiator method, for example, an azo-based radical polymerization initiator represented by the following chemical structure (III) is used to copolymerize a radical polymerizable monomer (II) having a charge transport structure and an acryl monomer for effective synthesis of a block copolymer.

Chemical structure (III)

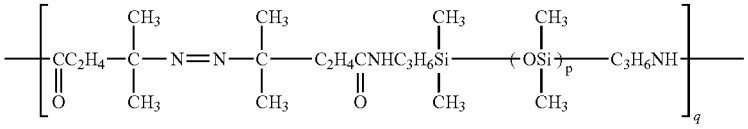

In Chemical structure (III), p represents an integer of from 10 to 300 and q represents an integer of from 1 to 50.

The radical polymerizable monomer having a charge transport structure for use in the polysiloxane-acryl block copolymer having a charge transport property in the present invention is, for example, a compound having a positive hole transport structure, for example, triarylamine, hydrazone, pyrazoline, and carbazole, or an electron-transport structure, for example, electron-sucking aromatic ring having condensed polycyclic quinone, diphenoquinone, cyano group, and nitro group, and a radical polymerizable functional group (in one molecule). Acryloyloxy group, methacryloyloxy group and vinyl group are suitable as the radical polymerizable functional groups. In addition, it is good to select a triaryl amine structure as the charge transport structure. Among them, the number of the radical polymerizable groups is preferably one (one functional group). In addition, when a radical polymerizable monomer (III) represented by the following chemical structures (1) or (2) is used, good electric characteristics are sustained.

Chemical structure (1)

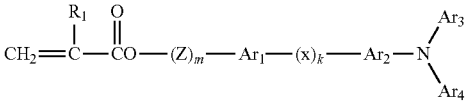

Chemical structure (2)

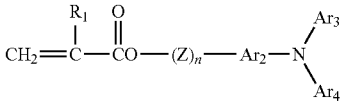

In the chemical structures (1) and (2), $R_1$ represents hydrogen atom, a halogen atom, an alkyl group, a substituted or non-substituted aralkyl group, a substituted or non-substituted aryl group, a cyano group, a nitro group, an alkoxy group, —$COOR_7$, wherein $R_7$ represents hydrogen atom, a substituted or non-substituted alkyl group, a substituted or non-substituted aralkyl group or a substituted or non-substituted aryl group, a halogenated carbonyl group or $CONR_8R_9$, wherein $R_8$ and $R_9$ each, independently, represent hydrogen atom, a halogen atom, a substituted or non-substituted alkyl group, a substituted or non-substituted aralkyl group or a substituted or non-substituted aryl group, $Ar_1$ and $Ar_2$ each, independently, represent an arylene group, $Ar_3$ and $Ar_4$ each, independently, represent an aryl group, X represents an alkylene group, an cycloalkylene group, an alkylene ether group, oxygen atom, sulfur atom or vinylene group, Z represents an alkylene group, an alkylene ether divalent group or an alkyleneoxy carbonyl divalent group, a represents 0 or 1 and m and n represent 0 or an integer of from 1 to 3.

In the chemical structures (1) and (2), in the substitution group of $R_1$, specific examples of the alkyl groups include, but are not limited to, methyl group, ethyl group, propyl group, and butyl group; specific examples of the aryl groups include, but are not limited to, phenyl group and naphthyl group; specific examples of the aralkyl groups include, but are not limited to, benzyl group, phenethyl group and naphthylmethyl group; specific examples of the alkoxy groups include, but are not limited to, methoxy group, ethoxy group, and propoxy group. These groups can be substituted by a halogen atom; nitro group; cyano group; an alkyl group, for example, methyl group and ethyl group; an alkoxy group, for example, methoxy group and ethoxy group; an aryloxy group, for example, phenoxy group; an aryl group, for example, phenyl group and naphthyl group; or an aralkyl group, for example, benzyl group and phenethyl group.

In the chemical structures (1) and (2), among the substituent groups of $R_1$, hydrogen atom, and methyl group are particularly preferred.

Substituted or non-substituted $Ar_3$ and $Ar_4$ are aryl groups, and specific examples thereof include, but are not limited to, condensed polycyclic hydrocarbon groups, non-condensed cyclic hydrocarbon groups, and heterocyclic groups.

Preferred specific examples of the condensed polycyclic hydrocarbon group include, but are not limited to, groups in which the number of the carbon atoms forming a ring is 18 or less. Specific examples thereof include, but are not limited to, pentanyl group, indenyl group, naphthyl group, azulenyl group, heptalenyl group, biphenylenyl group, as-indacenyl group, s-indacenyl group, fluorenyl group, acenaphthylenyl group, pleiadenyl group, acenaphtenyl group, phenalenyl group, phenanthryl group, anthryl group, fluoranthenyl group, acephenantolylenyl group, aceanthrylenyl group, triphenylel group, pyrenyl group, chrysenyl group and naphthacenyl group.

Specific examples of the uncondensed cyclic hydrocarbon groups include, but are not limited to, monovalent groups derived from monocyclic hydrocarbons such as benzene, diphenyl ether, polyethylene diphenyl ether, diphenyl thioether and diphenyl sulfone or uncondensed polycyclic hydrocarbons such as, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, monovalent groups derived from ring aggregation hydrocarbons such as 9,9-diphenyl fluorene can also be used.

Specific examples of the heterocyclic groups include, but are not limited to, monovalent groups derived from carbazole, dibenzofuran, dibenzothiophene, oxadiazole, thiazole, etc.

The aryl groups represented by $Ar_3$ and $Ar_4$ may have the following substituent groups.

(1) A halogen atom, cyano group, nitro group, etc.

(2) A straight-chain or branched-chain alkyl group having 1 to 12 carbon atoms, more preferably 1 to 8 carbon atoms, and much more preferably 1 to 6 carbon atoms, which may substituted with fluorine atom; hydroxyl group; cyano group; an alkoxy group having 1 to 4 carbon atoms; or a phenyl group substituted with a halogen atom, an alkyl group having 1 to 6 carbon atoms, or an alkoxy group having 1 to 4 carbon atoms. Specific examples of the alkyl groups and the alkoxy groups include, but are not limited to, methyl group, ethyl group, n-butyl group, i-propyl group, t-butyl group, s-butyl group, n-propyl group, trifluoromethyl group, 2-hydroxyethyl group, 2-ethoxyethyl group, 2-cyanoethyl group and 2-methoxyethyl group.

(3) An alkoxy group (—$OR_2$, wherein $R_2$ represents an alkyl group defined in the paragraph (2)). Specific examples of the alkoxy groups include, but are not limited to, methoxy group, ethoxy group, n-propoxy group, i-propoxy group, t-butoxy group, n-butoxy group, s-butoxy group, i-butoxy group, 2-hydroxyethoxy group, and trifluoromethoxy group.

(4) An aryloxy group. Specific examples of the aryl groups include, but are not limited to, phenyl group and naphthyl group. The aryloxy group can be substituted with an alkoxy group having 1 to 4 carbon atoms, an alkyl group having 1 to 6 carbon atoms, or a halogen atom. Specific examples of the aryloxy groups include, but are not limited to, phenoxy group, 1-naphthyloxy group, 2-naphthyloxy group, 4-methoxyphenoxy group, and 4-methylphenoxy group.

(5) An alkylmercapto group or an arylmercapto group. Specific examples of these groups include, but are not limited to, methylthio group, ethylthio group, phenylthio group, and p-methylphenylthio group.

(6) A substituent group represented by the following chemical structure:

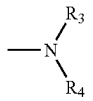

wherein each of $R_3$ and $R_4$ independently represents a hydrogen atom, an alkyl group defined in the paragraph (2), or an aryl group (e.g., phenyl group, biphenyl group, naphthyl group) which can be substituted with an alkoxy group having 1 to 4 carbon atoms, an alkyl group having 1 to 4 carbon atoms, or a halogen atom; and wherein $R_3$ and $R_4$ optionally share bond connectivity to form a ring. Specific examples of the substituent groups mentioned above include, but are not limited to, amino group, diethylamino group, N-methyl-N-phenylamino group, N,N-diphenylamino group, N,N-di(tolyl)amino group, dibenzylamino group, piperidino group, morpholino group, and pyrrolidino group.

(7) An alkylenedioxy group and an alkylenedithio group such as methylenedioxy group and methylenedithio group.

(8) styryl group, a β-phenyl styryl group, diphenyl aminophenyl group, ditolyl aminophenyl group, etc.

Specific examples of the arylene groups represented by $Ar_1$ and $Ar_2$ which can have a substituted group of (1) to (8) mentioned above include, but are not limited to, divalent groups derived from the aryl groups represented by $Ar_3$ and $Ar_4$ (i.e., groups in which -nyl of the aryl group is changed to -nylene to obtain an arylene group, e.g. pentanyl group changed to pentanylene group). More specifically, these arylene groups include, but are not limited to, condensed polycyclic hydrocarbon groups and non-condensed cyclic hydrocarbon groups Specific examples of the condensed polycyclic hydrocarbon groups include, but are not limited to, groups in which the number of the carbon atoms forming a ring is 18 or less. Specific examples thereof include, but are not limited to, pentanylene group, indenylene group, naphthylene group, azulenylene group, heptalenylene group, biphenylenylene group, as-indacenylene group, s-indacenylene group, fluorenylene group, acenaphthylenylene group, pleiadenylene group, acenaphtenylene group, phenalenylene group, phenanthrylene group, anthrylene group, fluoranthenylene group, acephenantolylenylene group, aceanthrylenylene group, triphenylelene group, pyrenylene group, chrysenylene group and naphthacenylene group.

Specific examples of the uncondensed cyclic hydrocarbon groups include, but are not limited to, monovalent groups derived from benzene, diphenyl ether, polyethylene diphenyl ether, diphenyl thioether, diphenyl sulfone, biphenyl, polyphenyl, diphenyl alkane, diphenyl alkene, diphenyl alkyne, triphenylmethane, distyrylbenzene, 1,1-diphenyl cycloalkane, polyphenyl alkane, and polyphenyl alkene. In addition, divalent groups derived from polycyclic hydrocarbons such as 9,9-diphenyl fluorene can also be used.

Specific examples of the heterocyclic groups include, but are not limited to, divalent groups derived from carbazole, dibenzofuran, dibenzothiophene, oxadiazole, thiazole, etc.

X represents an alkylene group, a cycloalkylene group, an alkylene ether group, oxygen atom, sulfur atom, or vinylene group.

The alkylene group is a straight-chained or branched-chain alkylene group having 1 to 12 carbon atoms, preferably 1 to 8 carbon atoms, and more preferably 1 to 4 carbon atoms. These alkylene groups may have a fluorine atom, a hydroxyl group, a cyano group, an alkoxy group having 1 to 4 carbon atoms, a phenyl group, or a phenyl group substituted with a halogen atom, an alkyl group having 1 to 4 carbon atoms, or an alkoxy group having 1 to 4 carbon atoms. Specific examples of the alkylene groups and the alkoxy groups include, but are hot limited to, methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

The cycloalkylene groups are a cyclic alkylene group having 5 to 7 carbon atoms which may have a fluorine atom, a hydroxyl group, an alkyl group having 1 to 4 carbon atoms, or an alkoxy group having 1 to 4 carbon atoms. Specific examples of the cycloalkylene groups include, but are not limited to, cyclohexylidene group, cyclohexylene group, and 3,3-dimethylcyclohexylidene group.

Specific examples of the substituted or non-substituted alkylene ether divalent groups include, but are not limited to, ethyleneoxy group, propyleneoxy group, ethylene glycol, propylene glycol, diethylene glycol, tetraethylene glycol, and tripropylene glycol. The alkylene group of the alkylene ether divalent group may have a substituent group, for example, a hydroxyl group, a methyl group, and an ethyl group.

The vinylene group is represented by the following chemical structure.

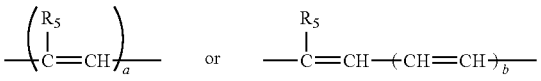

In the chemical structure illustrated above, $R_5$ represents a hydrogen atom, an alkyl group (same as defined in the paragraph (2)), or an aryl group (same aryl groups as represented by $Ar_3$ and $Ar_4$); a represents an integer of 1 or 2; and b represents an integer of from 1 to 3.

In the chemical structures (1) and (2), Z represents an alkylene group, an alkylene ether group, or an alkyleneoxycarbonyl group.

Specific examples of the alkylene group include, but are not limited to, the same alkylene groups as those described for the X.

Specific examples of the alkylene ether groups include, but are not limited to, the same alkylene ether groups as those described for the X.

Specific examples of the alkyleneoxycarbonyl groups include, but are not limited to, caprolactone-modified groups.

The polysiloxane-acryl block copolymer for use in the present invention using the radical polymerizable monomer (III) represented by the chemical structure (1) or (2) having a charge transport property is obtained by conducting polymerization reaction of a radical polymerizable monomer (III) having a charge transport structure and an acryl monomer under the presence of a silicone macro initiator including a polysiloxane chain. Therefore, the structure of the obtained polymer can be easily controlled and thus flexibly deals with various kinds of binder resins and charge transport materials. The siloxane structure portions improve the sliding property and render the surface energy low. In addition, since the acryl polymerization portions and the charge transport structure portions have good compatibility with a binder resin and a charge transport material, respectively, the side effect on the electric characteristics of a photoreceptor is limited so that the polysiloxane-acryl block copolymer can be contained in a layer in an ample amount. Addition of such a polysiloxane-acryl block copolymer having a charge transport property improves sustainability of a low surface energy and suitable electric characteristics and has a good impact on the cleaning property.

In addition, as the compound (monomer) having one radical polymerizable functional group for use in the photoreceptor of the present invention, the compound represented by the following chemical structure (3) is more preferred.

a high performance photoreceptor having an excellent cleaning property, a high anti-abrasion property, suitable electric characteristics, and a high durability and keeping a low surface energy for an extended period of time is obtained.

The charge transport monomer for use in the polysiloxane-acryl block copolymer having a charge transport property is highly reactive and has an excellent compatibility with the charge transport material in the surface layer. Therefore, the obtained polysiloxane-acryl block copolymer having a charge transport property can be added to the surface layer in a relatively large amount, which leads to good surface smoothness and few side effects on the electric characteristics such that the residual voltage is high.

The radical polymerizable monomers (III) or (IV) having a mono-functional charge transport structure illustrated by the chemical structure (1), (2) or (3), especially the radical polymerizable monomers (IV) having a mono-functional charge transport structure illustrated by the chemical structure (3), are polymerized in such a manner that the double linkage of C and C is open towards both ends. Therefore, under the presence of a polymerization initiator (polymer), the radical polymerizable monomers (III) or (IV) are not present at the end but in the chained polymer as illustrated in chemical structures (I) and (II) to form a block copolymer.

Specific examples of the radical polymerizable monomers (III) and (IV) having a mono-functional charge transport Chemical structure (3)

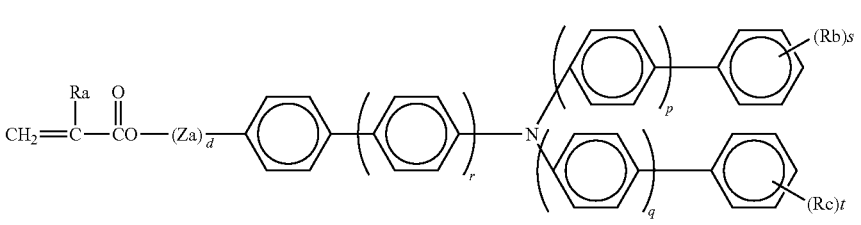

In the chemical structure (3), d, r, p, q represent 0 or 1, s and t independently represent 0 or an integer of from 1 to 3, Ra, represents hydrogen atom or methyl group, Rb and Rc each, independently, represent an alkyl group having 1 to 6 carbon atoms, and Za represents methylene group, ethylene group, —$CH_2CH_2O$—, —$CHCH_3CH_2O$—, or —$C_6H_5CH_2CH_2$—

Among the compounds represented by the chemical structure (3) illustrated above, a radical polymerizable monomer (IV) in which the functional groups of Rb and Rc are methyl group or ethyl group is particularly preferred.

According to the present invention using the compound illustrated by the chemical structure (3), the surface layer of the photosensitive layer is a cross-linking resin layer formed by curing the polysiloxane-acryl block copolymer having a charge transport property, the radical polymerizable monomer (I) having at least three functional groups without a charge transport structure, and the radical polymerizable monomer (II) having a charge transport structure. Therefore, polymer for use in the polysiloxane-acryl block copolymer include, but are not limited to, the following.

No. 1

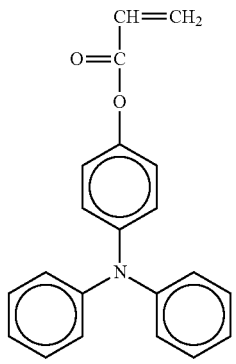

-continued
No. 2
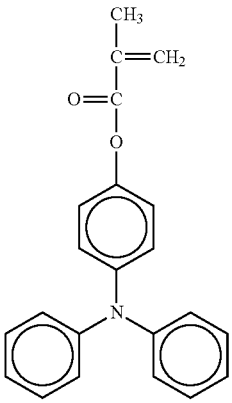
No. 3
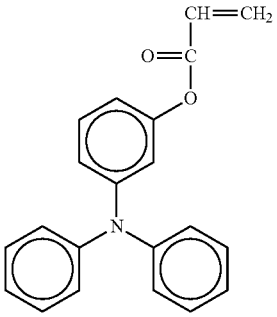
No. 4
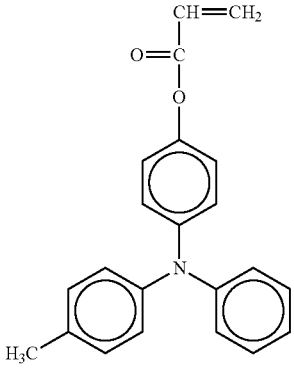
No. 5
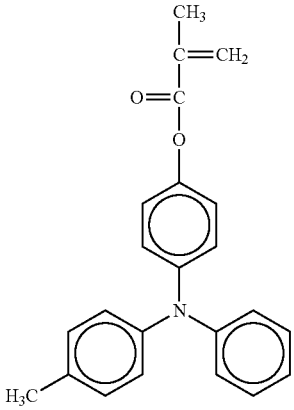
-continued
No. 6
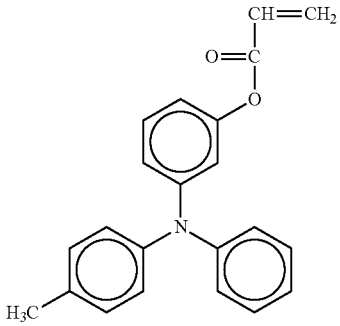
No. 7
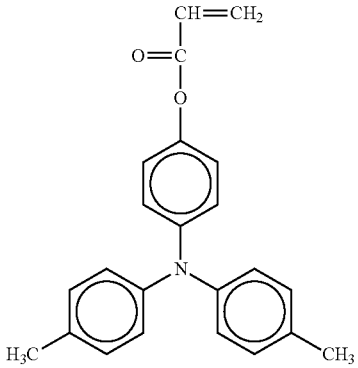
No. 8
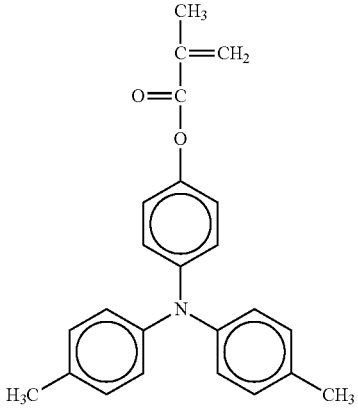
No. 9
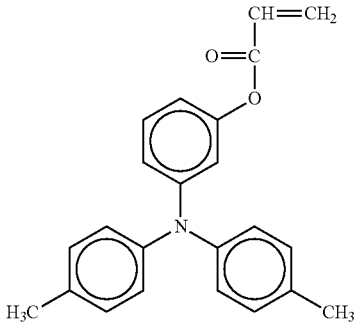

-continued
No. 10
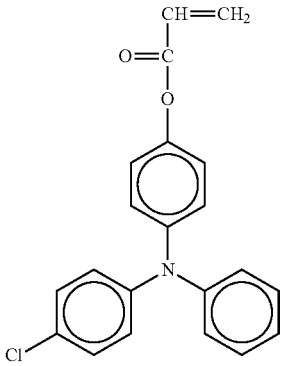
No. 11
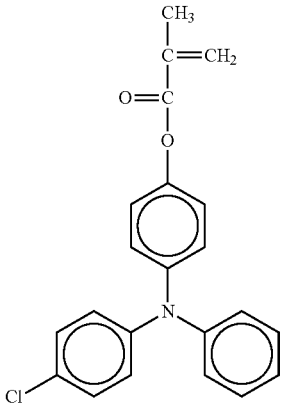
No. 12
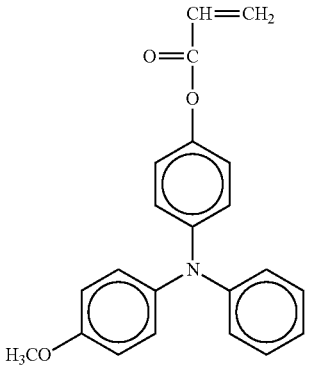
No. 13
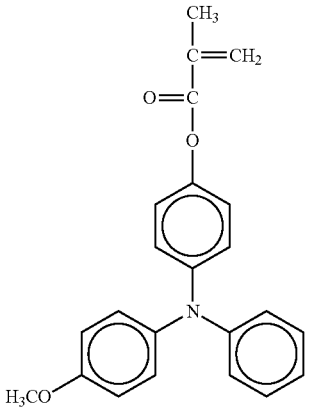
-continued
No. 14
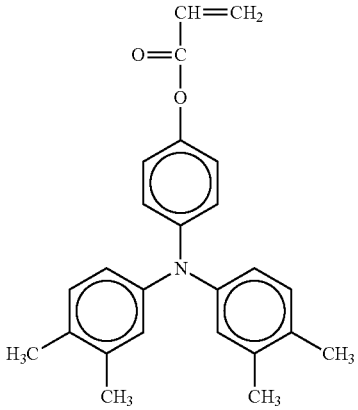
No. 15
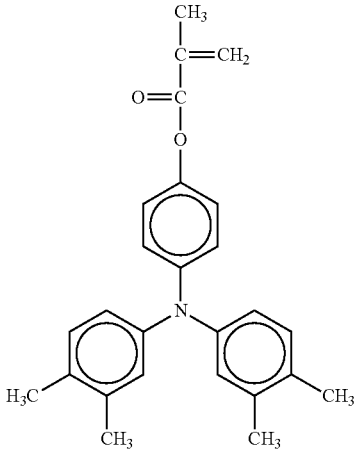
No. 16
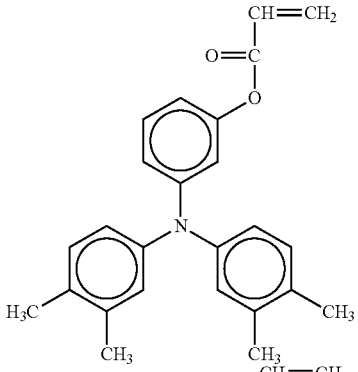
No. 17
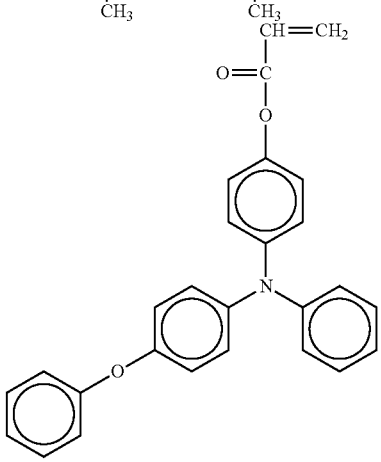

No. 18
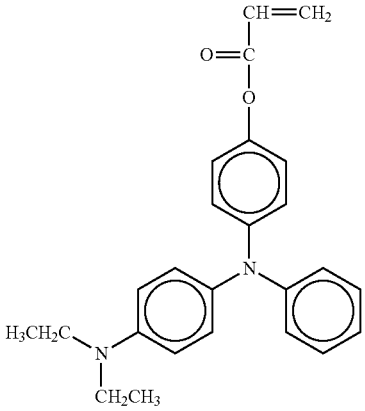
No. 19
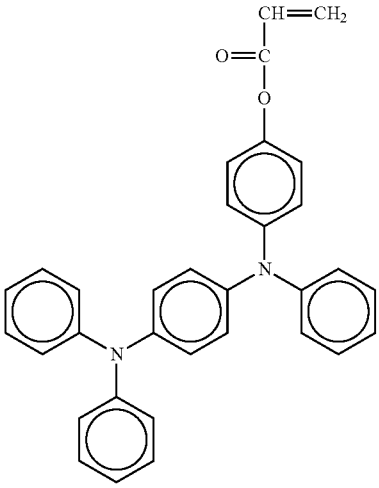
No. 20
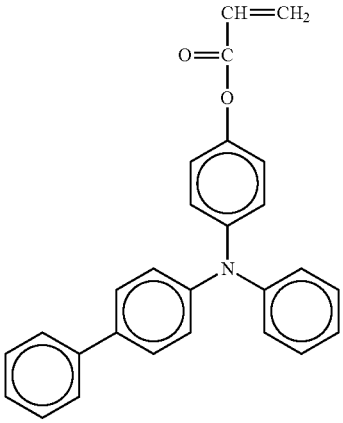
No. 21
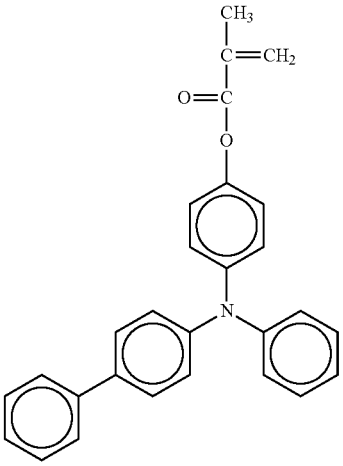
No. 22
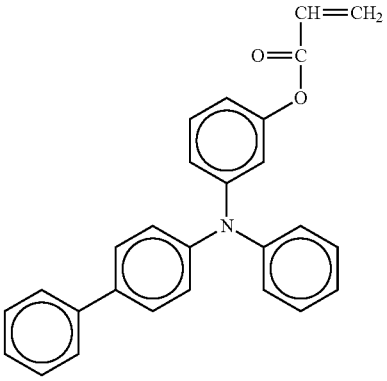
No. 23
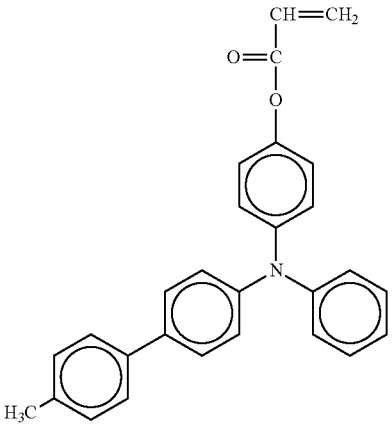

-continued
No. 24
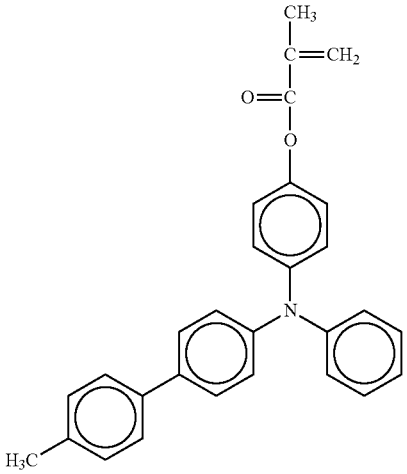
No. 25
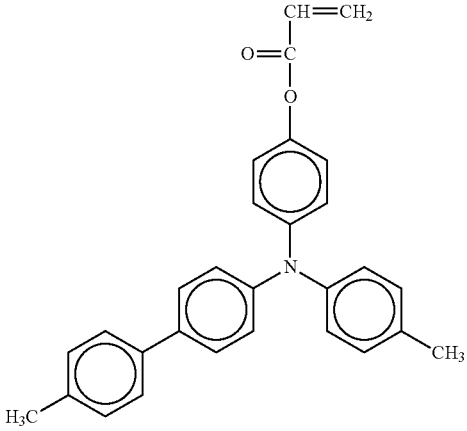
No. 26
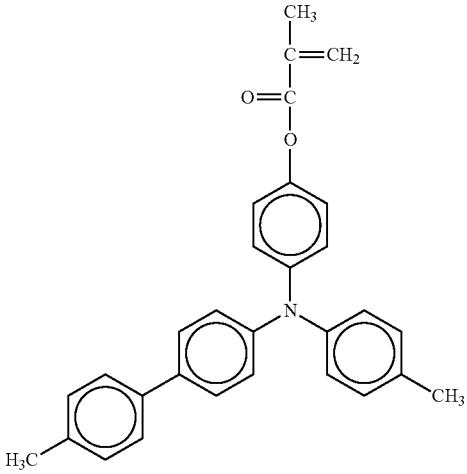
-continued
No. 27
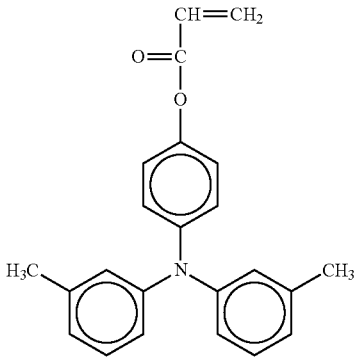
No. 28
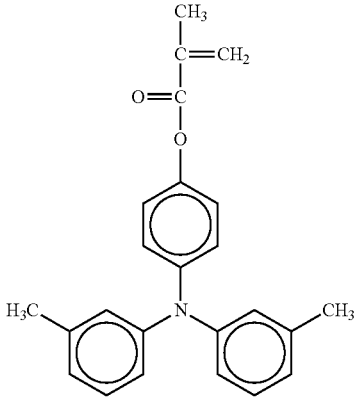
No. 29
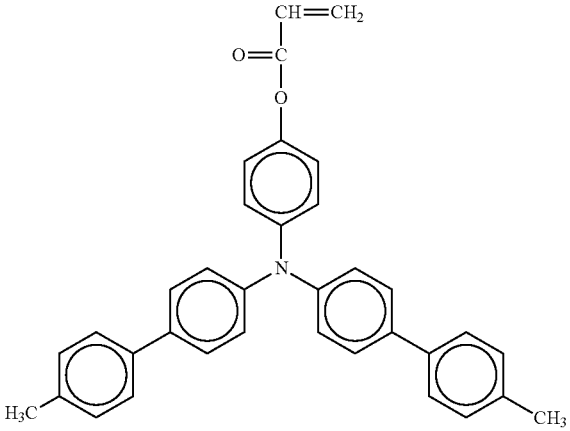
No. 30
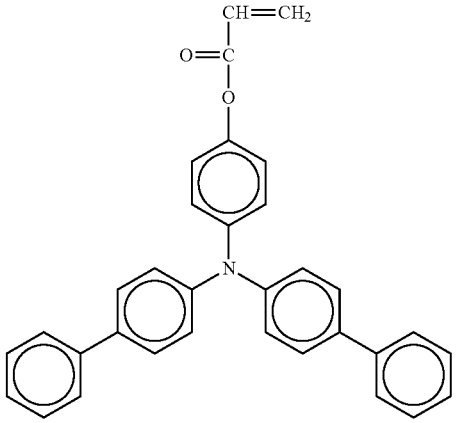

-continued
No. 31
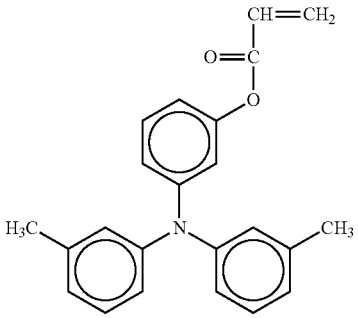
No. 32
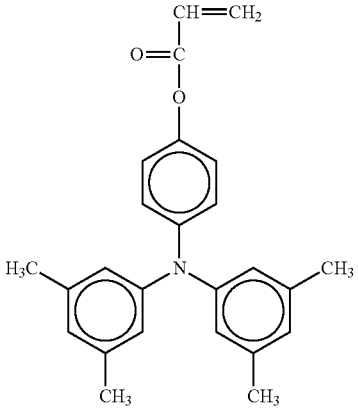
No. 33
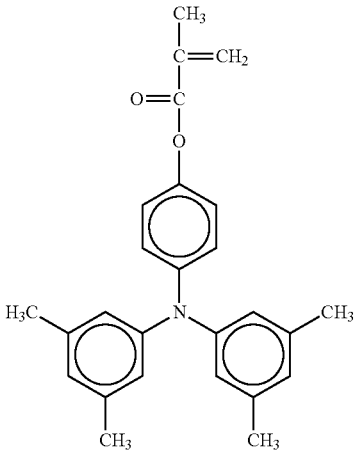
No. 34
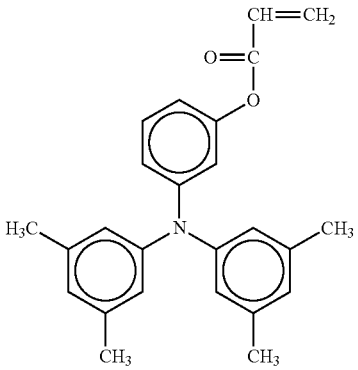
-continued
No. 35
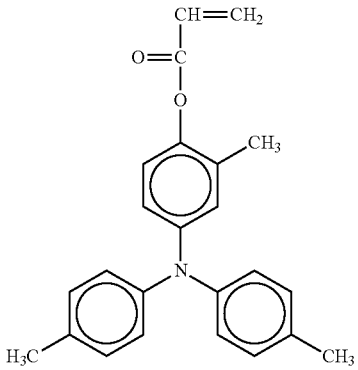
No. 36
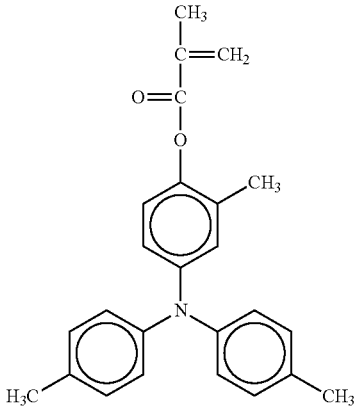
No. 37
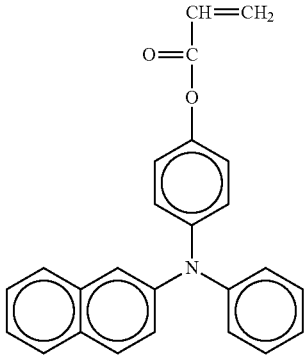
No. 38
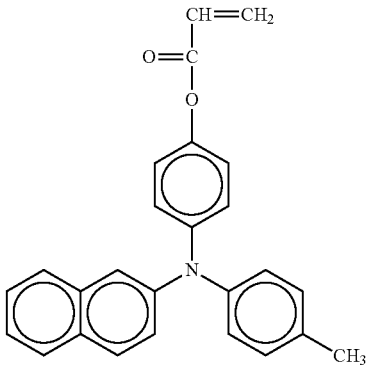

-continued
No. 39
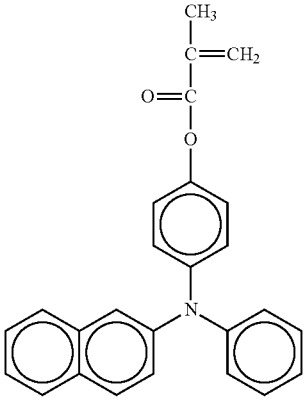
No. 40
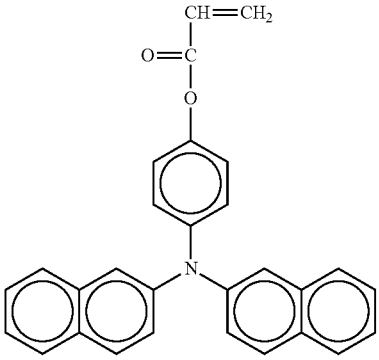
No. 41
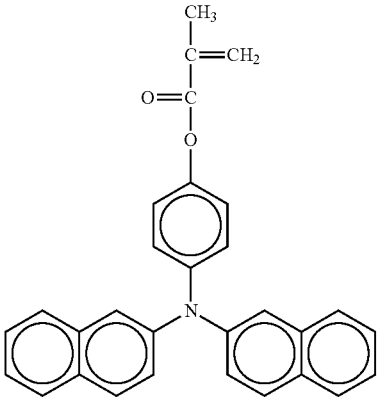
No. 42
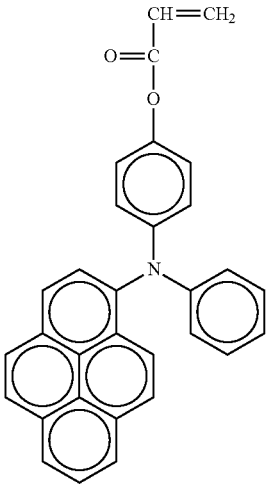
-continued
No. 43
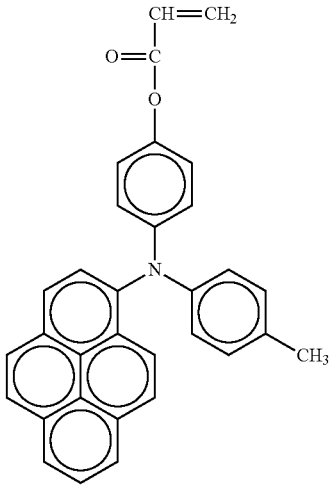
No. 44
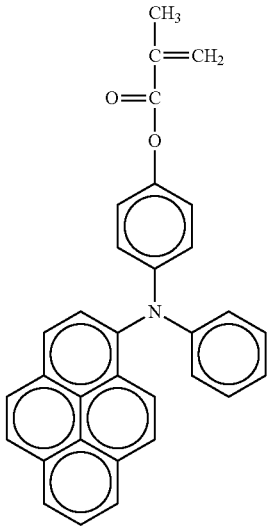
No. 45
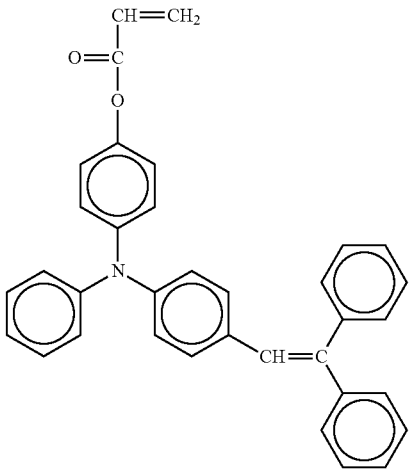

-continued
No. 46
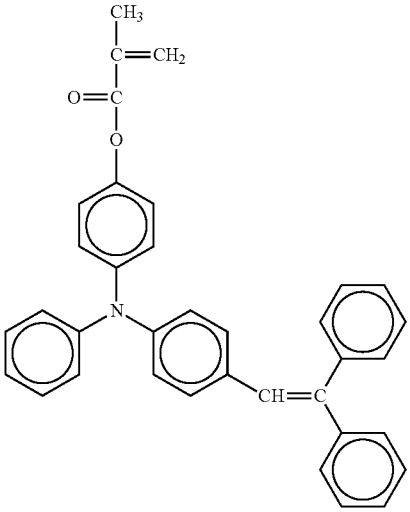
No. 47
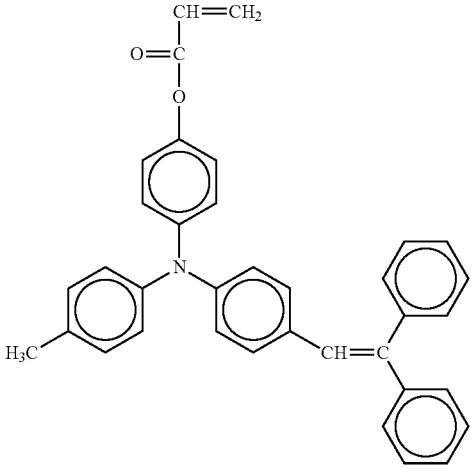
No. 48
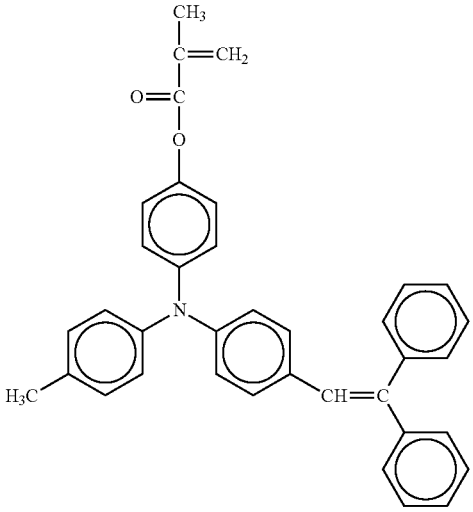
-continued
No. 49
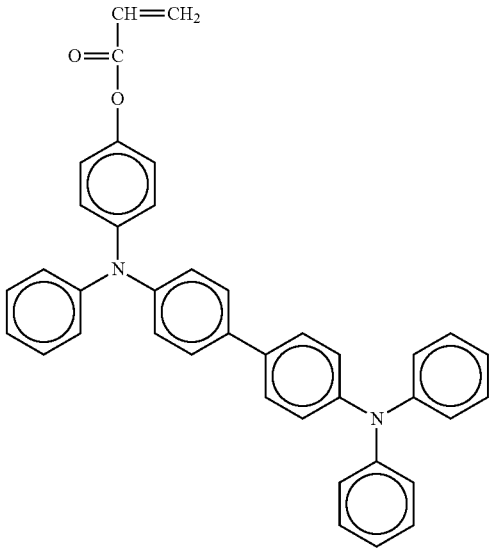
No. 50
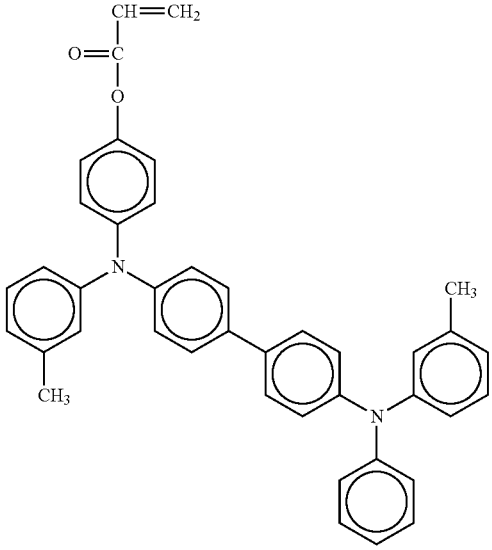
No. 51
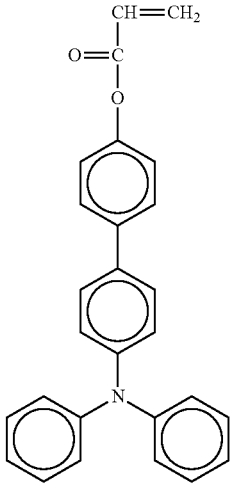

-continued
No. 52
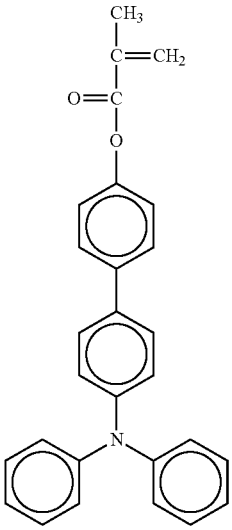
No. 53
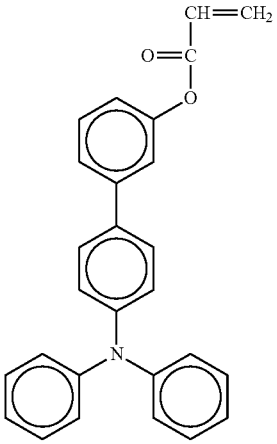
No. 54
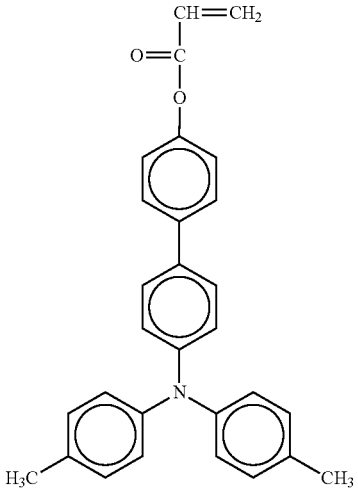
-continued
No. 55
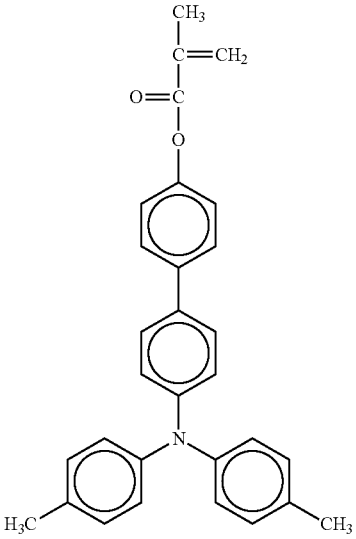
No. 56
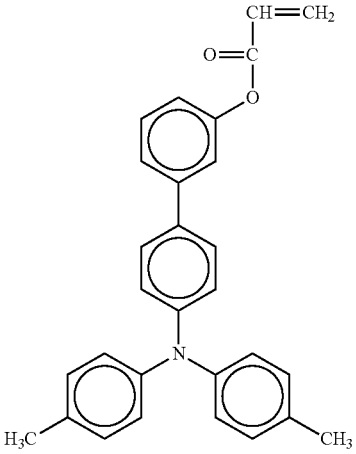
No. 57
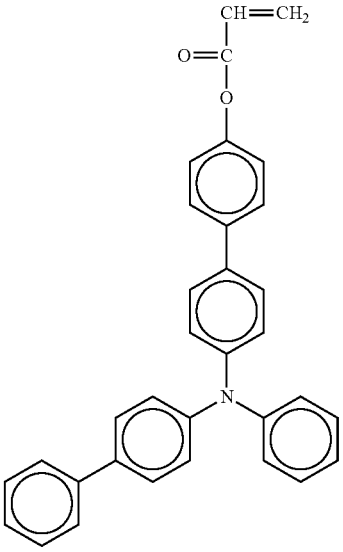

No. 58
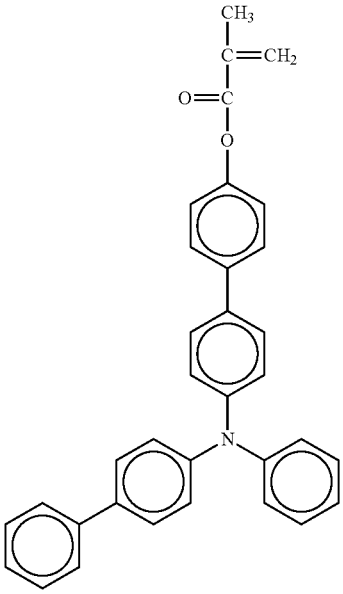
No. 59
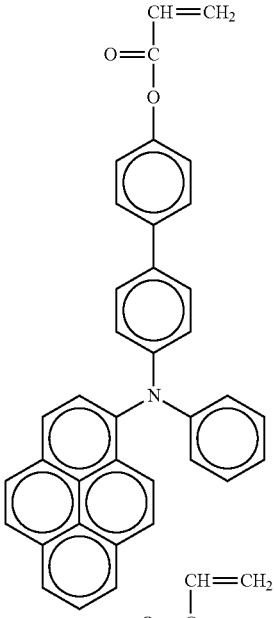
No. 60
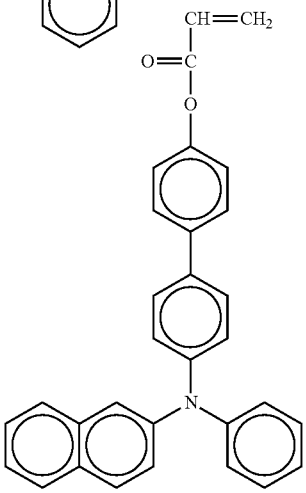
No. 61
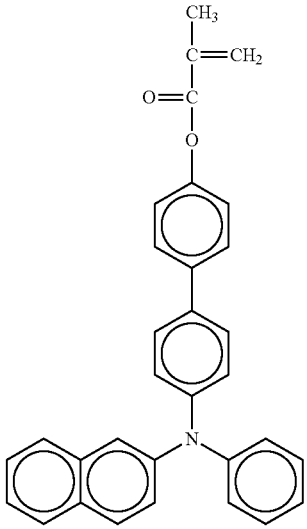
No. 62
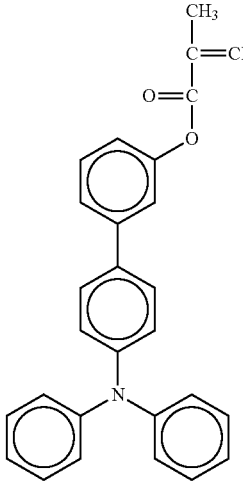
No. 63
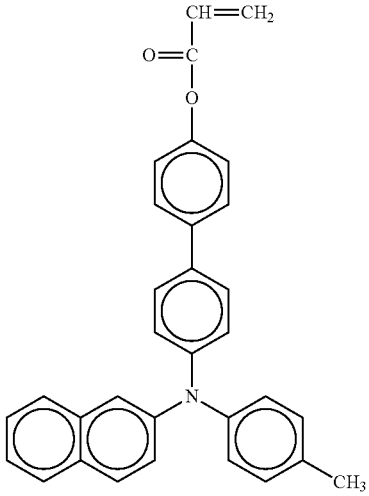

-continued
No. 64
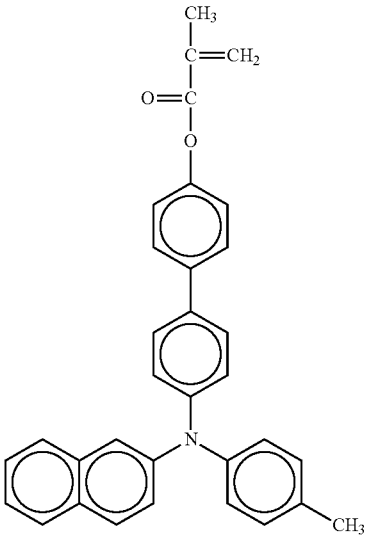
No. 65
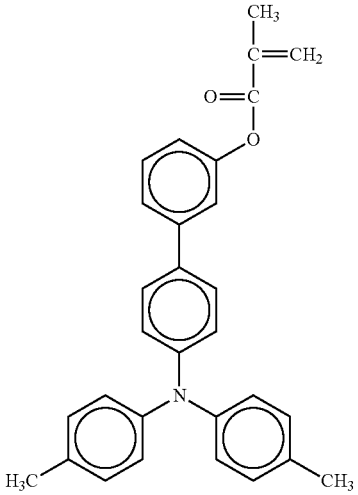
No. 66
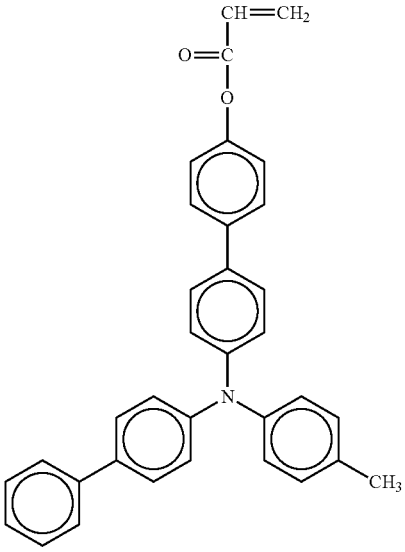
-continued
No. 67
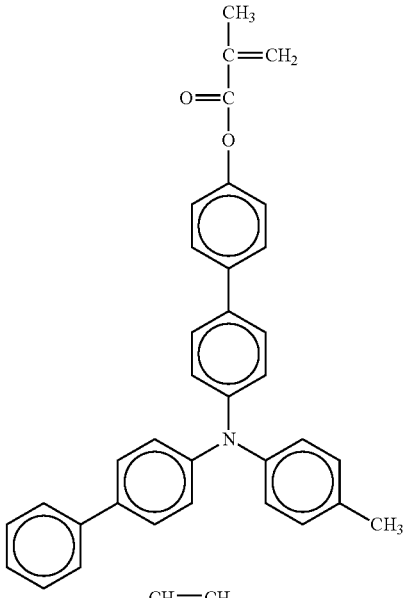
No. 68
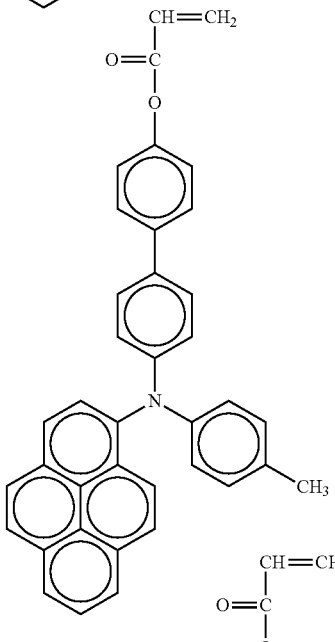
No. 69
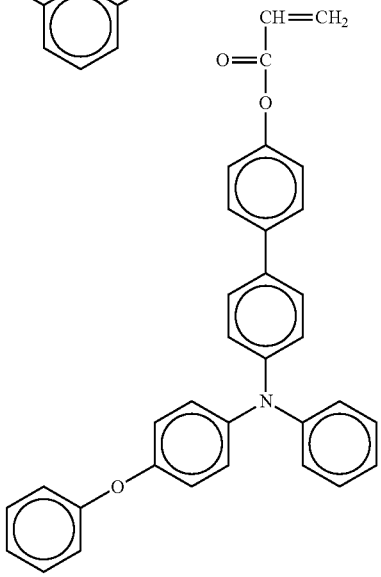

-continued
No. 70
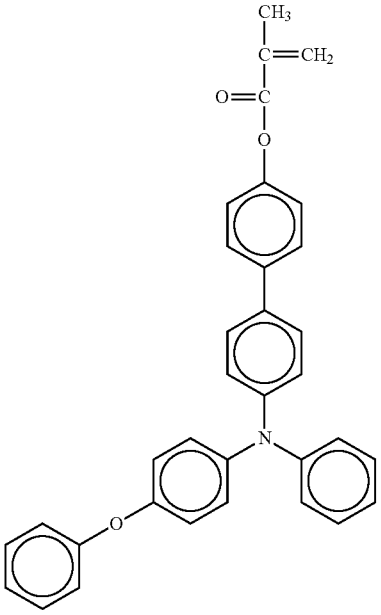
No. 71
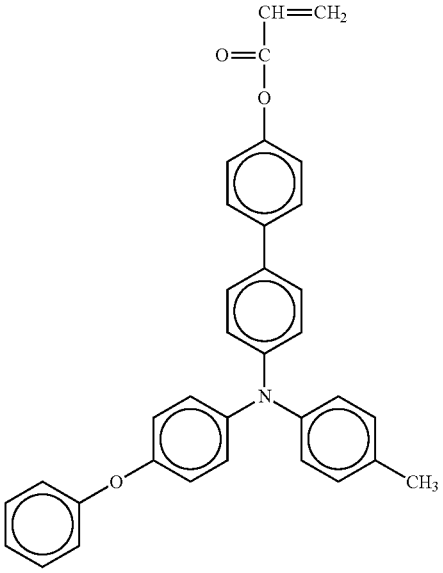
No. 72
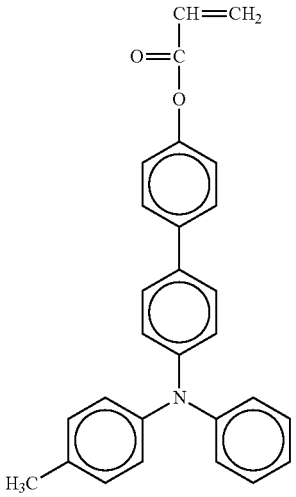
-continued
No. 73
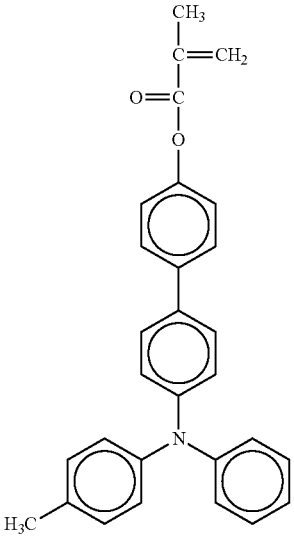
No. 74
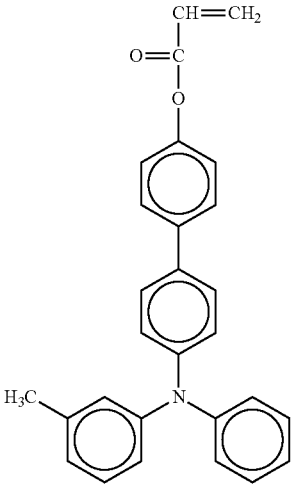
No. 75
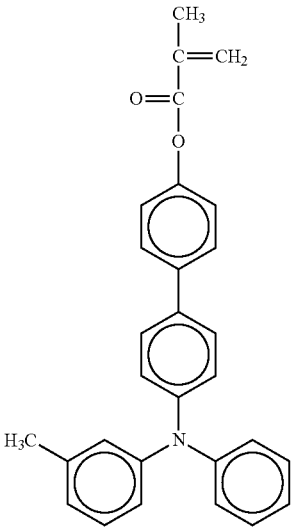

No. 76
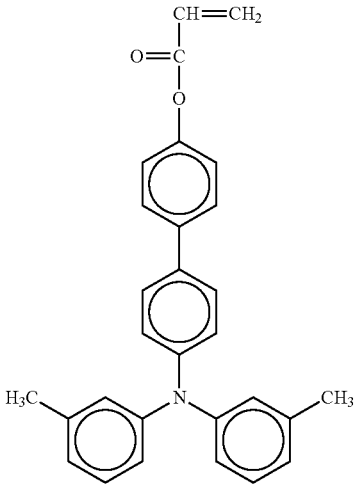
No. 77
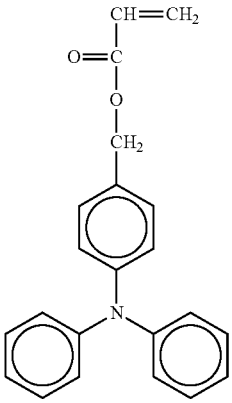
No. 78
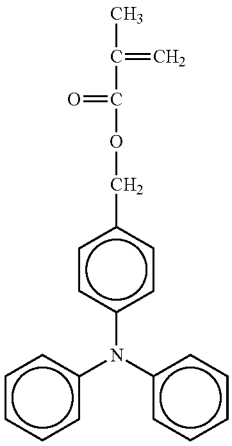
No. 79
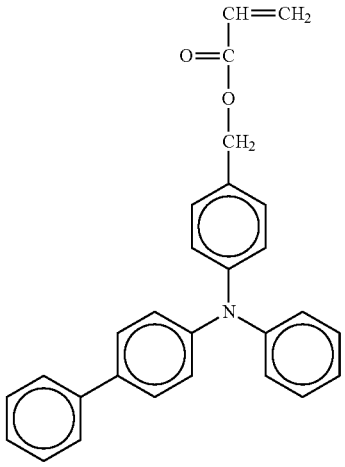
No. 80
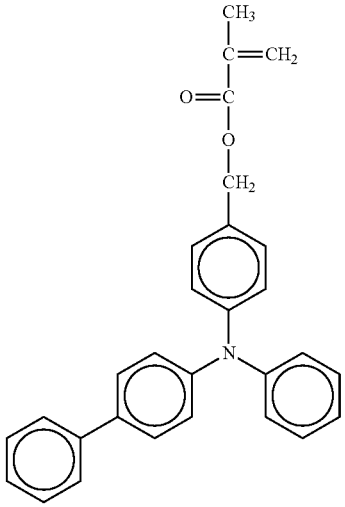
No. 81
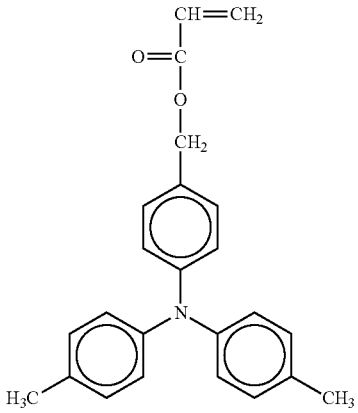

No. 82
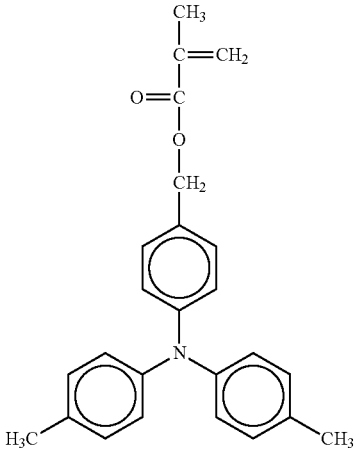
No. 83
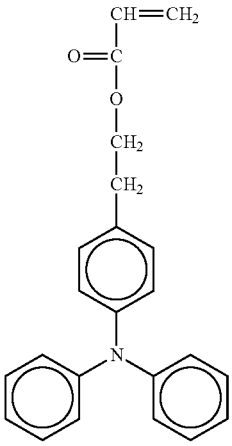
No. 84
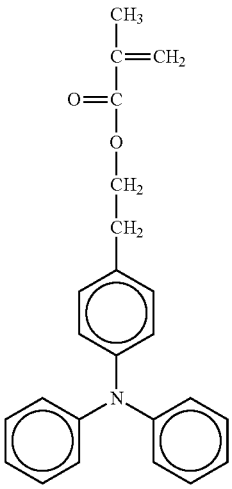
No. 85
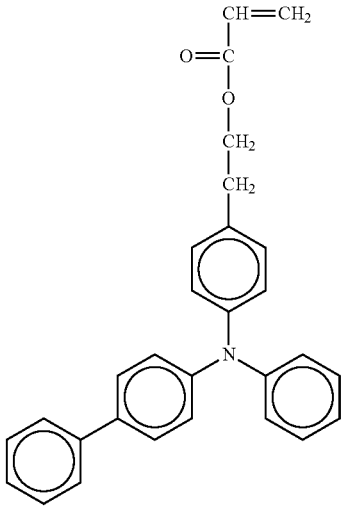
No. 86
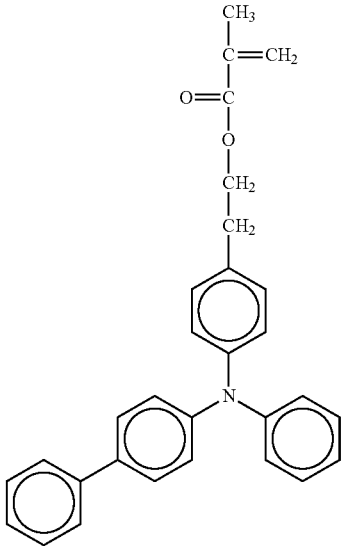
No. 87
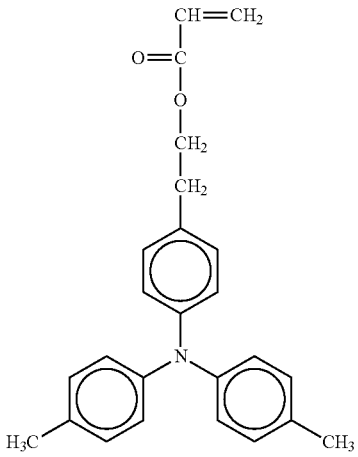

-continued
No. 88
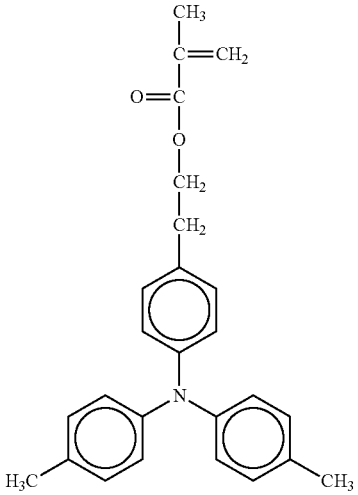
No. 89
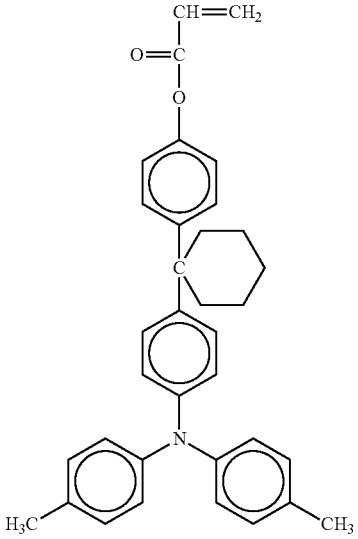
No. 90
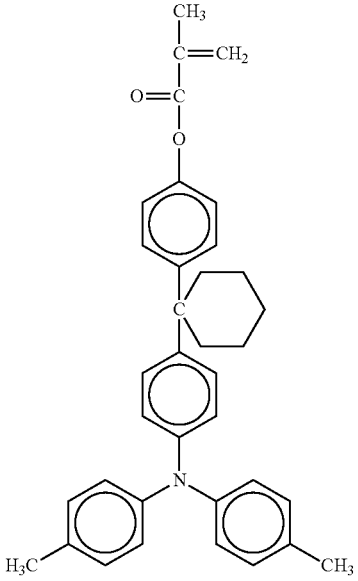
-continued
No. 91
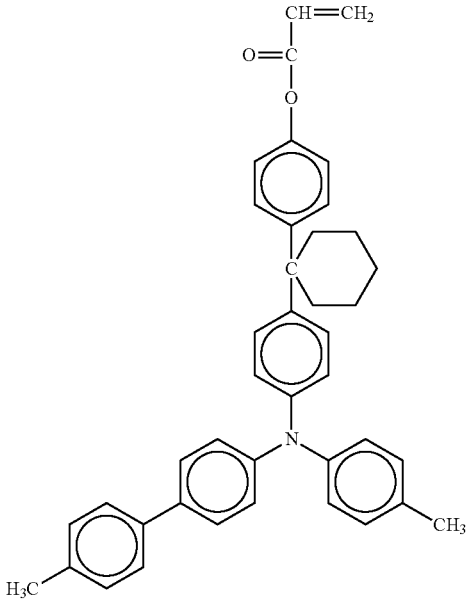
No. 92
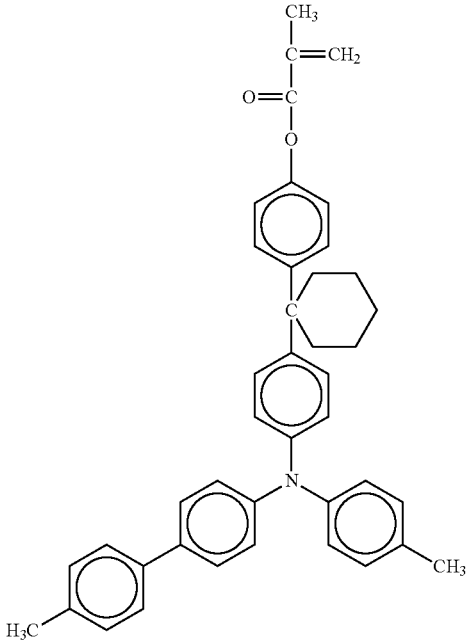

No. 93
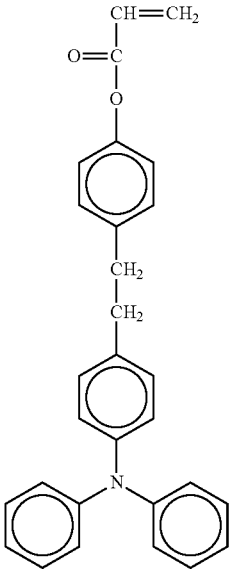
No. 94
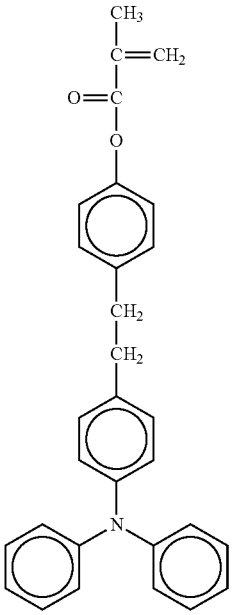
No. 95
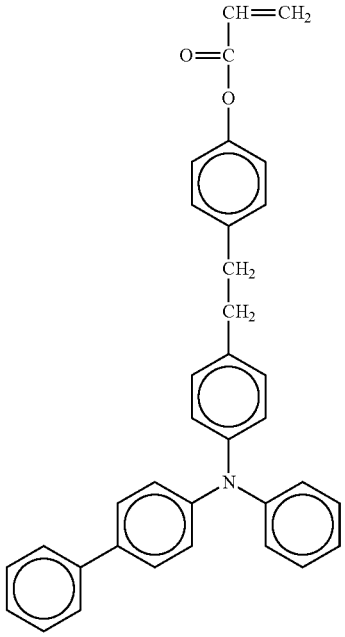
No. 96
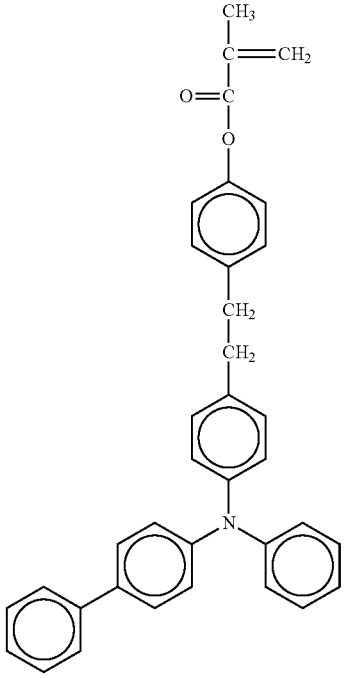

-continued
No. 97
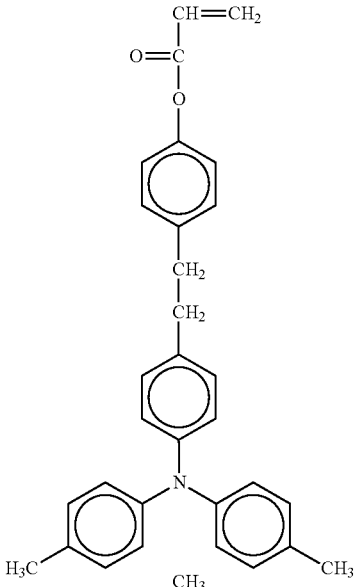
No. 98
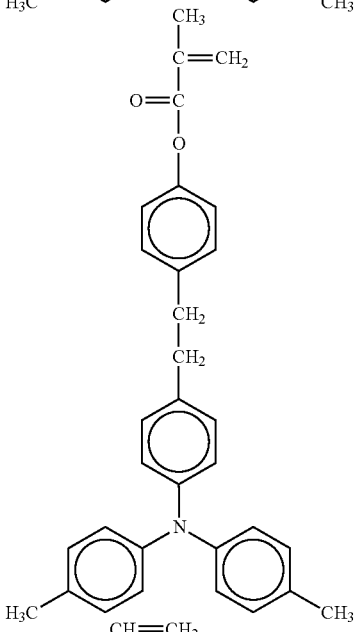
No. 99
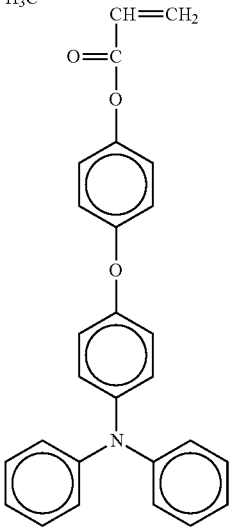
-continued
No. 100
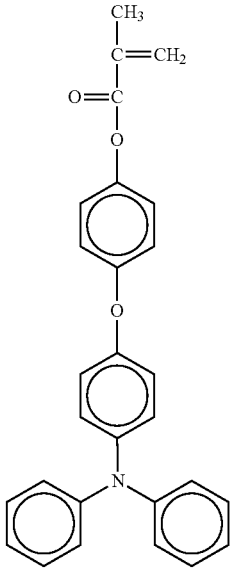
No. 101
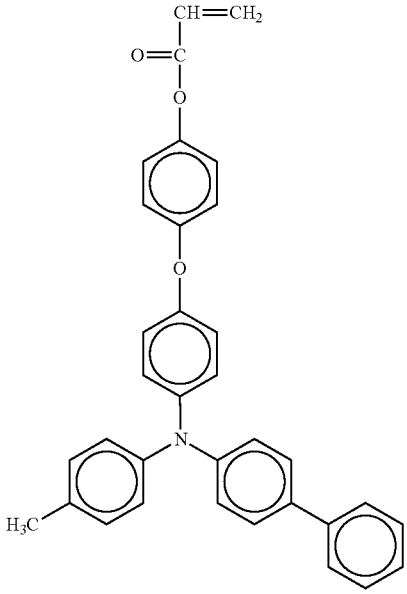

No. 102
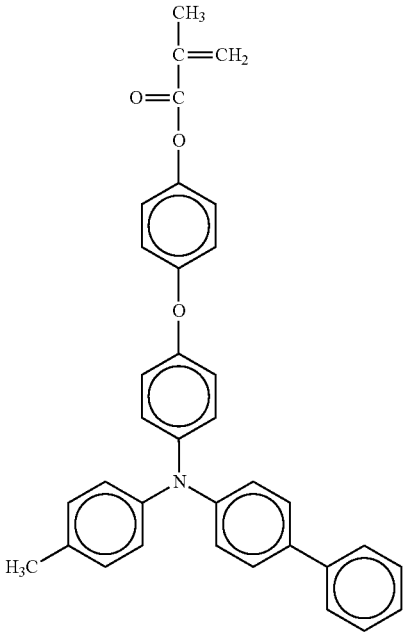
No. 103
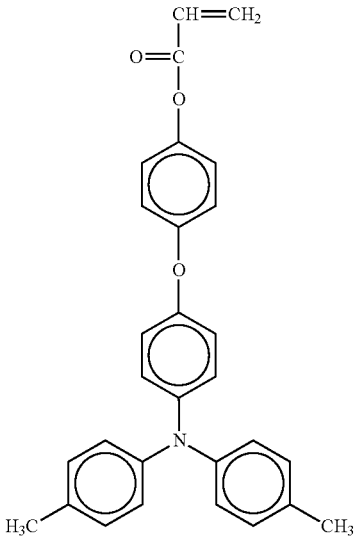
No. 104
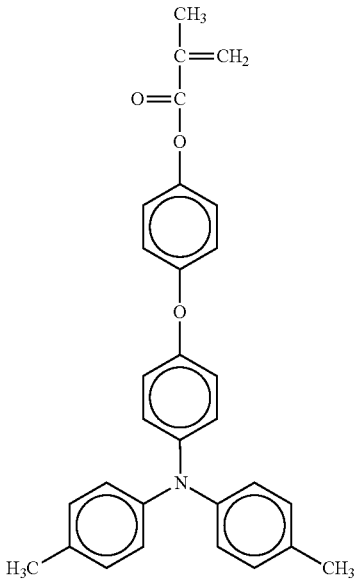
No. 105
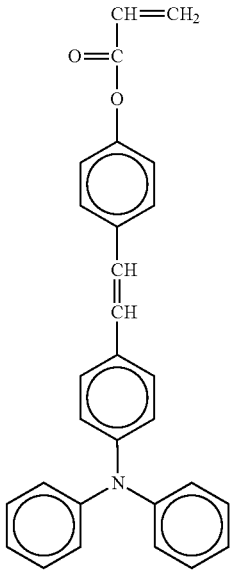

No. 106
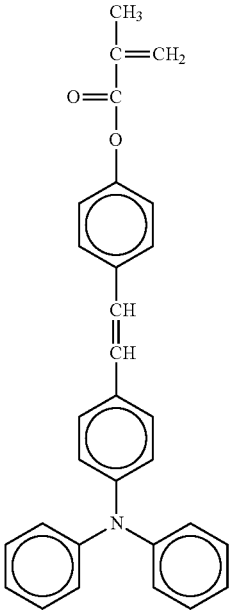
No. 107
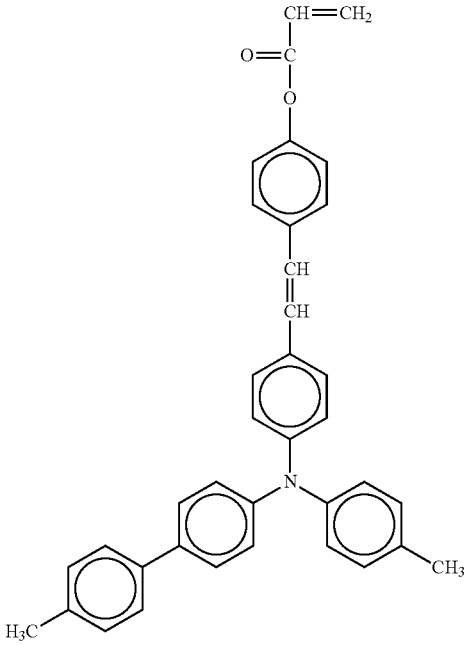
No. 108
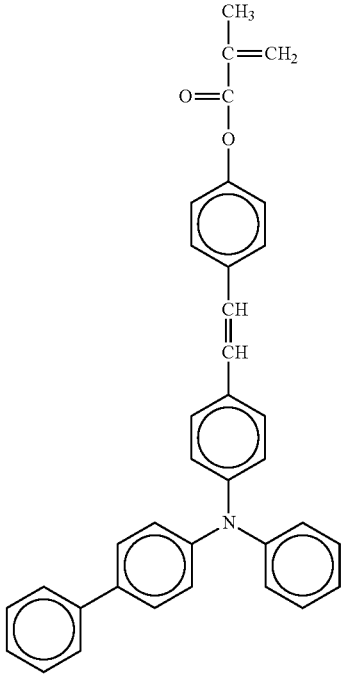
No. 109
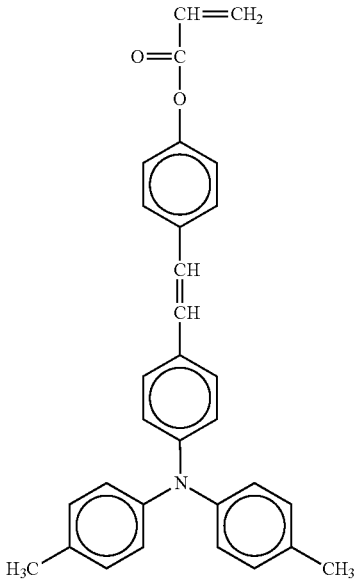

-continued
No. 110
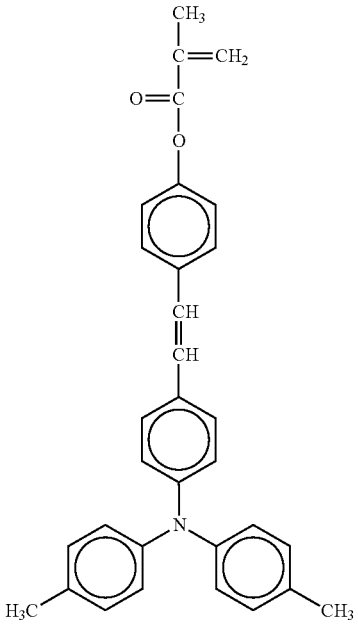
No. 111
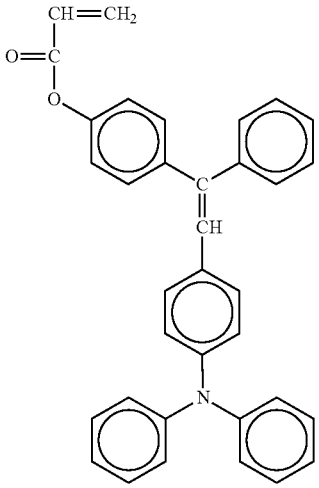
No. 112
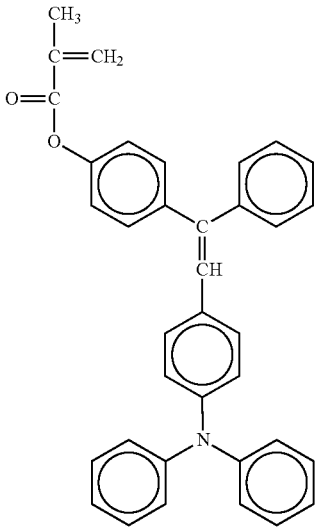
-continued
No. 113
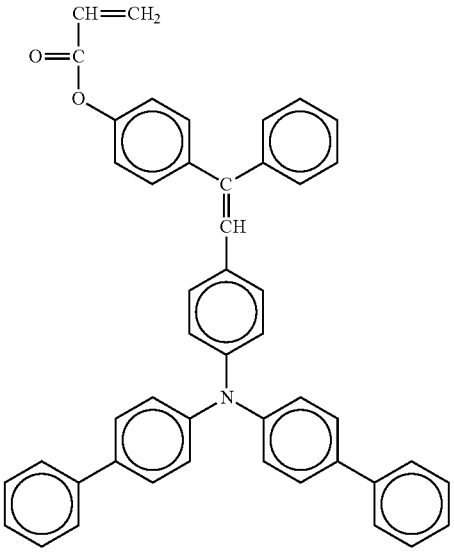
No. 114
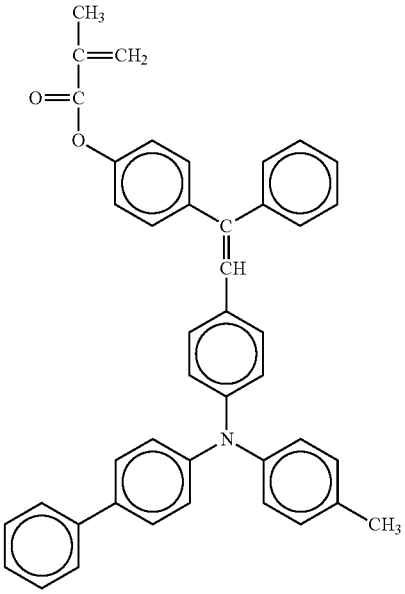
No. 115
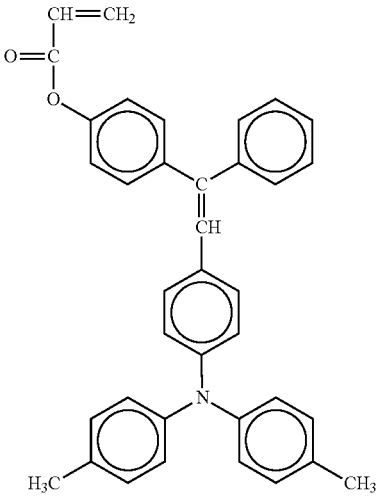

No. 116
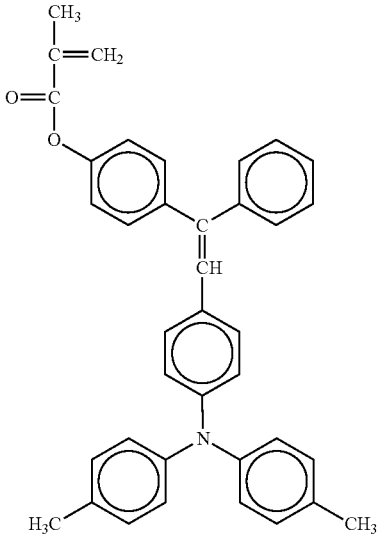
No. 117
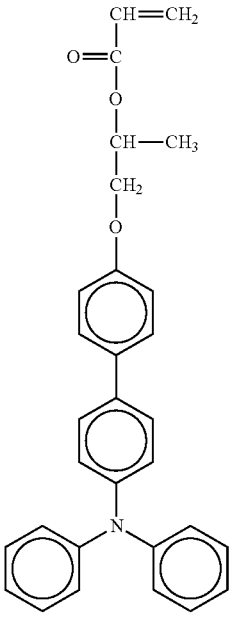
No. 118
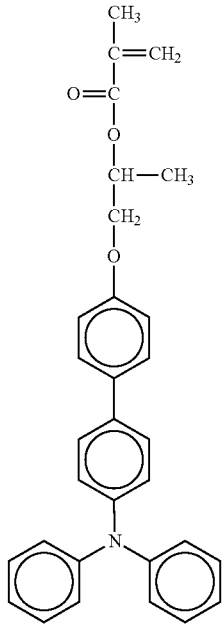
No. 119
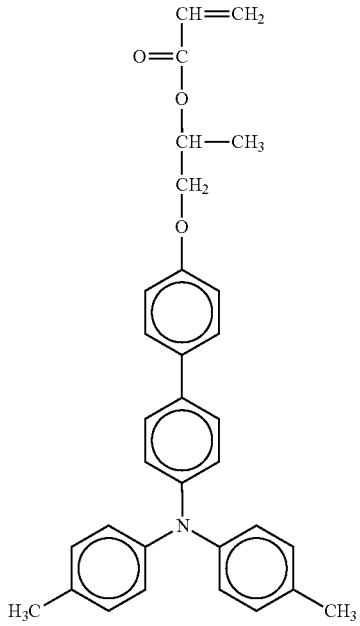

-continued
No. 120
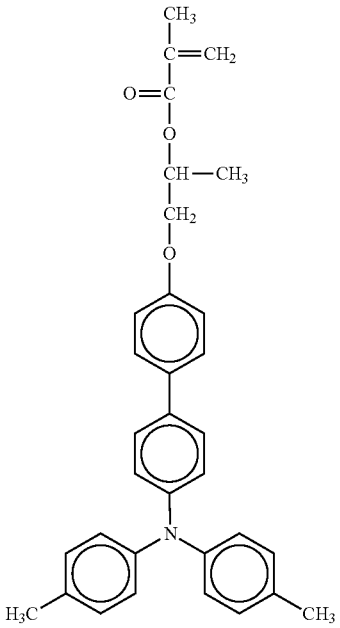
No. 121
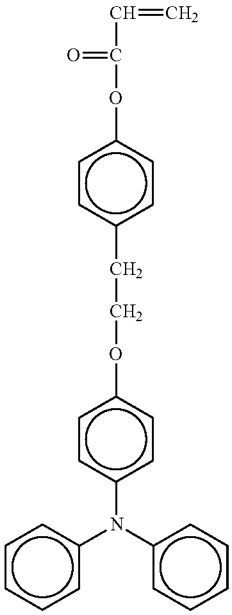
-continued
No. 122
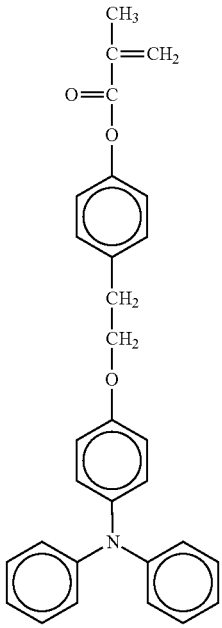
No. 123
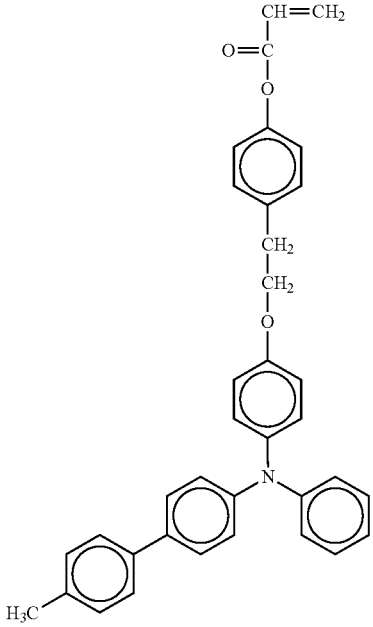

-continued
No. 124
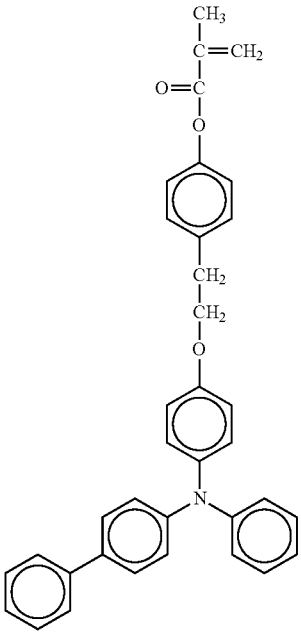
No. 125
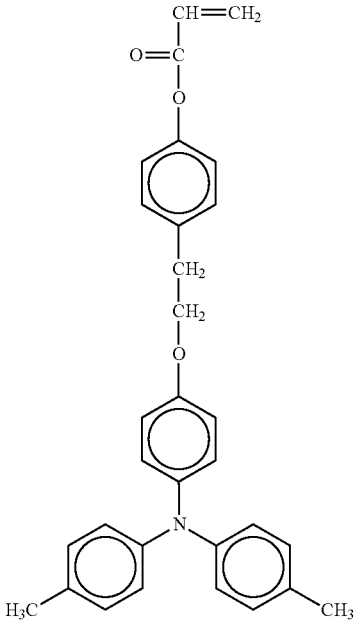
-continued
No. 126
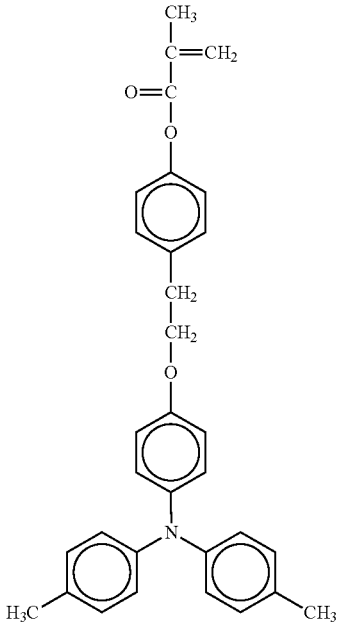
No. 127
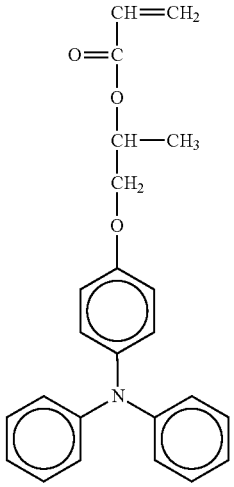
No. 128
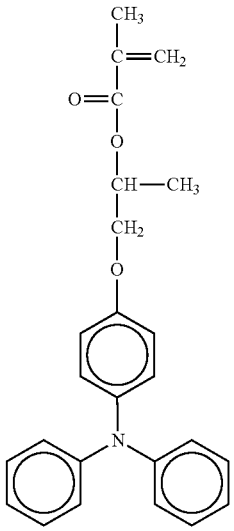

-continued
No. 129
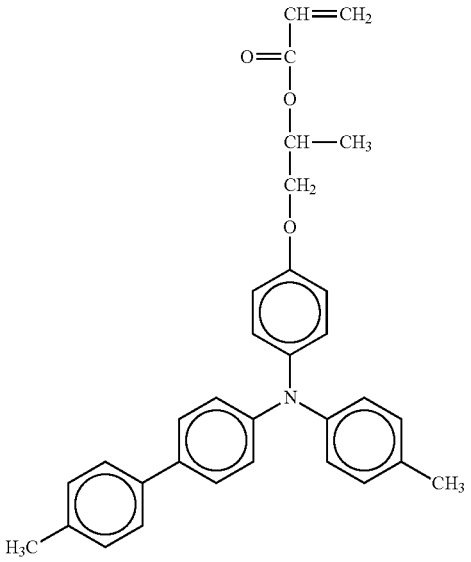
No. 130
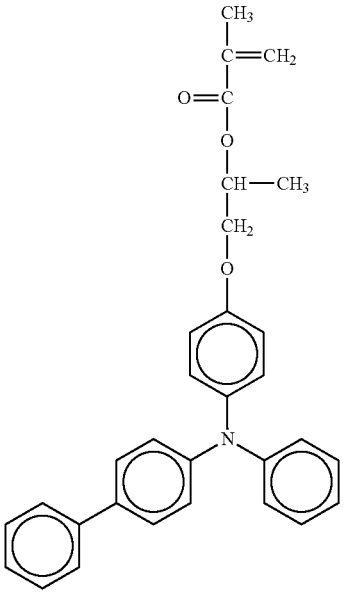
No. 131
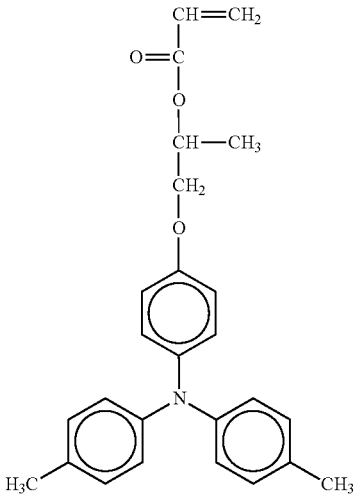
-continued
No. 132
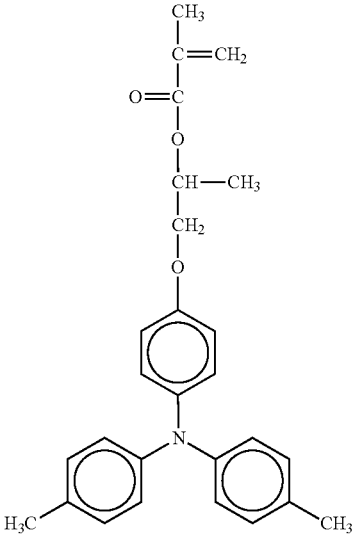
No. 133
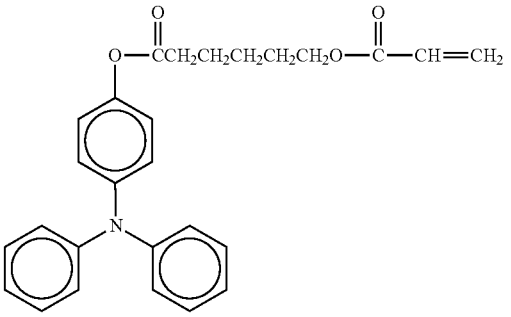
No. 134
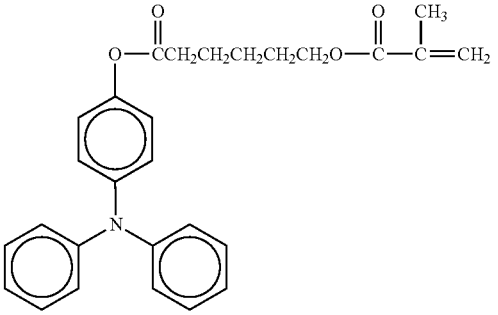
No. 135
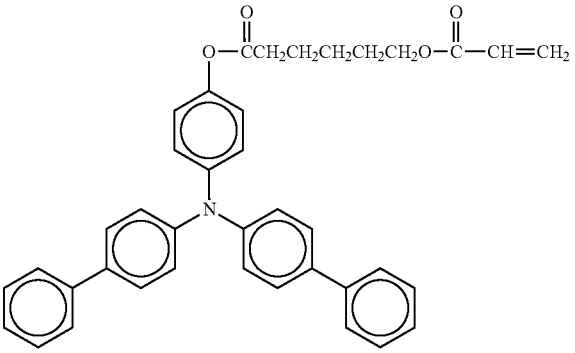

-continued
No. 136
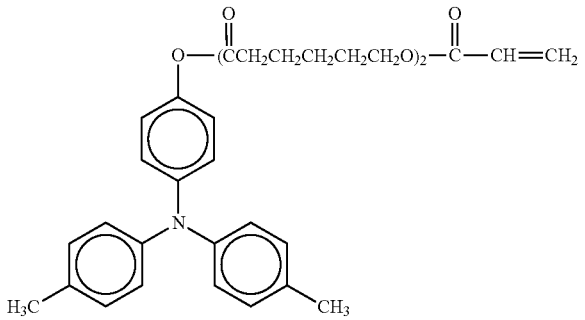
No. 137
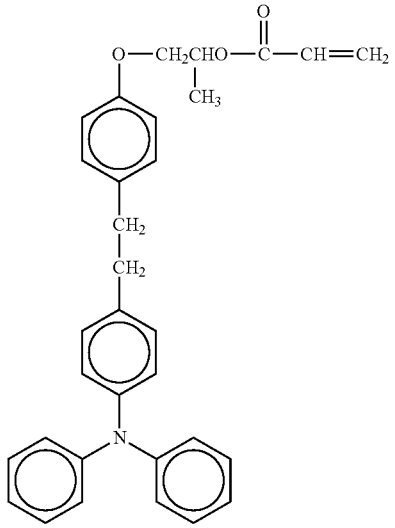
No. 138
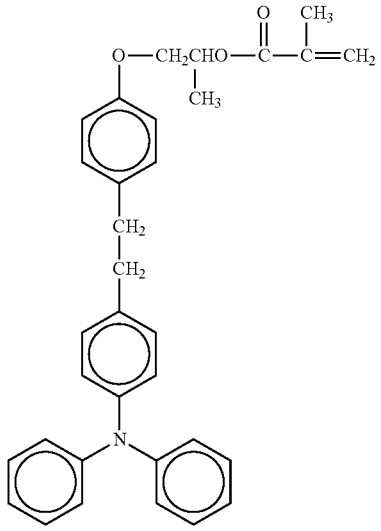
-continued
No. 139
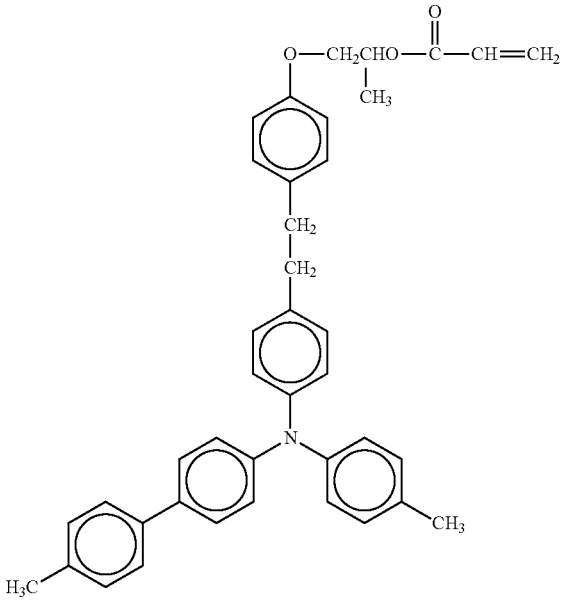
No. 140
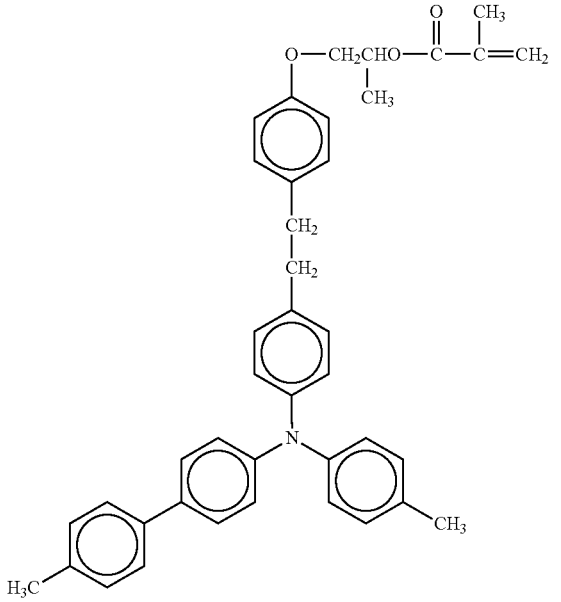

-continued
No. 141
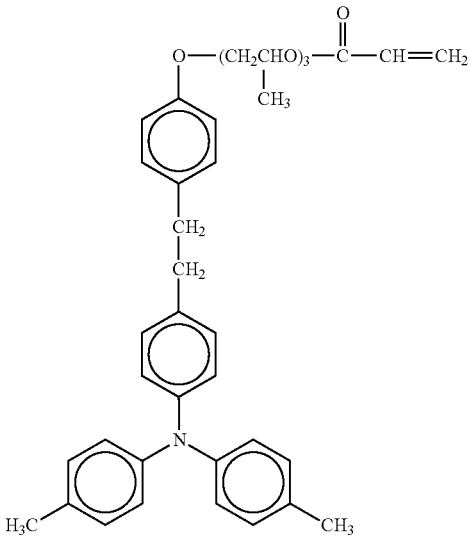
No. 142
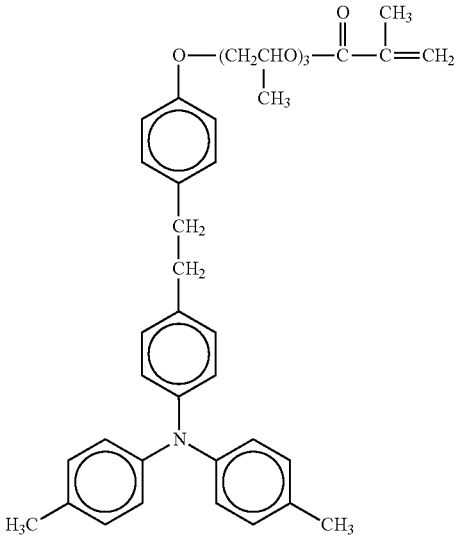
No. 143
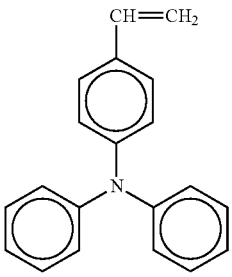
-continued
No. 144
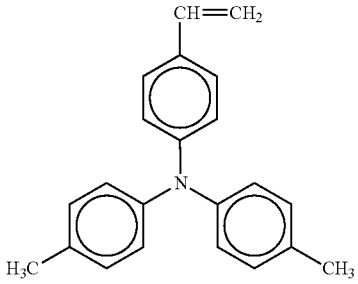
No. 145
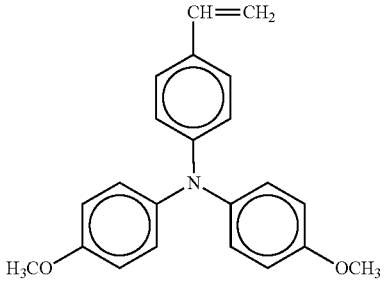
No. 146
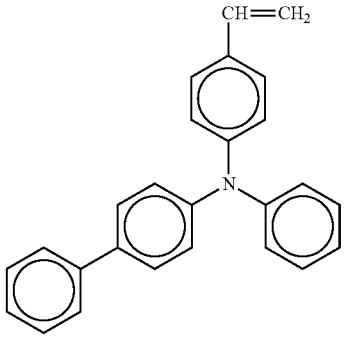
No. 147
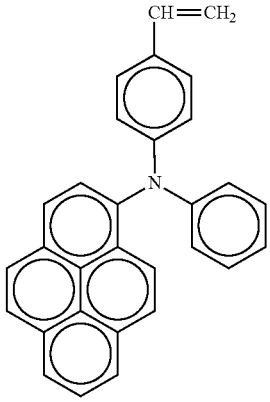
No. 148
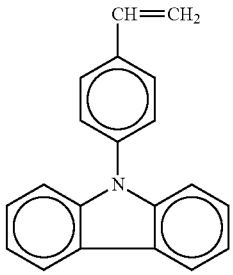

-continued
No. 149
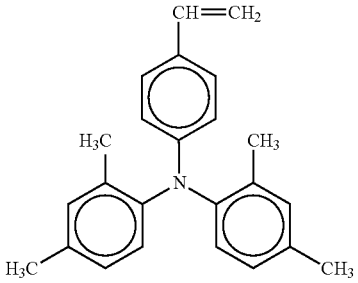
No. 150
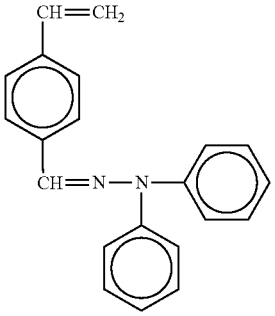
No. 151
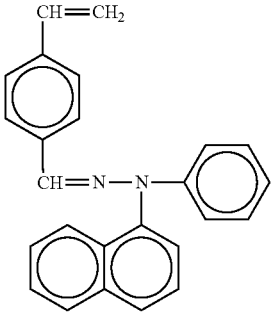
No. 152
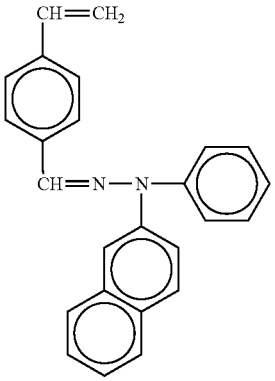
No. 153
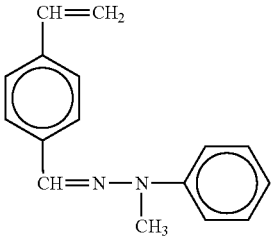
-continued
No. 154
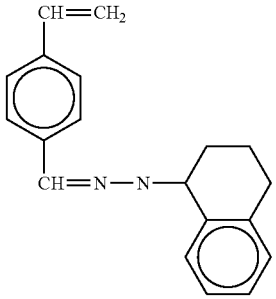
No. 155
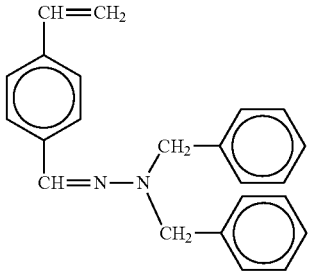
No. 156
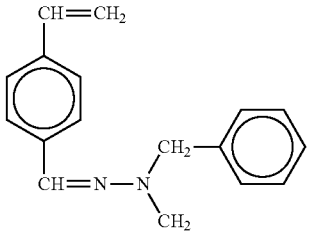
No. 157
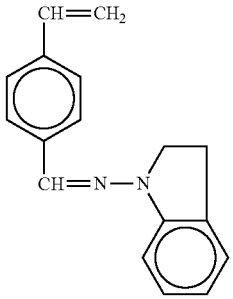
No. 158
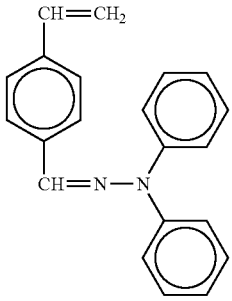

-continued

No. 159

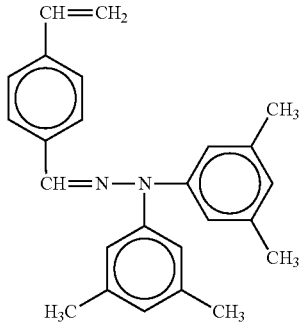

No. 160

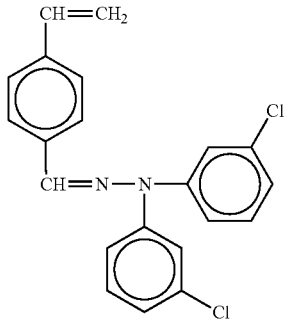

No. 160A

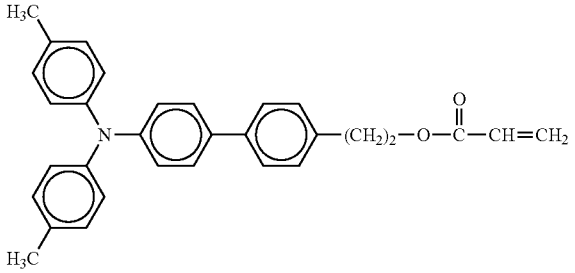

Specific examples of the acryl monomers having radical polymerizable property for use in the polysiloxane-acryl block copolymer having a charge transport property include, but are not limited to, methyl acrylate, ethyl acrylate, n-butyl acrylate, isobutyl acrylate, octyl acrylate, cyclohexyl acrylate, tetrahyofurfuryl acrylate, methyl methacrylate, ethyl methacrylate, n-butyl methacrylate, isobutyl methacrylate, 2-ethylhexyl methacrylate, stearylmethacrylate, laurylmethacrylate, methylvinyl ether, ethylvinyl ether, n-propylvinyl ether, n-butylvinyl ether, isobutylvinyl ether, styrene, α-methyl styrene, acrylonitrile, methacrylonitrile, vinyl acetate, vinyl chloride, vinylidene chloride, vinyl fluoride, vinylidene fluoride, glycidyl acrylate, glycidyl methacrylate, aryl glycidyl ether, acrylic acid, methacrylic acid, itaconic acid, crotonic acid, maleic acid, maleic anhydride, citraconic acid, acryl amide, methacryl amide, N-methylol acrylamide, N,N-dimethyl acrylamide, N,N-dimethylaminoethyl methacrylate, N,N-diethylaminoethylmethacrylate, and diacetoneacrylamide. Vinyl monomers having an OH group such as 2-hydroxyethyl acrylate, 2-hydroxyethyl methacrylate, 2-hydroxypropyl acrylate, 2-hydroxypropyl methacrylate, and aryl alcohol can be used. Also, the reaction compounds of Cardura E and acrylic acid, methacrylic acid, itaconic acid, crotonic acid, or maleic acid can be used.

Polymerization can be performed by a typical method of bulk polymerization method using an azo polymer based radical initiator or a solution polymerization method. The ratio of the polymer initiator and the radical monomer (radical monomer having a charge transport property and acryl monomer) has an impact on the low surface free energy of the block copolymer and the compatibility with a cross-linking surface layer resin. When the sum of the polymer initiator and the radical monomer is 100 parts by weight, a good combination of the low surface free energy and the compatibility is obtained in the ratio ranging from 95/5 to 5/95. In addition, the ratio of the radical monomer having a charge transport property and the acryl monomer has an impact on the charge transport performance and the polymerization property. When the sum of the radical monomer having a charge transport property and the acryl monomer is 100 parts by weight, a good combination of the charge transport performance and the polymerization property is obtained in the ratio ranging from 99:1 to 1:99.

Specific examples of the solution for use in a solution polymerization method include, but are not limited to, ethers such as tetrahydrofuran and dioxane, hydrocarbons such as petroleum ether, n-hexane, cyclohexane, toluene and xylene, esters such as ethyl acetate and butyl acetate, alcohols such as methanol, ethanol, isopropanol and butanol, ketones such as acetone, methylethyl ketone, methylisobutyl ketone and cyclo hexanone, chlorobenzene, acetonitrile, N,N-dimethylform amide and dimethyl sulfoxide. These can be used alone or in combination.

The molecular weight can be controlled by using chain transfer agent such as n-dodecylmercaptan, if desired. When a non-reacted vinyl monomer remains, which is not preferred, an initiator such as an azo-based initiator can be added in the middle of the reaction to complete the polymerization.

The obtained block copolymer is a mixture containing one or two vinyl polymer blocks in a chain and the number average molecular weight is of the order of magnitude of $10^4$.

Since the remaining of a monomer may degrade the electric characteristics of a photoreceptor during the polymerization, refinement is preferred for the polysiloxane-acryl block copolymer having a charge transport property for use in the present invention.

The radical polymerizable monomers (II) having a charge transport structure for use in the present invention include, but are not limited to, the following (part of them are the same as those illustrated above for the radical polymerizable monomers (III) and (IV):

Radical Polymerizable Monomers Having Charge Transport Structure with One Functional Groups No. 1

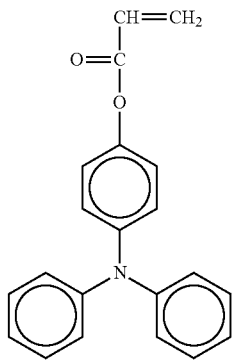

-continued
No. 2
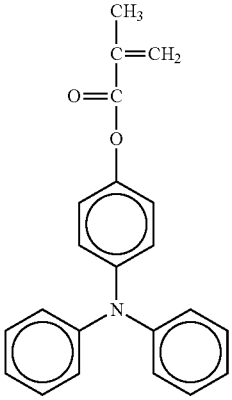
No. 3
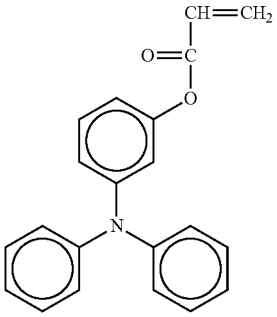
No. 4
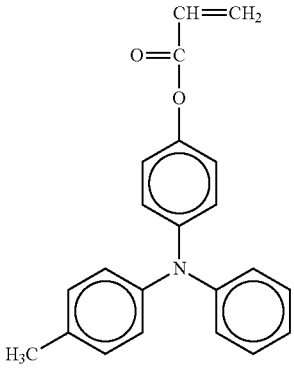
No. 5
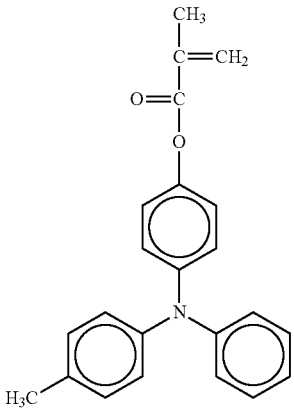
-continued
No. 6
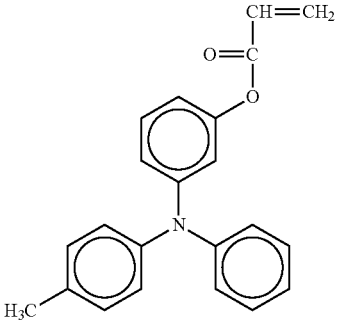
No. 7
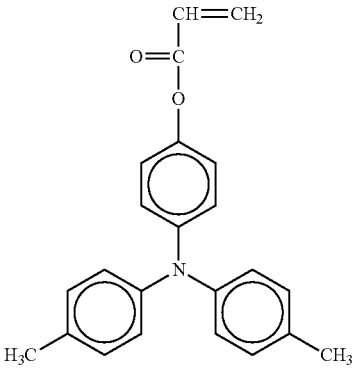
No. 8
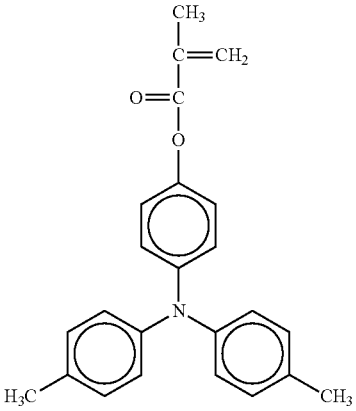
No. 9
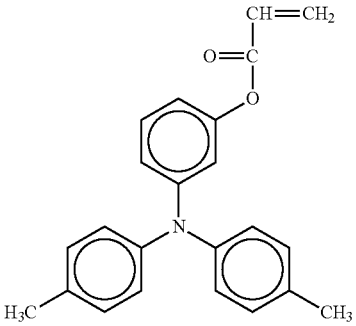

-continued
No. 10
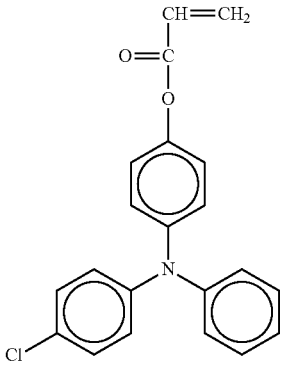
No. 11
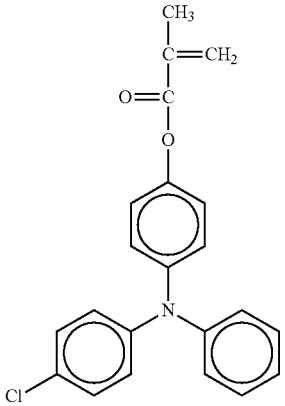
No. 12
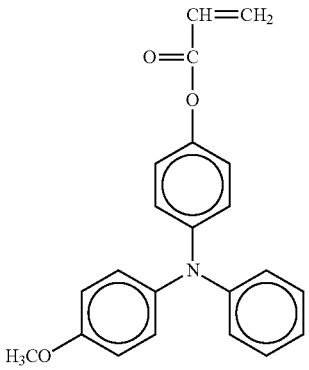
No. 13
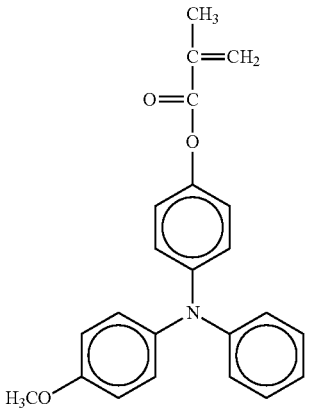
-continued
No. 14
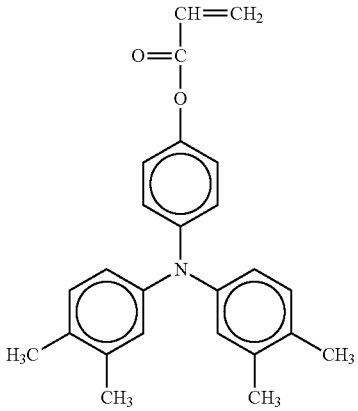
No. 15
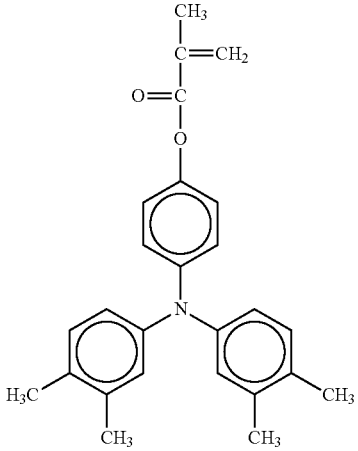
No. 16
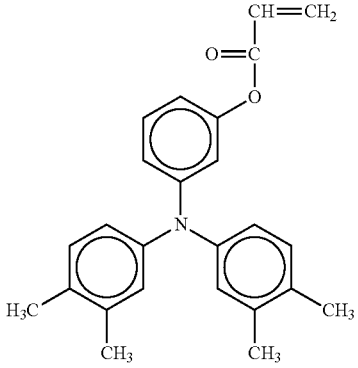
No. 17
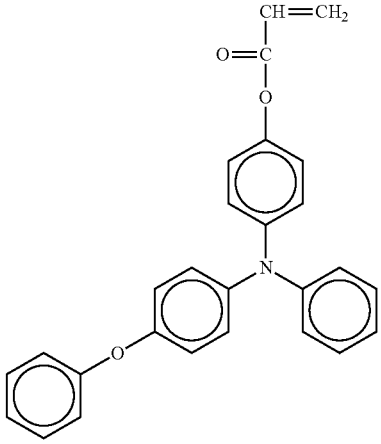

No. 18
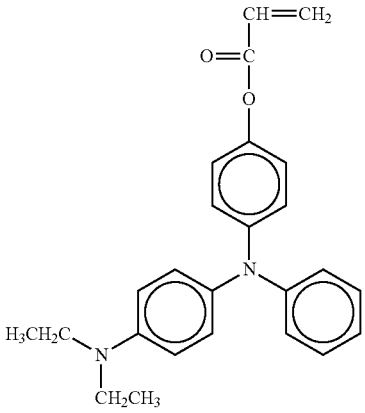
No. 19
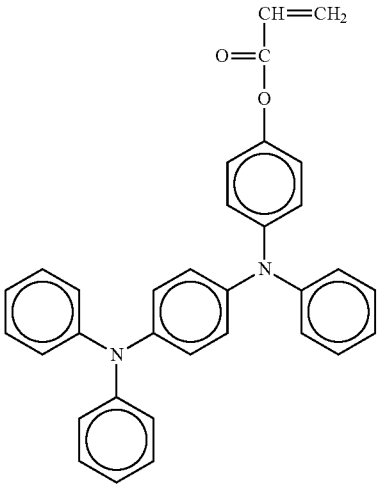
No. 20
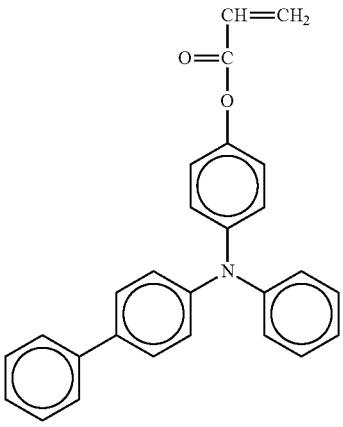
No. 21
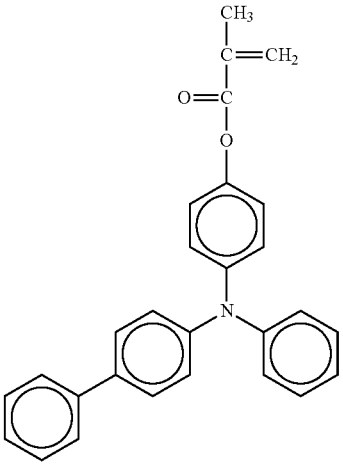
No. 22
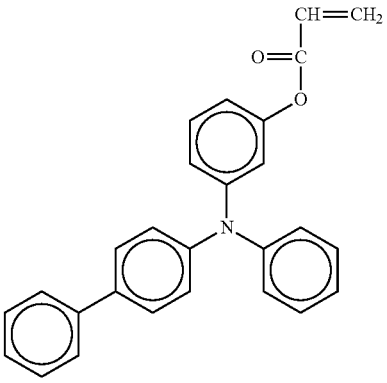
No. 23
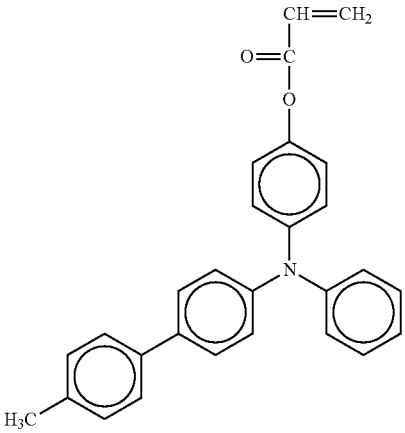

-continued
No. 24
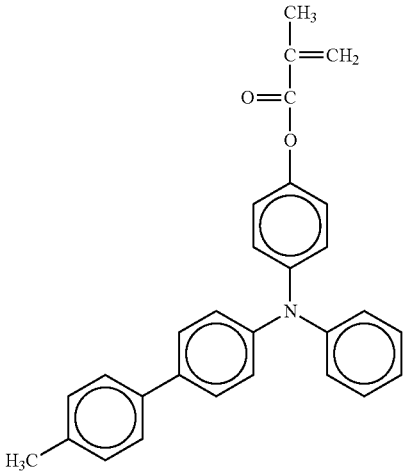
No. 25
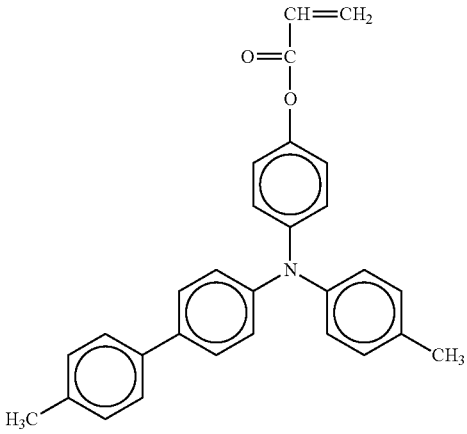
No. 26
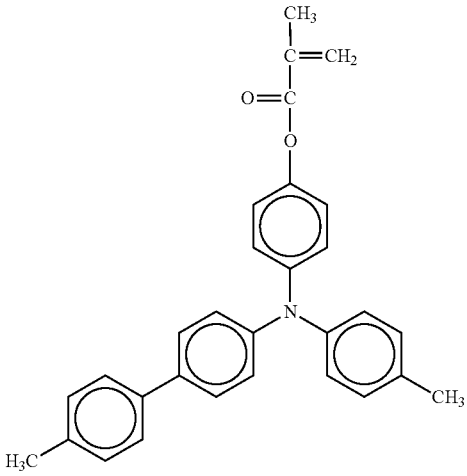
-continued
No. 27
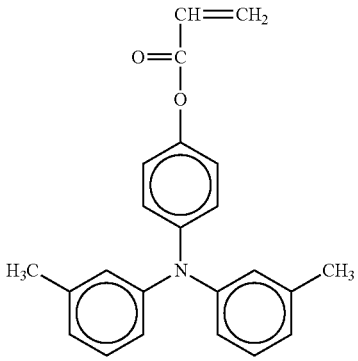
No. 28
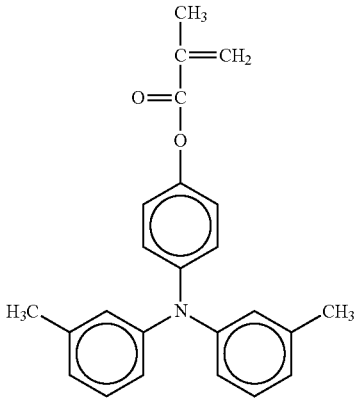
No. 29
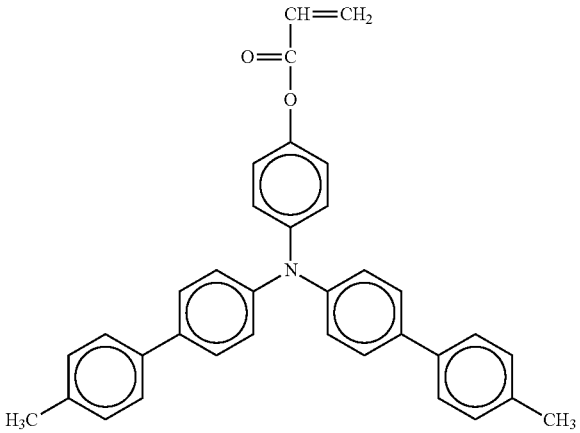
No. 30
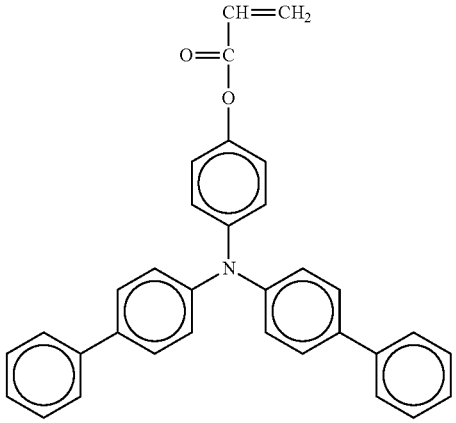

-continued
No. 31
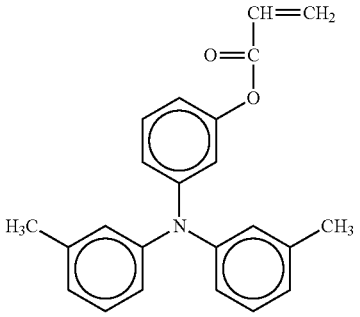
No. 32
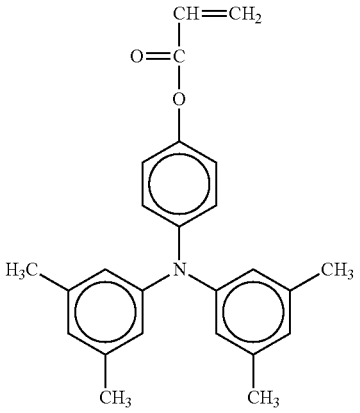
No. 33
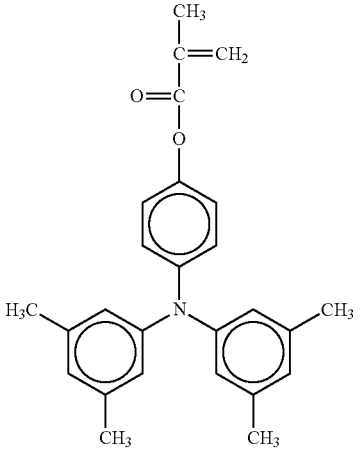
No. 34
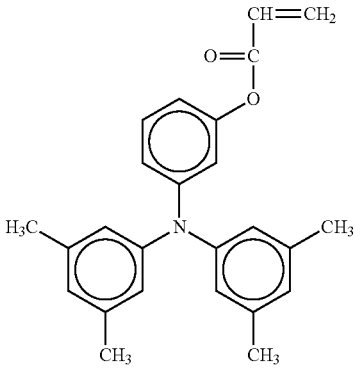
-continued
No. 35
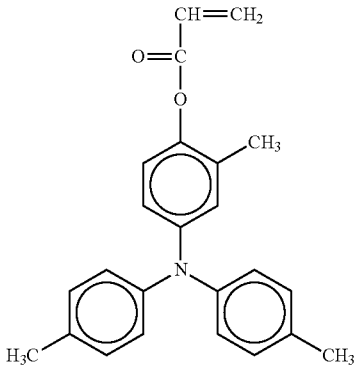
No. 36
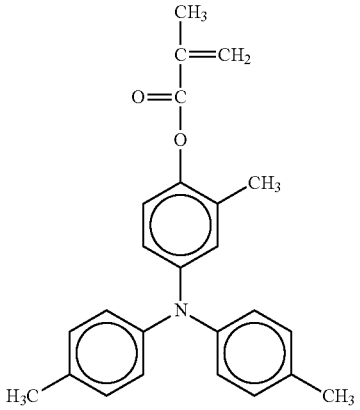
No. 37
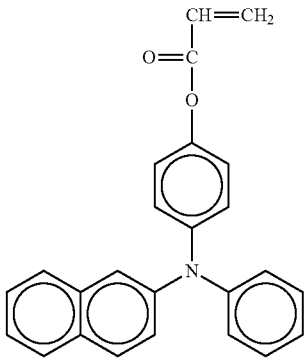
No. 38
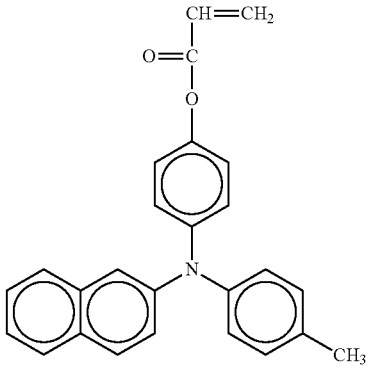

-continued
No. 39
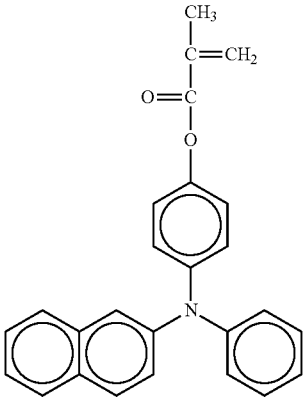
No. 40
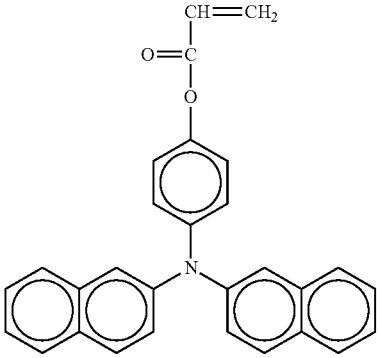
No. 41
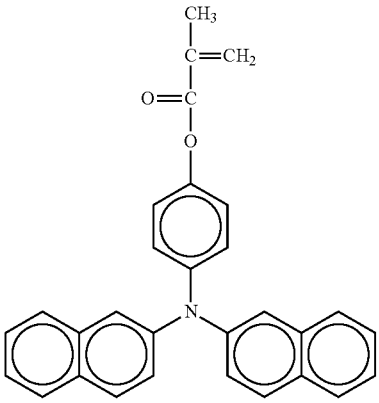
No. 42
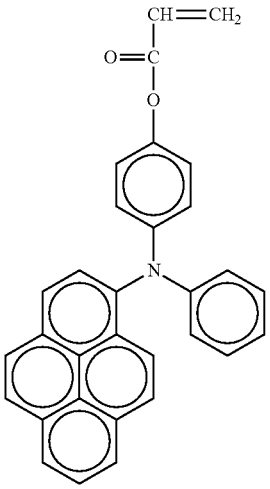
-continued
No. 43
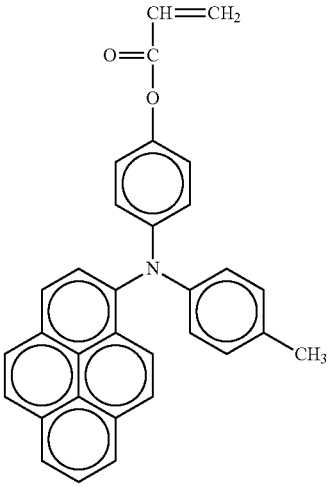
No. 44
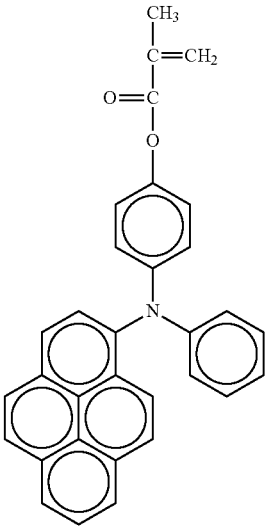
No. 45
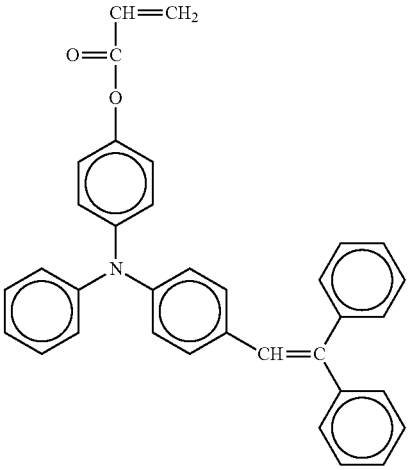

-continued
No. 46
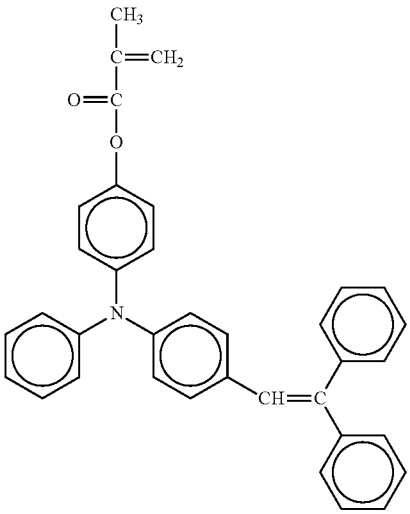
No. 47
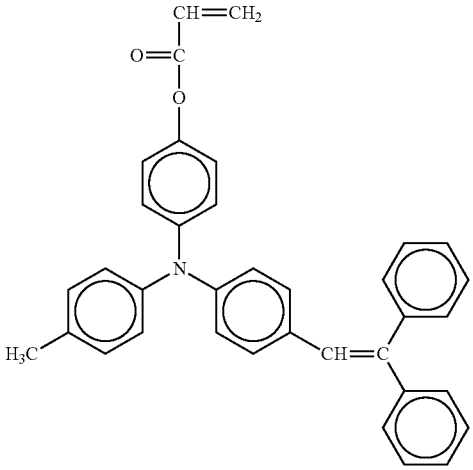
No. 48
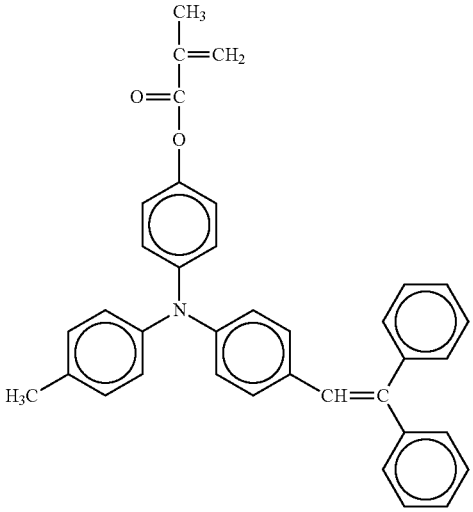
-continued
No. 49
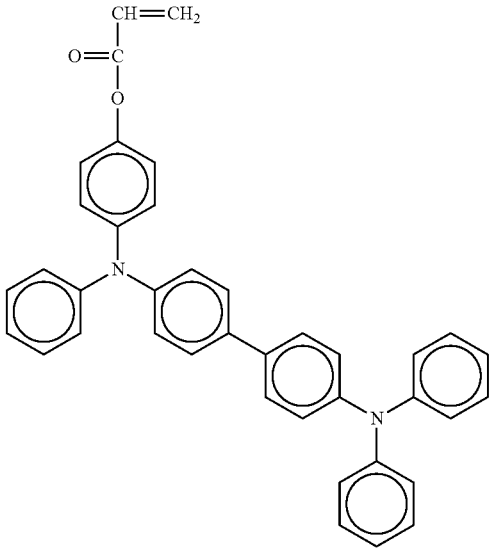
No. 50
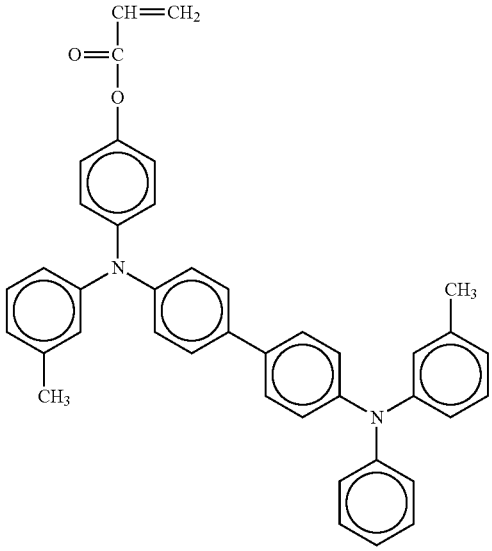
No. 51
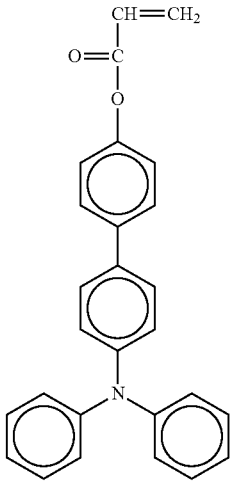

No. 52
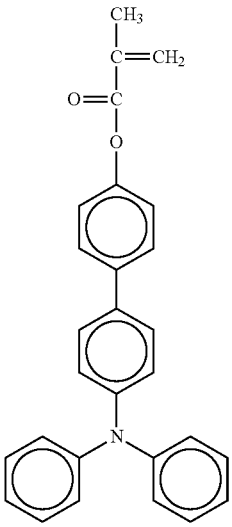
No. 53
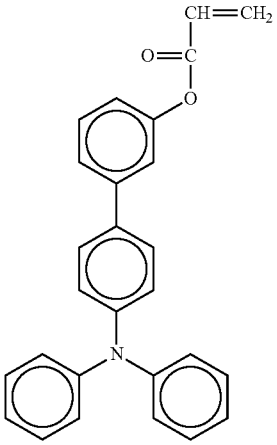
No. 54
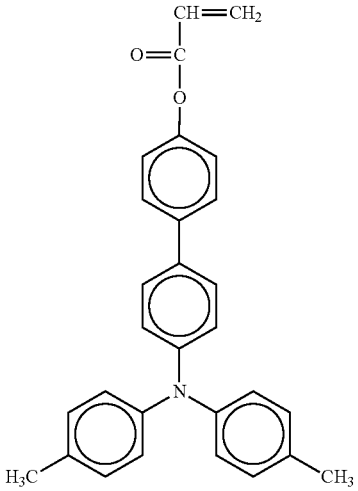
No. 55
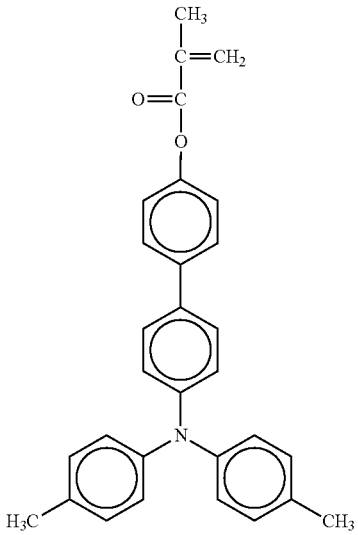
No. 56
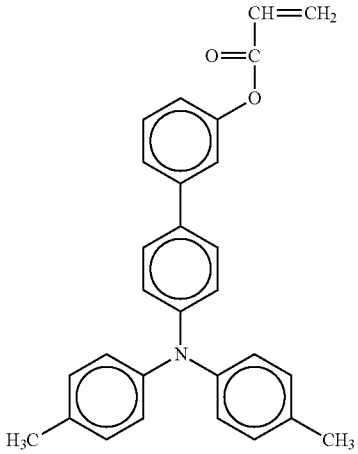
No. 57
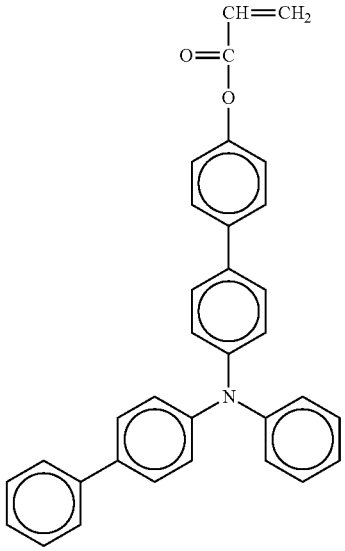

-continued
No. 58
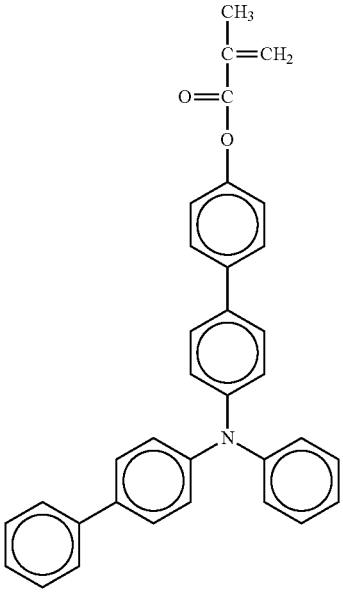
No. 59
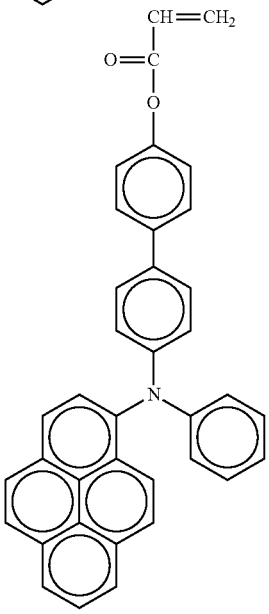
No. 60
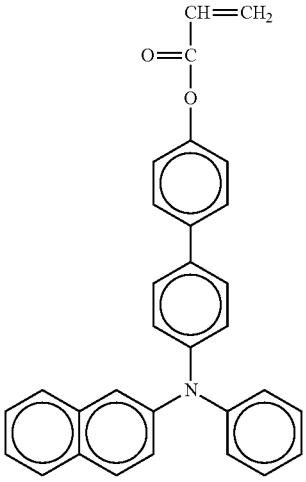
-continued
No. 61
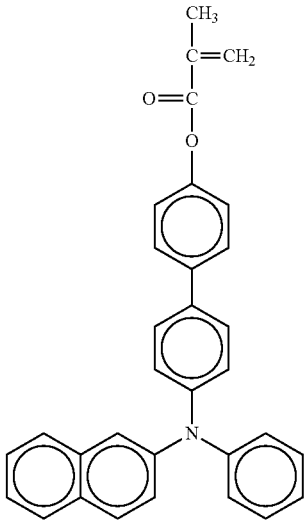
No. 62
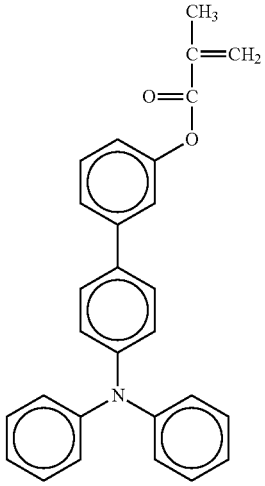
No. 63
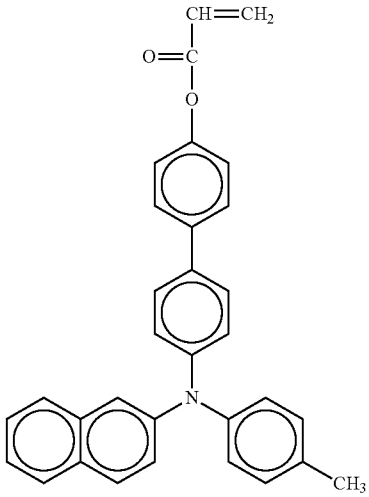

-continued
No. 64
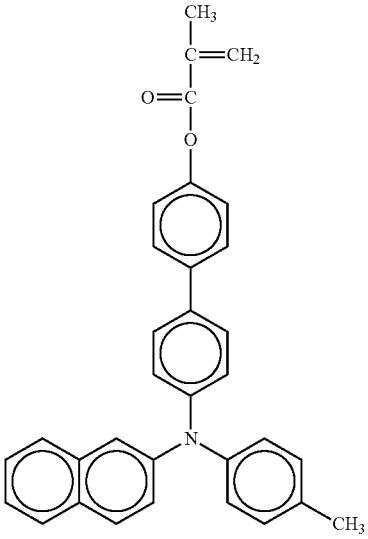
No. 65
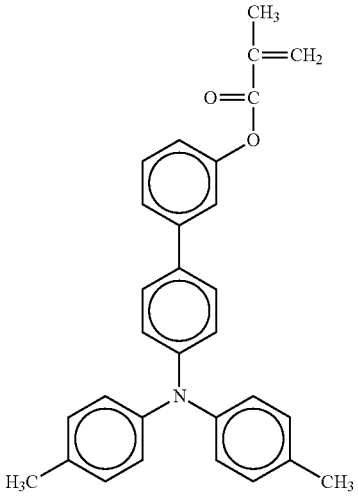
No. 66
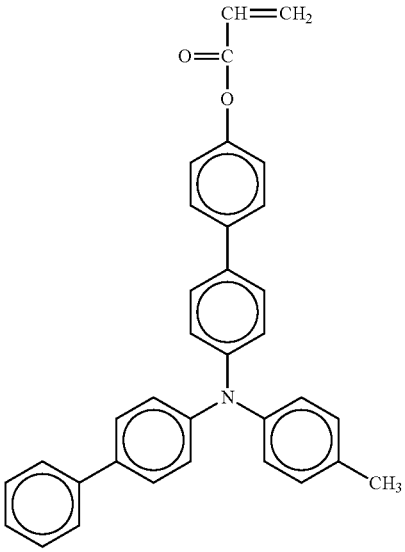
-continued
No. 67
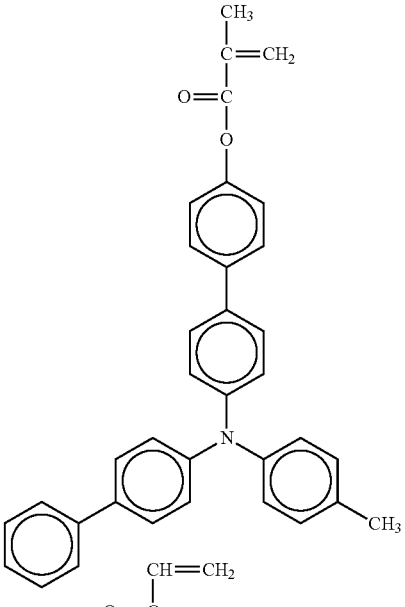
No. 68
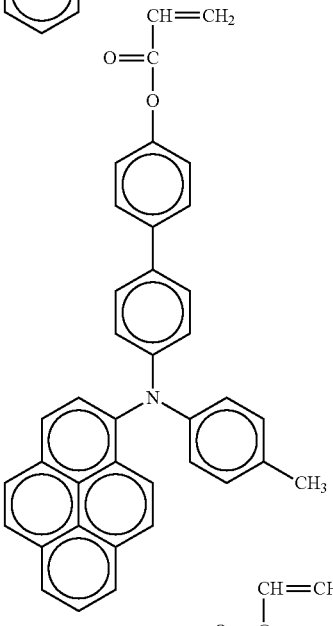
No. 69
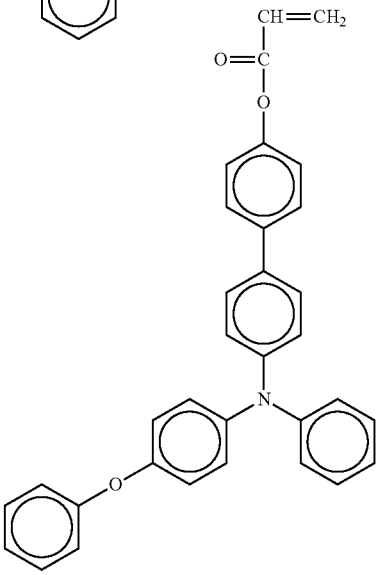

-continued
No. 70
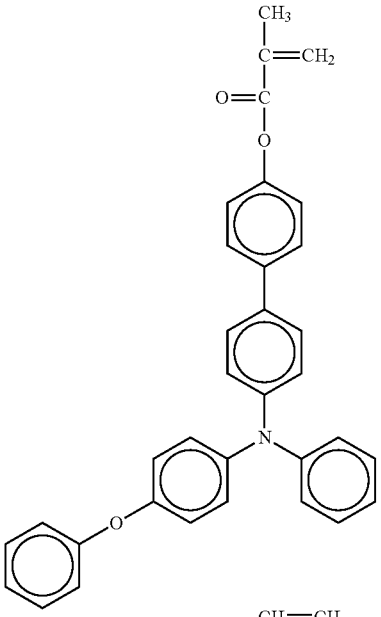
No. 71
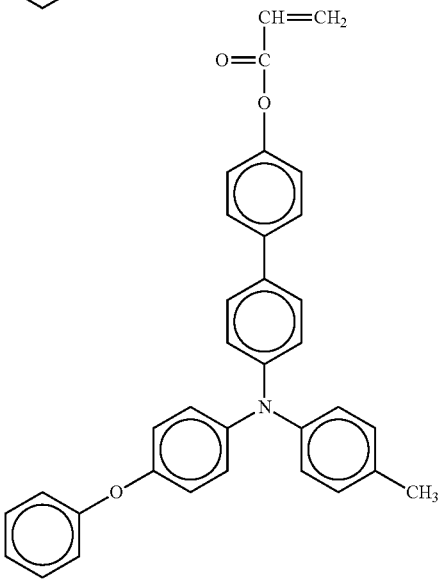
No. 72
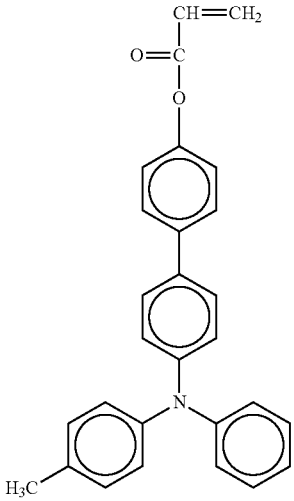
-continued
No. 73
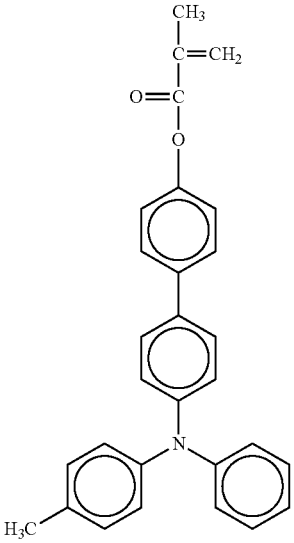
No. 74
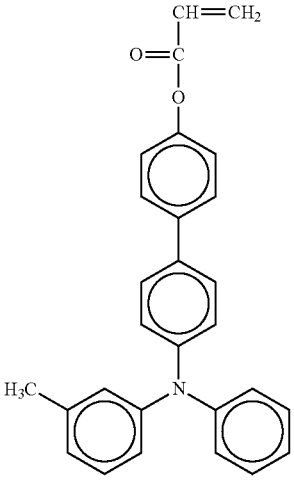
No. 75
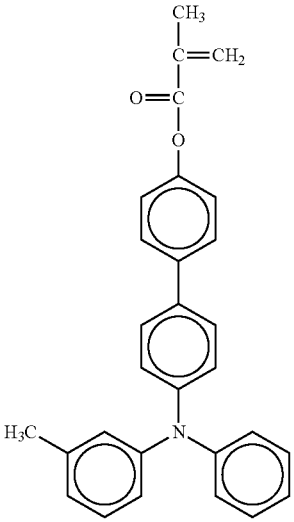

No. 76
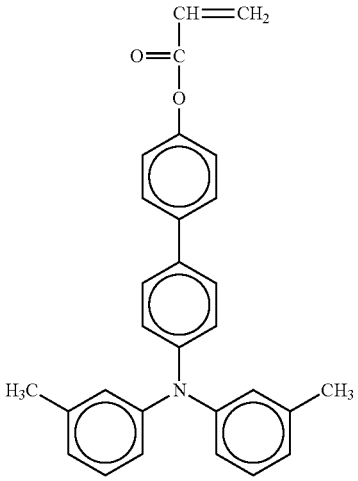
No. 77
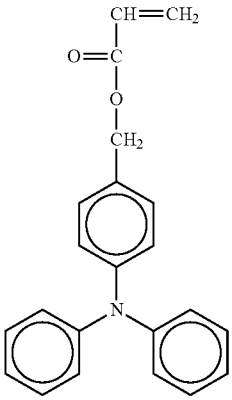
No. 78
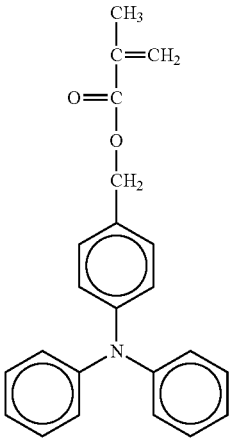
No. 79
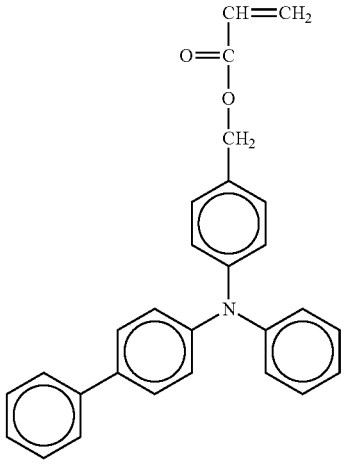
No. 80
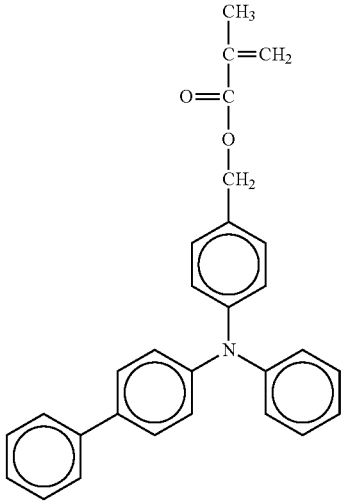
No. 81
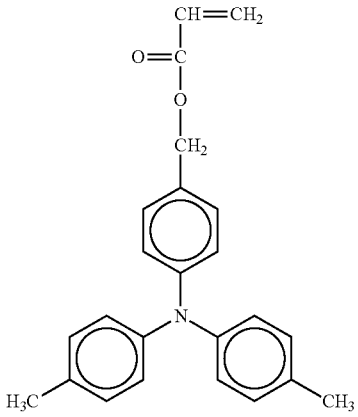

No. 82
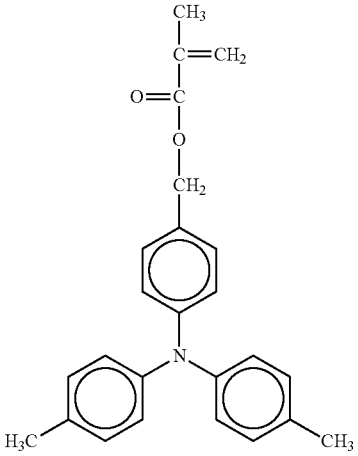
No. 83
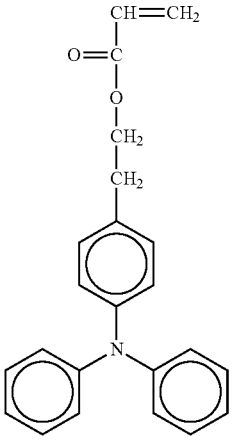
No. 84
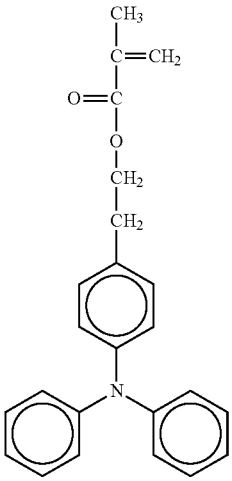
No. 85
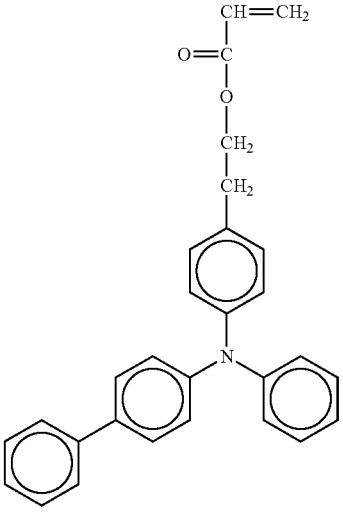
No. 86
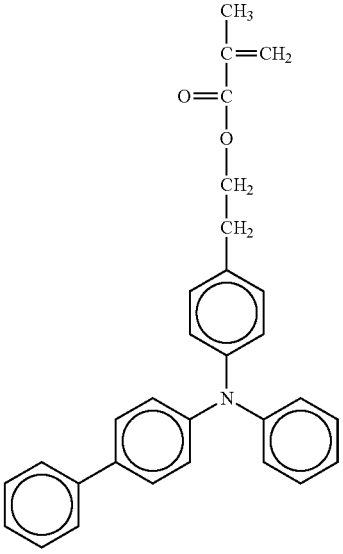
No. 87
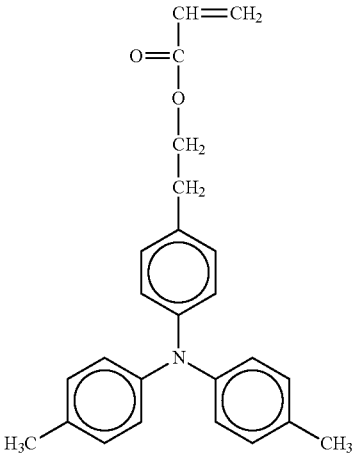

-continued
No. 88
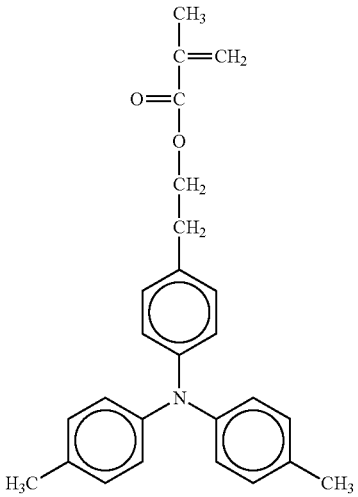
No. 89
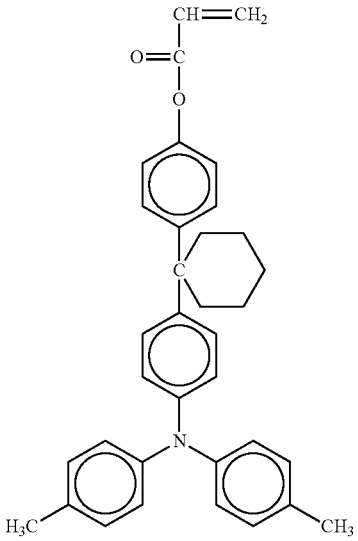
No. 90
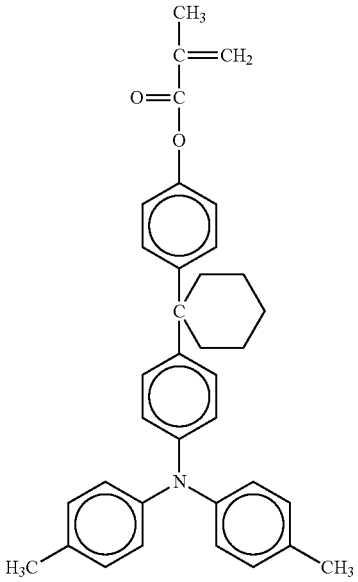
-continued
No. 91
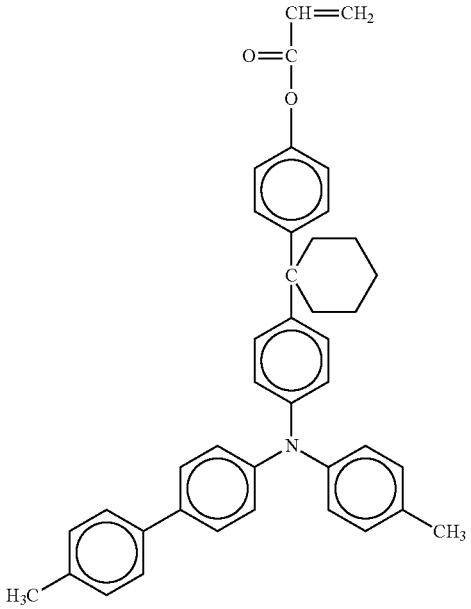
No. 92
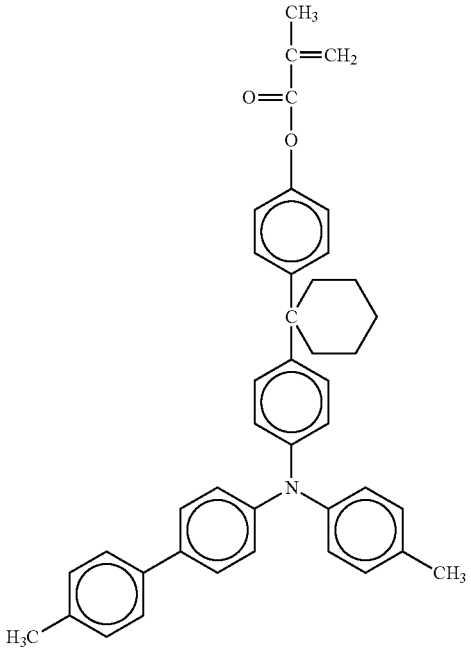

No. 93
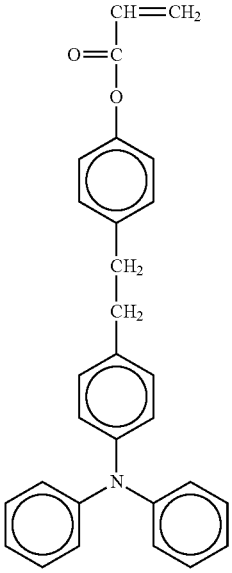
No. 94
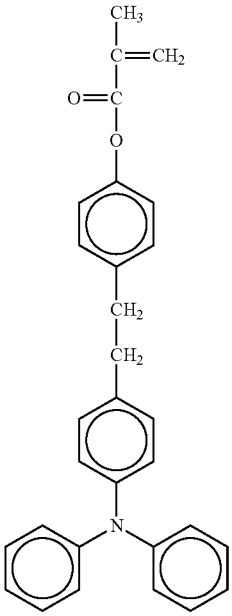
No. 95
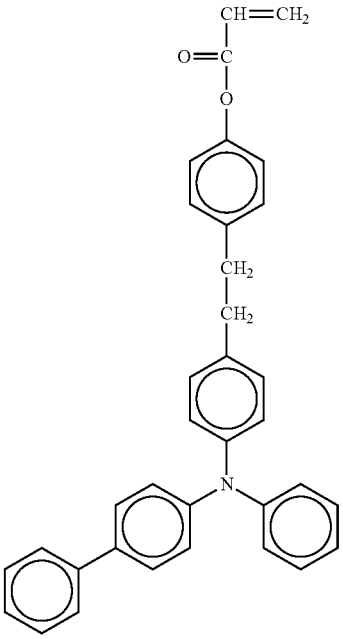
No. 96
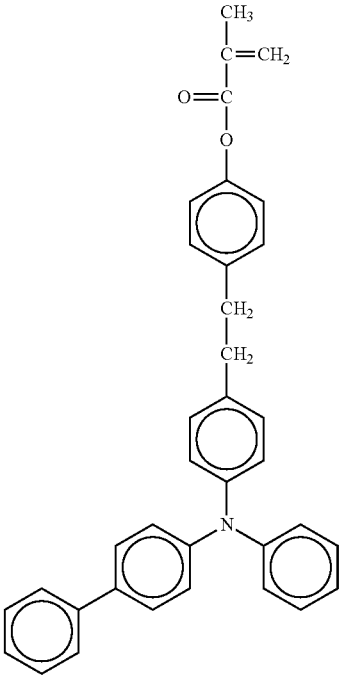

No. 97
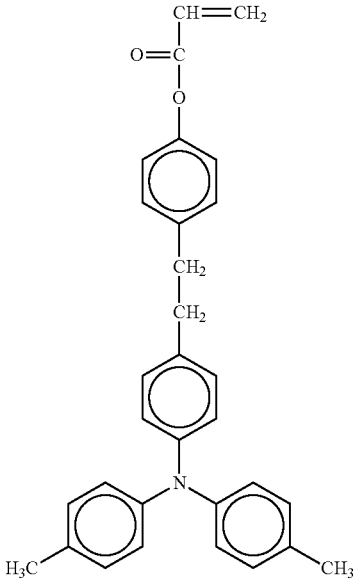
No. 98
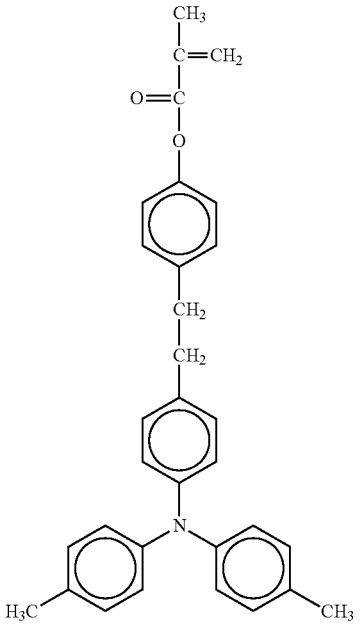
No. 99
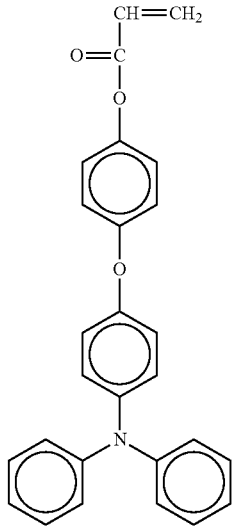
No. 100
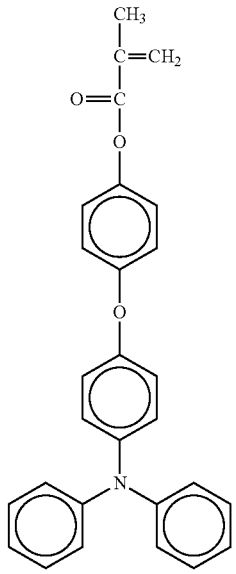

-continued
No. 101
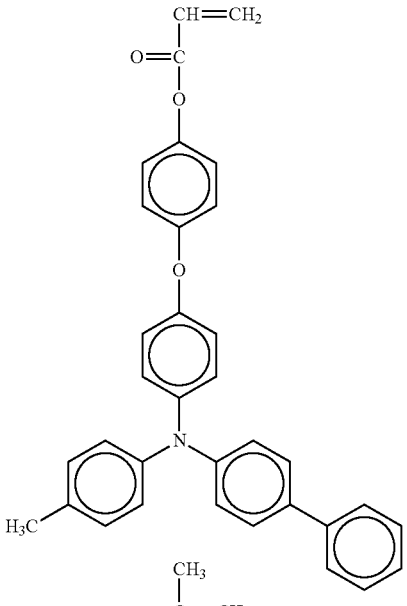
No. 102
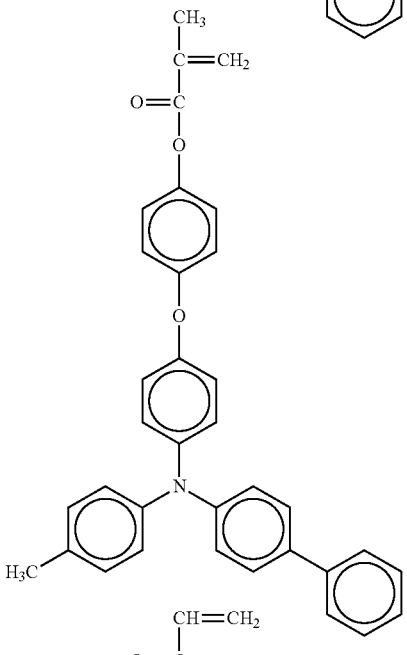
No. 103
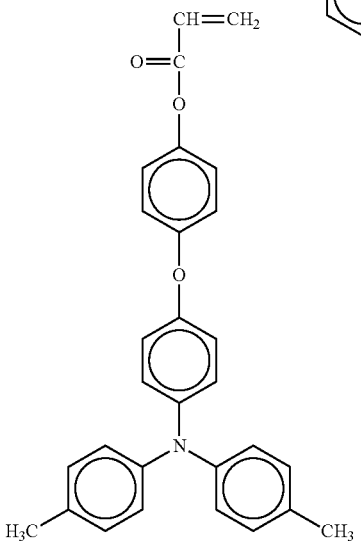
-continued
No. 104
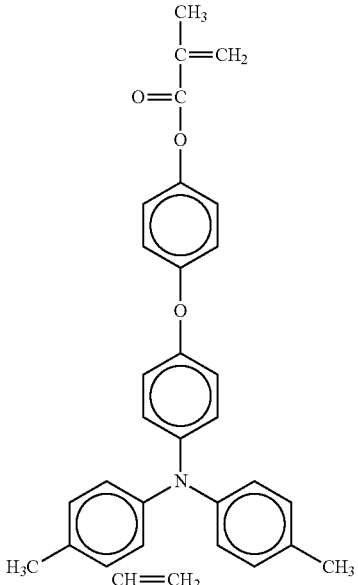
No. 105
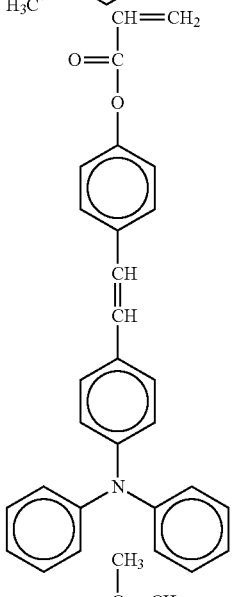
No. 106
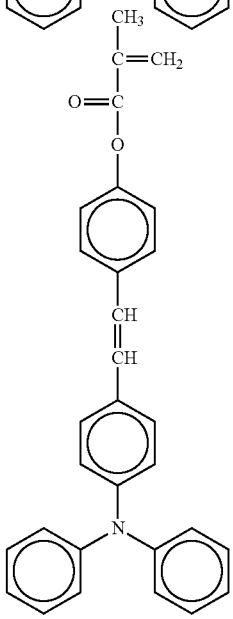

No. 107
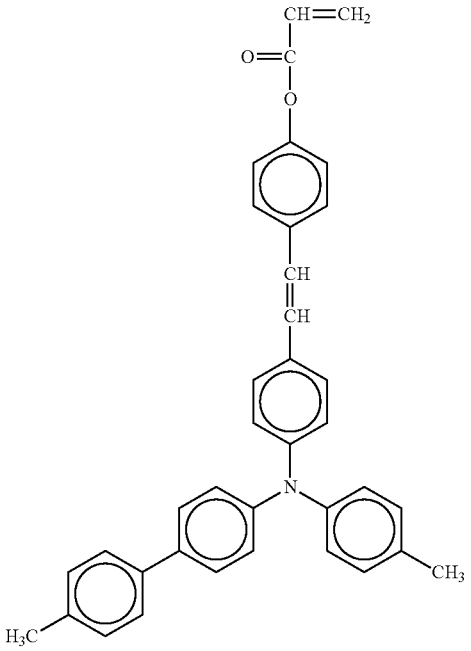
No. 108
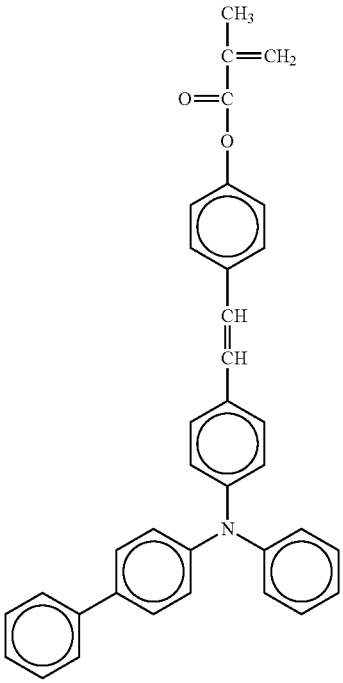
No. 109
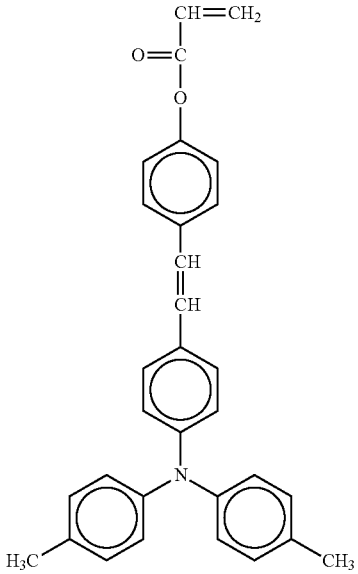
No. 110
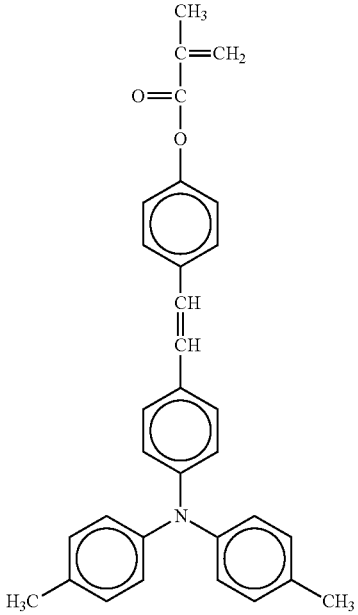

-continued
No. 111
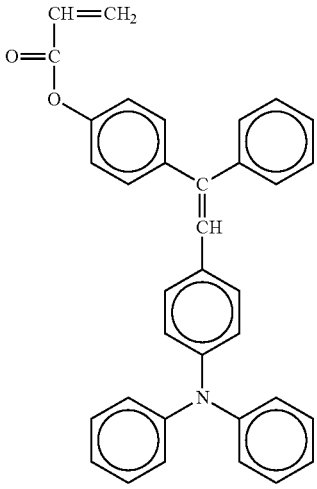
No. 112
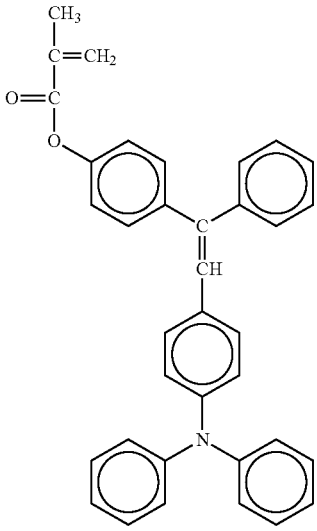
No. 113
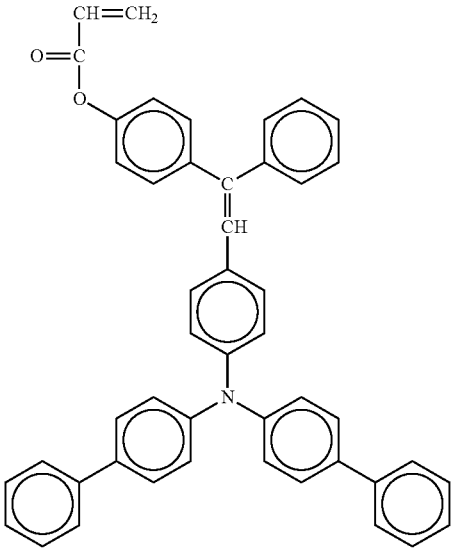
-continued
No. 114
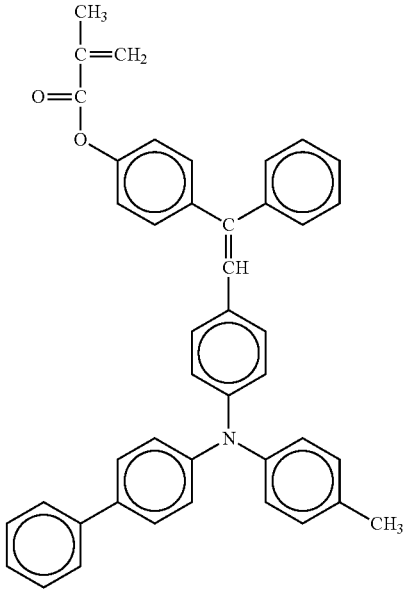
No. 115
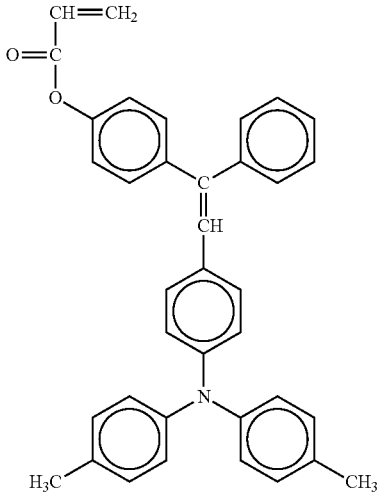
No. 116
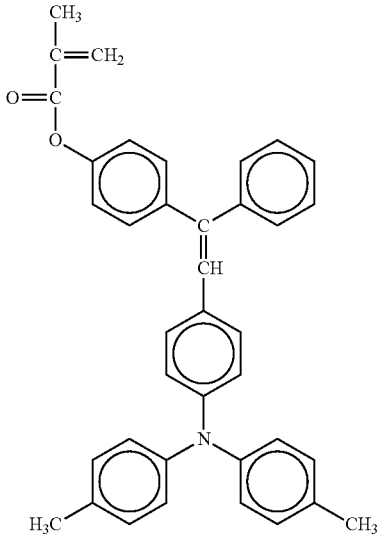

No. 117
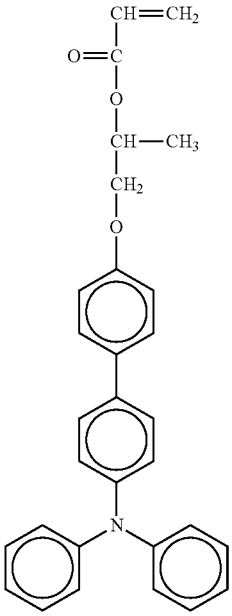
No. 118
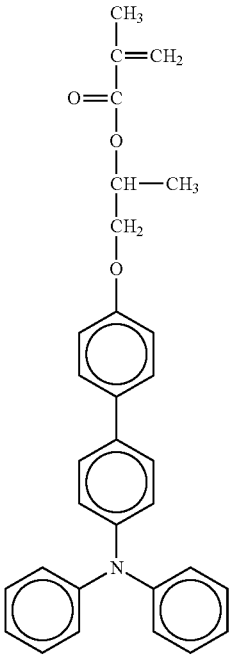
No. 119
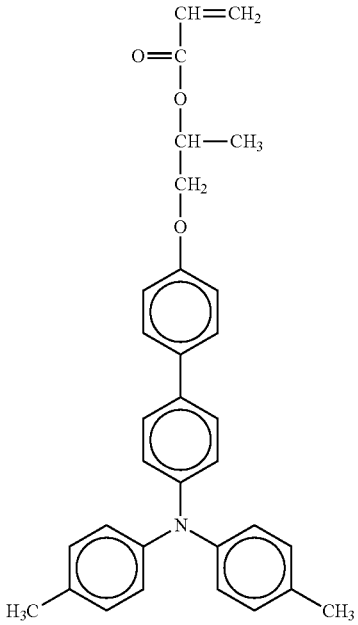
No. 120
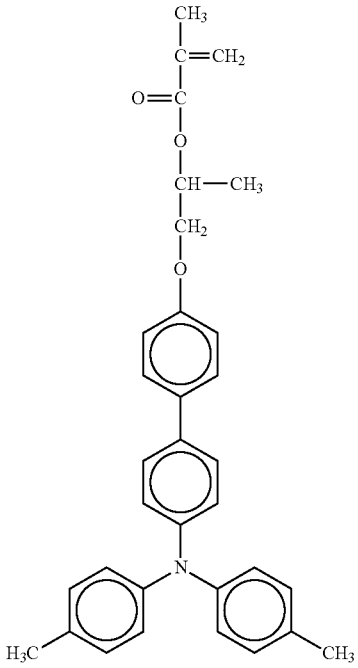

No. 121
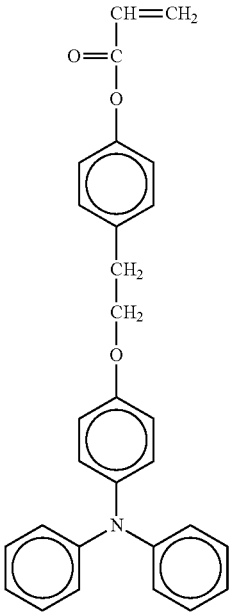
No. 122
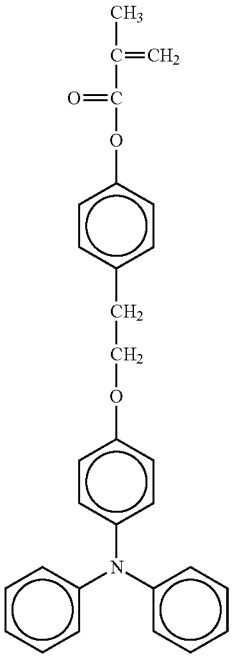
No. 123
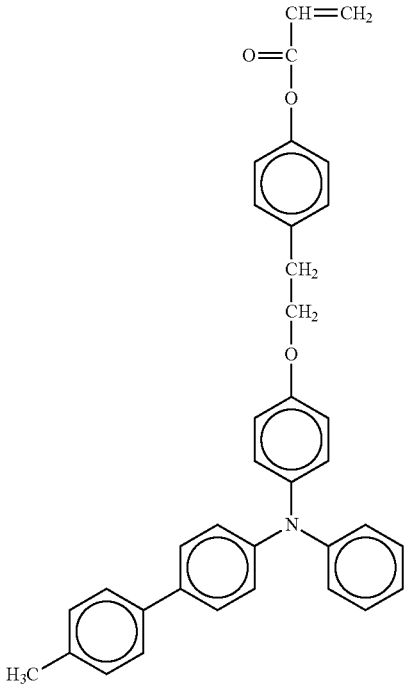
No. 124
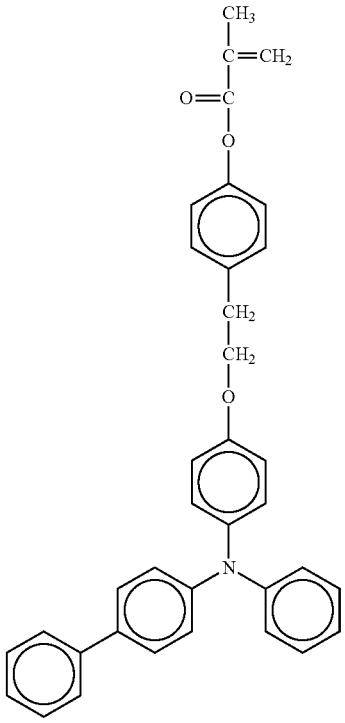

No. 125
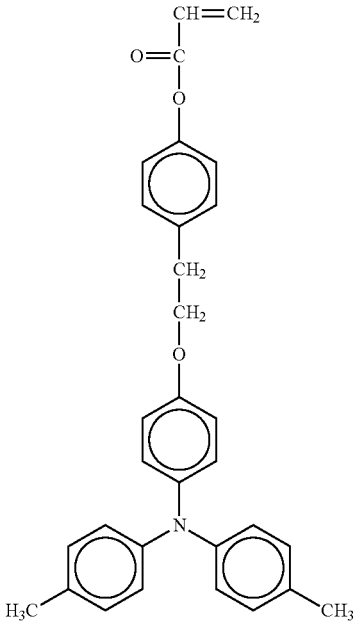
No. 126
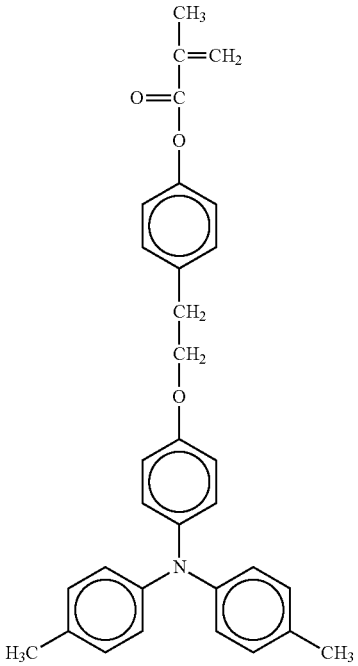
No. 127
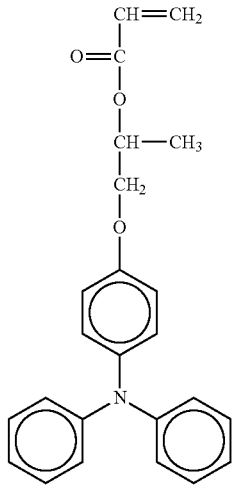
No. 128
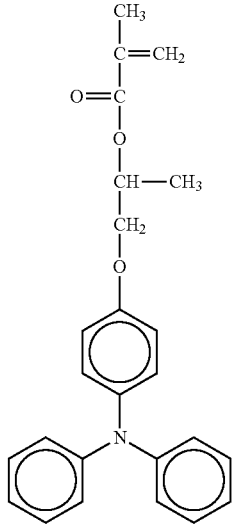
No. 129
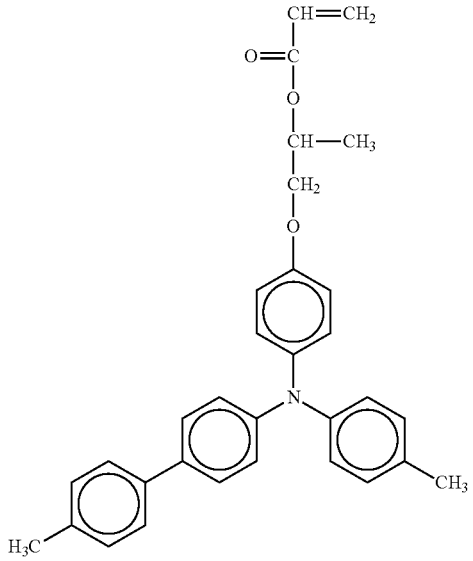

-continued
No. 130
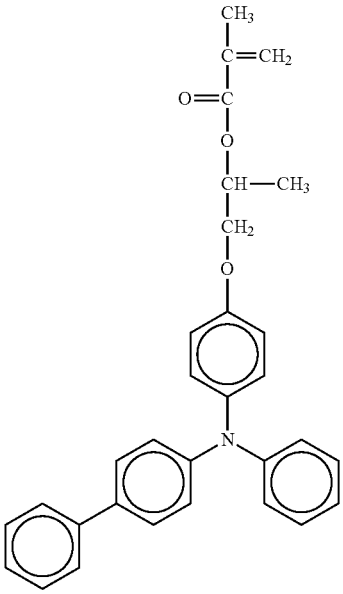
No. 131
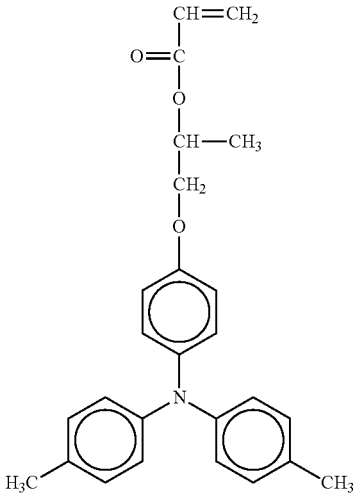
No. 132
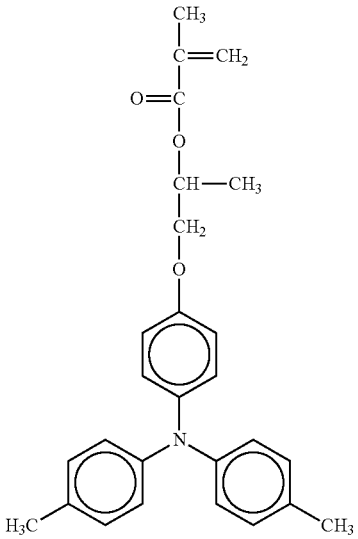
-continued
No. 133
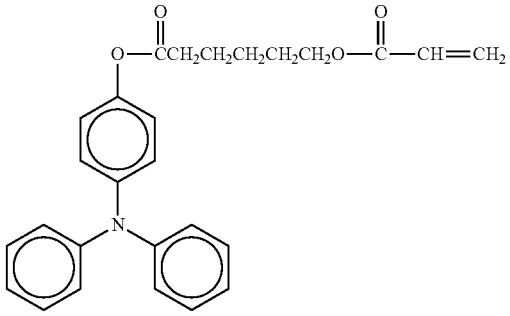
No. 134
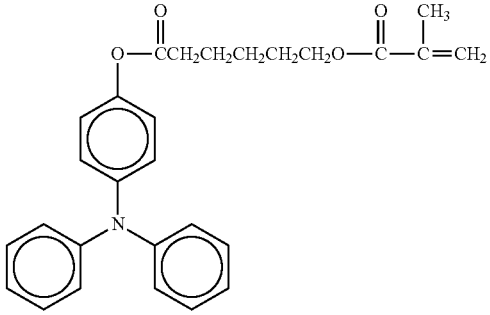
No. 135
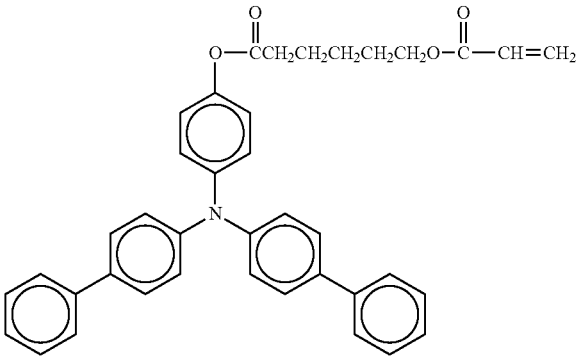
No. 136
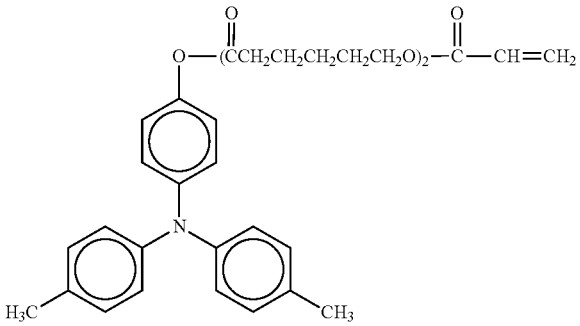

-continued
No. 137
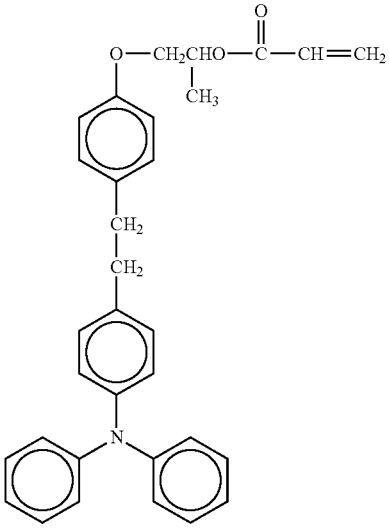
No. 138
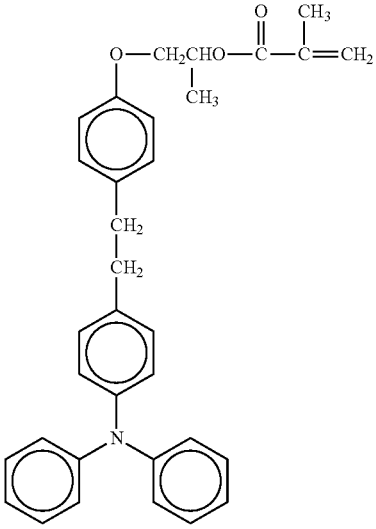
No. 139
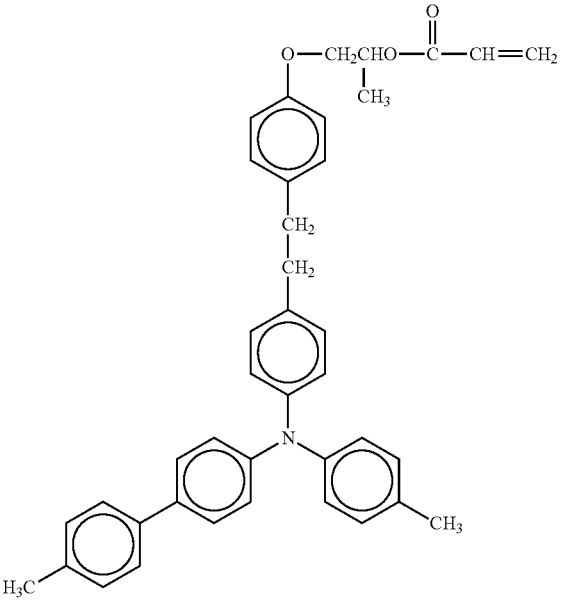
-continued
No. 140
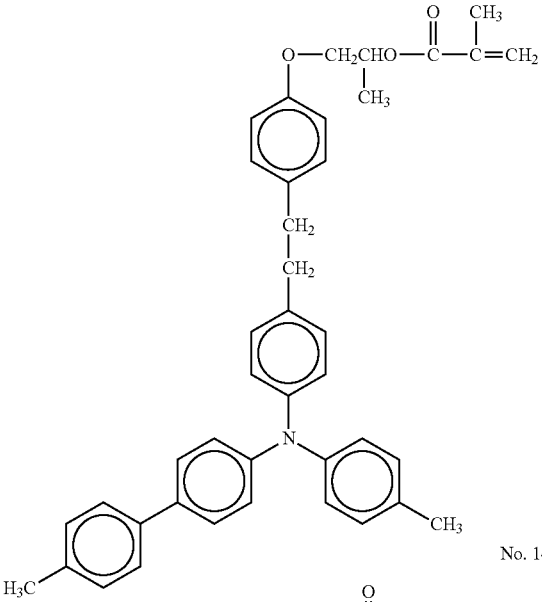
No. 141
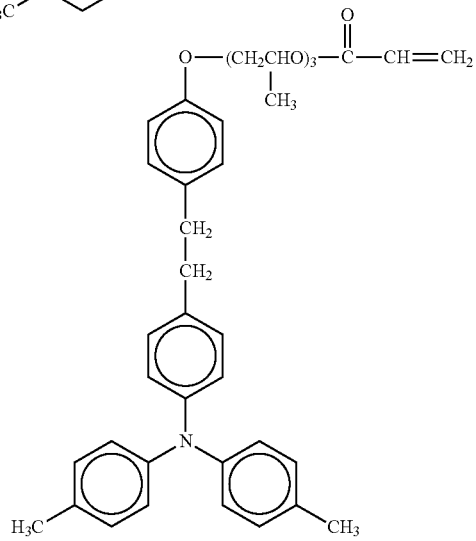
No. 142
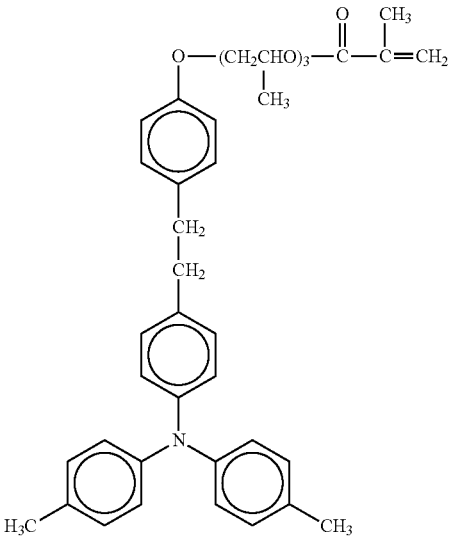

-continued
No. 143
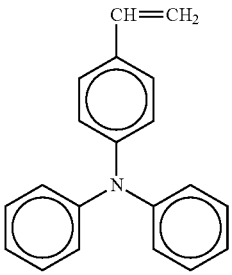
No. 144
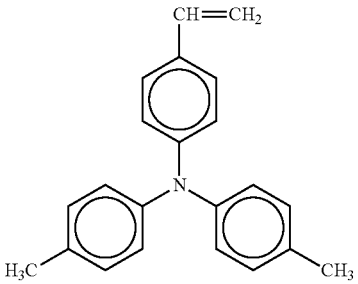
No. 145
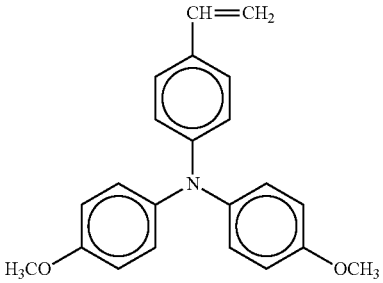
No. 146
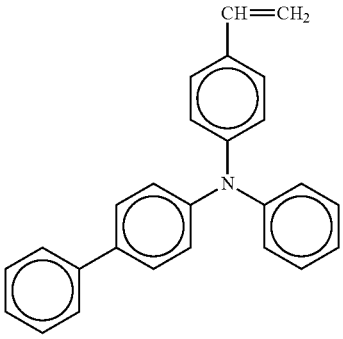
No. 147
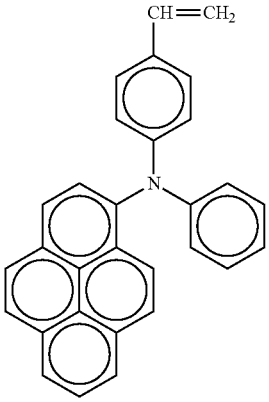
-continued
No. 148
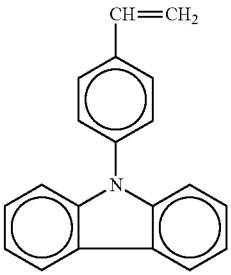
No. 149
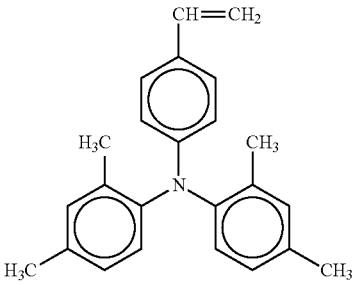
No. 150
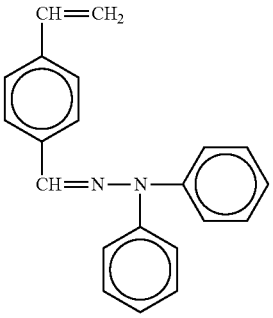
No. 151
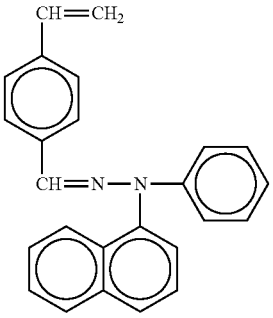
No. 152
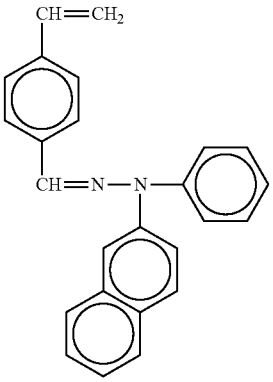

No. 153
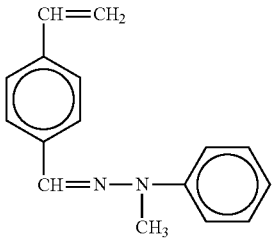
No. 154
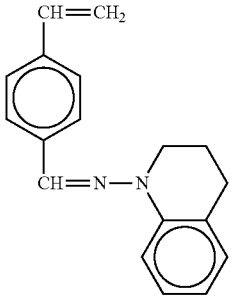
No. 155
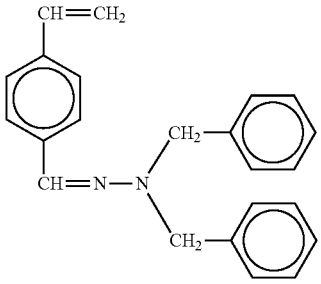
No. 156
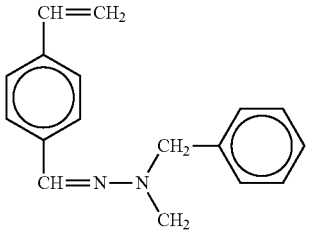
No. 157
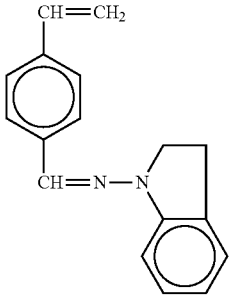
No. 158
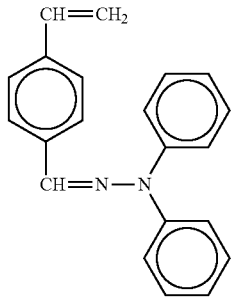
No. 159
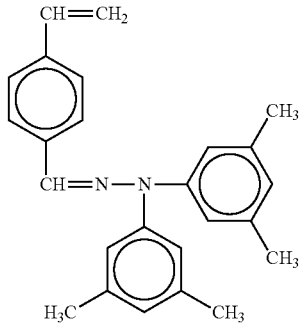
No. 160
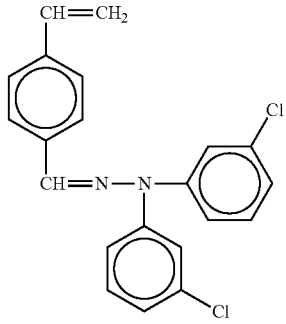
No. 160A
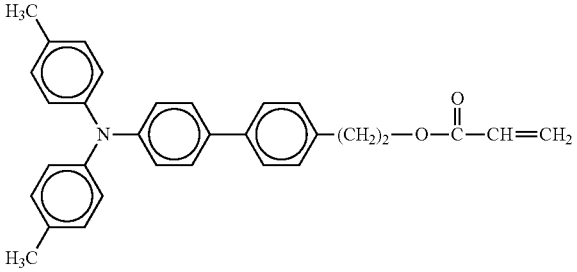

No. 161
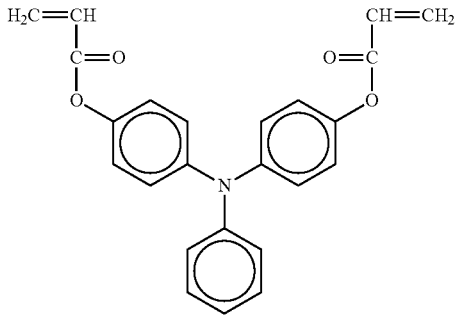
No. 162
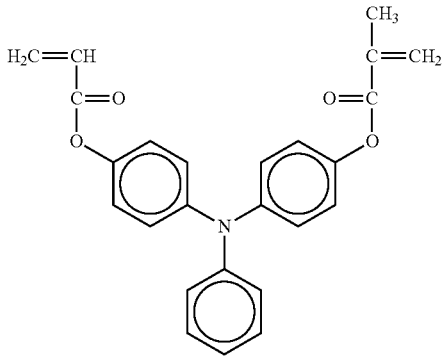
No. 163
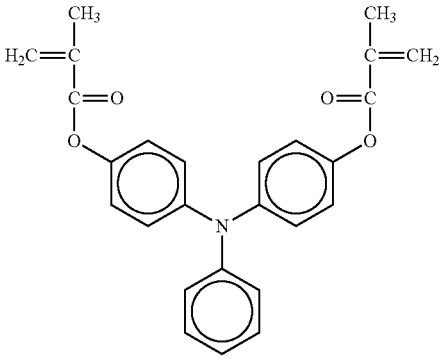
No. 164
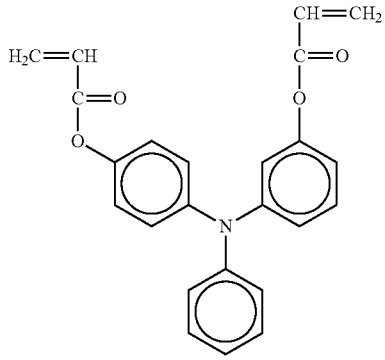
No. 165
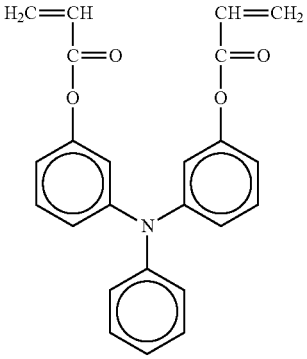
No. 166
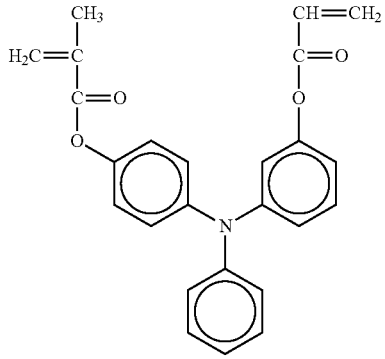
No. 167
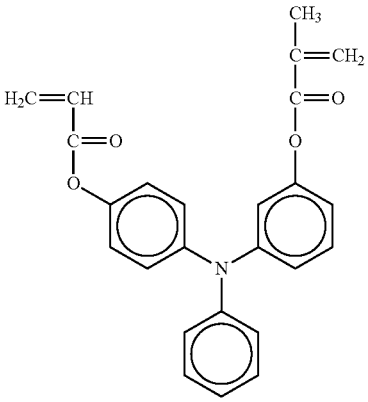
No. 168
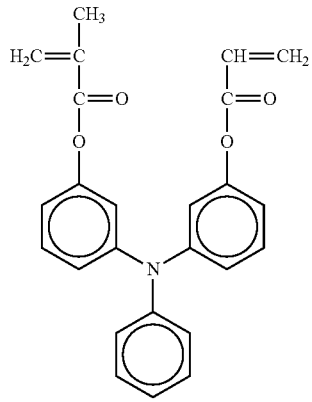

-continued
No. 169
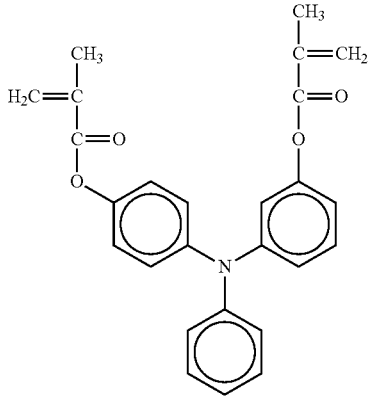
No. 170
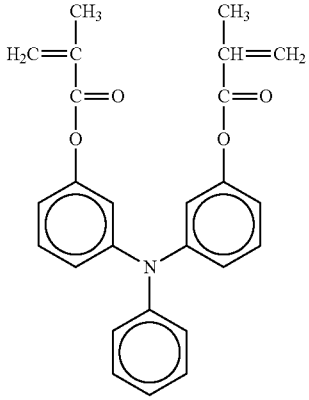
No. 171
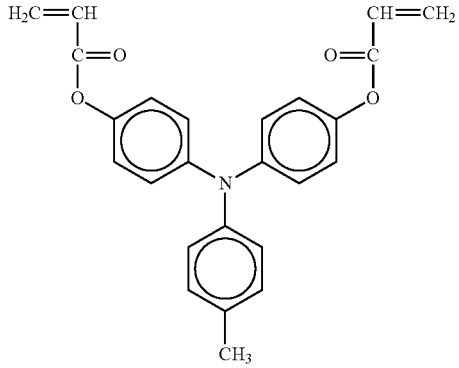
No. 172
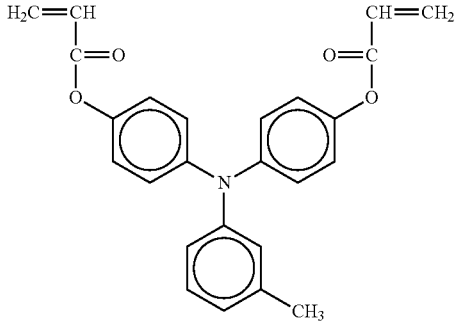
No. 173
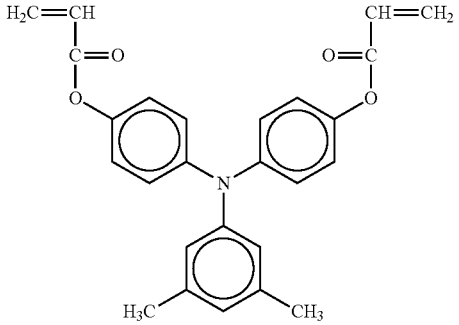
No. 174
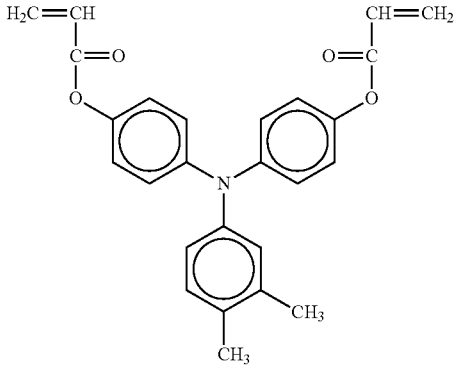
No. 175
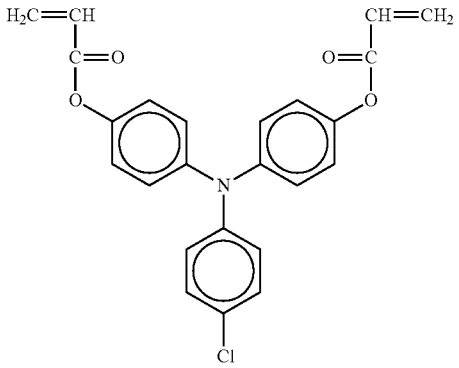
No. 176
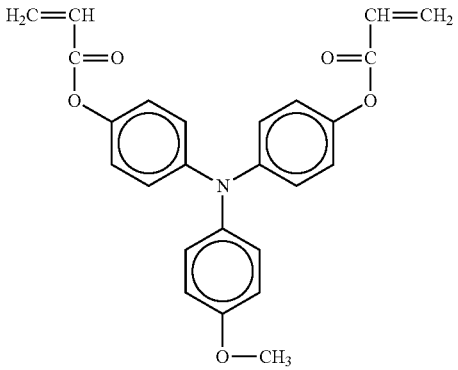

-continued
No. 177
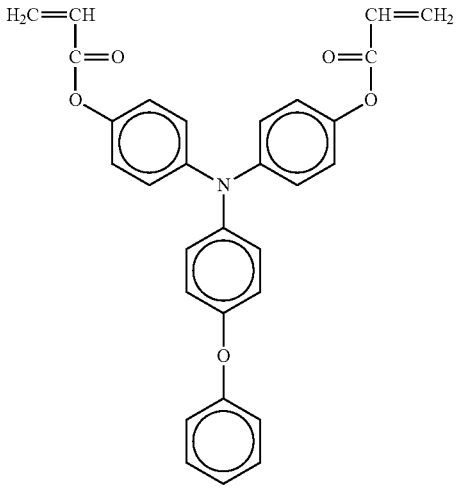
No. 178
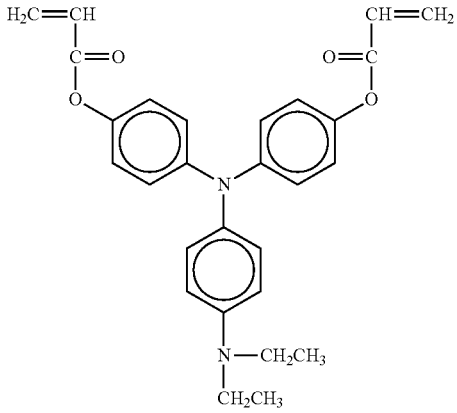
No. 179
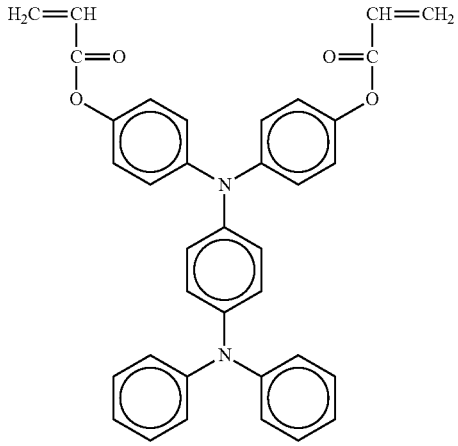
No. 180
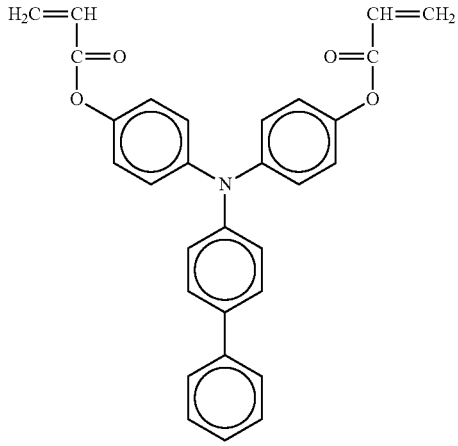
No. 181
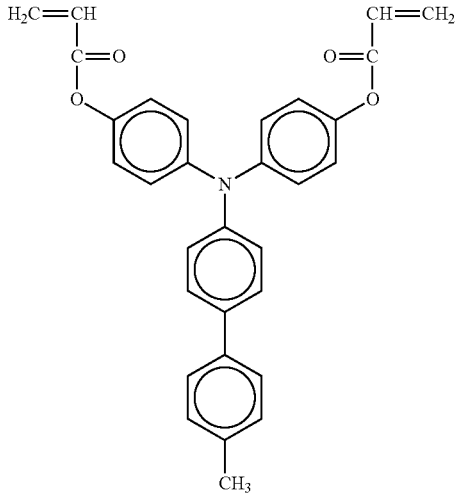
No. 182
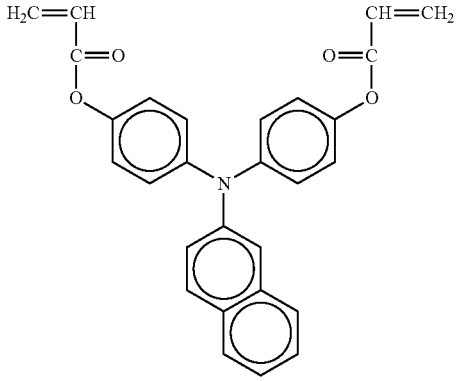

-continued
No. 183
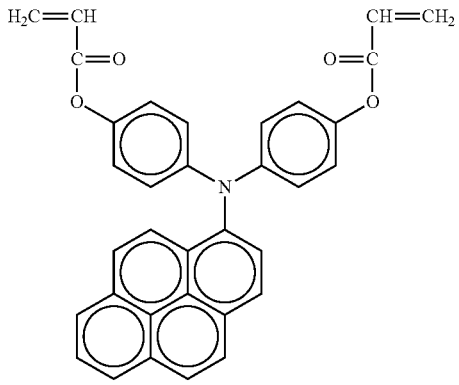
No. 184
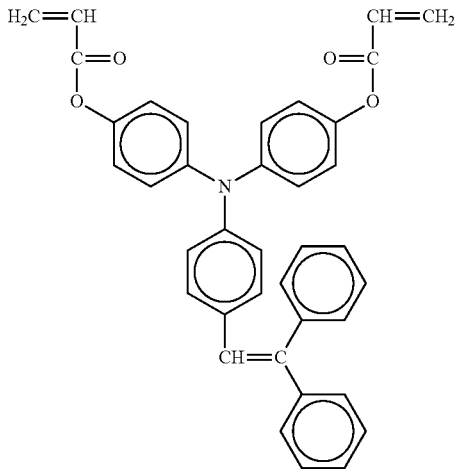
No. 185
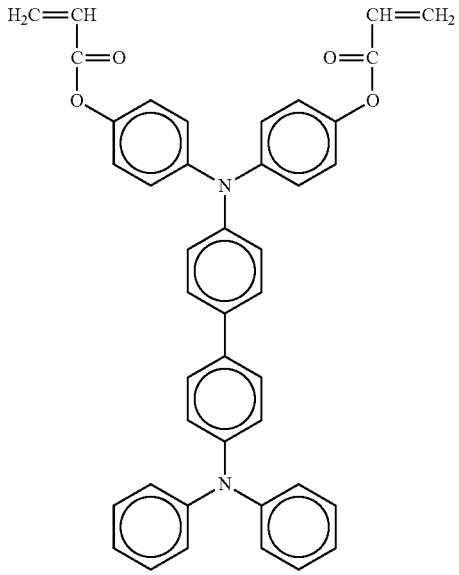
No. 186
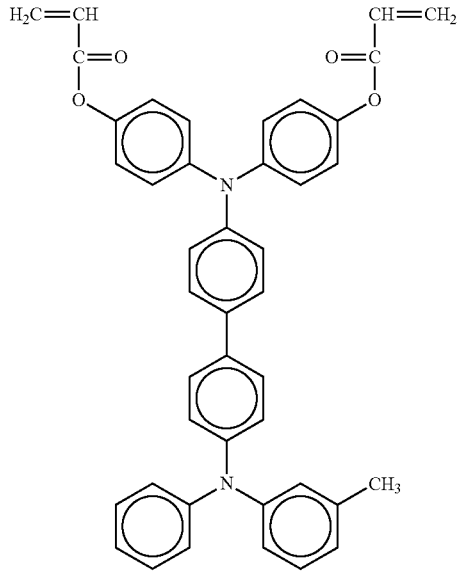

-continued
No. 187
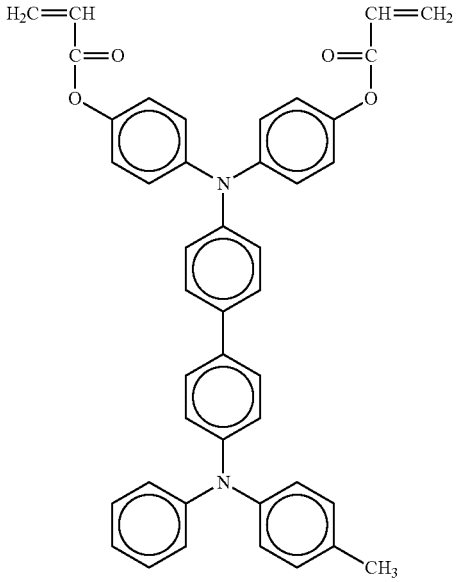
No. 188
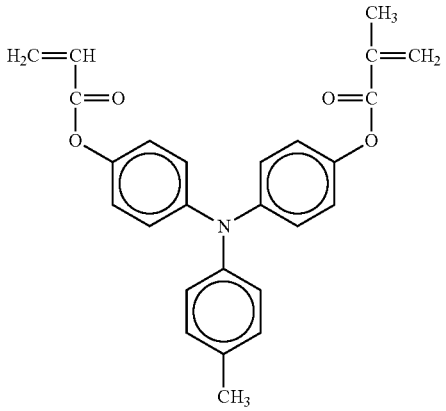
No. 189
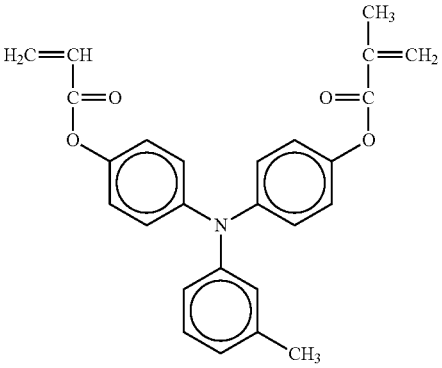
No. 190
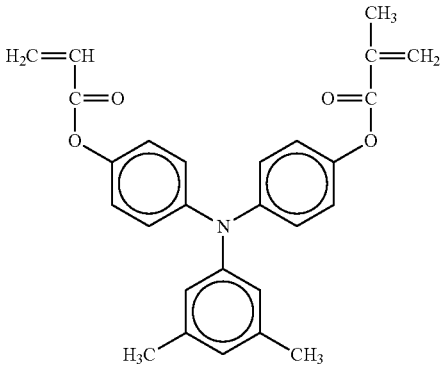
No. 191
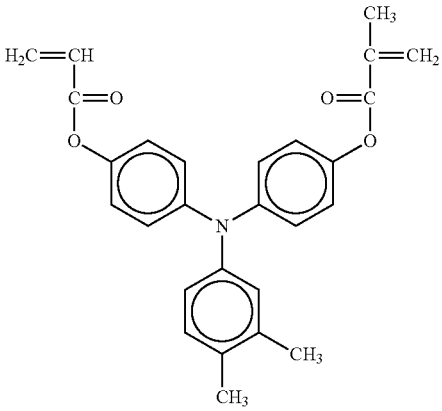
No. 192
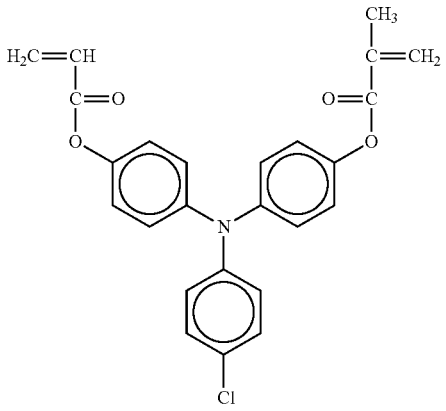

-continued
No. 193
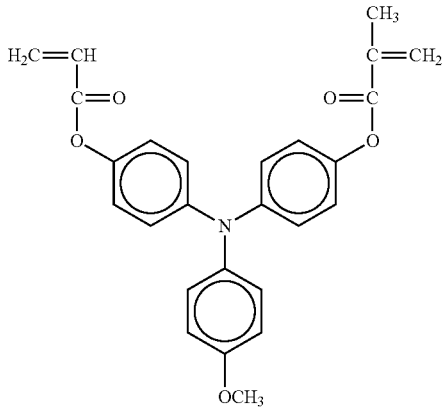
No. 194
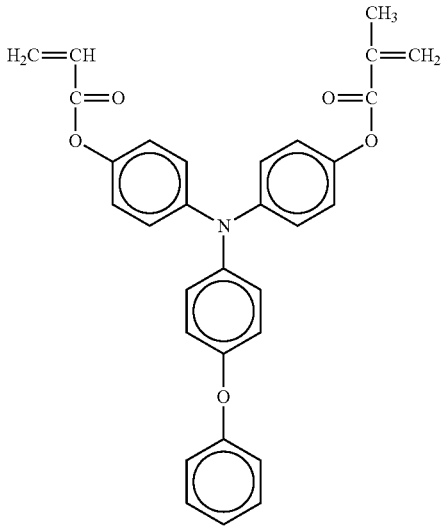
No. 195
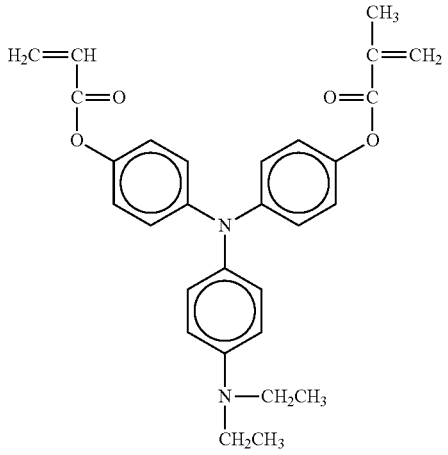
No. 196
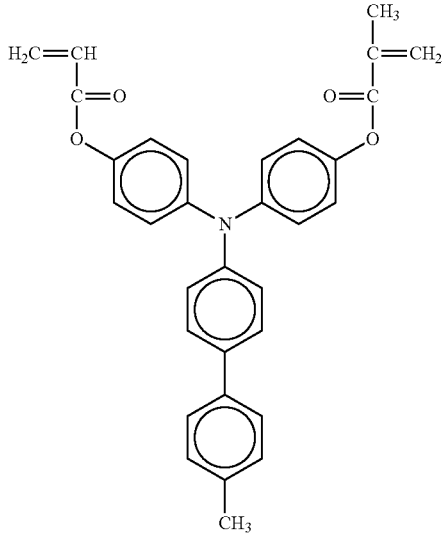
No. 197
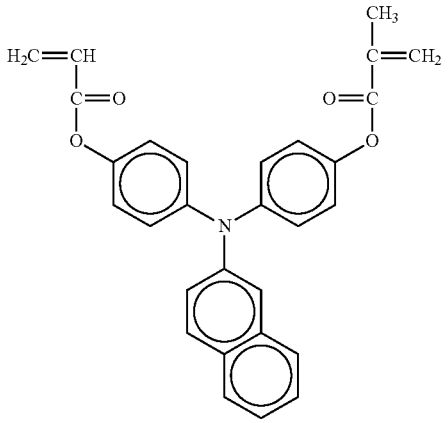
No. 198
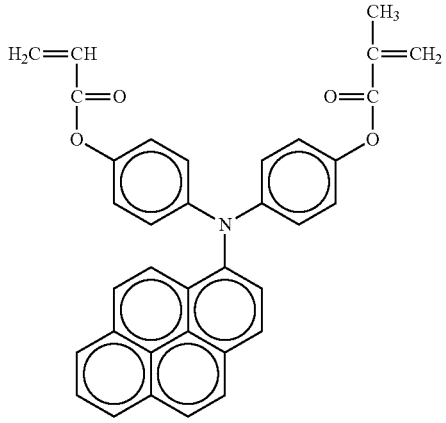

-continued
No. 199
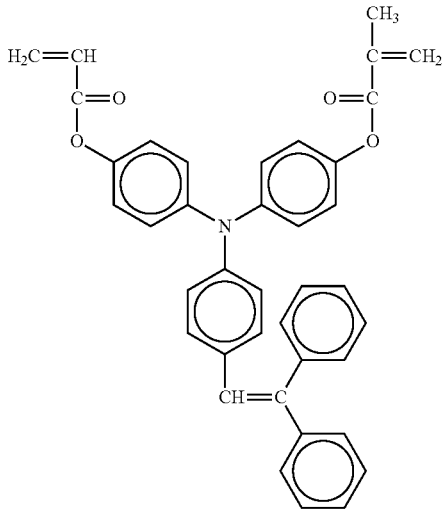
No. 200
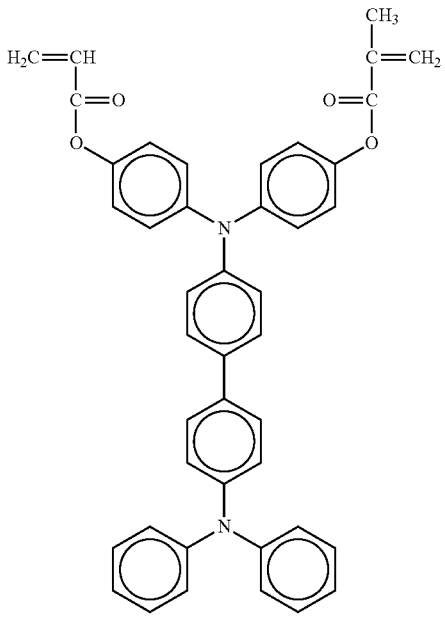
No. 201
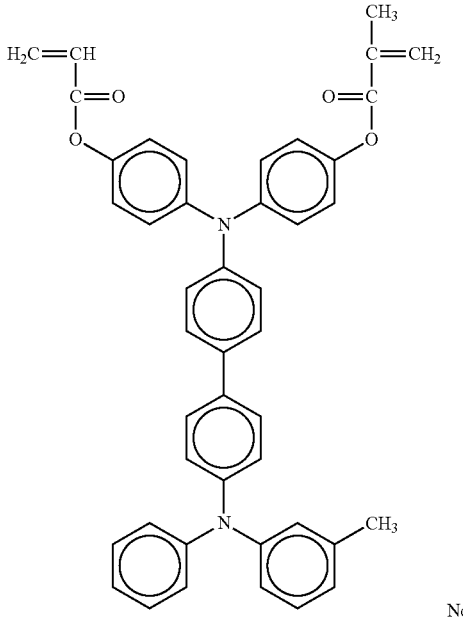
No. 202
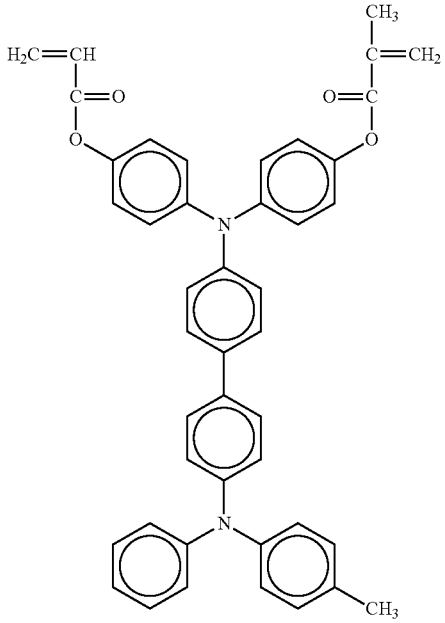
No. 203
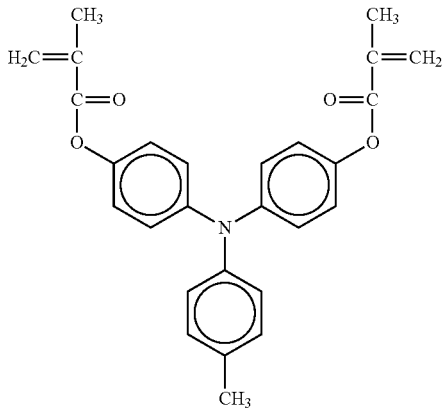
No. 204
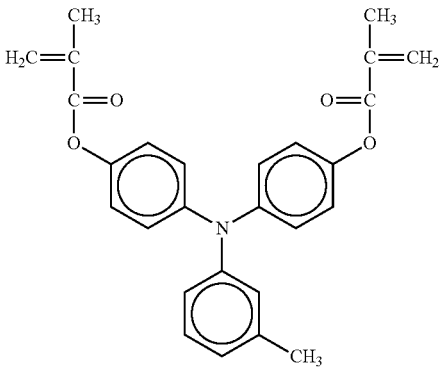

-continued
No. 205
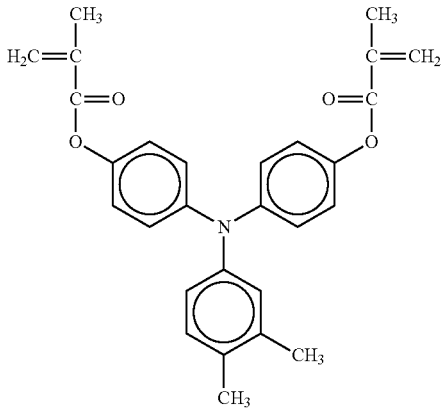
No. 206
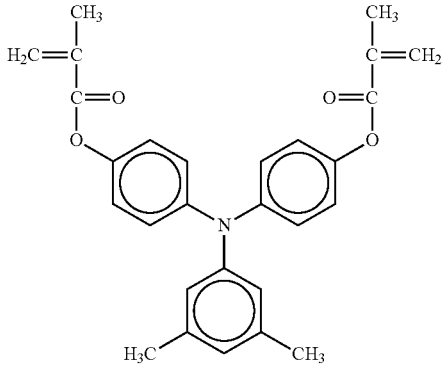
No. 207
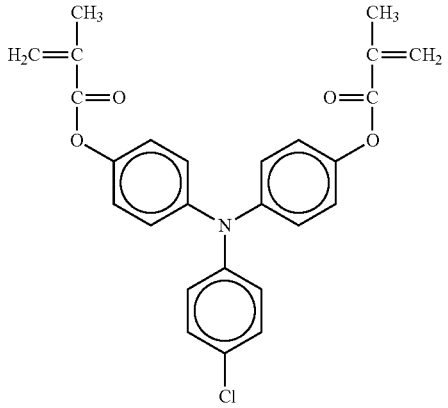
No. 208
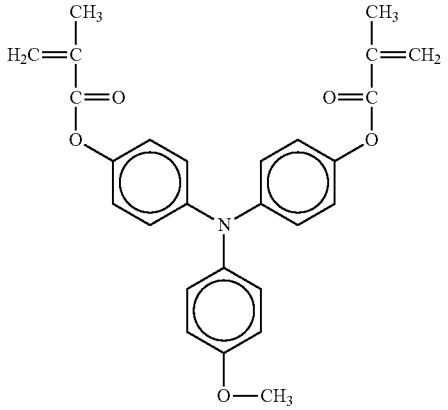
No. 209
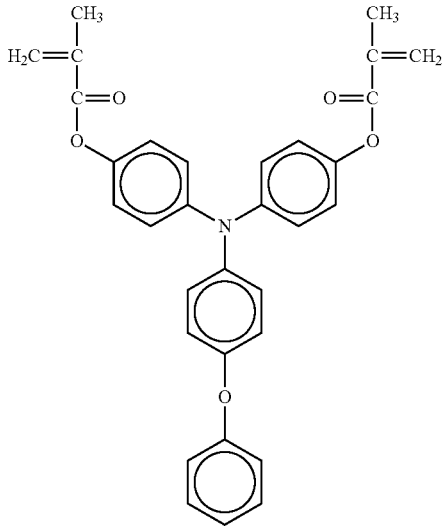
No. 210
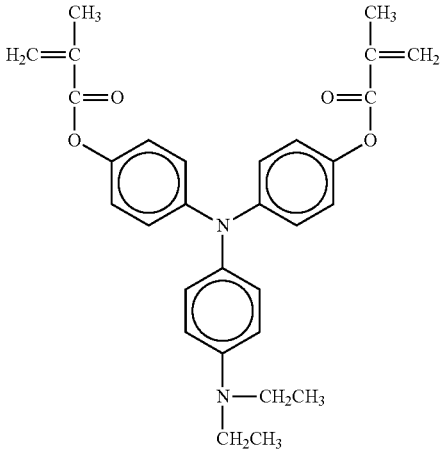

-continued
No. 211
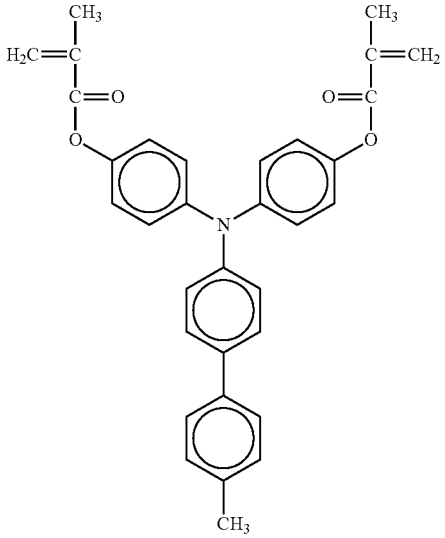
No. 212
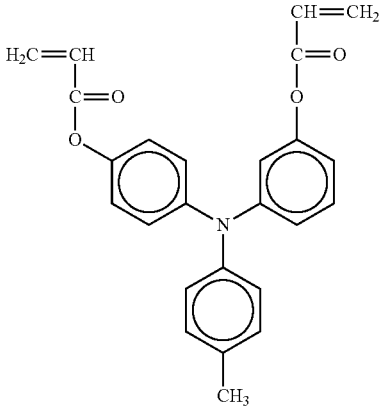
No. 213
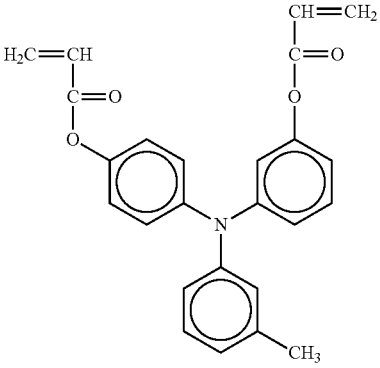
No. 214
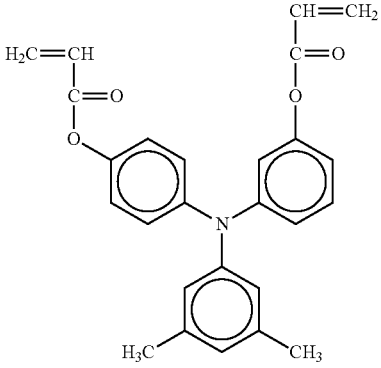
No. 215
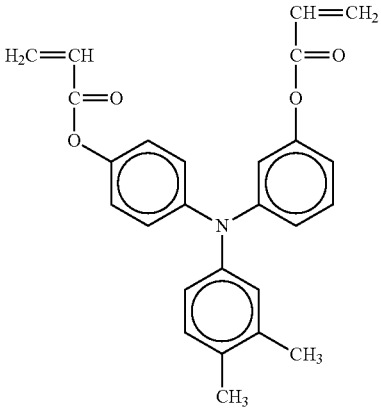
No. 216
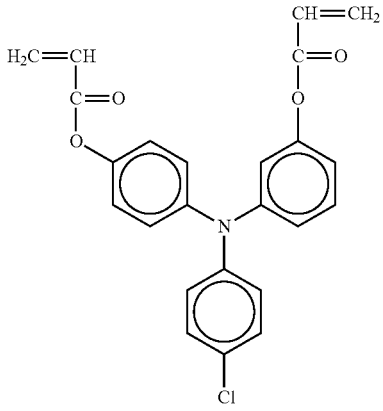

-continued
No. 217
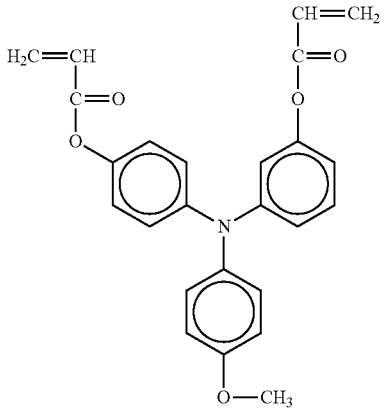
No. 223
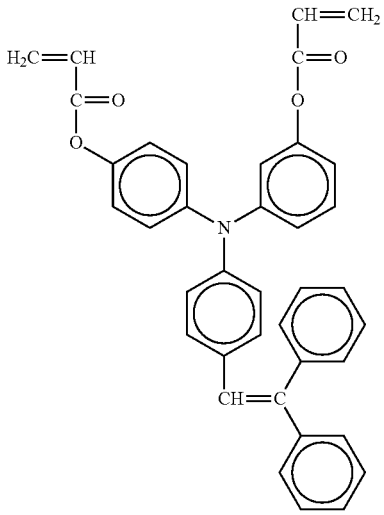
No. 224
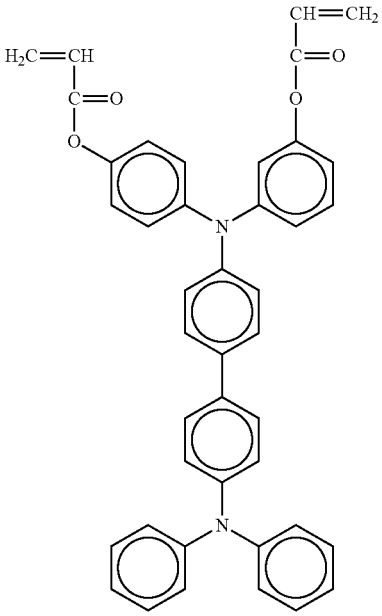
No. 225
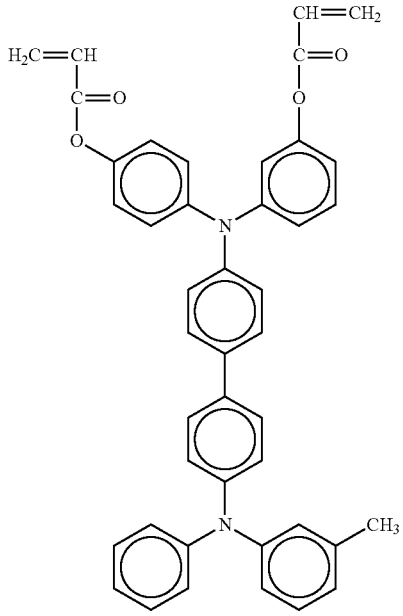

-continued
No. 226
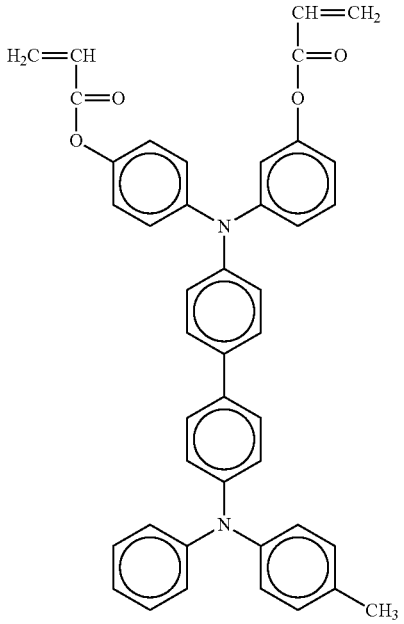
No. 227
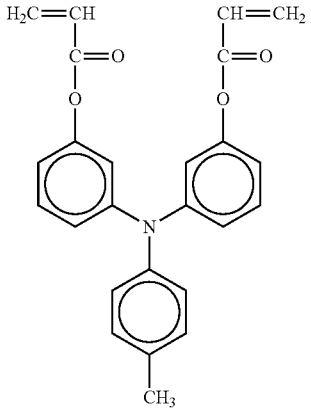
No. 228
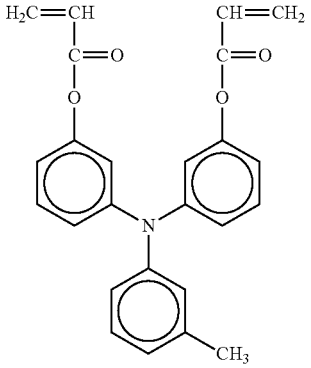
No. 229
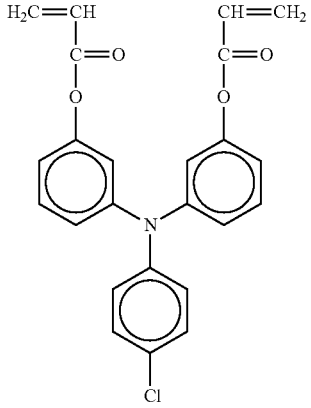
No. 230
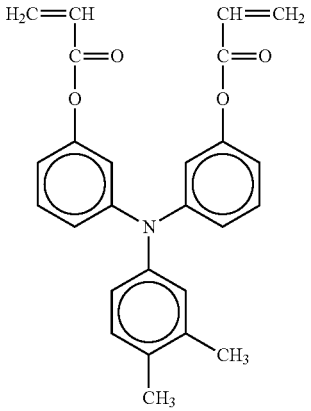
No. 231
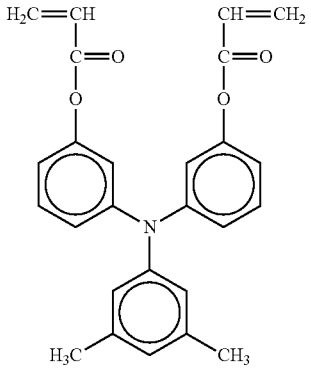

-continued
No. 232
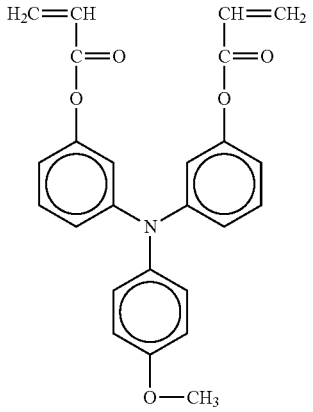
No. 233
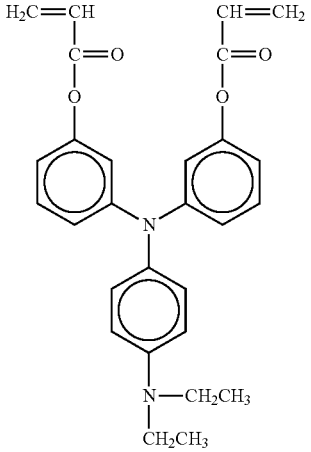
No. 234
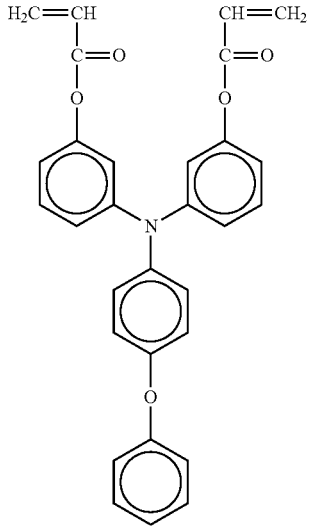
No. 235
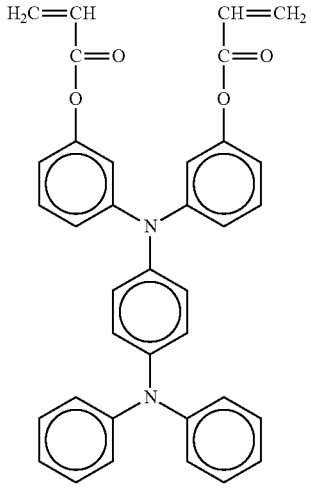
No. 236
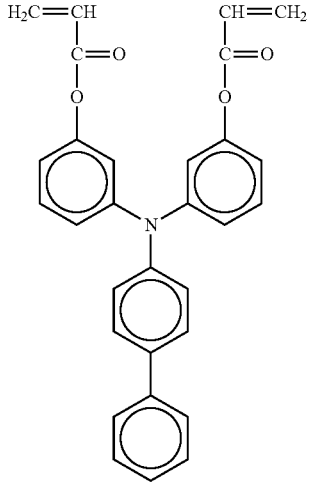
No. 237
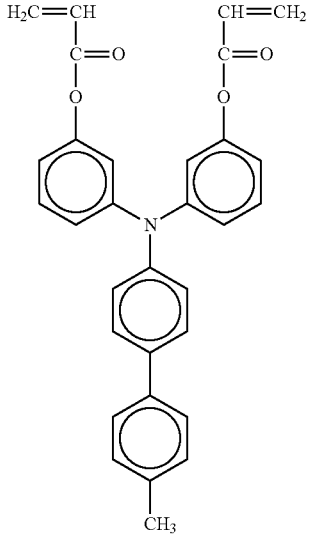

-continued
No. 238
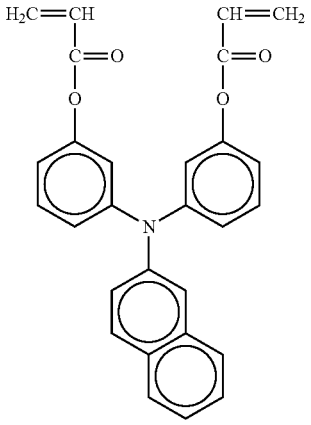
No. 239
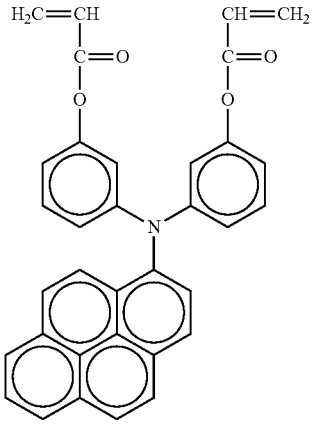
No. 240
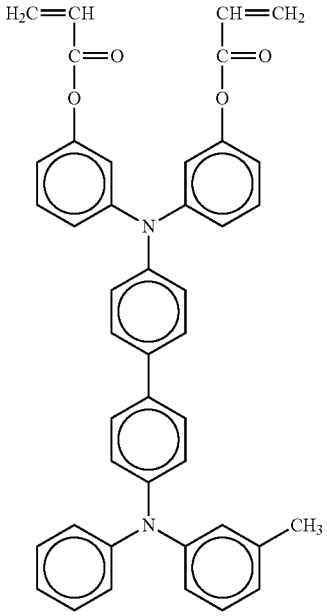
No. 241
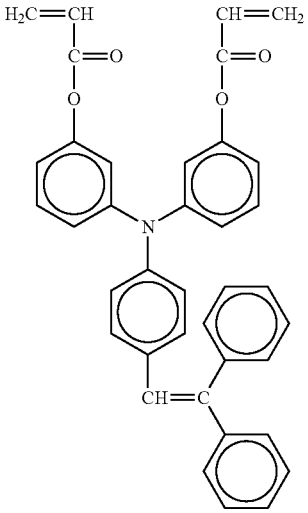
No. 242
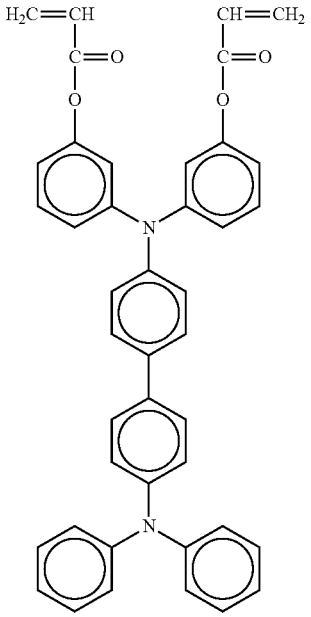
No. 243
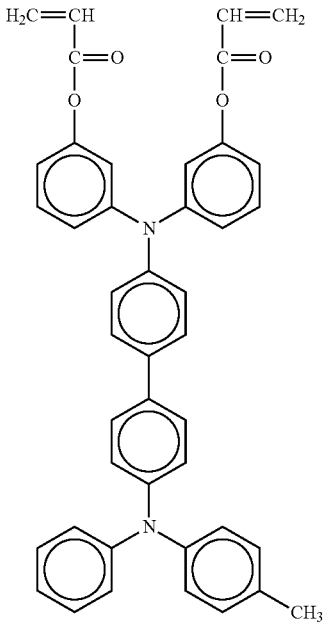

-continued
No. 244
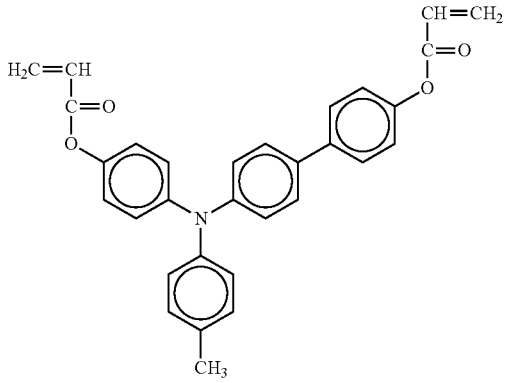
No. 245
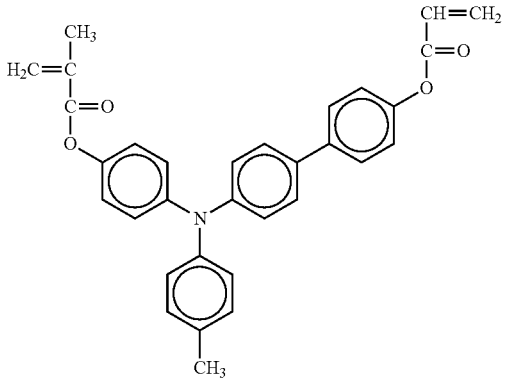
No. 246
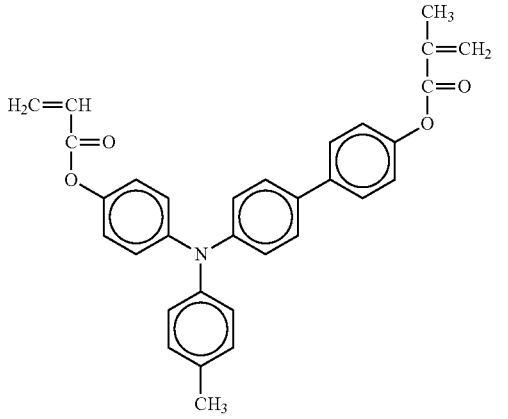
No. 247
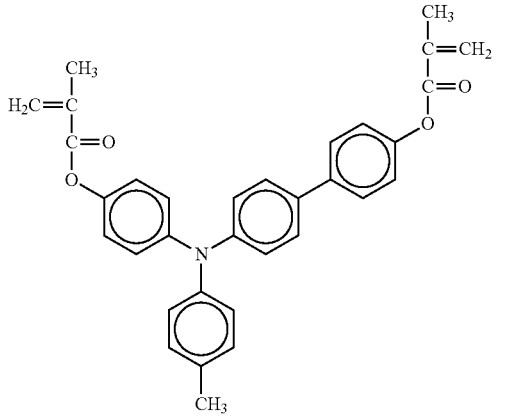
No. 248
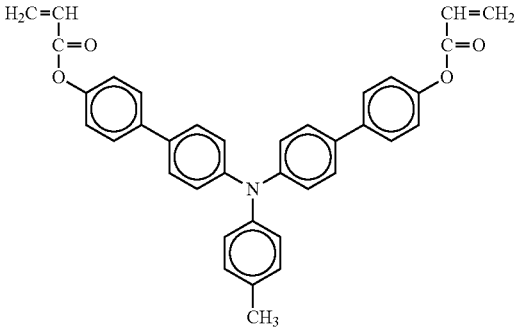
No. 249
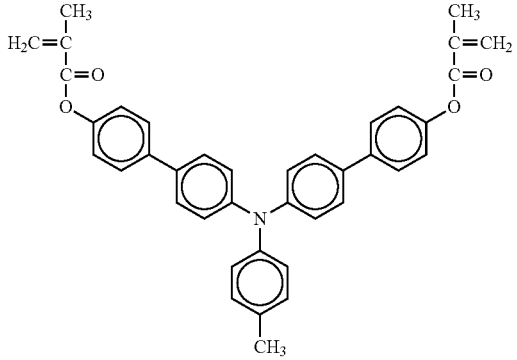
No. 250
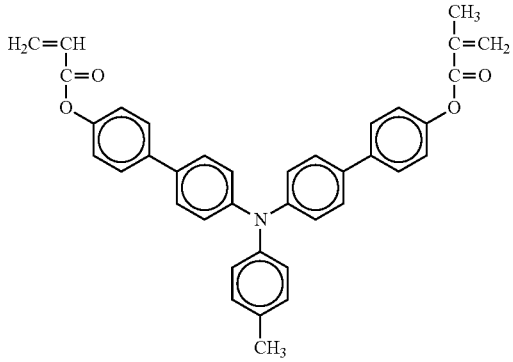
No. 251
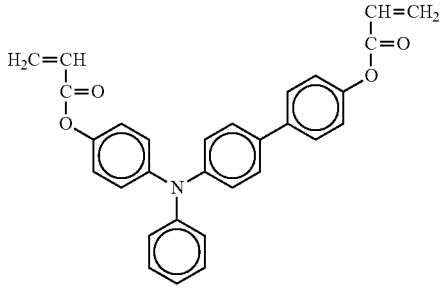

-continued
No. 252
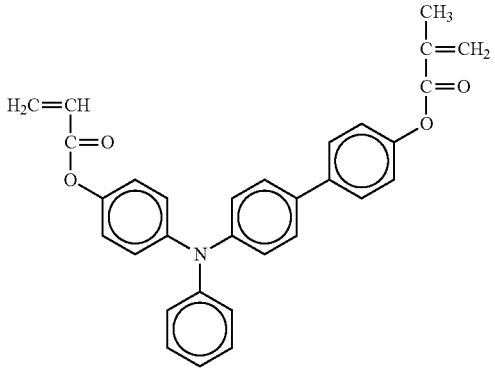
No. 253
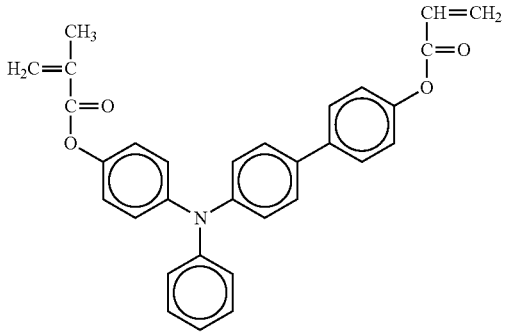
No. 254
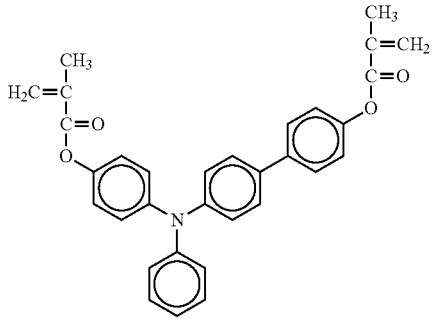
No. 255
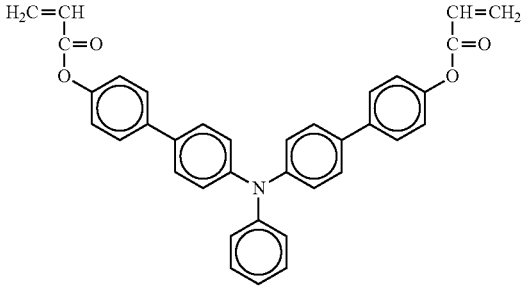
No. 256
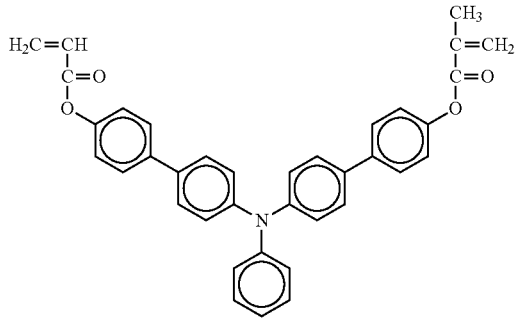
No. 257
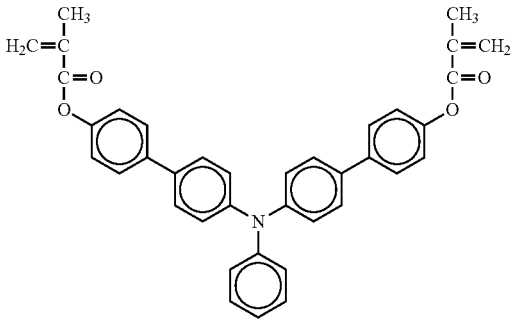
No. 258
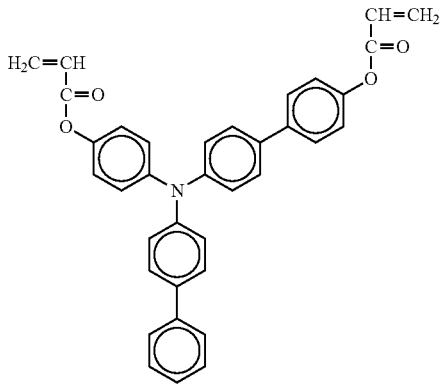
No. 259
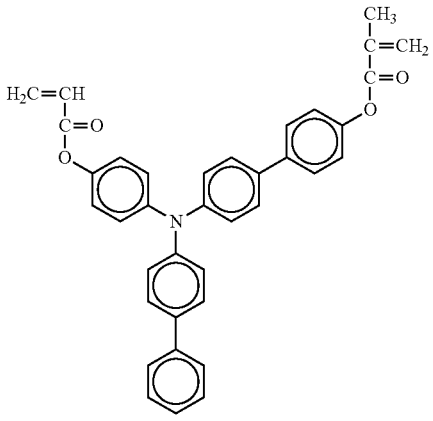

-continued
No. 260
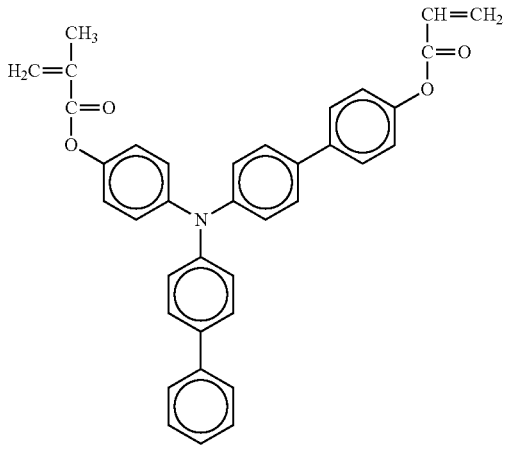
No. 261
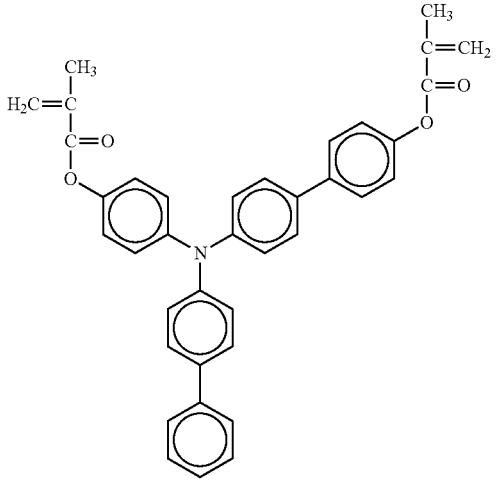
No. 262
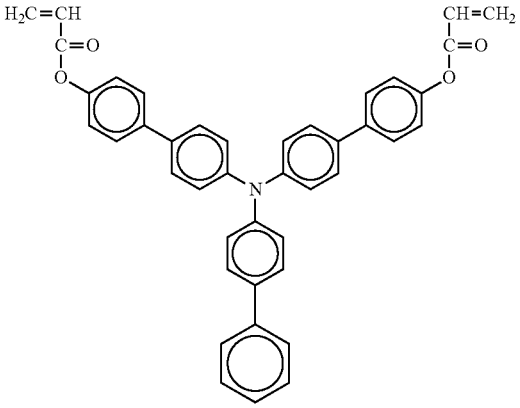
No. 263
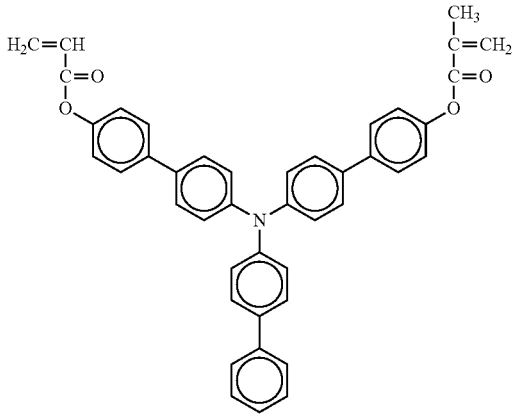
No. 265
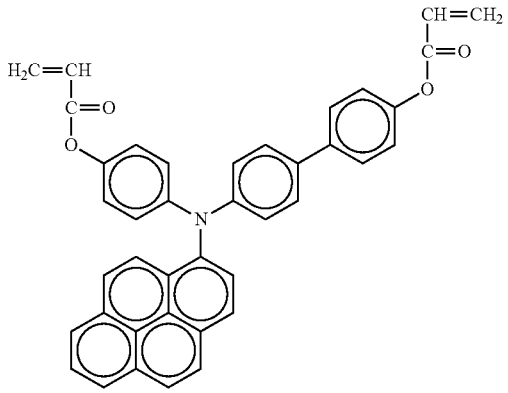
No. 266
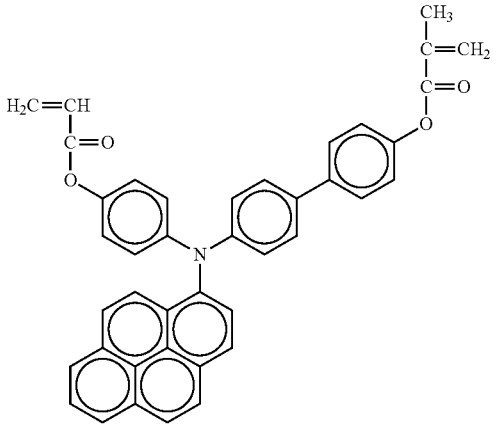

-continued
No. 267
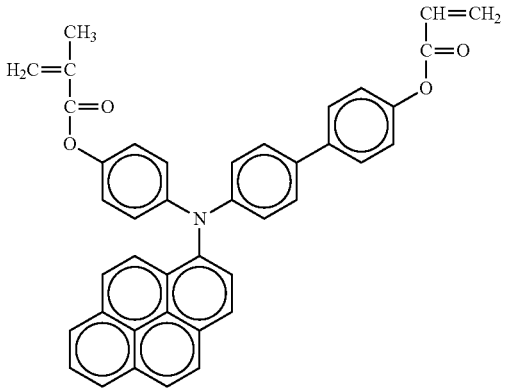
No. 268
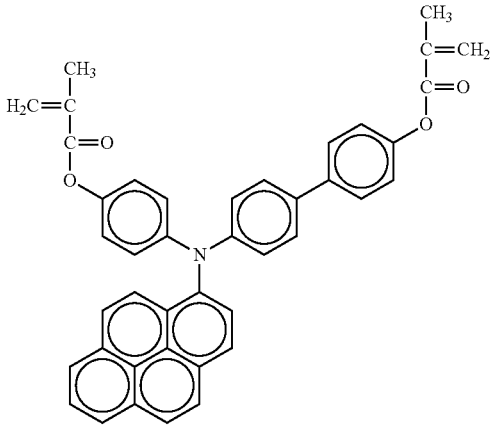
No. 269
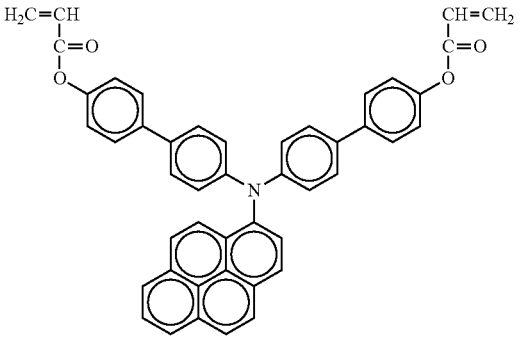
No. 270
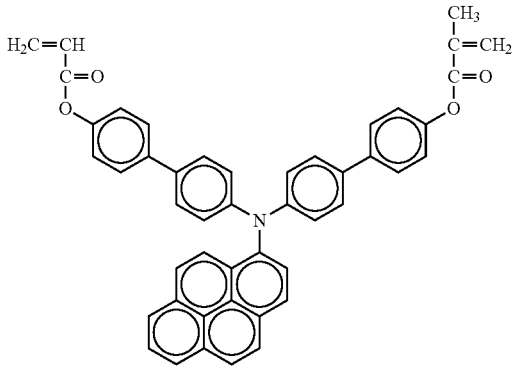
No. 271
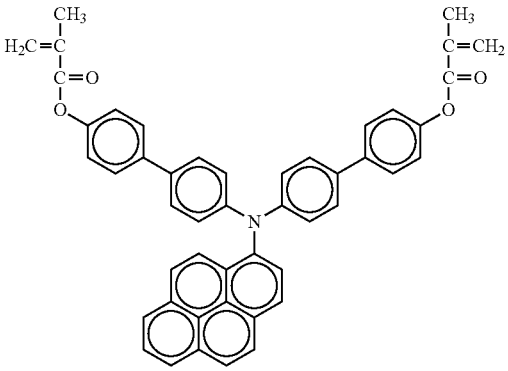
No. 272
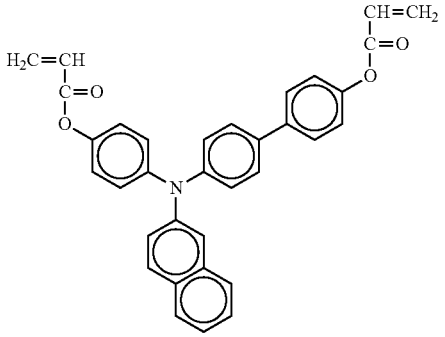

-continued
No. 273
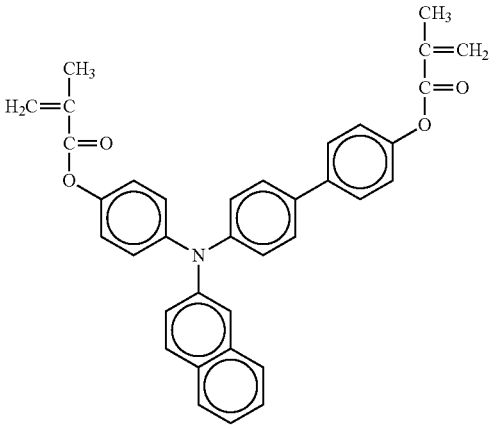
No. 274
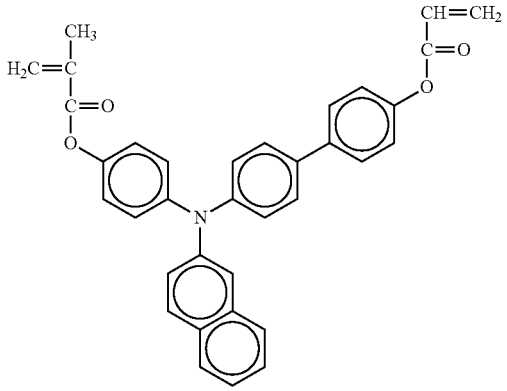
No. 275
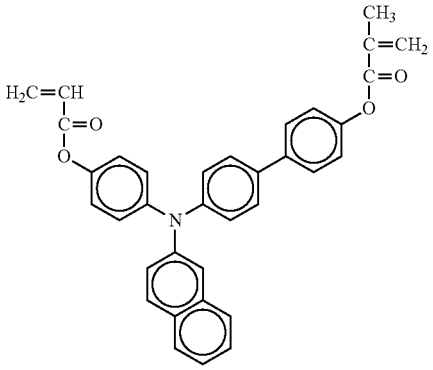
No. 276
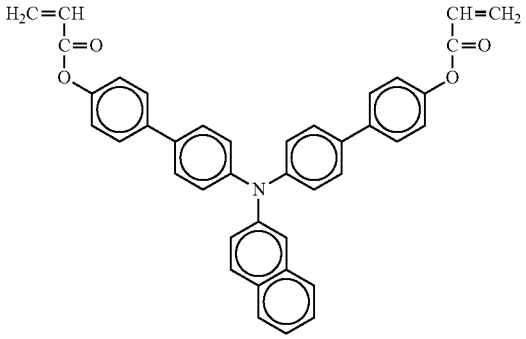
No. 277
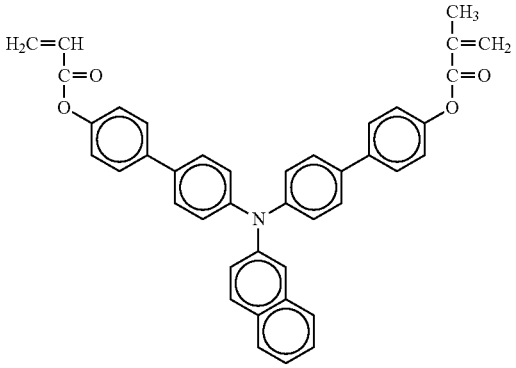
No. 278
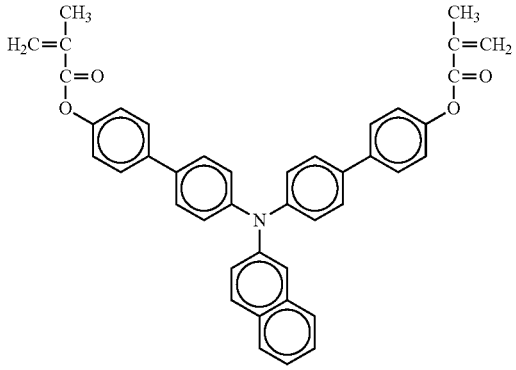

-continued
No. 279
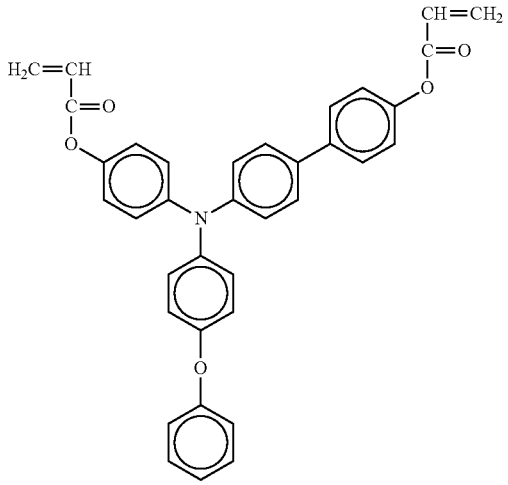
No. 280
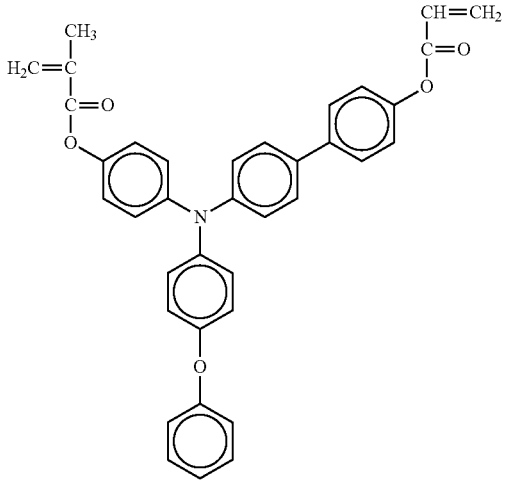
No. 281
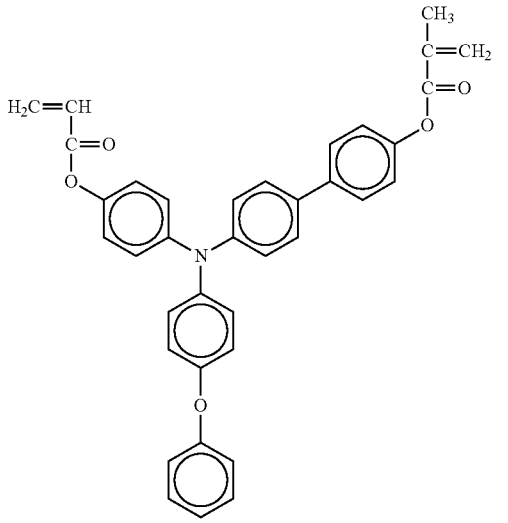
No. 282
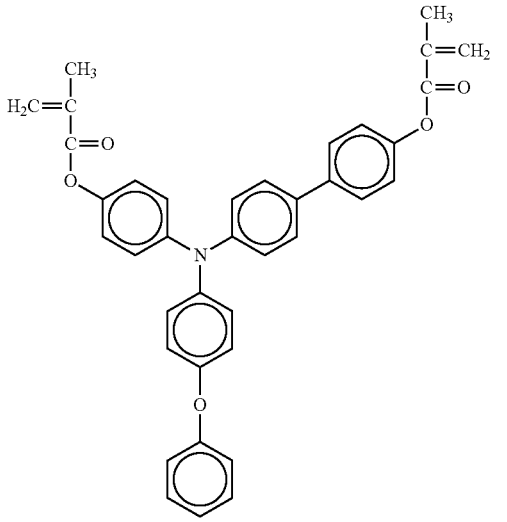
No. 283
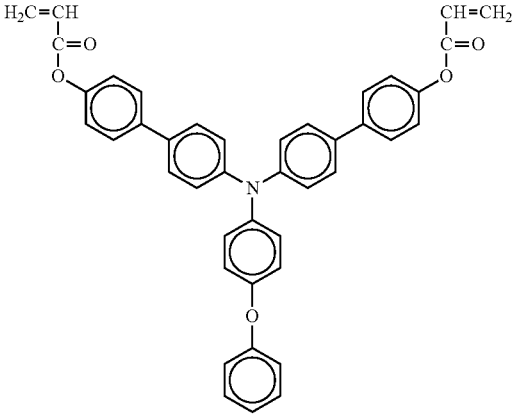
No. 284
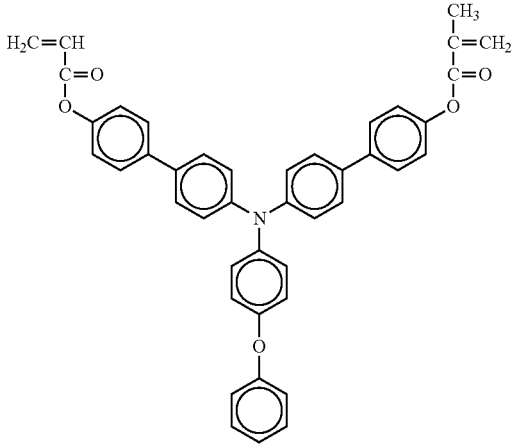

-continued
No. 285
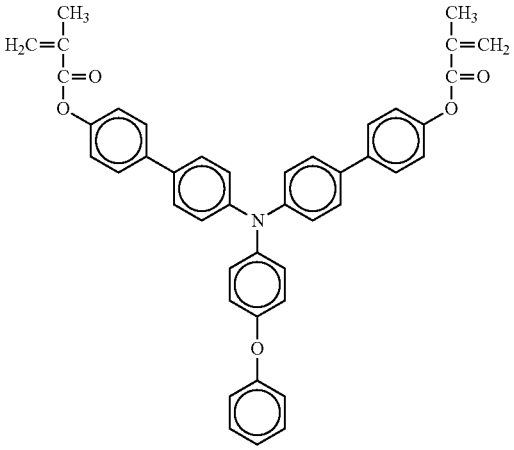
No. 286
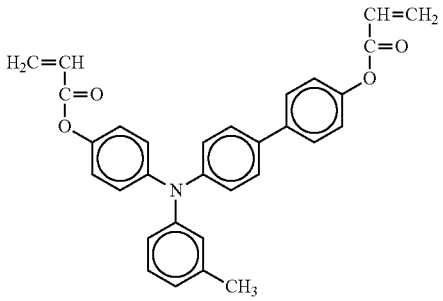
No. 287
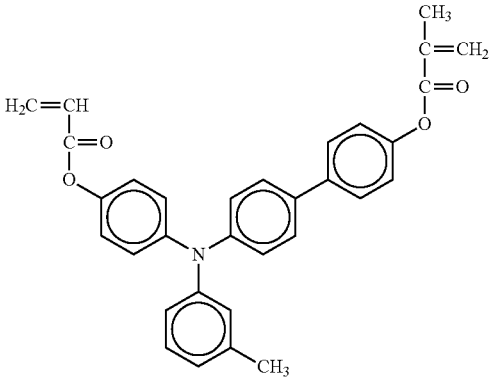
No. 288
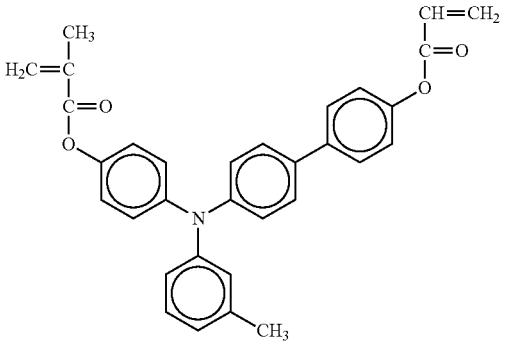
No. 289
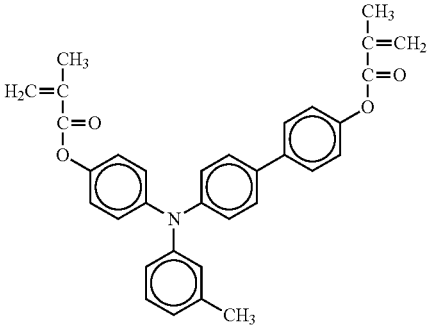
No. 290
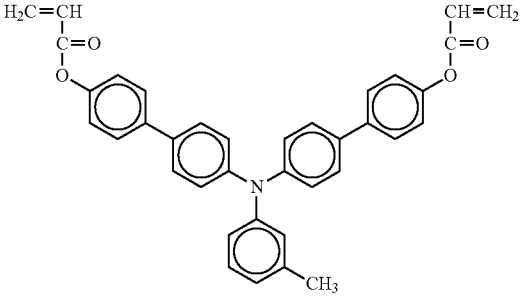

-continued
No. 291
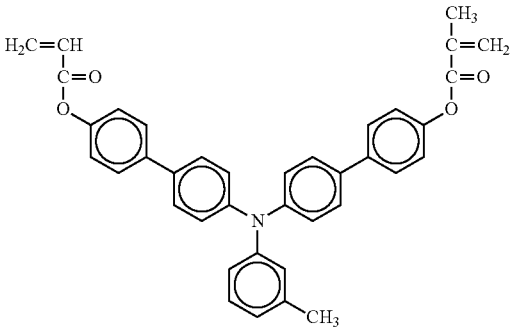
No. 292
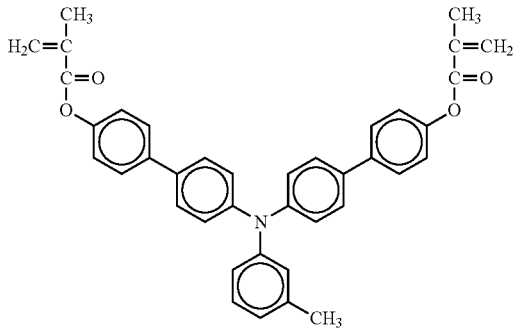
No. 293
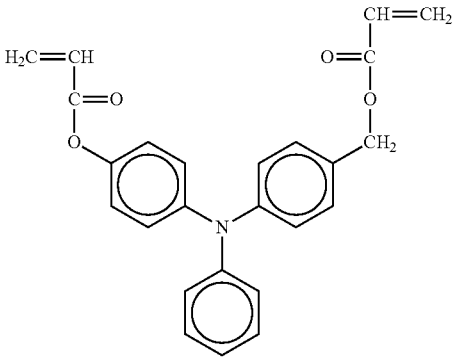
No. 294
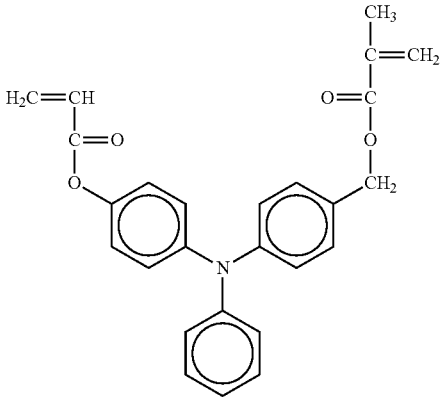
No. 295
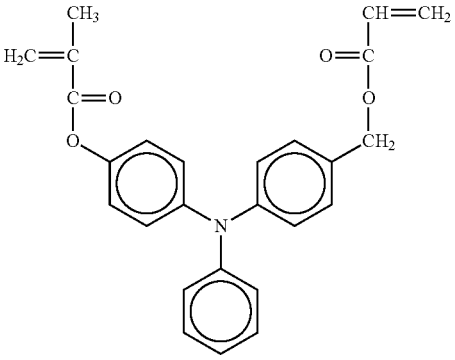
No. 296
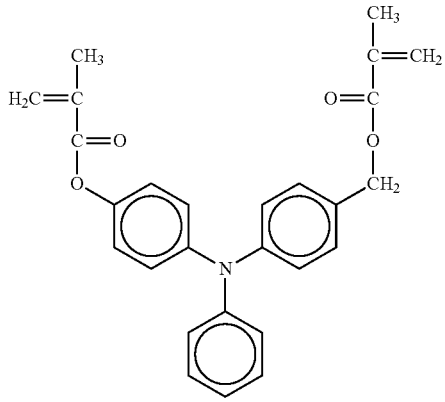
No. 297
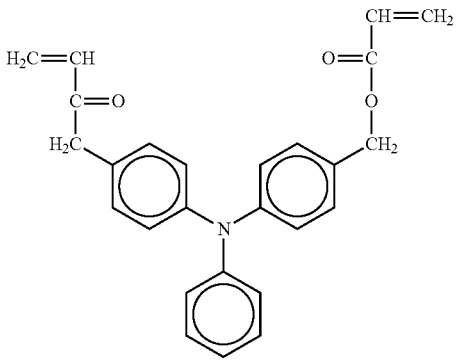
No. 298
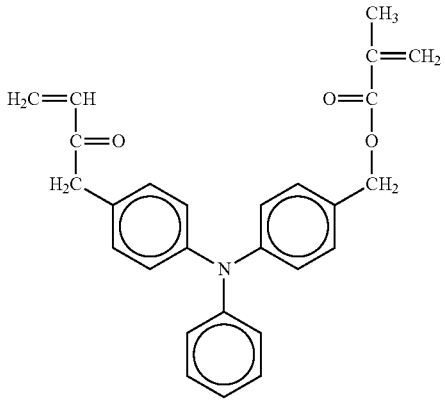

-continued
No. 299
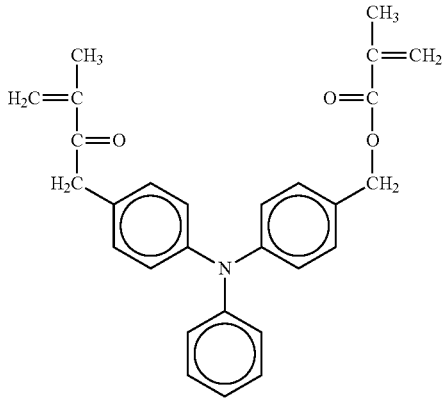
No. 300
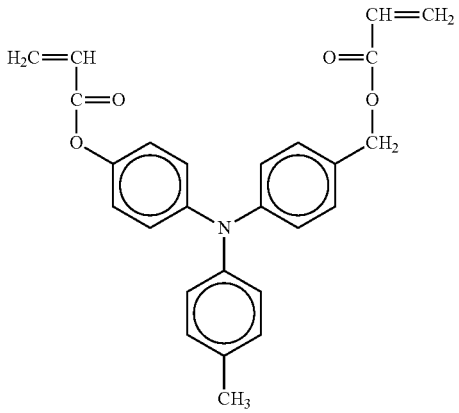
No. 301
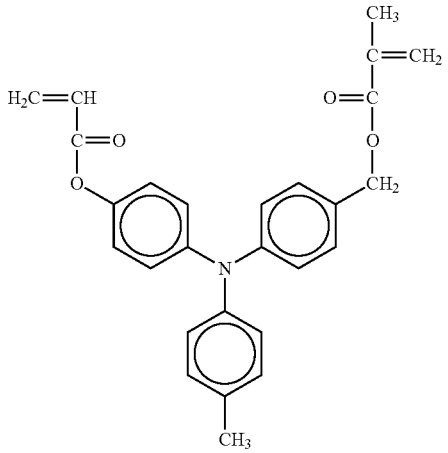
No. 302
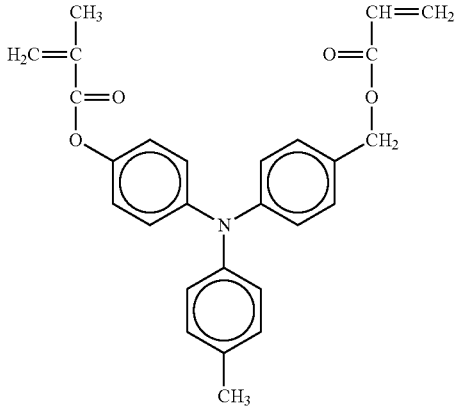
No. 303
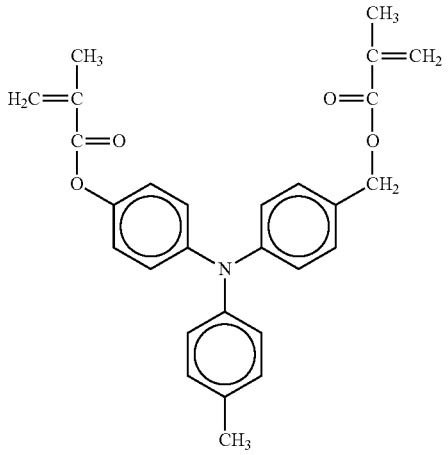
No. 304
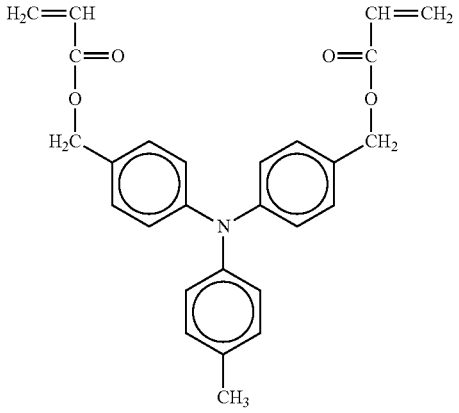

-continued
No. 305
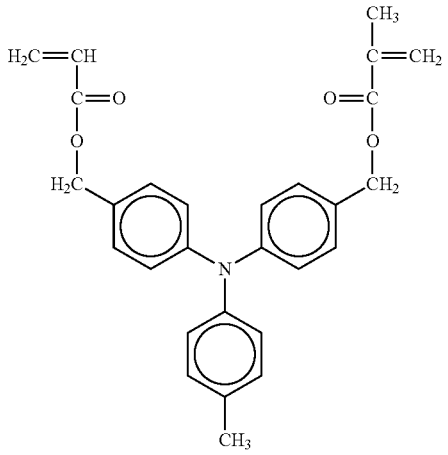
No. 306
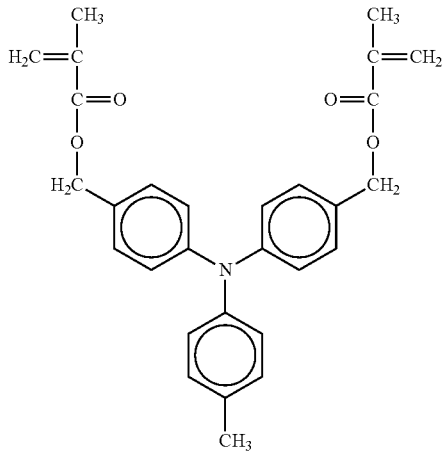
No. 307
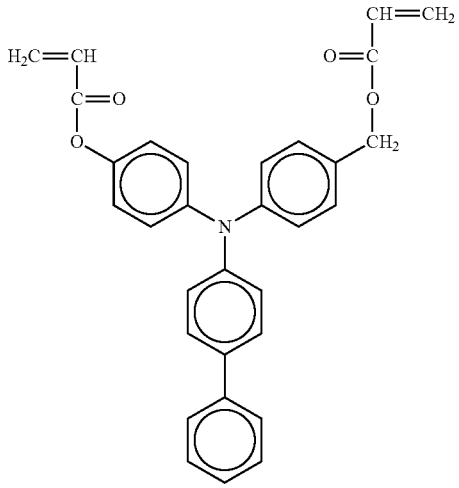
No. 308
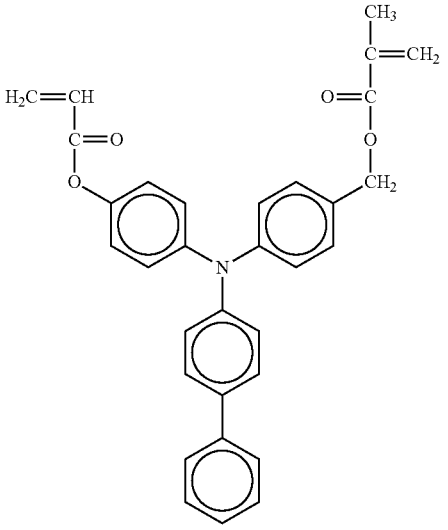
No. 309
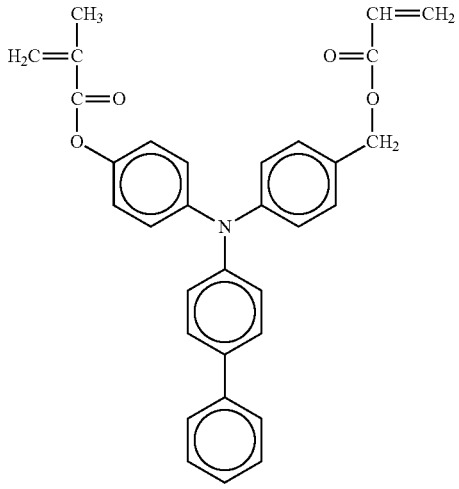
No. 310
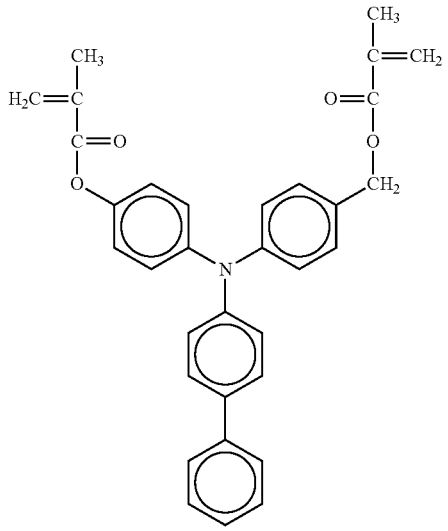

-continued
No. 311
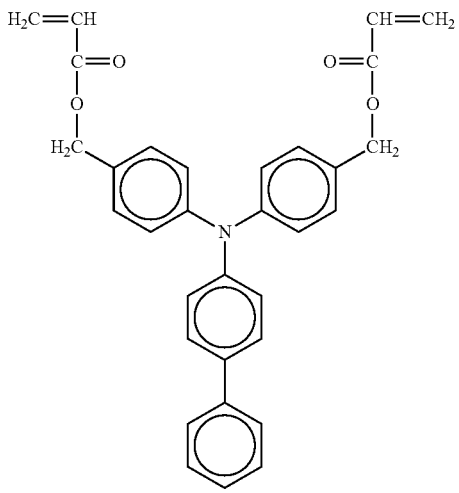
No. 312
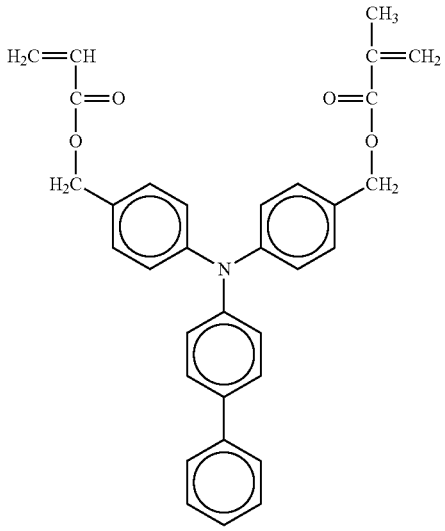
No. 313
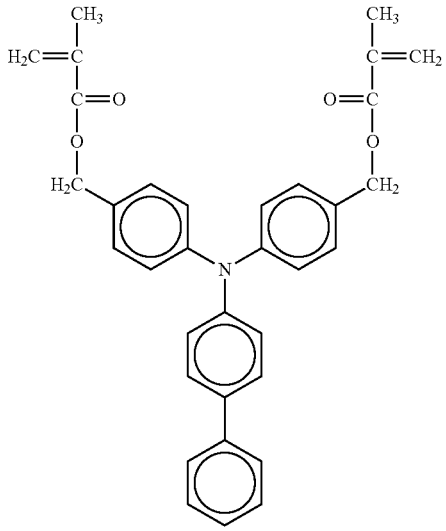
No. 314
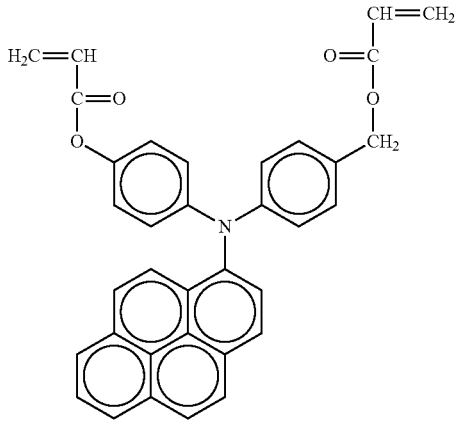
No. 315
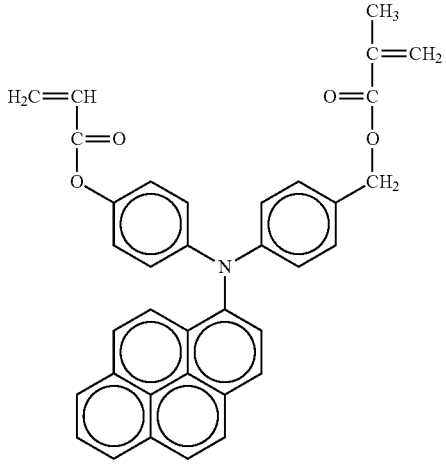
No. 316
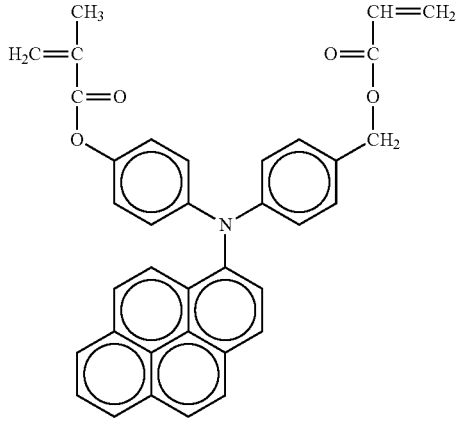

-continued
No. 317
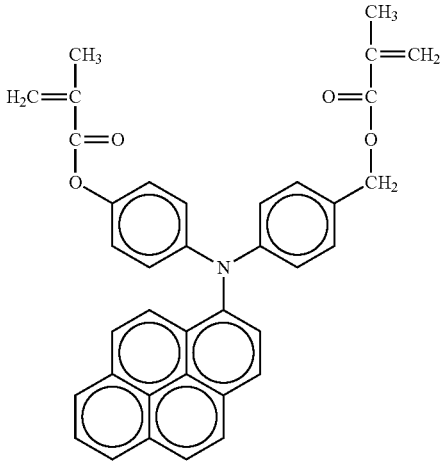
No. 318
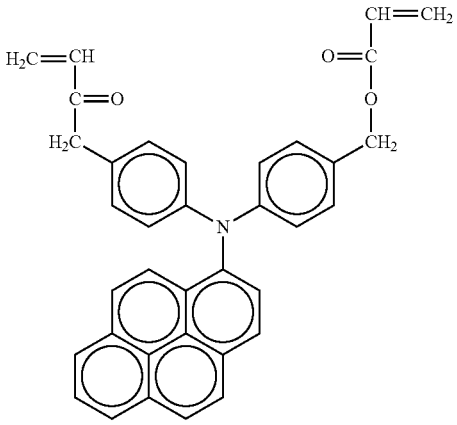
No. 319
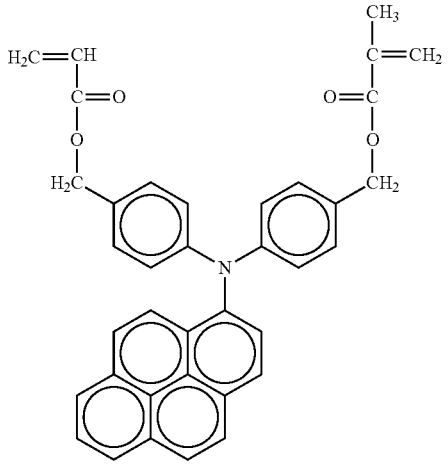
No. 320
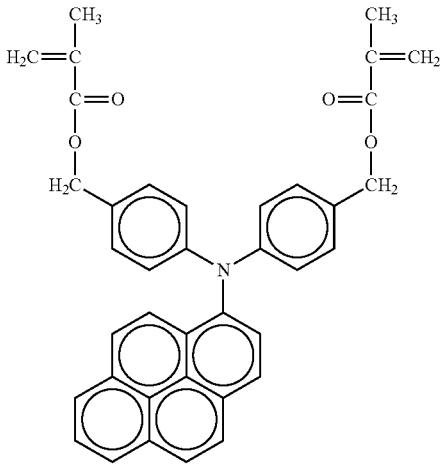
No. 321
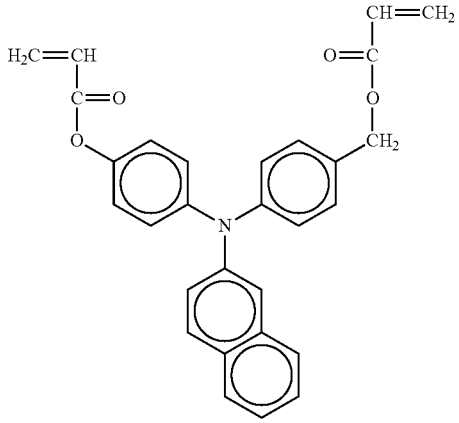
No. 322
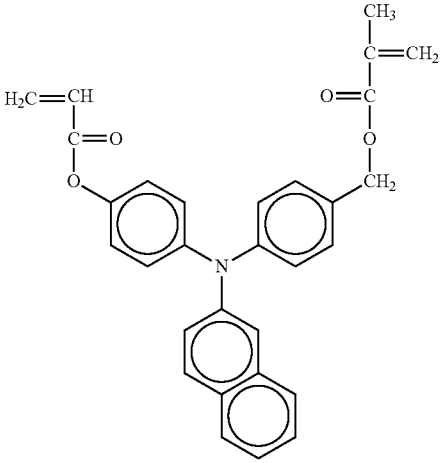

-continued
No. 323
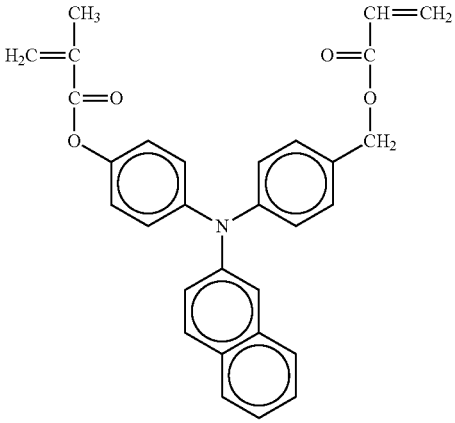
No. 324
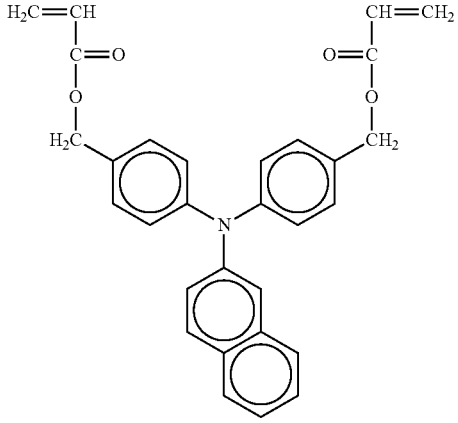
No. 325
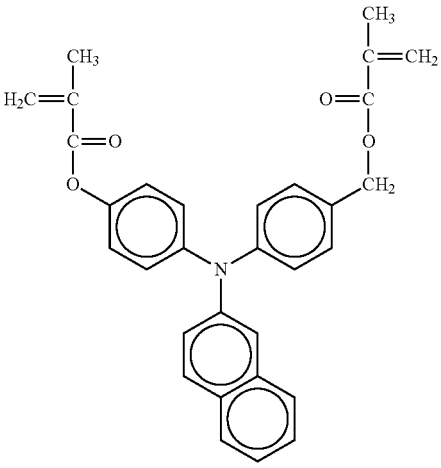
No. 326
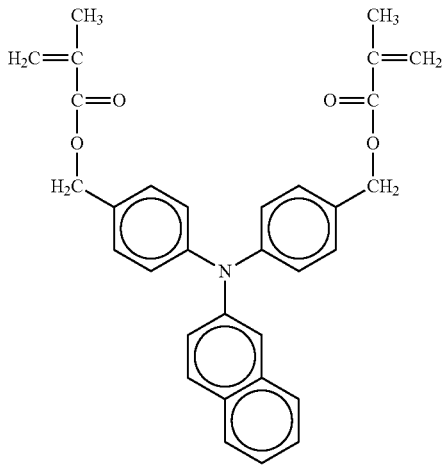
No. 327
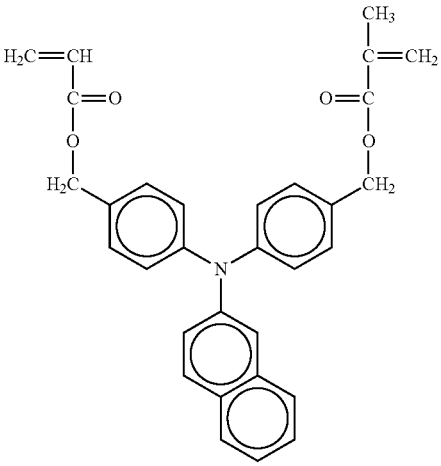
No. 328
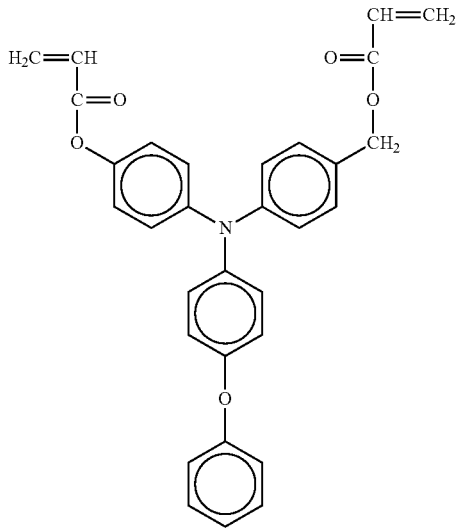

-continued
No. 329
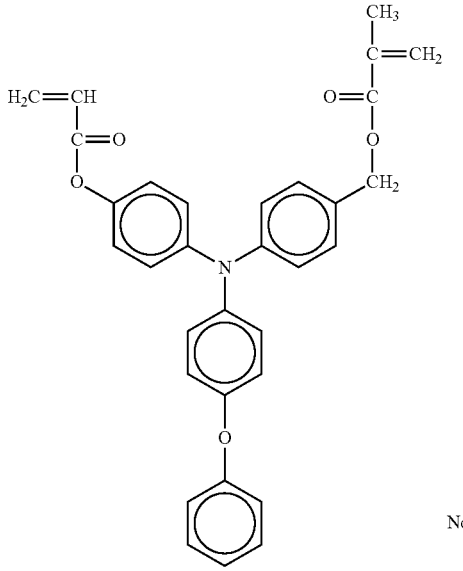
No. 330
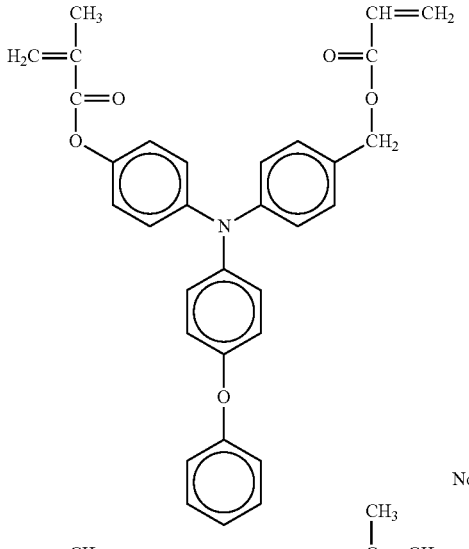
No. 331
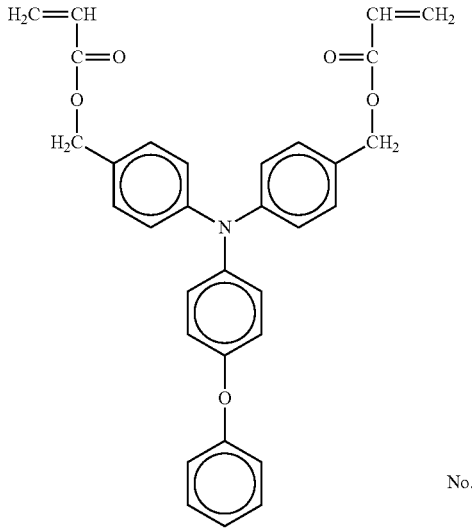
No. 332
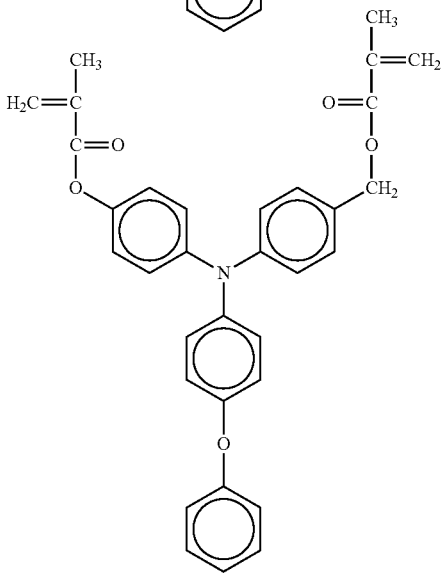
No. 333
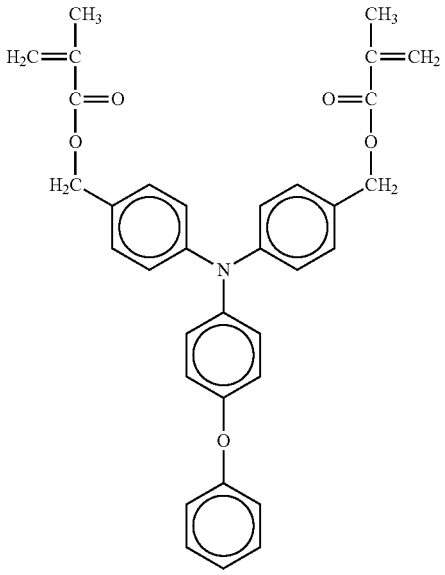
No. 334
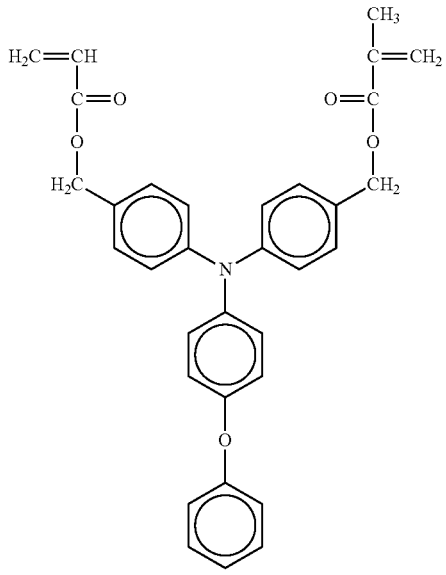

-continued
No. 335
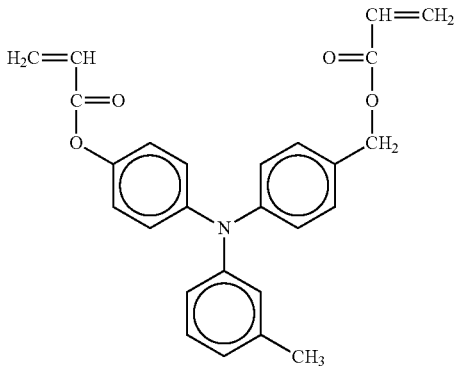
No. 336
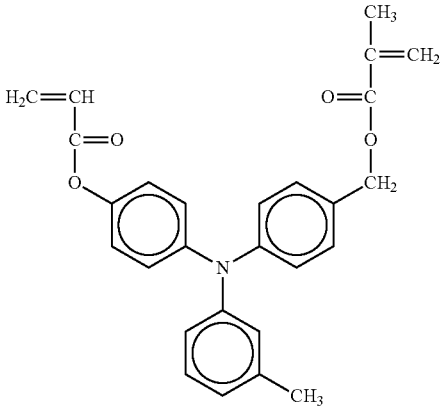
No. 337
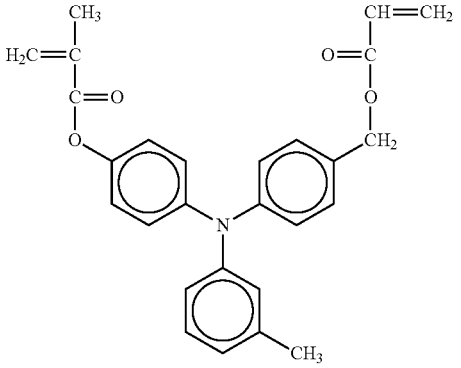
No. 338
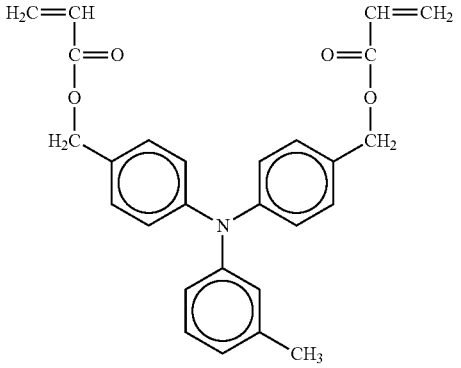
No. 339
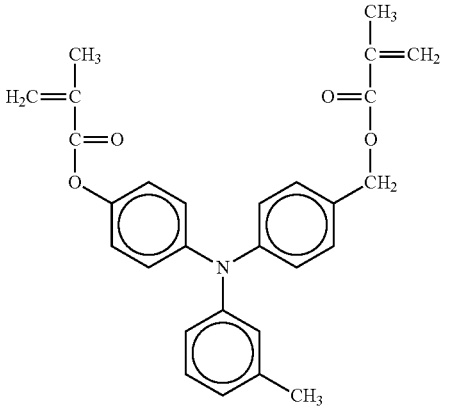
No. 340
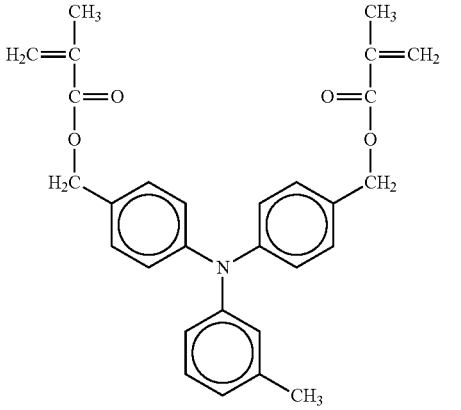

-continued
No. 341
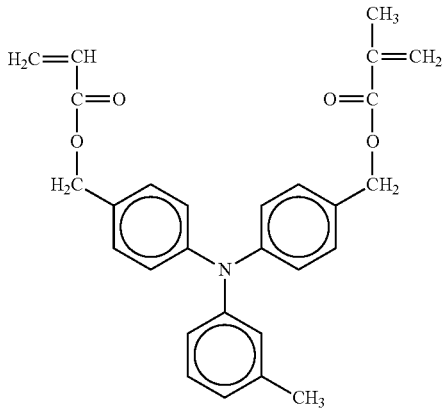
No. 342
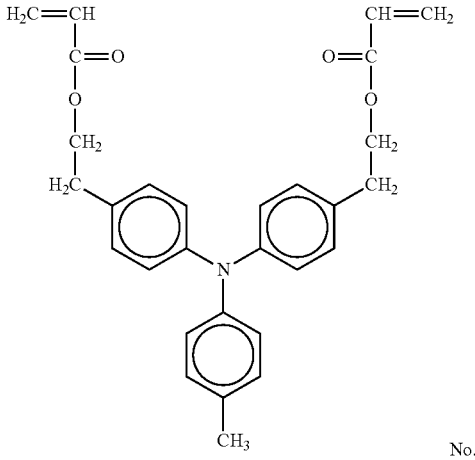
No. 343
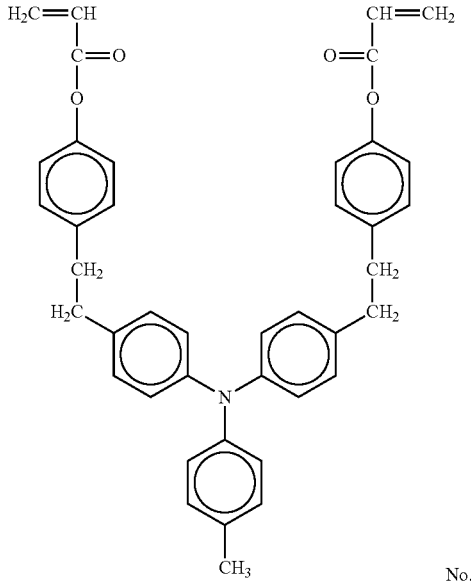
No. 344
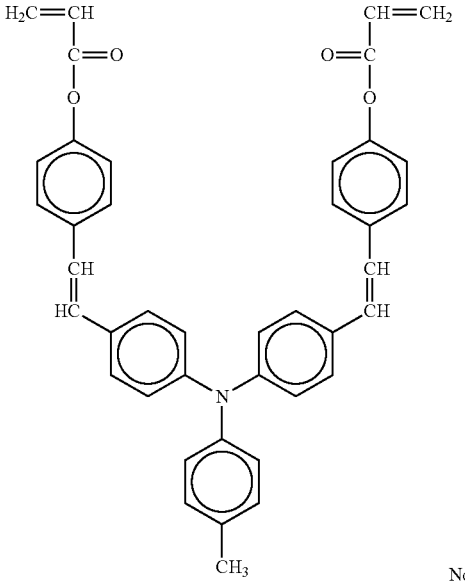
No. 345
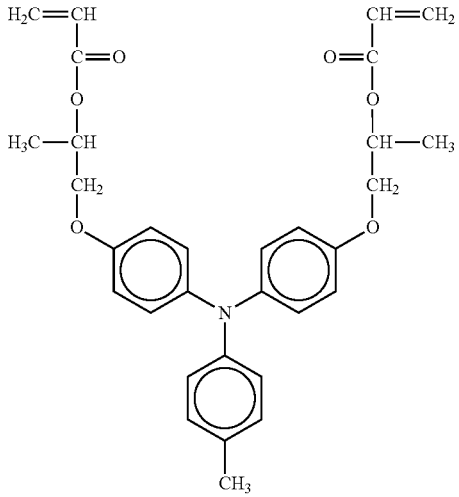
No. 346
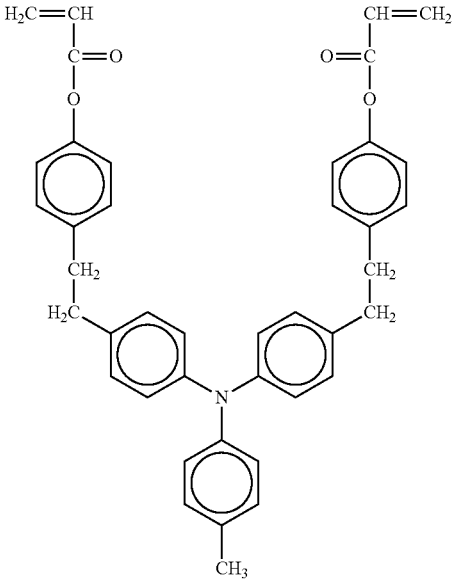

-continued
No. 347
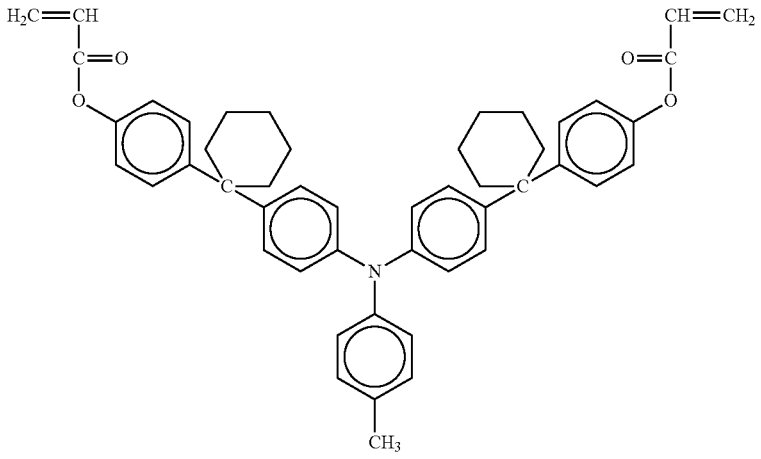
No. 348
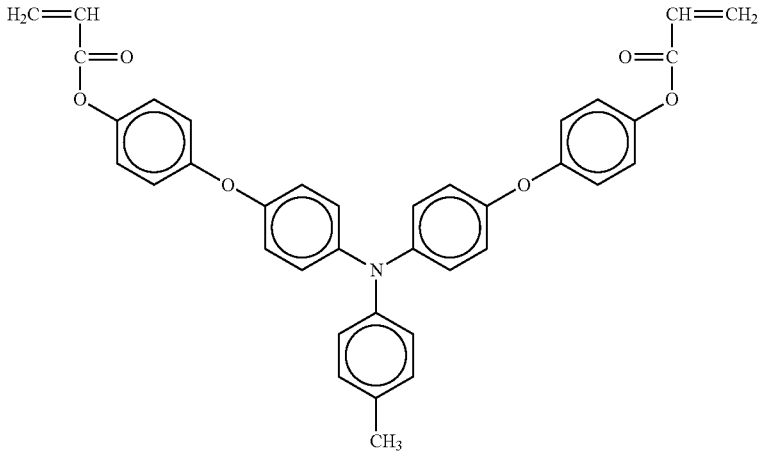
No. 349
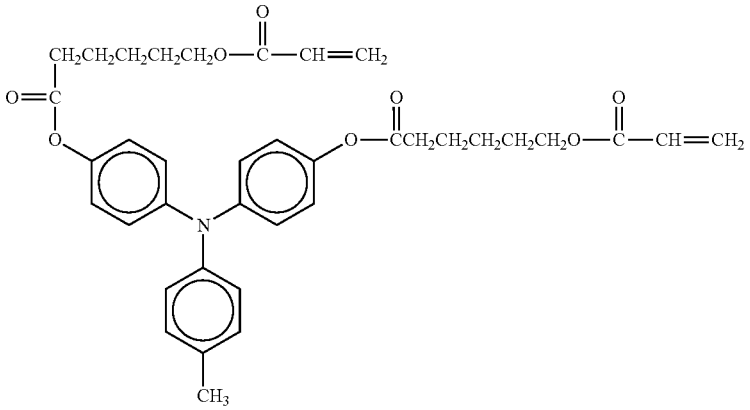

-continued
No. 350
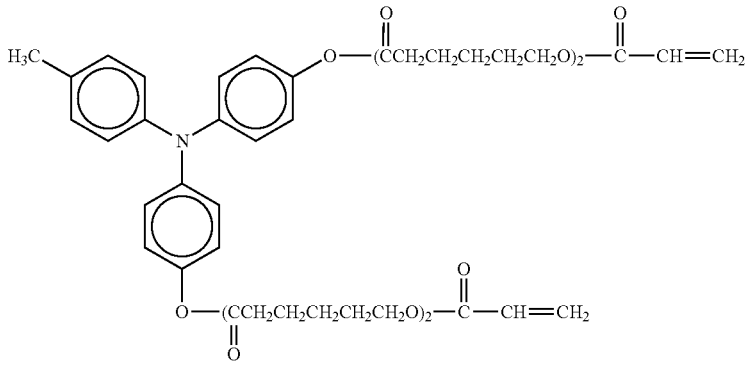
No. 351
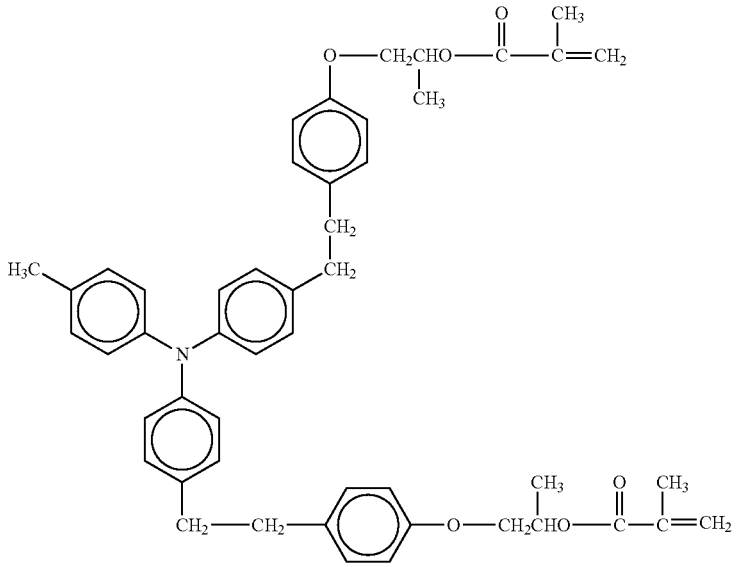
No. 352
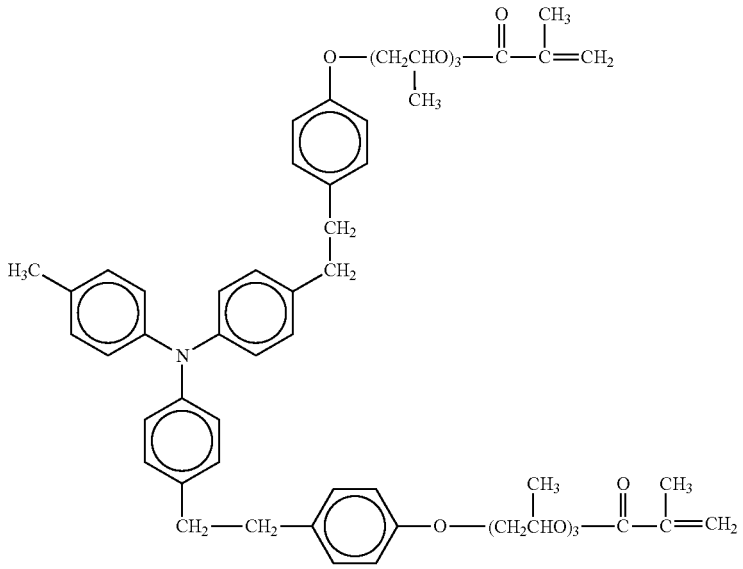

-continued
No. 353
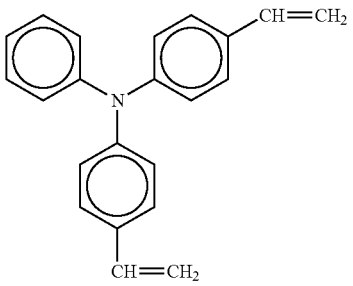
No. 354
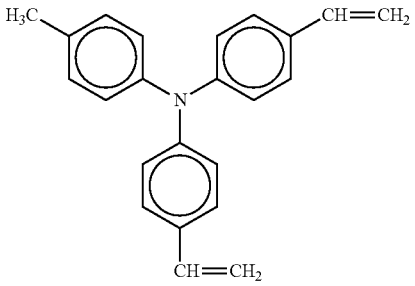
No. 355
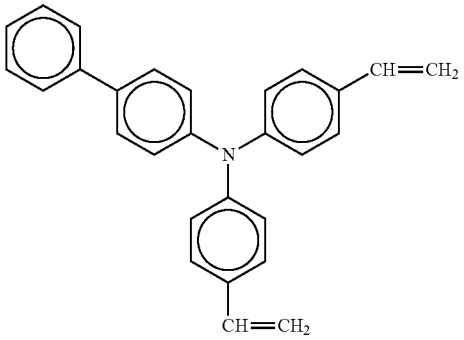
No. 356
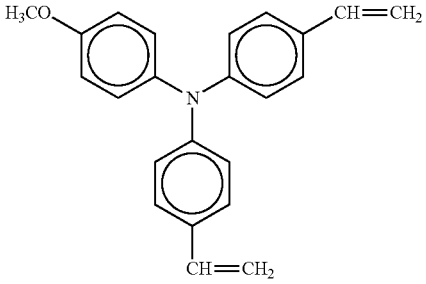
No. 357
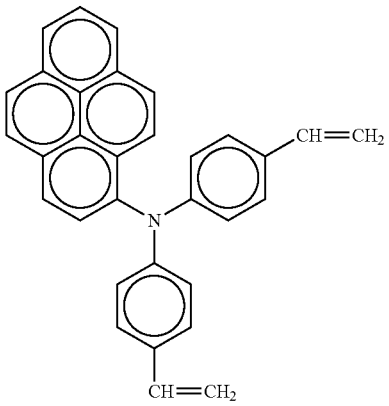
No. 358
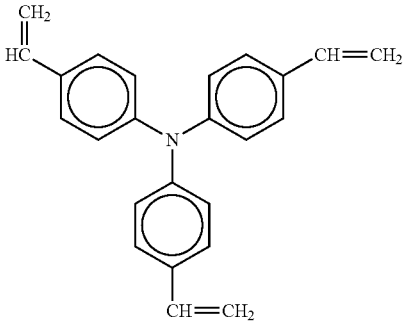

-continued
No. 359
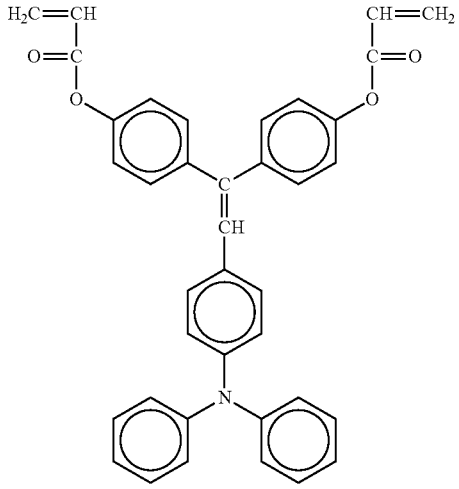
No. 360
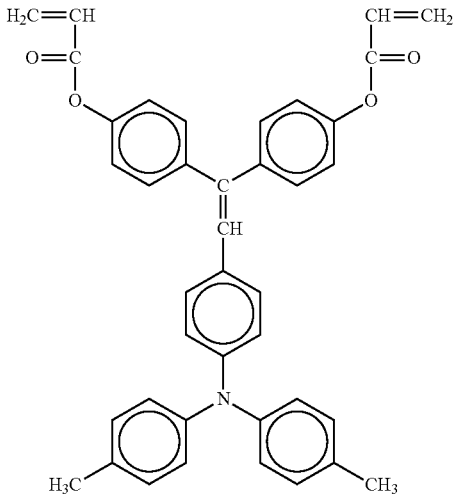
No. 361
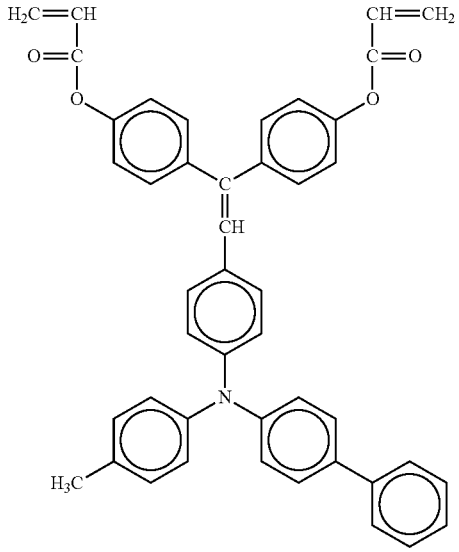
No. 362
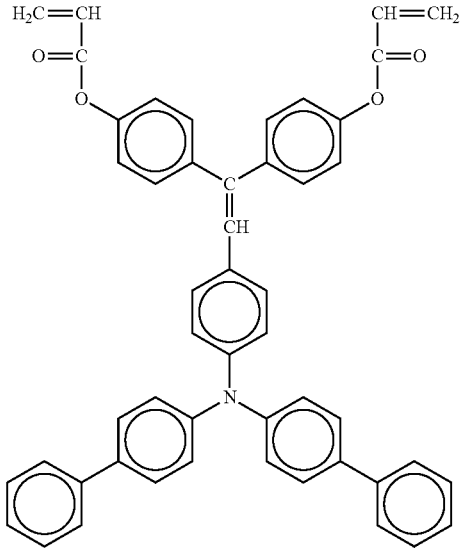

-continued
No. 363
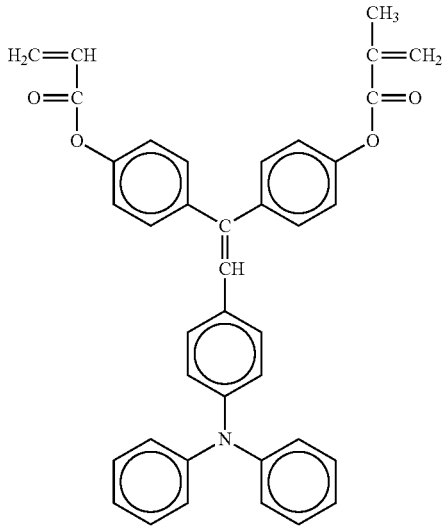
Radical Polymerizable Monomers Having Charge Transport Structure with Three Functional Groups
No. 364
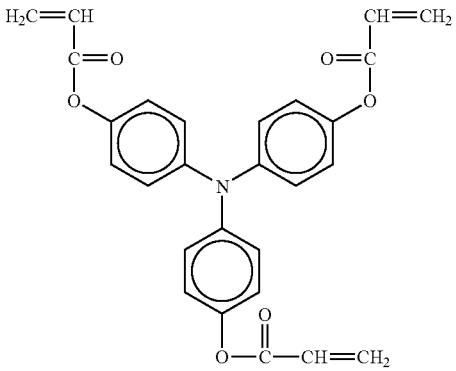
No. 365
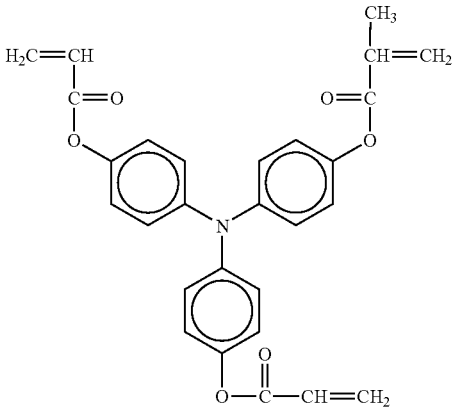
-continued
No. 366
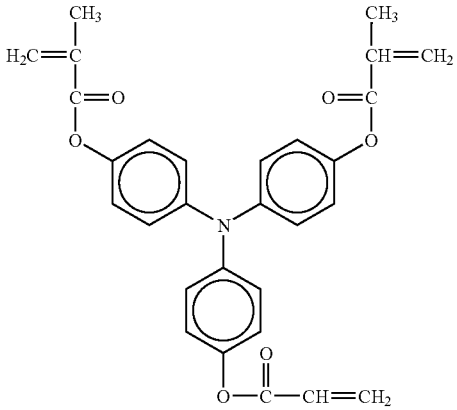
No. 367
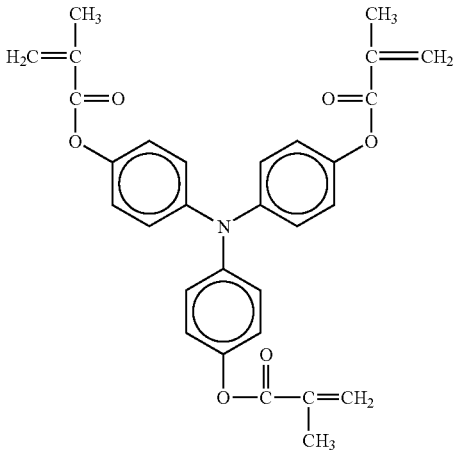

-continued
No. 368
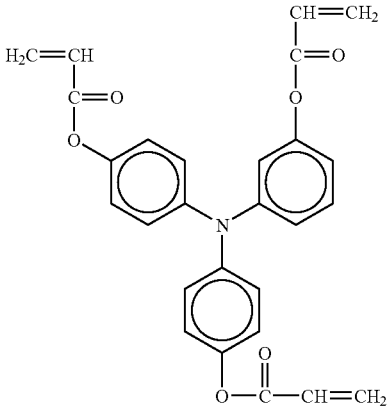
No. 369
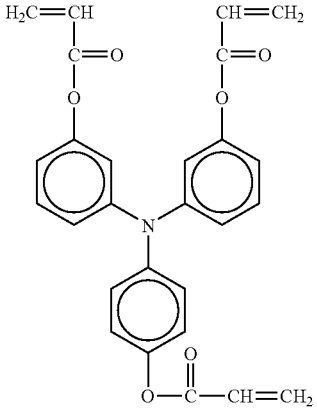
No. 370
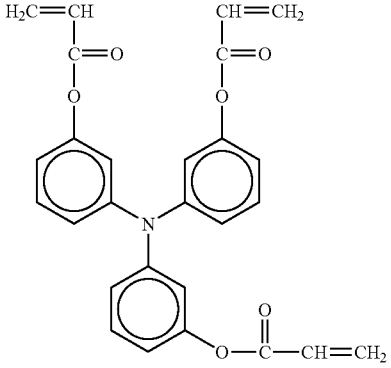
No. 371
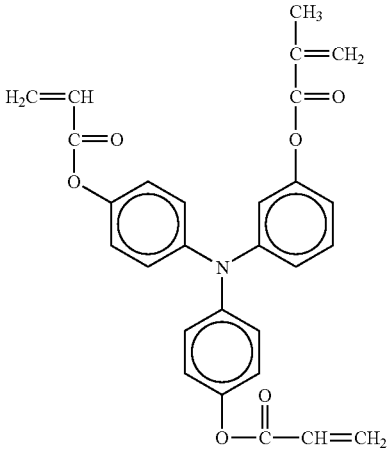
-continued
No. 372
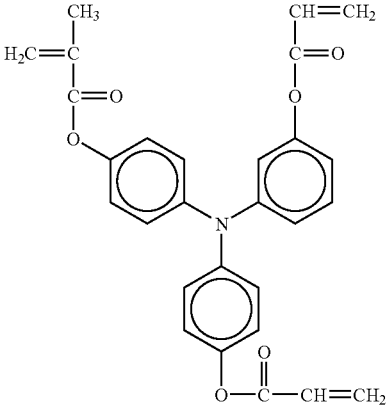
No. 373
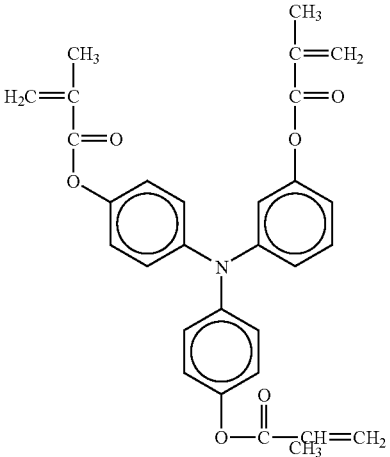
No. 374
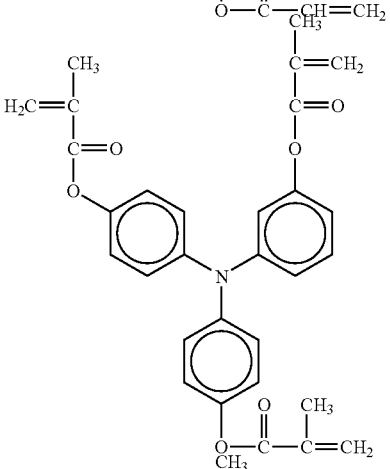
No. 375
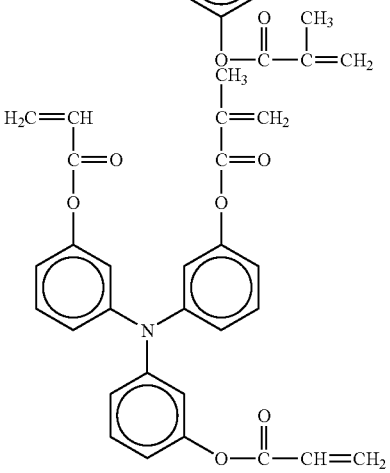

-continued
No. 376
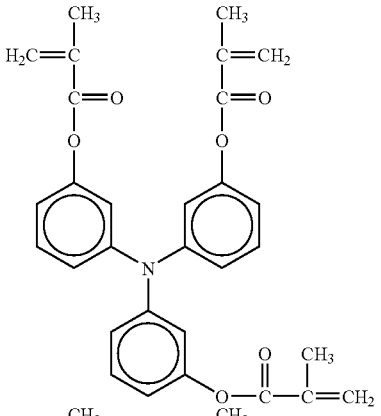
No. 377
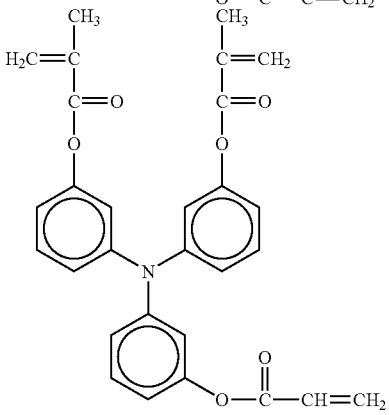
No. 378
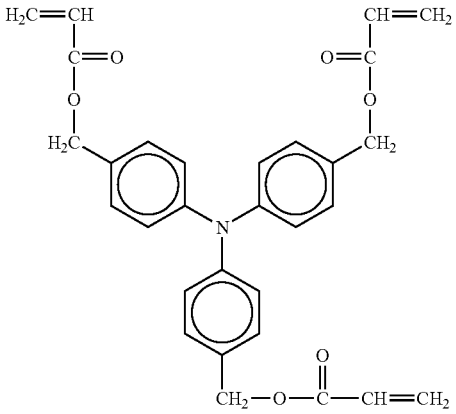
No. 379
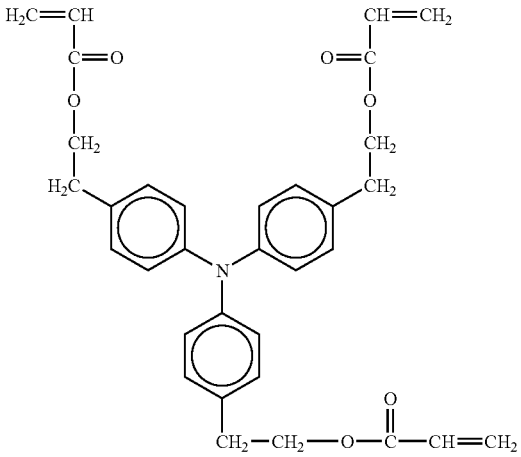
-continued
No. 380
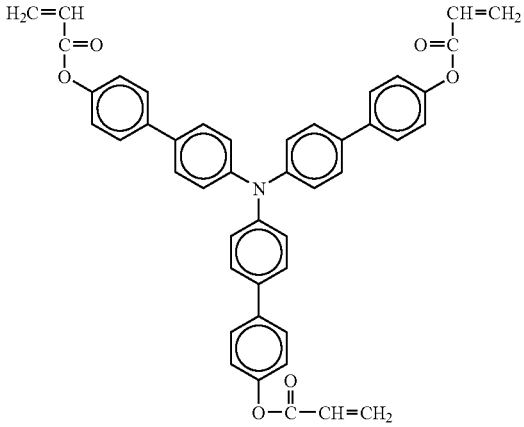
No. 381
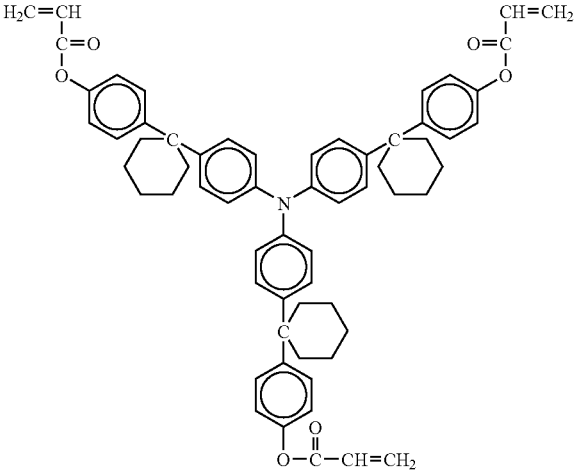
No. 382
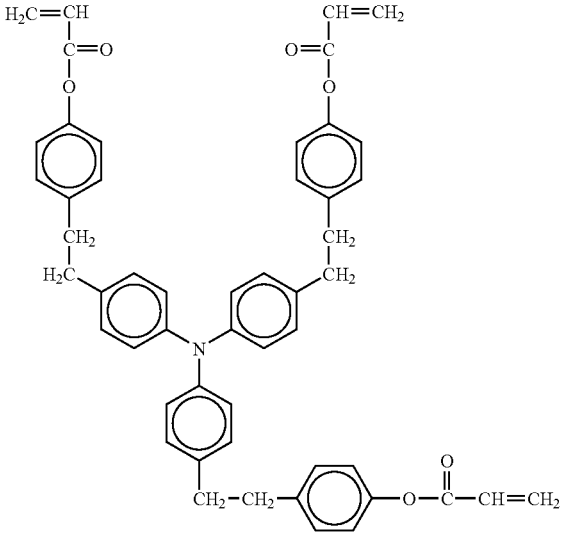

-continued

No. 383

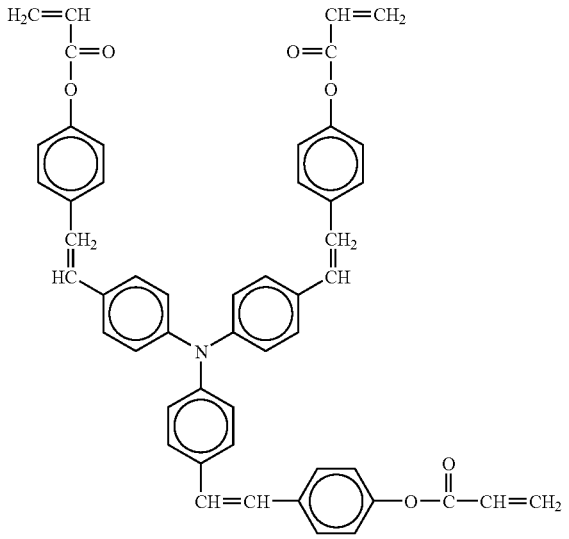

Among the radical polymerizable monomers (II) having a charge transport structure for use in the present invention, the same radical polymerizable monomer as the radical polymerizable monomers (III) and (IV) for use in preparation of the polysiloxane-acryl block copolymer having a charge transport property is preferably used in the present invention in terms of compatibility. This radical polymerizable monomer (II) has an impact on imparting the charge transport function to the cross-linking surface layer and occupies from 20 to 80% by weight and preferably from 30 to 70% by weight based on the total weight of the cross-linking surface layer. A radical polymerizable monomer that has too small a ratio tends to degrade the charge transport function of the cross-linking surface layer, resulting in deterioration of electric characteristics such as the sensitivity and the rise in the remaining voltage due to repetitive use. When the ratio is too large, the content of the monomer having at least three functional groups without a charge transport structure decreases, resulting in reduction of the cross-linking density which leads to degradation of the anti-abrasion property. Since desired electric characteristics and anti-abrasion property vary depending on the process, it is difficult to jump to any conclusion but considering the balance of both characteristics and property, the addition amount of the radical polymerizable monomer is most preferable from 30 to 70% by weight.

The radical polymerizable monomer (I) having at least three functional groups without a charge transport for use in the present invention is a monomer which do not have a positive hole transport structure, for example, triarylamine, hydrazone, pyrazoline, or carbazole, or an electron-transport structure, for example, electron-sucking aromatic ring having condensed polycyclic quinone, diphenoquinone, cyano group, or nitro group and has at least radical polymerizable functional groups. The radical polymerizable functional group has a carbon-carbon double linkage and any radical polymerizable functional group is acceptable.

Specific examples of these radical polymerizable functional groups include, but are not limited to, 1-ethylene substituted functional groups, and 1,1-substituted ethylene functional groups as follows:

Specific examples of the 1-substituted ethylene functional group include, but are not limited to, functional groups represented by the following chemical structure: $CH_2{=}CH{-}X_1{-}$ In the chemical structure illustrated above, $X_1$ represents a substituted or non-substituted arylene group, for example, phenylene group, or naphthylene group, a substituted or non-substituted alkenylene group, CO group, COO group, CON ($R_{10}$) group ($R_{10}$ represents a hydrogen atom, an alkyl group, for example, methyl group or ethyl group, or an aralkyl group, for example, benzyl group, naphthylmethyl group or phenethyl group, or an aryl group, for example, phenyl group or naphthyl group), or an S group.

Specific examples of these substituent groups include, but are not limited to, vinyl group, styryl group, 2-methyl-1,3-butadienyl group, vinylcarbonyl group, acryloyloxy group, acryloylamide group, and vinylthioether group.

Examples of the 1,1-substituted ethylene functional group include, but are not limited to, functional groups represented by the following chemical structure: $CH_2{=}CH(Y){-}X_2{-}$ In the chemical structure, Y represents a substituted or non-substituted alkyl group, a substituted or non-substituted aralkyl group, a substituted or non-substituted aryl group, for example, phenyl group and naphthyl group, a halogen atom, or an alkoxy group, for example, cyano group, nitro group, methoxy group or ethoxy group, $COOR_{11}$ ($R_{11}$ represents a hydrogen atom, a substituted or non-substituted alkyl group, for example, methyl group or ethyl group; a substituted or non-substituted aralkyl group, for example, benzyl group or phenethyl group, or a substituted or non-substituted aryl group, for example, phenyl group or naphthyl group), or $CONR_{12}R_{13}$ ($R_{12}$ and $R_{13}$ each, independently, represent a hydrogen atom, a substituted or non-substituted alkyl group, for example, methyl group or ethyl group, a substituted or non-substituted aralkyl group, for example, benzyl group, naphthylmethyl group or phenethyl group, or a substituted or non-substituted aryl group, for example, phenyl group or naphthyl group. $X_2$ represents the same substituent group as $X_1$ in the chemical structure illustrated above, a single bond or an alkylene group. At least one of Y and $X_2$ is an oxycarbonyl group, cyano group, an alkenylene group or an aromatic ring group.

Specific examples of these substituent groups include, but are not limited to, α-acryloyloxy chloride group, methacryloyloxy group, α-cyanoethylene group, α-cyanoacryloyloxy group, α-cyanophenylene group, and methacryloylamino group.

Specific examples of substituent groups that are furthermore substituted in the substituent group of $X_1$, $X_2$, or Y include, but are not limited to, an alkyl group, for example, a halogen atom, nitro group, cyano group, methyl group or ethyl group; an alkoxy group, for example, methoxy group, and ethoxy group; an aryloxy group, for example, phenoxy group; an aryl group, for example, phenyl group and naphthyl group; and an aralkyl group, for example, benzyl group and phenethyl group.

Among these radical polymerizable functional groups, acryloyloxy group, methacryloyloxy group and vinyl group are particularly effective, and a compound having three or more acryloyloxy groups can be obtained by conducting, for example, desalt, dehydration, dehydrohalide, an ester reaction or an ester exchange reaction of a compound having three or more hydroxyl groups in a molecule, and an acrylic acid (including salts thereof), an acrylic acid halide (e.g., acrylic acid fluoride, acrylic acid chloride, acrylic acid bromide and acrylic acid iodide) or an acrylic acid ester. A compound having three or more methacryloyloxy groups can also be obtained in the same manner. The radical polymerizable functional groups in the monomer having three or more radical polymerizable functional groups may be the same or different from each other.

The monomer having at least three radical polymerizable functional groups without a charge transport structure for use in the present invention preferably has a ratio of molecular weight to the number of functional groups (molecular weight/the number of functional group) in the monomer of 250 or less to form a dense cross-linking bond in the cross-linking surface layer (protective layer). When the ratio is excessively great, the cross-linking surface layer tends to be soft and the abrasion resistance tends to be degraded in some degree. Thus, it is not suitable to single out a compound having an extremely long modified group among the monomers having a modified group described above, for example, hydroxypropyl acryl (HPA) modified group, ethyleneoxide (EO) modified group, and propylene oxide (PO) modified group. The content of the radical polymerizable monomer (I) having at least three radical polymerizable functional groups without a charge transport structure for use in the cross-linking surface layer is from 20 to 80% by weight, and preferably from 30 to 70% by weight based on the total amount of the cross-linking surface layer. When the content of the monomer component is too small, the three dimensionally cross-linked bonding density of the cross-liking surface layer tends to be low. Also the abrasion resistance tends to be not significantly improved in comparison with the case where a typical thermoplastic binder resin is used. When the content of the monomer is too great, the content of the charge transport compound tends to decrease, which causes degradation of electric characteristics. Since the demand for the abrasion resistance and the electric characteristics varies depending on the process, it is difficult to jump to any conclusion but considering a good combination of the abrasion resistance and the electric characteristics, a preferred content of the monomer ranges from 30 to 70% by weight.

The surface layer for use in the photoreceptor of the present invention is a layer formed by curing at least the radical polymerizable monomer (I) having three or more functional groups without a charge transport structure and the radical polymerizable monomer (II) having a charge transport structure. In addition, optionally a radical polymerizable monomer or oligomer having one or two functional groups without a charge transport structure can be used to provide functions of, for example, adjusting the viscosity upon coating, relaxing the stress in the cross-linking surface layer, reducing the surface energy, and decreasing the friction index, etc. Any known radical polymerizable monomers and oligomers having one or two functional groups without a charge transport structure can be used. Also, functional monomers or oligomers can be added.

Specific examples of the radical polymerizable monomer having one-functional group without a charge transport structure include, but are not limited to, monomers of 2-ethylhexyl acrylate, 2-hydroxyethyl acrylate, 2-hydroxypropyl acrylate, tetrahydrofurfuryl acrylate, 2-ethylhexyl carbitol acrylate, 3-methoxybutyl acrylate, benzyl acrylate, cyclohexyl acrylate, isoamyl acrylate, isobutyl acrylate, methoxy triethylene glycol acrylate, phenoxy tetraethylene glycol acrylate, cetyl acrylate, isostearyl acrylate, stearyl acrylate, and styrene.

Specific examples of the radical polymerizable monomer having two functional groups without a charge transport structure include, but are not limited to, 1,3-butandiol diacrylate, 1,4-butane diol diacrylate, 1,4-butane diol dimethacrylate, 1,6-hexane diol diacrylate, 1,6-hexane diol dimethacrylate, diethylene glycol diacrylate, neopenthyl glycol diacrylate, bisphenol A-EO modified diacrylate, bisphenol F-EO modified diacrylate and neopenthyl glycol diacrylate.

Specific examples of the functional monomer include, but are not limited to, monomers in which a fluorine atom of, for example, octafluoro penthyl acrylate, 2-perfluorooctyl ethyl acrylate, 2-perfluorooctyl ethyl methacrylate and 2-perfluoroisononyl ethyl acrylate is substituted, and vinyl monomers, acrylates and methacrylates having polysiloxane groups, for example, acryloyl polydimethyl siloxane ethyl, methacryloyl polydimethyl siloxane ethyl, acryloyl polydimethyl siloxane propyl, acryloyl polydimethyl siloxane butyl and diacryloyl polydimethyl siloxane diethyl having 20 to 70 siloxane repeating units set forth in examined published Japanese patent applications Nos. (hereinafter referred to as JPP) H05-60503 and H06-45770.

Specific examples of the radical polymerizable oligomer include, but are not limited to, epoxyacrylate based oligomers, urethane acrylate based oligomers, and polyester acrylate based oligomers.

When a radical polymerizable monomer and/or a radical polymerizable oligomer having one or two functional groups without a charge transport structure are contained in a large amount, the three dimensional cross linking density of the cross linking surface layer substantially decreases, which invites the deterioration of the anti-abrasion property. Therefore, the content of these monomers and oligomers is not greater than 50 parts by weight and preferably not greater than 30 parts by weight based on 100 parts by weight of the radical polymerizable monomer having at least three functional groups without a charge transport structure.

The surface layer for use in the photoreceptor of the present invention is a layer formed by curing at least the radical polymerizable monomer (I) having three or more functional groups without a charge transport structure and the radical polymerizable monomer (II) having a charge transport structure. A polymerization initiator can be optionally used in the cross-linking surface layer to effectively conduct this cross-linking reaction. Thermal polymerization initiators and photo polymerization initiators (photosensitizer) can be used as the polymerization initiator.

Specific examples of such thermal polymerization initiators include, but are not limited to, peroxide-based initiators, for example, 2,5-dimethylhexane-2,5-dihydroperoxide, dicumyl peroxide, benzoyl peroxide, t-butyl cumyl peroxide, 2,5-dimethyl-2,5-di(peroxybenzoyl)hexyne-3, di-t-butyl peroxide, t-butylhydroperoxide, cumene hydroperoxide, and lauroyl peroxide, and azo based initiators, for example, azobis isobutylnitrile, azobiscyclohexane carbonitrile, azobis methyl isobutyric acid, azobis isobutyl amidine hydrochloride salts, and 4,4'-azobis-4-cyano valeric acid.

Specific examples of such photo polymerization initiators include acetophenone based or ketal based photo polymerization initiators, for example, diethoxy acetopenone, 2,2-dimethoxy-1,2-diphenylethane-1-one, 1-hydroxy cyclohexyl phenylketone, 4-(2-hydroxyethoxy)phenyl-(2-hydroxy-2-propyl)ketone, 2-benzyl-2-dimethylamino-1-(4-morpholinophenyl)butanone-1,2-hydroxy-2-methyl-1-phenylpropane-1-one, 2-methyl-2-morpholino(4-methylthiophenyl) propane-1-one, and 1-phenyl-1,2-propane dione-2-(o-ethoxycarbonyl)oxime; benzoin ether based photo polymerization initiators, for example, benzoine, benzoine methyl ether, benzoin ethyl ether, benzoine isobutyl ether and benzoine isopropyl ether; benzophenone based photo polymerization initiators, for example, benzophenone, 4-hydroxy benzophenone, o-benzoyl benzoic acid methyl, 2-benzoyl naphthalene, 4-benzoyl biphenyl, 4-benzoyl phenyl ether, acrylated benzophenone and 1,4-benzoyl benzene; and thioxanthone based photo polymerization initiators, for example, 2-isopropyl thioxanthone, 2-chloro thioxanthone, 2,4-dimethyl thioxanthone, 2,4-diethyl thioxanthone, and 2,4-dichloro thioxanthone.

Other photo polymerization initiators are, for example, ethylanthraquinone, 2,4,6-trimethyl benzoyl diphenyl phosphine oxide, 2,4,6-trimethyl benzoyl phenyl ethoxy phosphine oxide, bis(2,4,6-trimethyl benzoyl)phenyl phosphine oxide, bis(2,4-dimethoxy benzoyl)-2,4,4-trimethyl pentyl phosphine oxide, methylphenyl glyoxy esters, 9,10-phenanthrene, acridine based compounds, triadine based compounds, and imidazole based compounds. In addition, a compound which accelerates the photopolymerization can be used alone or in combination with the photopolymerization initiators mentioned above. Specific examples thereof include, but are not limited to, triethanol amine, methyldiethanol amine, 4-dimethylamino ethyl benzoate, 4-dimethylamino isoamil benzoate, benzoic acid (2-dimethylamino) ethyl, and 4,4'-dimethylamino benzophenone.

These polymerization initiators described above can be used in combination. At least one of the thermal polymerization initiators and the photopolymerization initiators (and photosensitization agents) can be used in combination and at least one polymerization initiators selected from each polymerization initiator can be used in combination. The addition amount of the polymerization initiator is from 0.5 to 40 parts by weight and preferably from 1 to 20 parts by weight based on 100 parts by weight of the total weight of the radical polymerizable compound.

Furthermore, a liquid application used to manufacture the photoreceptor of the present invention can contain additives, for example, various kinds of a plasticizing agent (to relax internal stress or improve adhesiveness), a leveling agent, and a low molecular weight charge transport material which is not radically reactive, if desired. Any known additives can be used. Specific examples of the plasticizing agent include, but are not limited to, dibutyl phthalate and dioctyl phthalate, which are typically used for resins. The addition amount of the plasticizing agent is not greater than 20% by weight and more preferably not greater than 10% by weight based on all the solid portion of the liquid application. Specific examples of the leveling agent include, but are not limited to, silicone oils such as dimethyl silicone oil and methylphenyl silicone oil, and polymers or oligomers having a perfluoroalkyl group in its branch chain. The addition amount of the leveling agent is not greater than 3% by weight based on all the solid portion of the liquid application.

As the density of the polysiloxane-acryl block copolymer having a charge transport property in the surface layer increases, the sustainability and the stability of the low surface free energy become high. A density that is too high tends to cause side effects such as a rise in the residual voltage and decrease in the hardness of the protective (surface) layer. Therefore, the density of the polysiloxane-acryl block copolymer having a charge transport property is not greater than 50% by weight and preferably not greater than 30% by weight based on all the solid portion which forms the surface layer.

A liquid dispersion is prepared by mixing the polysiloxane-acryl block copolymer having a charge transport property and the radical polymerizable monomers (I) and (II) in an organic solvent with optional dispersion treatment. Also, the polysiloxane-acryl block copolymer having a charge transport property can be dispersed in an organic solvent first and then the radical polymerizable monomers (I) and (II) can be added to the liquid dispersion. Charge transport material and various kinds of additives can be optionally added to the liquid dispersion.

Any known dispersion method and device such as a ball mill, an attritor, a sand mill, a bead mill, ultrasonic wave, high pressure liquid collision can be used.

The cross-linking surface layer of the photoreceptor of the present invention is preferably formed by coating and curing a liquid application containing at least a radical polymerizable monomer (I) having three or more functional groups without a charge transport structure, a radical polymerizable monomer (II) having a charge transport structure and a polysiloxane-acryl block copolymer having a charge transport property. When the radical polymerizable monomers (I) and (II) are liquid, other compositions can be dissolved therein for application or optionally diluted by a solvent before application. Specific examples of the solvent include, but are not limited to, alcohols such as methanol, ethanol, propanol and butanol, ketones such as acetone, methylethylketone, methylisobutylketone, and cyclohexanone, esters such as ethyl acetate and butyl acetate, ethers such as tetrahydrofuran, dioxane, and propylether, halogen-based solvents such as dichloromethane, dichloroethane, trichloroethane, and chlorobenzene, aromatic compounds such as benzene, toluene, and xylene, cellosolves such as methylcellosolve, ethylcellosolve, and cellosolve acetate. These solvents can be used alone or in combination. The dilution ratio by such a solvent varies depending on solubility of a composition, application method, target layer thickness. A dip coating method, a spray coating method, a bead coating method, a ring coating method, etc. can be used.

When manufacturing the photoreceptor of the present invention, the liquid application is applied and cured by an external energy to form a cross-linking surface layer. Specific examples of the external energy include, but are not limited to, heat, light and radioactive ray. Heat is provided (irradiated) to a target from the application surface side or the substrate side using air or vapors such as atmosphere or nitrogen, various kinds of heat medium, infrared and electromagnetic wave. The heating temperature is preferably from 100 to 170° C. When the heating temperature is too low, the reaction speed tends to be slow, resulting in incomplete reaction. When the heating temperature is too high, the reaction is not conducted uniformly, resulting in distortion in the cross-linking surface layer, which is not preferred. Heating at a relatively low temperature (lower than 100° C.) first followed by heating at a temperature not lower than 100° C. is also an effective method to complete the curing reaction.

As light energy, a UV irradiation light source, for example, a high pressure mercury lamp or a metal halide lamp having an emission wavelength mainly in the ultraviolet area can be used. A visible light source can be selected according to the absorption wavelength of a radical polymerizable compound and a photopolymerization initiator. The irradiation light amount is preferably from 50 $mW/cm^2$ to 1,000 $mW/cm^2$. When the irradiation light amount is too small, it tends to take a long time to complete the curing reaction. When the irradiation light amount is too large, the reaction tends to be not uniformly conducted, resulting in the occurrence of wrinkle on the surface of the protective layer. As radiation ray energy, electron beam can be used. Among these forms of energies, heat and/or light energy is suitably used in terms of easiness of reaction speed control and simplicity of a device.

In the present invention, since the layer thickness of the cross-linking surface layer varies depending on the layer structure of the photoreceptor in which the cross-linking surface layer is used, the layer thickness is described in combination with the layer structure.

The composition contained in the liquid application (liquid application for cross-linking surface layer) to form a cross-linking surface layer may contain a binder resin as long as the smoothness, the electric characteristics and the durability of the surface of a photoreceptor are not damaged thereby. However, when such a liquid application contains polymerizable material such as a binder resin, the phase separation occurs due to bad compatibility between the polymerizable material and polymers produced in the curing reaction of the radical polymerizable composition {(radical polymerizable monomers (I) and (II)}, resulting in increase in irregularity of the surface of the cross-linking surface layer. Therefore, it is not preferred to use a binder resin.

The cross-linking surface layer for use in the photoreceptor of the present invention is desired to have a bulky charge transport structure to maintain the electric characteristics and needs a high cross-linking bonding density (cross-linking density) to improve the mechanical strength. When curing is performed rapidly upon application of an extremely high energy from outside subsequent to the application of a cross-linking surface layer, curing proceeds unevenly so that the surface of the cross-linking layer is made rough. Therefore, external energy such as heat or light energy by which the curing reaction speed can be controlled by adjustment of the heating condition, irradiation intensity of light, the amount of a polymerization initiator, etc., is preferably used.

When cross-linking surface layer forming material is used to form the photoreceptor of the present invention and a liquid application therefor contains, for example, an acrylate monomer having three acryloyloxy groups and a triaryl amine compound having one acryloyloxy group, the ratio thereof is from 7:3 to 3:7. In addition, a polymerization initiator is added in an amount of from 3 to 20% by weight based on the total weight of the acrylate compounds and a solvent is added to prepare the liquid application. For example, when the cross-linking surface layer is spray-coated on a charge transport layer which includes a triaryl amine based donor as the charge transport material and a polycarbonate as the binder resin, the solvent for the liquid application described above is preferably tetrahydrofuran, 2-butanone, ethylacetate, etc. The ratio of the solvent is from 3 to 10 times as much as the total weight of the acrylate compounds.

The thus obtained cross-linking surface layer is preferred to be in soluble in an organic solvent. When the layer is not sufficiently cured, the layer is soluble in an organic solvent in most cases and the cross-linking density is low so that the mechanical strength is weak.

For example, the cross-linking surface layer is applied by spraying, etc. to a photoreceptor having a substrate such as an aluminum cylinder on which an undercoating layer, a charge generation layer, and the charge transport layer are accumulated in this sequence and dried at a relatively low temperature (25 to 80° C.) for a short time of period (1 to 10 minutes). Thereafter, the liquid application is cured by heating or irradiation of radioactive ray including light such as UV irradiation.

When cured by the heat energy described above, the heating temperature is preferably from 100 to 170° C. as described above. When a blow type oven is used as the heating device and the heating temperature is set to 150° C., the heating time, is from 20 minutes to 3 hours. After curing, the photoreceptor of the present invention is obtained subsequent to heating at from 100 to 150° C. for 10 to 30 minutes to reduce the residual solvent.

When cured by the photo energy described above using UV irradiation as the photo energy as described above, a metal halide lamp, etc. is used. The intensity of illumination is preferably from 50 to 1,000 mW/cm$^2$. For example, when a UV light of 700 mW/cm$^2$ is irradiated, it is suitable to irradiate a drum for curing while revolving the drum such that all the surface thereof is irradiated for about 20 seconds. The drum temperature is controlled preferably not to surpass 50° C.

Layer Structure of Photoreceptor

The layer structure of the photoreceptor of the present invention is described.

The photoreceptor of the present invention is described with reference to the accompanying drawings.

FIG. 1 is a cross section illustrating the photoreceptor of the present invention.

Figure 2:
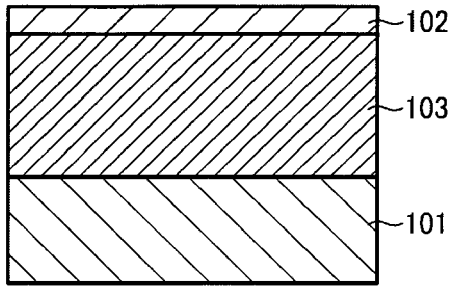
FIG. 2 is a diagram illustrating a cross section of an example of the photoreceptor of the present invention which has a single-layered structure including a photosensitive layer having the charge generation function and the charge transport function simultaneously on an electroconductive substrate and in which the surface portion of the photosensitive layer is a cross-linking surface layer.
Figure 3:
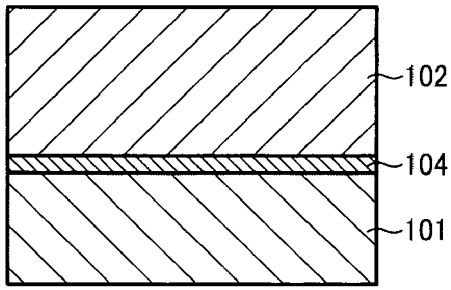
FIG. 3 is a diagram illustrating a cross section of an example of the photoreceptor of the present invention which has a laminar structure formed of a charge generation layer having the charge generation function and a charge transport layer having the charge transport function on an electroconductive substrate and in which the entire charge transport layer is a cross-linking surface layer.
Figure 4:
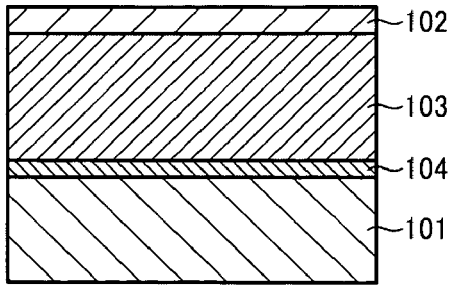
FIG. 4 is a diagram illustrating a cross section of an example of the photoreceptor of the present invention which has a laminar structure formed of a charge generation layer having the charge generation function and a charge transport layer having the charge transport function on an electroconductive substrate and in which the surface portion of the charge transport layer is a cross-linking surface layer.

The photoreceptor in FIG. 1 has a single layer structure in which a photosensitive layer 102 having both charge generation function and charge transport function is provided on an electroconductive substrate 101 and the entire photosensitive layer 102 is a cross-linking surface layer. FIG. 2 is a diagram illustrating a case in which the cross-linking surface layer 102 is the surface portion of a photosensitive layer. The single layer structure represents a layer having both charge generation function and charge transport function simultaneously as described above and can be a single layer or multiple layers FIG. 3 is a diagram illustrating a laminate structure photoreceptor in which a charge generation layer 104 having a charge generation function and a charge transport layer having a charge transport function are accumulated on an electroconductive substrate and the cross-linking surface layer 102 represents the entire charge transport layer. FIG. 4 is a diagram illustrating a casein which the cross-linking surface layer 102 is the surface portion of a charge transport layer 103. The laminate structure, as described above, represents a structure having a charge generation layer having a charge generation function and a charge transport layer having a charge transport function.

The photoreceptor of the present invention can have a photosensitive layer of a single layer structure or a laminate structure of FIGS. 1 and 4.

Electroconductive Substrate

Materials having a volume resistance of not greater than $10^{10}$ Ω·cm can be used as a material for the electroconductive substrate. For example, there can be used plastic or paper having a film form or cylindrical form covered with a metal such as aluminum, nickel, chrome, nichrome, copper, gold, silver, and platinum, or a metal oxide such as tin oxide and indium oxide by depositing or sputtering. Also a board formed of aluminum, an aluminum alloy, nickel, and a stainless metal can be used. Further, a tube which is manufactured from the board mentioned above by a crafting technique such as extruding and extracting and surface-treatment such as cutting, super finishing and grinding is also usable. In addition, endless nickel belt and endless stainless belt (for example, described in JOP S52-36016) can be used as the electroconductive substrate.

The electroconductive substrate of the present invention can be formed by applying to the substrate mentioned above a liquid application in which electroconductive powder is dispersed in a suitable binder resin.

Specific examples of such electroconductive powder include, but are not limited to, carbon black, acetylene black, metal powder such as aluminum, nickel, iron, nichrome, copper, zinc and silver, and metal oxide powder such as electroconductive tin oxide, and indium tin oxide (ITO).

Specific examples of the binder resins which are used together with the electroconductive powder include, but are not limited to, thermoplastic resins, thermosetting resins, and optical curing resins such as a polystyrene, a styrene-acrylonitrile copolymer, a styrene-butadiene copolymer, a styrene-anhydride maleic acid copolymer, a polyester, a polyvinyl chlorides a vinyl chloride-vinyl acetate copolymer, a polyvinyl acetate, a polyvinylidene chloride, a polyarylate (PAR) resin, a phenoxy resin, polycarbonate, a cellulose acetate resin, an ethyl cellulose resin, a polyvinyl butyral, a polyvinyl formal, a polyvinyl toluene, a poly-N-vinyl carbazole, an acryl resin, a silicone resin, an epoxy resin, a melamine resin, an urethane resin, a phenol resin, and an alkyd resin. Such an electroconductive layer can be formed by dispersing the electroconductive powder and the binder resins mentioned above in a suitable solvent such as tetrahydrofuran (THF), dichloromethane (MDC), methyl ethyl ketone (MEK), and toluene and applying the resultant to a substrate.

Also, an electroconductive substrate formed by providing a heat contraction rubber tube on a suitable cylindrical substrate can be used as the electroconductive substrate of the present invention. The heat contraction tube is formed of a material such as polyvinyl chloride, polypropylene, polyester, polystyrene, polyvinylidene chloride, polyethylene, chloride rubber, and fluorine resin (TEFLON®) in which the electroconductive powder mentioned above is contained.

Photosensitive Layer

Next, the photosensitive layer is described. The photosensitive layer can be laminate structured or single layered as described above.

The photosensitive layer is structured by a charge generation layer having a charge generation function and a charge transport layer having a charge transport function in a laminate structure. The photosensitive layer is a layer having both functions of charge generation and charge transport simultaneously.

Below are descriptions about the photosensitive layer of a laminate structure and of a single layer structure.

Photosensitive layer of Laminate Structure

Charge Generation Layer

The charge generation layer is a layer mainly formed of a charge generation material having a charge generation function with an optional binder resin. As the charge generation material, an inorganic material and an organic material can be used.

Specific examples of the inorganic material include, but are not limited to, crystal selenium, amorphous selenium, selenium-tellurium, selenium-tellurium-halogen, selenium-arsenic compounds and amorphous silicon. With regard to the amorphous silicon, amorphous silicon in which the dangling bonding is terminated by hydrogen atoms and halogen atoms or boron atoms and phosphorous atoms are doped are suitably used.

On the other hand, known materials can be used as the organic materials. Specific examples thereof include, but are not limited to, phthalocyanine based pigments, for example, metal phthalocyanine and non-metal phthalocyanine, azulenium salt pigments, methine squaric acid pigments, azo pigments having carbazole skeleton, azo pigments having triphenyl amine skeleton, azo pigments having dibenzothiophene skeleton, azo pigments having fluorenone skeleton, azo pigments having oxadiazole skeleton, azo pigments having bis stilbene skeleton, azo pigments having distyryl oxadiazole skeleton, azo pigments having distyryl carbazole skeleton, perylene based pigments, anthraquinone based or polycyclic quinone pigments, quinone imine pigments, diphenyl methane based pigments, triphenyl methane based pigments, benzoquinone based pigments, naphthoquinone based pigments, cyanine based pigments, azomethine based pigments, indigoid based pigments, and bisbenzimidazole pigments. These charge generation materials can be used alone or in combination.

Specific examples of the optional binder resins for use in a charge generation layer include, but are not limited to, polyamides, polyurethanes, epoxy resins, polyketones, polycarbonates, silicone resins, acrylic resins, polyvinyl butyrals, polyvinyl formals, polyvinyl ketones, polystyrenes, polysulfones, poly-N-vinyl carbazoles, and polyacrylamides. These binder resins can be used alone or in combination. In addition to the binder resins mentioned as the binder resin for the charge generation layer, charge transport polymer materials having a charge transport function, for example, polymer materials, for example, polycarbonate resins, polyester resins, polyurethane resins, polyether resins, polysiloxane resins, and acryl resins which have arylamine skeleton, benzidine skeleton, hydrazone skeleton, carbazole skeleton, stilbene skeleton, pyrazoline skeleton, etc.; and polymer materials having polysilane skeleton, can be used as the binder resin.

Specific examples of the binder resin include, but are not limited to, charge transport materials set forth in, for example, JOPs H01-001728 (S64-1728), H01-009964, H01-013061, H01-019049, H01-241559, H04-011627, H04-175337, H04-183719, H04-225014, H04-230767, H04-320420, H05-232727, H05-310904, H06-234836, H06-234837, H06-234838, H06-234839, H06-234840, H06-234841, H06-239049, H06-236050, H06-236051, H06-295077, H07-056374, H08-176293, H08-208820, H08-211640, H08-253568, H08-269183, H09-062019, H09-043883, H09-71642, H09-87376, H09-104746, H09-110974, H09-110976, H09-157378, H09-221544, H09-227669, H09-268226, H09-272735, H09-302084, H09-302085 and H09-328539.

Specific examples of the charge transport polymer materials having a charge transport function include, but are not limited to, polysililenes set forth in JOP S63-285552, H05-19497, H05-70595 and H10-73944.

In addition, the charge generating layer can contain a charge transport material having a low molecular weight.

As the charge transport material having a low molecular weight for use in the charge generating layer, there are two types thereof, which are a positive hole transport material and an electron transport material.

Specific examples of the charge transport materials include, but are not limited to, electron accepting materials, for example, chloroanyl, bromoanyl, tetracyanoethylene, tetracyano quinodimethane, 2,4,7-trinitro-9-fluorenone, 2,4,5,7-tetranitro-9-fluorenone, 2,4,5,7-tetranitroxanthone, 2,4,8-trinitrothioxanthone, 2,6,8-trinitro-4H-indeno[1,2-b]thiophene-4-one, 1,3,7-trinitro dibenzothiophen-5,5-dioxide, and diphenoquinone derivatives. These can be used alone or in combination.

As the positive hole transport materials, the following electron donating materials can be suitably used.

Specific examples thereof include, but are not limited to, oxazole derivatives, oxadiazole derivatives, imidazole derivatives, monoaryl amine derivatives, diaryl amine derivatives, triaryl amine derivatives, stilbene derivatives, α-phenyl stilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives and other known materials. These charge transport materials can be used alone or in combination.

As a method of forming a charge generating layer, it is possible to use a vacuum thin layer manufacturing method and a casting method from a solution dispersion system.

Specific examples of the vacuum thin layer manufacturing method include, but are not limited to, a vacuum deposition method, a glow discharging decomposition method, an ion plating method, a sputtering method, and a reactive sputtering method and a chemical vacuum deposition (CVD) method. Both inorganic materials and organic materials mentioned above can be used to form a charge transport layer.

When a casting method is used, it is possible to form a charge generation layer by applying a suitably diluted liquid dispersion obtained by dispersing the inorganic material or the organic material mentioned above in a solvent together with an optional binder resin using a dispersing device. Specific examples of the solvent include, but are not limited to, tetrahydrofuran, dioxane, dioxolan, toluene, dichloromethane, monochlorobenzene, dichloroethane, cyclohexanone, cyclopentanone, anisole, xylene, methylethylketone, acetone, ethyl acetate and butylacetate. Specific examples of the dispersing device include, but are not limited to, a ball mill, an attritor, a sand mill, and a bead mill. In addition, if desired, a leveling agent, for example, dimethyl silicone oil and methylphenyl silicone oil, can be added to the liquid dispersion mentioned above. Furthermore, the application mentioned above is performed by a dip coating method, a spray coating method, a bead coating method and a ring coating method.

The thickness of the charge transport layer obtained as described above is preferably from 0.01 to 5 μm and more preferably from 0.05 to 2 μm.

Charge Transport Layer

The charge transport layer is a layer having a charge transport function and the cross-linking surface layer having a charge transport structure for use in the present invention is suitably used as the charge transport layer. When the cross-linking surface layer is the entire of the charge transport layer, a liquid application containing the radical polymerizable monomers (I) and (II) for use in the present invention and the polysiloxane-acryl block copolymer having a charge transport property mentioned above are applied to the charge generation layer and dried, if desired, followed by curing reaction upon application of an external energy to form the cross-linking surface layer as described in the method of manufacturing the cross-linking surface layer. The layer thickness of the cross-linking surface layer is from 10 to 30 μm and preferably from 10 to 25 μm. When the layer thickness is too thin, a sufficient charging voltage is not easily maintained. A layer thickness that is too thick tends to cause peeling-off from the lower layer due to the volume contraction during curing.

In addition, when the cross-linking surface layer is formed on the surface portion of the charge transport layer having a laminate structure, the lower layer portion of the charge transport layer is formed by dissolving or dispersing a charge transport material and a binder resin in a suitable solvent and applying the liquid to the charge generation layer followed by drying. Thereafter, the liquid application described above of the radical polymerizable composition and the polysiloxane-acryl block copolymer having a charge transport property is applied thereto followed by cross-linking curing upon application of an external energy.

As the charge transport material, the charge transport materials, the positive hole transport materials and the charge transport polymers specified for the charge generation layer described above can be used. Especially, as described above, using the charge transport polymers is effective to reduce the solubility of a layer lying under the surface layer during application thereof.

Specific examples of the binder resins include, but are not limited to, thermal curing resins and thermal plastic resins such as polystyrenes, styrene-acrylonitrile copolymers, styrene-butadiene copolymers, styrene-maleic acid anhydride copolymers, polyesters, polyvinyl chlorides, vinyl chloride-vinyl acetate copolymers, polyvinyl acetates, polyvinyl vinylidenes, polyarylates resins, phenoxy resins, polycarbonates, cellulose acetate resins, ethyl cellulose resins, polyvinyl butyrals, polyvinyl formals, polyvinyl toluene, poly-N-vinylcarbazols, acrylic resins, silicone resins, epoxy resins, melamine resins, urethane resins, phenol resins, and alkyd resins.

The content of such a charge transport material is from 20 to 300 parts by weight and preferably from 40 to 150 parts by weight based on 100 parts by weight of a binder resin. When a charge transport polymer is used, the charge transport polymer can be used alone or in combination with a binder resin.

As the solvent for use in application of a charge transport layer, the same solvent as those specified for the charge generation layer can be used. Among those, the solvent that suitably dissolves the charge transport material and the binder resin is preferred. These solvents can be used alone or in combination. To form the bottom portion of the charge transport layer, the same method as those specified for the charge generation layer can be used.

Additives such as a plasticizer and a leveling agent can be optionally added.

Specific examples of the plasticizers which can be added to the bottom layer portion of the charge transport layer include known resin plasticizers such as dibutyl phthalate and dioctyl phthalate. The content of the resin plasticizer in the charge transport layer is from 0 to about 30 parts by weight based on 100 parts of a binder resin.

As the leveling agent for use in the bottom layer portion of the charge transport layer, silicone oil such as dimethyl silicone oil, methyl phenyl silicone oil and a polymer or an oligomer having a perfluoroalkyl group in its side chain can be used. The content thereof is suitably from 0 to about 1 part by weight based on 100 parts of a binder resin.

The layer thickness of the charge transport layer is suitably from about 5 to about 40 μm and preferably from about 10 to about 30 μm.

When the cross-linking surface layer is the surface portion of the charge transport layer, a liquid application containing the radical polymerizable composition for use in the present invention is applied to the bottom portion of the charge transport layer and dried, if desired, followed by curing reaction upon application of an external energy such as heat and light to form the cross-linking surface layer as described in the method of manufacturing the cross-linking surface layer. The layer thickness of the cross-linking surface layer is from 1 to 20 μm and preferably from 2 to 10 μm. When the layer thickness is too thin, the durability tends to be not stable due to the uneven layer thickness. A layer thickness of the bottom portion that is too thick makes the entire charge transport layer thick so that the image reproducibility deteriorates because of charge diffusion.

Photosensitive Layer of Single Layer Structure

The single layered photosensitive layer has both a charge generation function and a charge transport function simultaneously and the cross-linking surface layer having a charge transport structure of the present invention can be suitably used as the photosensitive layer of the single layered structure. As described in the casting method for the charge generation layer, the charge generation material is dispersed in a liquid application containing the radical polymerizable composition and applied to the charge generation layer and dried, if desired, followed by curing reaction upon an external energy to form the cross-linking surface layer. The charge generation material can be preliminarily dispersed in a solvent and then added to the liquid application of the cross-linking surface layer. The layer thickness of the cross-linking surface layer is from 10 to 30 μm and preferably from 10 to 25 μm. When the layer thickness is too thin, a sufficient charging voltage is not easily maintained. A layer thickness that is too thick tends to cause peeling-off from the undercoating layer or the electroconductive substrate due to the volume contraction during curing.

In addition, when the cross-linking surface layer occupies the photosensitive layer of a single layered structure, the bottom layer of the photosensitive layer can be formed by applying a liquid application in which a charge generation compound having a charge generation function, a charge transport compound having a charge transport function and a binder resin are dispersed or dissolved in a suitable solvent to an electroconductive substrate followed by optional drying. In addition, a plasticizing agent and/or a leveling agent can be added, if desired.

With regard to the dispersion method of a charge generation material, the charge generation compound (material), the charge transport compound (material), the plasticizing agent, and the leveling agent, the same as specified above for the charge generation layer and the charge transport layer can be used. With regard to the binder resin, in addition to the binder resins specified above for the charge transport layer, the binder resin for use in the charge generation layer can be mixed in combination. In addition, the charge transport polymers mentioned above can be also used. This is useful in light that mingling of the compositions of the bottom portion of the photosensitive layer with the cross-linking surface layer can be reduced. The layer thickness of the bottom portion of the photosensitive layer is suitably from about 5 to about 30 μm and preferably from about 10 to about 25 μm.

When the cross-linking surface layer is the surface portion of the photosensitive layer of a single layered structure, the cross linking surface layer is formed by applying a liquid application for the cross linking surface layer to the photosensitive layer followed by optional drying and thereafter curing the liquid upon irradiation of energy of light, heat or radiation. The layer thickness of the cross-linking surface layer is from 1 to 20 μm and preferably from 2 to 10 μm. When the layer thickness is too thin, the durability tends to be not stable due to the uneven layer thickness.

The content of the charge generation material contained in the photosensitive layer of a single layered structure is preferably from 1 to 30% by weight, the content of the binder resin contained in the lower layer portion of the photosensitive layer is from 20 to 80% by weight, and the content of the charge transport material is preferably from 10 to 70% by weight based on the total amount of the photosensitive layer.

Intermediate Layer

In the photoreceptor of the present invention, when the cross-linking surface layer forms the surface portion of the photosensitive layer, an intermediate layer can be provided between the cross linking surface layer and the photosensitive layer. This intermediate layer is to limit mingling of the lower layer composition to the cross-linking surface layer or improve the adhesiveness with the lower layer. This intermediate layer prevents inhibition of curing reaction and/or formation of a rough cross-linking surface layer caused by mingling of a composition in the lower layer portion of the photosensitive layer into the surface layer containing a radical polymerizable composition. Furthermore, it is possible to improve the adhesiveness between the photosensitive layer and the cross-linking surface layer provided thereabove.

In the intermediate layer, a binder resin is used as the main component. Specific examples of such binder resins include, but are nor limited to, polyamide, alcohol soluble nylon, water soluble polyvinyl butyral, polyvinyl butyral and polyvinyl alcohol. Such an intermediate layer is formed by the typical method described above. The intermediate layer thickness is suitably from about 0.05 to about 2 μm.

Undercoating Layer

As to the image bearing member of the present invention, an undercoating layer can be provided between the electroconductive substrate and the photosensitive layer. In general, such an undercoating layer is mainly formed of a resin. Considering the case in which a photosensitive layer is formed on the intermediate layer (i.e., resin) using a solvent, the resin is preferably hardly soluble in a typically used organic solvent. Specific examples of such resins include water soluble resins, for example, polyvinyl alcohol, casein, and sodium polyacrylate, alcohol soluble resins, for example, copolymerized nylon and methoxymethylized nylon and curing resins which form a three-dimensional mesh structure, for example, polyurethane, melamine resins, phenol resins, alkyd-melamine resins and epoxy resins. In addition, fine powder pigments of metal oxides exemplified by titanium oxide, silica, alumina, zirconium oxide, tin oxide and indium oxide can be added to the undercoating layer to prevent the occurrence of moiré, reduce the residual voltage and so on.

The undercoating layer can be formed by using the same solvents and the same coating methods as those for the photosensitive layer. Furthermore, silane coupling agents, titanium coupling agents and chromium coupling agents can be used in the undercoating layer. In addition, $Al_2O_3$ formed by anodic oxidization, organic compounds, for example, polyparaxylylene (parylene), which are formed by a vacuum thin layer manufacturing method, and inorganic materials, for example, $SiO_2$, $SnO_2$, $TiO_2$, ITO and $CeO_2$ can be also suitably used in the undercoating layer. Furthermore, any known suitable compounds can be used. The thickness of the undercoating layer is suitably from 0 to 5 μm.

Addition of Anti-Oxidizing Agent to Each Layer

In addition, in the present invention, to improve the anti-environment properties, especially to prevent the reduction in the sensitivity and the rise in the residual voltage, an anti-oxidizing agent can be added to each layer of the protective layer, the charge generating layer, the charge transport layer, the undercoating layer, the intermediate layer, etc.

Specific examples of the anti-oxidizing agents for use in the present invention include, but are not limited to, the following:

Phenol-Based Compounds:

2,6-di-t-butyl-p-cresol, butylated hydroxyl anisole,
2,6-di-t-butyl-4-ethylphenol, stearyl-β-(3,5-di-t-butyl-4-hydroxyphehyl)propionate,
2,2'-methylene-bis-(4-methyl-6-t-butylphenol),
2,2'-methylene-bis-(4-ethyl-6-t-butylphenol),
4,4'-thiobis-(3-methyl-6-t-butylphenol),
4,4'-butylidenebis-(3-methyl-6-t-butylphenol),
1,1,3-tris-(2-methyl-4-hydroroxy-5-t-butylphenyl)butane,
1,3,5-trimethyl-2,4,6-tris(3,5-di-t-butyl-4-hydroxybenzyl) benzene, tetrakis-[methylene-3-(3',5'-di-t-butyl-4'-hydroxyphenyl)propionate]methane,
bis[3,3'-bis(4'-hydroxy-3'-t-butylphenyl)butyric acid]glycol ester and tocopherol;

Paraphenylene Diamines:

N-phenyl-N'-isopropyl-p-phenylene diamine,
N,N'-di-(sec-butyl)-p-phenylene diamine,
N-phenyl-N-sec-butyl-p-phenylene diamine,
N,N'-di-isopropyl-p-phenylene diamine, and
N,N'-dimethyl-N,N'-di-t-butyl-p-phenylene diamine;

Hydroquinones:

2,5-di-t-octyl hydroquinone, 2,6-didodecyl hydroquinone, 2-dodecyl hydroquinone, 2-dodecyl-5-chloro hydroquinone, 2-t-octyl-5-methyl hydroquinone, and 2-(2-octadecenyl)-5-methyl hydroquinone;

Organic Sulfur Compounds:

dilauryl-3,3-thiodipropionate, distearyl-3,3'-thiodipropionate, and ditetradecyle-3,3'-thiodipropionate; and Organic Phosphorous Compound:

triphenyl phosphine, tri(nonylphenyl)phosphine, tri(dinonylphenyl)phosphine, tricresyl phosphine, and tri-2,4-dibutylphenoxy)phosphine These compounds are known as anti-oxidants for rubber, plastic, oils and products thereof are easily available in the market.

The addition amount of the anti-oxidizing agent in the present invention is from 0.01 to 10% by weight based on the total weight of the layer to which the anti-oxidization is added.

Below is a description about the image forming apparatus.

Image Forming Apparatus

The image forming apparatus of the present invention includes the photoreceptor described above, a charging device, an irradiation device (latent electrostatic image formation device), a developing device, a transfer device and a cleaning device as described above. The image forming apparatus of the present invention has a mechanism in which the cleaning device includes a resin blade directly contacting with the photoreceptor to remove toner remaining after transfer. Furthermore, the image forming apparatus includes other optional devices such as a fixing device, a discharging device, a recycling device and a controlling device.

Images can be formed by using the image forming apparatus of the present invention. The latent electrostatic image formation process described above is performed by the latent electrostatic formation device described above. The development process described above is performed by the development device described above. The fixing process described above is performed by the fixing device described above. The other processes described above are performed by the other devices described above.

Latent Electrostatic Image Formation Process and Latent Electrostatic Image Formation Device The latent electrostatic image formation process is a process of forming a latent electrostatic image on a photoreceptor. There is no specific limit to the photoreceptor in light of the material, form, structure, size, etc. Any known materials can be selected and a photoreceptor having a drum form is preferred.

The photoreceptor of the present invention is used as the photoreceptor in this process.

Latent electrostatic images can be formed by, for example, uniformly charging the surface of the photoreceptor and irradiating the surface with light according to image information by the latent electrostatic image formation device.

The latent electrostatic image formation device includes at least, for example, a charging device to uniformly charge the surface of the photoreceptor described above and an irradiation device to irradiate the surface of the photoreceptor according to image information.

The charging process is performed by applying a voltage to the surface of the photoreceptor using the charging device.

There is no specific limit to the charging device. Specific examples thereof include, but are not limited to, a known contact type charging device having electroconductive or semi-conductive roll, brush, film, rubber plate, etc., and an on-contact type charging device such as a corotron or scorotron using corona discharging.

The irradiation process is performed by irradiating the surface of the photoreceptor using the irradiation device.

There is no specific limit to the irradiation device as long as the surface of the photoreceptor charged by the charging device can be irradiated according to image information. Specific examples of such irradiation devices include, a photocopying optical system, a rod lens array system, a laser optical system, and a liquid crystal shutter optical system.

As to the present invention, the bottom side irradiation system by which an image bearing member is irradiated from the bottom side can be also employed.

In addition, when image irradiation is used in an image forming apparatus, a photocopier, a printer, etc. is used, the image irradiation process is performed by irradiating a photoreceptor with reflection light or transmission light, or forming reading signals from an original by a sensor, scanning a laser beam according to the signals, driving an LED array or a liquid crystal shutter array, etc.

Transfer Process and Transfer Device

The transfer process is a process of transferring a visualized image to a recording medium. A mechanism including an intermediate transfer body is preferred in which a visualized image is primarily transferred to the intermediate transfer body and then secondarily transferred to a recording medium. Two-color toner and preferably full color toner is used. It is more preferred to use a process including a primary transfer process of forming a complex transfer image in which a visualized image is transferred to an intermediate transfer body and a secondary transfer process in which the complex image is transferred to a recording medium.

The transfer process is performed by, for example, charging the photoreceptor using the charging device and transferring the visualized image by the transfer device. The transfer device preferably includes a primary transfer device by which a visualized image is transferred to form a complex image and a secondary transfer device by which the complex image is transferred to a recording medium.

There is no specific limit to the intermediate transfer body and any intermediate transfer body, for example, a transfer belt, can be selected.

The transfer device (primary transfer device and secondary transfer device) preferably includes at least a transfer unit which peel-off charges a visualized image formed on the photoreceptor to the recording medium side. The number of transfer devices can be one or more.

Specific examples of the transfer devices include, but are not limited to, a corona transfer unit, a transfer belt, a transfer roller, a pressure transfer roller, an adhesive transfer unit, etc.

Plain paper is typically used as the recording medium. There is no specific limit to the recording medium as long as an unfixed image after development is transferred thereto. PET base for transparent sheet can be also used.

Fixing Process and Fixing Device

The fixing process is a process of fixing a visualized image transferred to a recording medium by a fixing device. This fixing can be performed for each color toner image every time each color toner image is transferred to the recording medium or for an accumulated image of each color toner images at one time.

There is no specific limit to the fixing device, any known devices can be used. Known heating and pressure devices are preferred. A combination of a heating roller and a pressure roller or a combination of a heating roller, a pressure roller and an endless belt are typically used as the heating and pressure device.

Heating by such a heating and pressure device is preferably from 80 to 200° C.

In the present invention, for example, a known optical fixing device can be used together with or instead of the fixing device described above.

Cleaning Process and Cleaning Device

The cleaning process is a process of cleaning the surface of a photoreceptor by a cleaning device.

Specific examples of the cleaning device include, but are not limited to, a cleaner blade, a magnet brush cleaner, an electroconductive brush cleaner, a magnetic roller cleaner, a blade cleaner, a brush cleaner, a web cleaner, etc.

Any of the cleaning systems can be used for the combination of the photoreceptor and the toner having a small particle diameter which is effective in reducing the adhesive force of the toner. Among these, a system in which a cleaning blade is directly in contact with a photoreceptor is preferred in terms of size reduction, simplicity, durability and high speed printing performance. High fine images can be output by a combination of this cleaning blade system, the photoreceptor and the toner having a small particle diameter. By this combination, it is possible to provide a small-sized, energy saving and high speed image forming apparatus which has no lubricant application mechanism and in which toner is recycled and the fixing temperature is low.

Also, the cleaning blade can be used in combination with other cleaning devices.

Any known conditions, materials and forms can be used with regard to the contact pressure, the contact angle, material and form of the cleaning blade. In general, as the contact pressure increases, the cleaning property ameliorates but the abrasion of the photoreceptor and the blade tends to increase. Therefore, the contact pressure is suitably adjusted to the specification of devices. Known elastic rubber blades are used as a preferred cleaning blade.

Especially, an elastic rubber blade which has an impact resilience of from 5 to 15% in the temperature range of from 15 to 30° C. and 10 to 20% in the temperature range of from 30 to 45° C. and has a hardness (according to JIS A: Hs) of from 77° to 85° is preferred.

In addition, two cleaning blades can be used simultaneously for cleaning.

The discharging process is a process of discharging a photoreceptor by applying a discharging bias thereto by a discharging device.

There is no specific limit to the discharging device as long as a discharging bias is applied to a photoreceptor. Any known discharging device can be suitably used. For example, a discharging lamp is preferably used.

The recycling process is a process of returning toner removed in the cleaning process to the developing device by a recycling device.

There is no specific limit to the recycling device. Any known transfer device can be used.

The control process is a process of controlling the behavior of each device and there is no specific limit thereto. Any known device such as a sequencer and a computer can be selected as long as the control device is capable of control each device.

An example of the image forming apparatus of the present invention is described with reference to FIG. 5.

Figure 5:
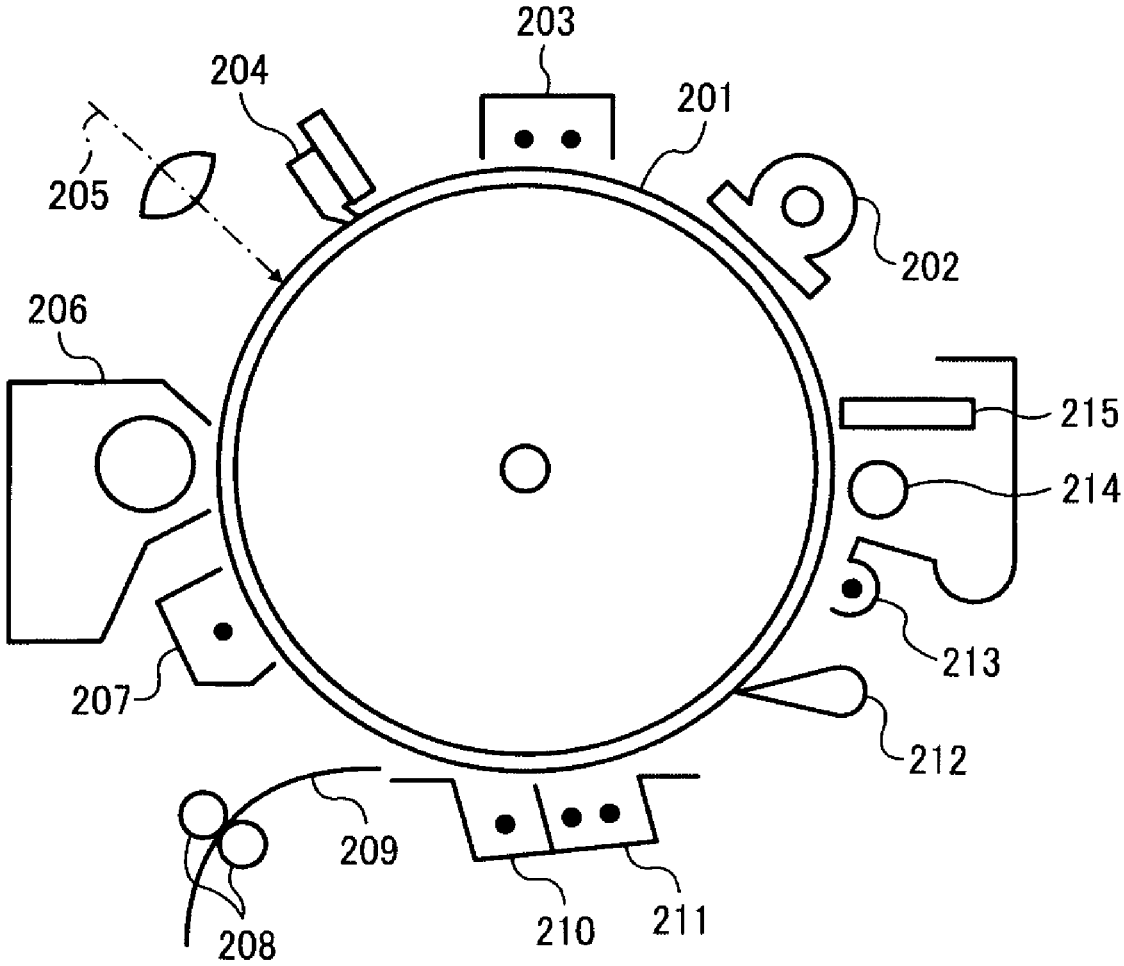
FIG. 5 is a schematic diagram illustrating an example of the image forming apparatus of the present invention.

FIG. 5 is a schematic diagram illustrating an example of the image forming apparatus of the present invention. The variations described later are also within the scope of the present invention.

A photoreceptor 201 is the photoreceptor described above. The photoreceptor 201 has a drum form. A sheet form or an endless belt form can be also employed. 204 in FIG. 5 represents an eraser.

A charger 203 is used to uniformly charge the photoreceptor 201. Known chargers can be used and specific examples thereof include, but are not limited to, a corotron device, a scorotron device, a solid discharging element, a needle electrode device, a roller charging device and an electroconductive brush device.

A charging device employing a contact type charging system or a vicinity (non-contact) type charging system which can decompose the compositions of the photoreceptor 201 is especially desired for the present invention. The contact type charging system represents a charging system in which a charging roller, a charging brush, a charging blade, etc. directly contacts with a photoreceptor. In addition, the vicinity type charging system represents a system in which a charging roller is situated between the surface of a photoreceptor and a charging device with a gap of not wider than 200 μm. When this gap is too wide, charging tends to be unstable. When the gap is too narrow, the surface of the charging member is easily contaminated when toner remains on the photoreceptor. Thus, the gap is preferably from 10 to 200 μm and more preferably from 10 to 100 μm.

Next, an image irradiation portion 205 is used to form a latent electrostatic image on the photoreceptor 201 which is uniformly charged. As the light source, typical luminescent materials, for example, a fluorescent lamp, a tungsten lamp, a halogen lamp, a mercury lamp, a sodium lamp, a luminescent diode (LED), a semi-conductor laser (LD) and electroluminescence (EL) can be used. Various kinds of filters, for example, a sharp cut filter, a band pass filter, an infrared cut filter, a dichroic filter, a coherency filter and a color conversion filter can be used to irradiate the photoreceptor 201 with light having only a desired wavelength.

Next, a developing unit 206 is used to visualize a latent electrostatic image formed on the photoreceptor 201. As the developing method, there are a single component development method and a two component development method both of which use a dry toner and a wet development method which uses a wet toner. When the photoreceptor 201 is positively (negatively) charged and image irradiation is performed, a positive (negative) latent electrostatic image is formed on the surface of the photoreceptor 201. When this positive (negative) latent electrostatic image is developed with a toner (electric detecting particulates) having a negative (positive) polarity, a positive image is obtained. When the image is developed with a toner having a positive (negative) polarity, a negative image is obtained.

Next, a transfer charging device 210 is used to transfer the toner image visualized on the photoreceptor 201 to a recording medium 209 by way of a pair of registration rollers 208. In addition, a charging device 207 prior can be used before transferring to perform a good transferring. As these transfer devices, an electrostatic transfer system using a transfer charging device or a bias roller, a mechanical transfer system using an adhesive transfer method or a pressure transfer method, and a magnetic transfer system can be used. The same device as the charging device described above can be used as the electrostatic transfer system.

Next, a separation charging device 211 and a separation claw 212 are used as a device to separate the recording medium 209 from the photoreceptor 201. As other separating devices, an electrostatic absorption guiding separation device, a side end belt separation device, a front end grip transfer device, a curvature separation device, etc. can be used. As the separation charging device 211, the same device as the charging device described above can be used.

Next, a fur brush 214 and a cleaning blade 215 are used to remove the toner remaining on the photoreceptor 201. In addition, a charging device 213 can be used before cleaning to effectively perform cleaning. Other cleaning devices, for example, a web-system device and a magnet brush system device, can be also used. These cleaning devices can be used alone or in combination.

Next, if desired, a discharging device is used to remove the latent electrostatic image on the photoreceptor 201. A discharging lamp 202 or a discharging charger can be used as the discharging device. The same devices as the irradiation light sources and the charging devices can be used therefor.

In addition to those mentioned above, known devices can be used in the processes of scanning originals, paper feeding, fixing images, discharging recording media, etc., which are performed not in the vicinity of the photoreceptor 201.

An embodiment of image formation by the image forming apparatus of the present invention is described with reference to FIG. 6. An image forming apparatus 100 illustrated in FIG. 6 includes a photoreceptor drum 10 functioning as the photoreceptor described above, a charging roller 20 functioning as the charging device described above, an irradiation device 30 functioning as the irradiation device described above, a development device 40 functioning as the development device described above, an intermediate transfer body 50, a cleaning device (blade) 63 having a cleaning blade functioning as the cleaning device described above, and a discharging lamp 70 functioning as the discharging device described above.

The intermediate transfer body 50 is an endless belt and movable in the direction indicated by an arrow by three rollers 51 located inside the endless belt to suspend it. Part of the three rollers 51 functions as a transfer bias roller which can apply a particular bias (primary transfer bias) to the intermediate transfer body 50. A cleaning device 90 having a cleaning blade is provided in the vicinity of the intermediate transfer body 50. Also, a transfer roller 80 which applies a transfer bias to the intermediate transfer body 50 to (secondarily) transfer a development (toner) image to a transfer medium 95 as the final transfer medium is provided opposing the intermediate transfer body 50. A corona charging device 58 which imparts charges to a toner image on the intermediate transfer body 50 is provided between the contact portion of the photoreceptor drum 10 and the intermediate transfer body 50 and the contact portion of the intermediate transfer body 50 and the transfer medium 95 relative to the rotation direction of intermediate transfer body 50.

The development device 40 includes a development belt 41 functioning as the development agent bearing member described above and a black development unit 45K, a yellow development unit 45Y, a magenta development unit 45M and a cyan development unit 45C arranged around the development belt 41. The black development unit 45K includes a developing agent accommodation portion 42K, a development agent supply roller 43K, and a development roller 44K. The yellow development unit 45Y includes a developing agent accommodation portion 42Y, a development agent supply roller 43Y, and a development roller 44Y. The magenta development unit 45M includes a developing agent accommodation portion 42M, a development agent supply roller 43M, and a development roller 44M. The cyan development unit 45C includes a developing agent accommodation portion 42C, a development agent supply roller 43C, and a development roller 44C. In addition, the development belt 41 is an endless belt and suspended over multiple belt rollers in such a way that the development belt 41 can rotate and is partially in contact with the photoreceptor 10.

Figure 6:
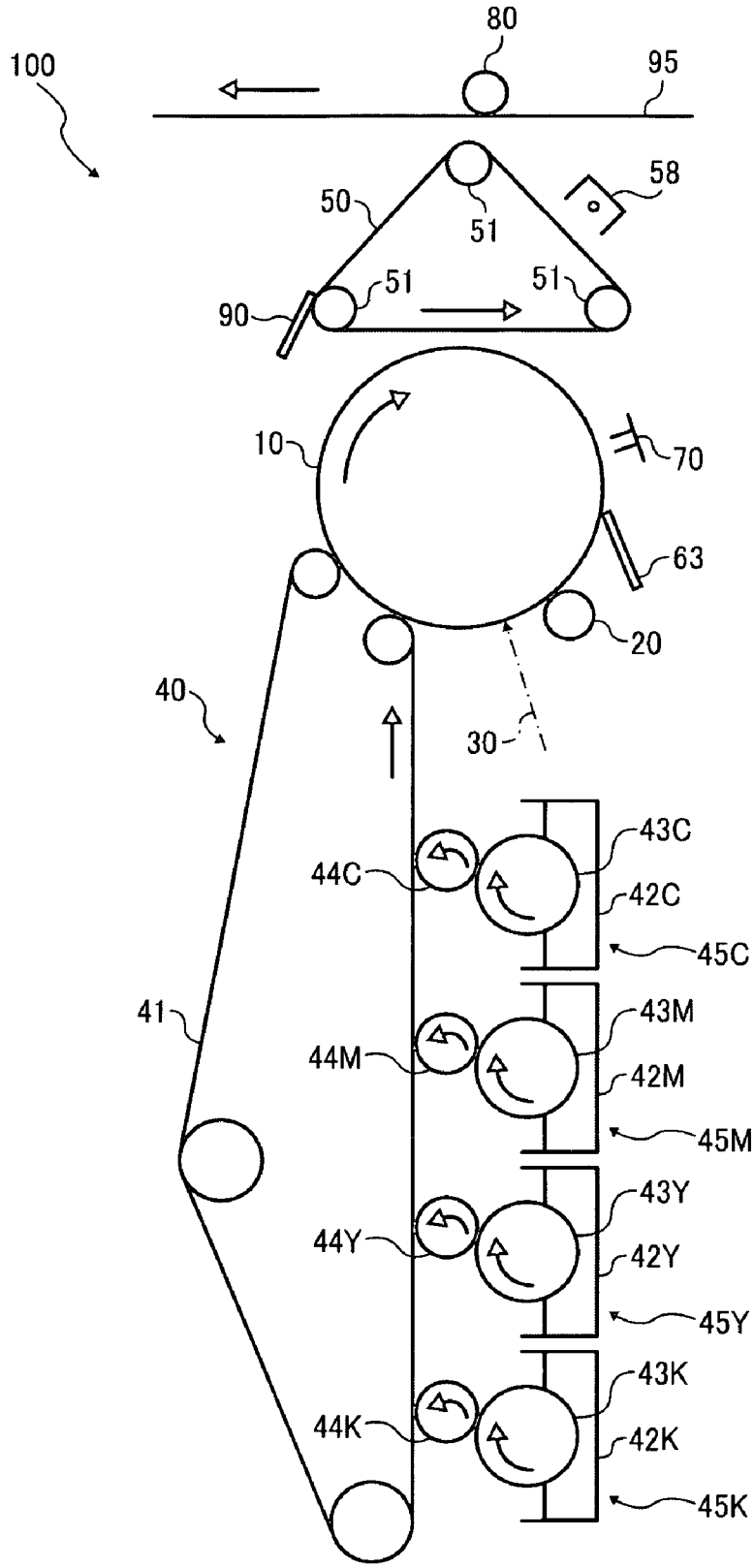
FIG. 6 is a diagram illustrating an example of image formation by the image forming apparatus.

The charging roller 20 uniformly charges the photoreceptor drum 10 in the image forming apparatus 100 illustrated in FIG. 6. The irradiation device 30 irradiates the photoreceptor drum 10 according to obtained data information to form a lateen electrostatic image thereon. The latent electrostatic image formed on the photoreceptor drum 10 is developed by supplying toner from the development device, 40 to form a visualized image (toner image). The visualized image (toner image) is primarily transferred to the intermediate transfer body 50 by a voltage applied by the roller 51 and then secondarily transferred to the transfer medium 95. The toner remaining on the photoreceptor drum 10 is removed by the cleaning device 63 and the charges remaining on the photoreceptor drum 10 are removed by the discharging lamp 70.

Figure 7:
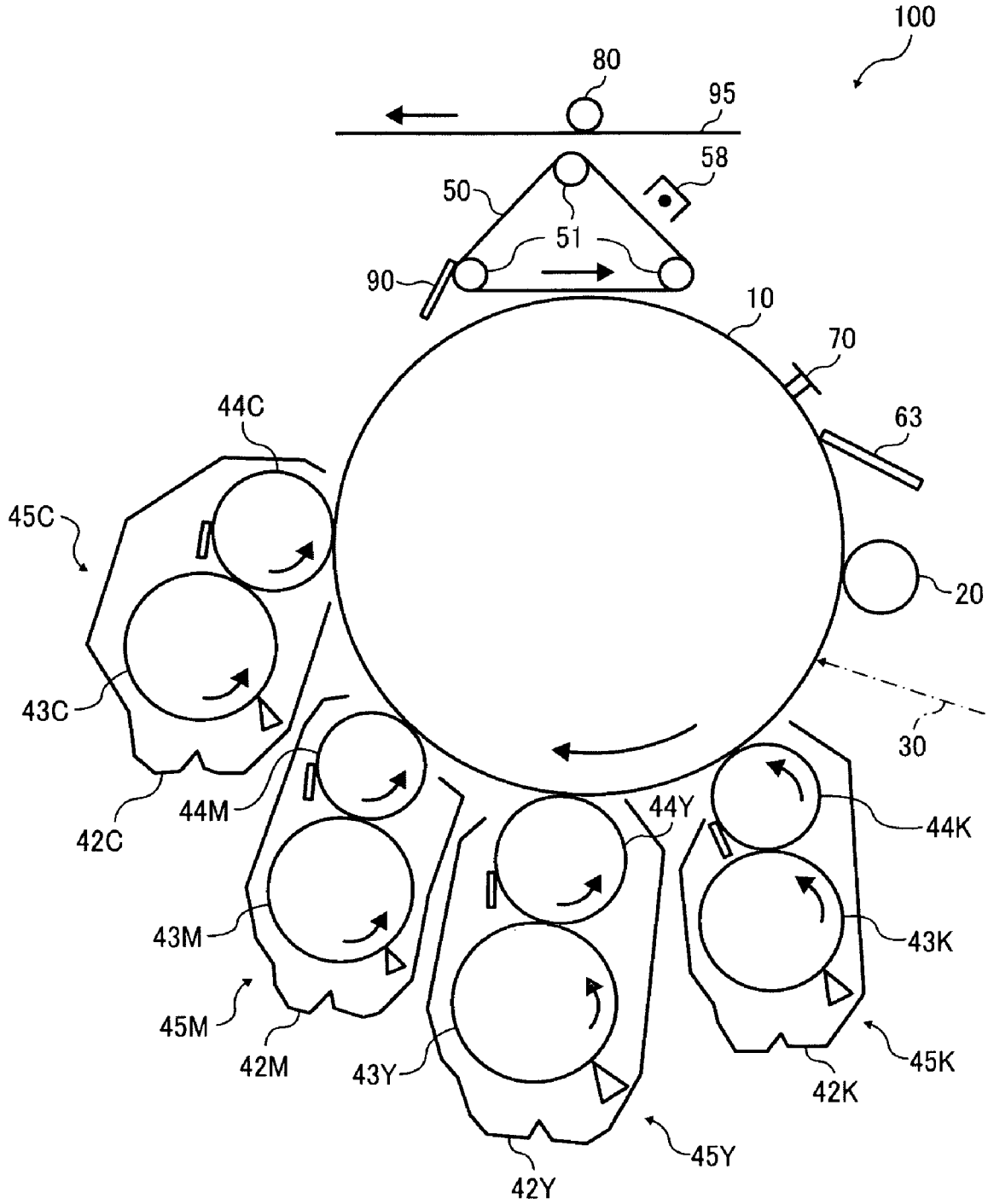
FIG. 7 is a diagram illustrating another example of image formation by the image forming apparatus.

Another embodiment of the image formation by the image forming apparatus of the present invention is described with reference to FIG. 7. The image forming apparatus 100 illustrated in FIG. 7 has the same configuration as the image forming apparatus 100 illustrated in FIG. 6 except that the development belt 41 is not provided and the black development unit 45K, the yellow development unit 45Y, the magenta development unit 45M and the cyan development unit 45C are directly arranged opposing the photoreceptor drum 10. The same reference numbers as in FIG. 6 are used in FIG. 7.

Figure 8:
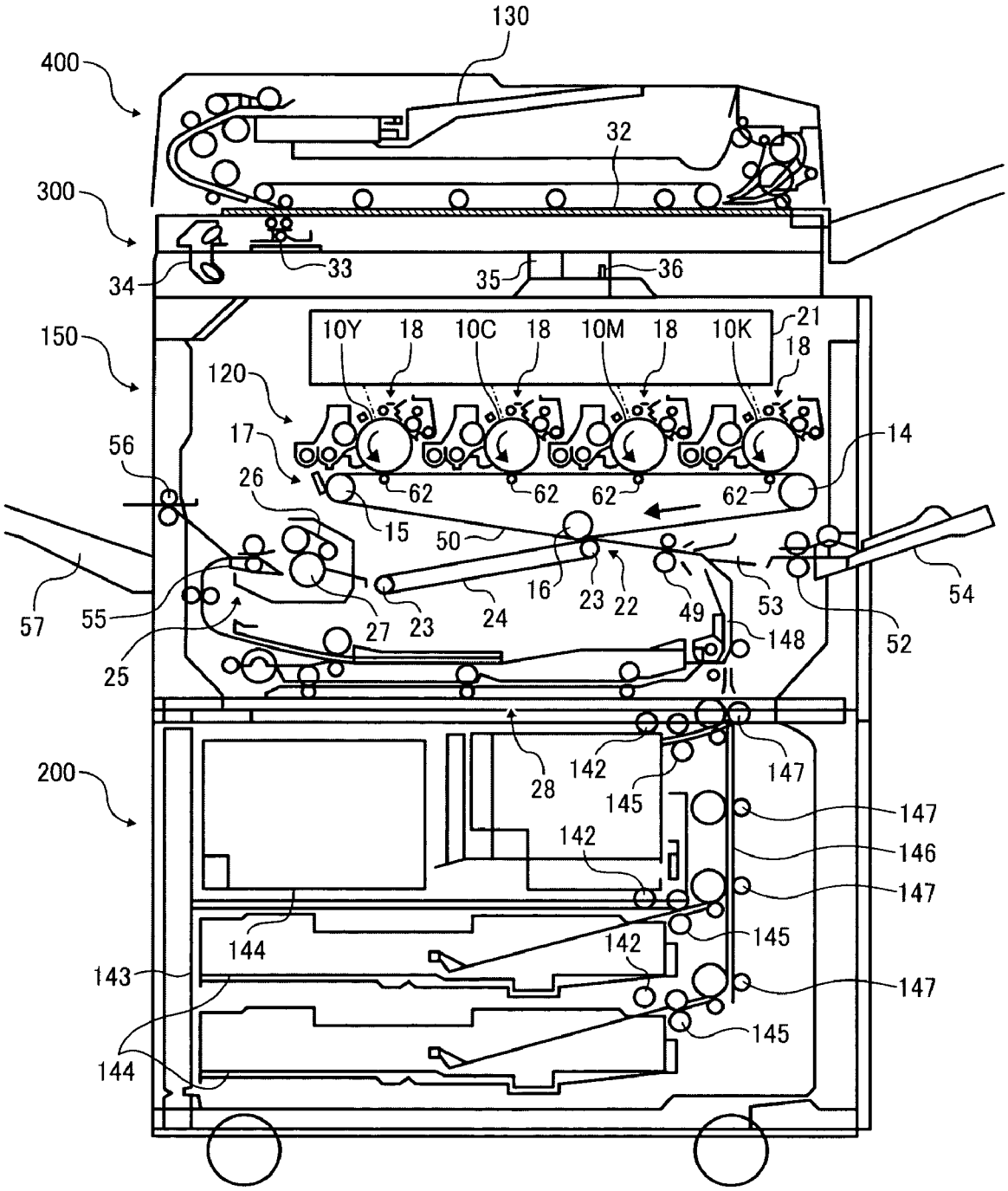
FIG. 8 is a diagram illustrating still another example of image formation by the image forming apparatus.

Another embodiment of the image formation by the image forming apparatus of the present invention is described with reference to FIGS. 8 and 9. The tandem image forming apparatus illustrated in FIG. 8 is a tandem type color image forming apparatus. The tandem type image forming apparatus includes a main body 150, a paper feeder table 200, a scanner 300 and an automatic document feeder (ADF) 400.

The main body 150 has an intermediate transfer body 50 having an endless belt form arranged in the center of the main body 150. The intermediate transfer body 50 is suspended over supporting rollers 14, 15 and 16 and can rotate clockwise in FIG. 8. An intermediate transfer body cleaning device 17 is arranged in the vicinity of the supporting roller 15 to remove the toner remaining on the intermediate transfer body 50. A tandem type development unit 120 is provided along the intermediate transfer body 50 and includes four image formation devices 18 of yellow, cyan, magenta, and black arranged-along the moving direction of the intermediate transfer body 50 while opposing the intermediate transfer body 50 suspended over the supporting rollers 14 and 15. An irradiation device 21 is situated close to the tandem type development unit 120. A secondary transfer device 22 is provided on the opposite side of the tandem type development unit 120 and includes a secondary transfer belt 24 (an endless belt) and a pair of rollers 23 suspending the secondary transfer belt 24. A transfer sheet being transferred on the secondary transfer belt 24 can contact with the intermediate transfer body 50. A fixing device 25 is arranged in the vicinity of the secondary transfer device 22 and includes a fixing belt 26 and a pressing roller 21 pressed thereby. Also, a sheet reversing device 28 is arranged near the secondary transfer device 22 and the fixing device 25 to reverse the side of the transfer sheet for duplex printing.

Next, full color image formation by the tandem type image forming apparatus is described. An original is set on a manual table 130 of the automatic document feeder 400 or a contact glass 32 of a scanner 300 after the automatic document feeder 400 is open and then the automatic document feeder 400 is closed.

When a start switch (not shown) is pressed, the scanner 300 is driven and a first carrier 33 and a second carrier 34 travel immediately in the case in which the original is set on the contact glass 32 or after the original is transferred to the contact glass 32 in the case in which an original is set on the automatic document feeder 400. The original is irradiated with light from the light source by the first carrier 33 and the reflected light from the original is reflected by a mirror of the second carrier 34. Then, the reflected light is received at a scanning sensor 36 by way of an image focus lens 35 to read the color original (color image) and obtain image information of black, yellow, magenta and cyan.

Each image information of black, yellow, magenta and cyan in the tandem type image forming apparatus is relayed to each image formation device 18 (image formation device for black, image formation device for yellow, image formation device for magenta and image formation device for cyan) and each toner image of black, yellow, magenta and cyan is formed by each image formation device. Each image formation device 18 (image formation device for black, image formation device for yellow, image formation device for magenta and image formation device for cyan) in the tandem type image forming apparatus irradiates the corresponding photoreceptor drum 10 (photoreceptor drum 10K for black, photoreceptor drum 10Y for yellow, photoreceptor drum 10M for magenta and photoreceptor drum 10C for cyan) with light L (illustrated in FIG. 9), and uniformly charges the charging device 60 which uniformly charges the photoreceptor drum 10, an irradiating device to irradiate the photoreceptor drum 10 with light 9 to form a latent electrostatic image on the photoreceptor drum 10 corresponding to each color image information, a development device 61 which develops the latent electrostatic image with each color toner (black toner, yellow toner, magenta toner, and cyan toner) to form each color toner image, a transfer charging device 62 to transfer the toner image to the intermediate transfer body 50, a photoreceptor drum cleaning device 63 and a discharging device 64. Each single color toner image (black image, yellow image, magenta image and cyan image) can be formed according to corresponding color image information. The thus formed black image, yellow image, magenta image and cyan image on the photoreceptor drum 10K, the photoreceptor drum 10Y, the photoreceptor drum 10M, and the photoreceptor drum 10C, respectively, are sequentially transferred (primarily transferred) to the intermediate transfer body 50 rotationally driven by the supporting rollers 14, 15 and 16. The black image, the yellow image, the magenta image and the cyan image are overlapped on the intermediate transfer body 50 to obtain a synthesized color image (color transfer image).

One of paper feeder rollers 142 in the paper feeder table 200 is selectively rotated to feed sheets (recording medium) from one of banked paper feeder cassettes 144 and then a separation roller 145 separates sheets one by one and sends it out to a paper feeding path 146. The sheet is guided to a paper feeding path 148 in the main body 150 and stuck at the registration rollers 49. The registration rollers 49 are grounded in general but can be used with a bias applied to remove paper dust of a sheet. The registration rollers 49 are rotated in synchronization with the synthesized color image (transferred color image) and set out the sheet (recording medium) between the intermediate transfer body 50 and the secondary transfer device 22. The secondary transfer device 22 (secondarily) transfers the synthesized color image (transferred color image) to the sheet (recording medium). The toner remaining on the intermediate transfer body 50 after image transfer is removed by an intermediate transfer body cleaning device 17.

Figure 9:
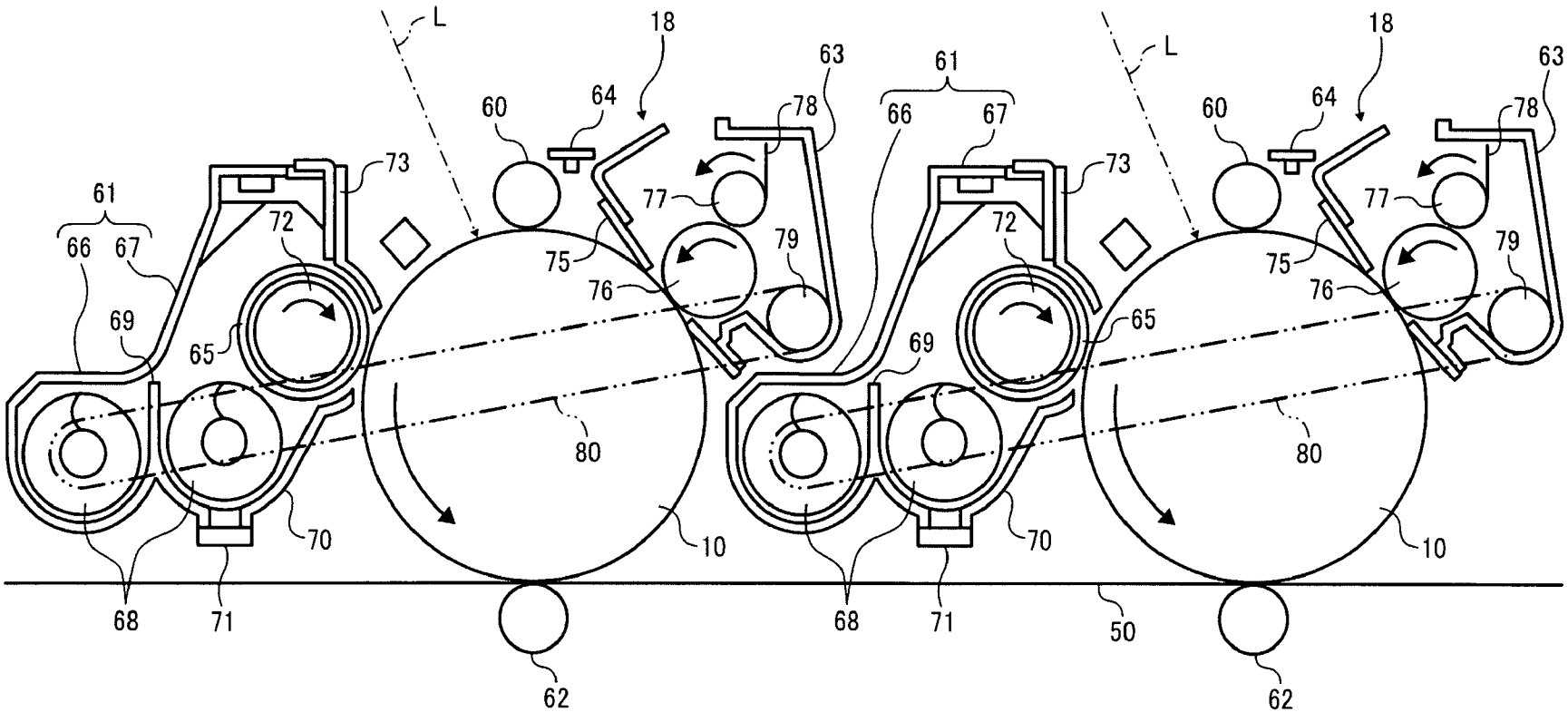
FIG. 9 is a diagram illustrating yet another example of image formation by the image forming apparatus.

FIG. 9 is an enlarged diagram illustrating a portion of the image forming apparatus illustrated in FIG. 8.

Although the development device 61 may use a single component developing agent, a two component developing agent containing a magnetic carrier and a non-magnetic toner is used in FIG. 9. The development device 61 includes a development sleeve 65, a stirring member 66 to supply and attach toner to the development sleeve 65, a development portion 67 to transfer the toner in the two component developing agent attached to the development sleeve 65 to the photoreceptor drum 10. The stirring member 66 is located lower than the development portion 67. The stirring member 66 has two parallel screws 68. A separation board 69 is provided between the two screws 68 except for the end portions thereof. A toner density sensor 71 is attached to a development case 70. The development sleeve 65 is provided to the development portion 67 while facing the photoreceptor drum 10 through an opening of the development case 70. A magnet 72 is fixed to the inside of the development sleeve 65. In addition, a doctor blade 73 is provided to the development sleeve 65 with the front end of the doctor blade 73 close to the development sleeve 65. The two component developing agent is transferred, circulated and supplied to the development sleeve 65 by stirring by the two screws 68. The developing agent supplied to the development sleeve 65 is pumped up by the magnet 72, held there and forms magnetic brush on the development sleeve 65. The magnet brush is regulated by the doctor blade 73 to be a suitable amount as the development sleeve 65 rotates. The developing agent severed from the magnet brush is returned to stirring portion 66. The toner in the developing agent on the development sleeve 65 is transferred to the photoreceptor drum 10 by a development bias applied to the development sleeve 65 to develop and visualize a latent electrostatic image on the photoreceptor drum 10. After visualization of the image, the developing agent remaining on the development sleeve 65 is detached from the development sleeve 65 at a portion where the magnetic force of the magnet 72 is not present and returned to the stirring portion 66. When the toner density in the stirring portion 66 is thin, the toner density sensor 71 detects it and the toner is replenished to the stirring portion 66. A photoreceptor drum cleaning device 63 has a cleaning blade formed of, for example, polyurethane rubber with its front end pressed against the photoreceptor drum 10. A contact brush can be used in combination to improve the cleaning property of the photoreceptor drum 10. In FIG. 9, an electroconductive fur brush 76 the outer surface of which is made in contact with the photoreceptor drum 10 is arranged in a manner that the fur brush 76 can rotate in the direction indicated by an arrow. In addition, a metal electric field roller 77 to apply a bias to the fur brush 76 is provided rotatable in the direction indicated by an arrow. The tip of a scraper 78 is pressed against the metal electric field roller 77. Furthermore, a collection screw 79 to collect the removed toner is provided. The toner remaining on the photoreceptor drum 10 is removed by the fur brush 76 which rotates in the counter direction to the rotation direction of the photoreceptor drum 10. The toner attached to the fur brush 76 is removed by the metal electric field roller 77 which rotates in the counter direction to the fur brush 76 while in contact with the fur brush 76. The toner attached to the metal electric field roller 77 is removed by the scraper 78. The toner collected by the photoreceptor drum cleaning device 63 is moved to one side of the photoreceptor drum cleaning device 63 by a collection screw 79 and retuned to the development device 61 by a toner recycle device 80 for re-use.

The sheet (recording medium) to which the color image has been transferred is moved to the fixing device 25 by the secondary transfer device 22. The synthesized color image (transferred color image) is fixed on the sheet (recording medium) upon application of heat and pressure by the fixing device 25. Thereafter, the sheet (recording medium) is discharged to and stuck on a discharging tray 57 by discharging rollers 56 by way of a switching claw 55 or reversed by the sheet reverse device 28 by way of the switching claw 55, guided back to the transfer point followed by image formation on the reverse side, and discharged to and stuck on the discharging tray 57 by the discharging roller 56.

Process Cartridge

The process cartridge of the present invention includes at least the photoreceptor of the present invention, a development device which develops a latent electrostatic image formed on the photoreceptor with toner to form a visualized image and optional other devices such as a charging device, a transfer device, a cleaning device and a discharging device.

The development device has at least a developing agent container to accommodate toner or developing agent and a developing agent bearing member which bears and transfers the toner or the developing agent accommodated in the developing agent container. Optionally, for example, a layer regulating applicator can be provided to regulate the layer thickness of the toner borne on the photoreceptor.

The process cartridge of the present invention can be detachably attachable to various kinds of image forming apparatuses and is preferably attached to the image forming apparatus of the present invention.

Figure 10:
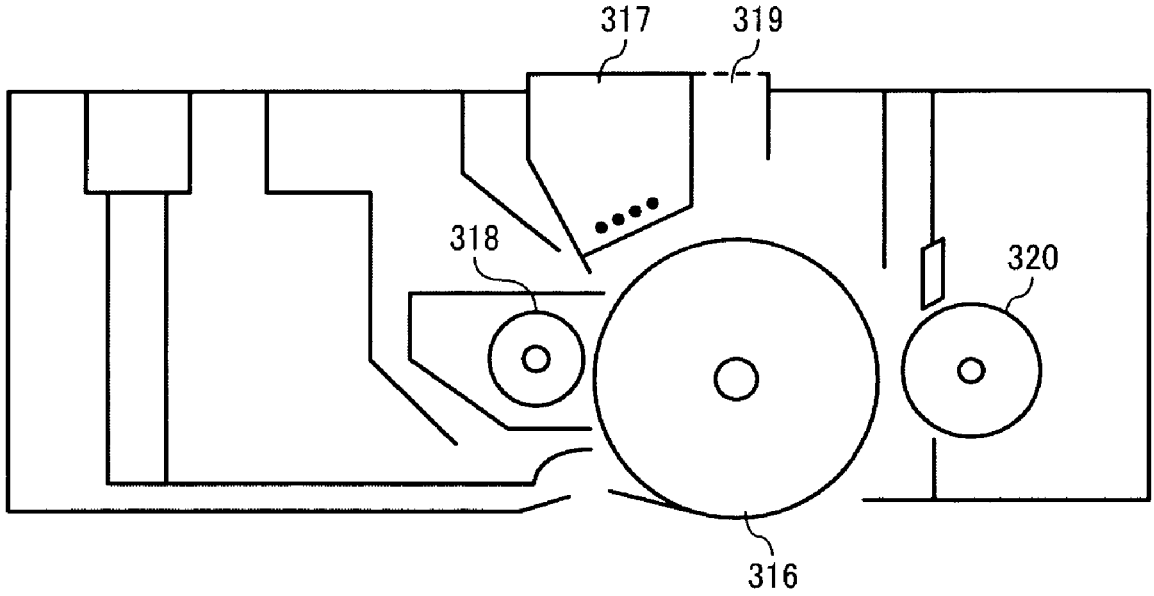
FIG. 10 is a diagram illustrating an example of the configuration of the process cartridge of the present invention.

The process cartridge includes, for example, as illustrated in FIG. 10, a photoreceptor 316, a charging device 317, an irradiation device 319, a development device 320, a cleaning device 318, a transfer device (not shown), a discharging device (not shown) and other optional devices.

Next, the image formation process by the process cartridge illustrated in FIG. 10 is described. While the photoreceptor 316 rotates in the direction indicated by an arrow, the charging device 317 charges the photoreceptor 316 followed by irradiation by the irradiation device 319 to form a latent electrostatic image corresponding, to the irradiation image. This latent electrostatic image is developed with toner by a development device 320. The toner image is transferred to a recording medium by a transfer device (not shown) and printed. Next, the surface of the photoreceptor after image transfer is cleaned by a cleaning device 318 and discharged by a discharging device (not shown) to be ready for the next image formation cycle.

The image forming apparatus of the present invention has a configuration including a process cartridge integrally including the photoreceptor described above and other optional devices such as a development unit and a cleaning device, which can be detachably attachable to the image forming apparatus. Also, the process cartridge can integrally include the photoreceptor and at least one device selected from the group consisting of a charging device, an image irradiation device, a development device, a transfer separation device, and a cleaning device and serve as a single unit detachably attachable to the image forming apparatus by using a guiding device such as a rail attached to the image forming apparatus.

The image formation method, the image forming apparatus and the process cartridge of the present invention are applicable not only to an electrophotographic photocopier but also to the electrophotography applied field including a laser beam printer, a CRT printer, an LED printer, a liquid crystal printer and a laser plate making.

Having generally described preferred embodiments of this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples of manufacturing polysiloxane-acryl block copolymer having a charge transport property are specifically described below but the present invention is not limited thereto.

Manufacturing Example 1

60 g of chlorobenzene is placed in a 300 ml flask equipped with a stirrer, a nitrogen introduction tube, a condenser, a dripping funnel, and a thermometer and heated to 120° C. in nitrogen atmosphere. A liquid mixture of an initiator and a monomer containing 3.45 g of a silicone macro initiator VPS-1001 (manufactured by Wako Pure Chemical Industries, Ltd.) having an azo group having the following structure,

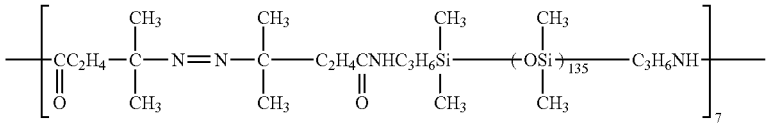

3.45 g of 2-hydroxyethyl methacrylate (HEMA) and 6.9 g of the radical polymerizable monomer (Illustrated Compound No. 54) is dropped to the chlorobenzene in two hours at a constant speed. Thereafter, the system is kept at 120° C. for 3 hours and the resultant is refined by a recycle preparative isolator HPLC (LC-9201, manufactured by Japan Analytical Industry Co., Ltd.). Subsequent to removal of the solvent, a polysiloxane-acryl block copolymer (Block copolymer 1) having a charge transport property is obtained. Standard polystyrene conversion molecular weight based on gel permeation chromatography (GPC) is: Mn=16,200; Mw=65,500; Mw/Mn=4.04.

Manufacturing Example 2

Polysiloxane-acryl block copolymer having a charge transport property (Block copolymer 2) is obtained in the same manner as in Manufacturing Example 1 except that the content of the radical polymerizable monomer (Illustrated Compound No. 54) having a charge transport property is changed to 3.45 g. Standard polystyrene conversion molecular weight of Block copolymer 2 based on gel permeation chromatography (GPC) is: Mn=14,200; Mw=55,500; Mw/Mn=3.91.

Manufacturing Example 3

Polysiloxane-acryl block copolymer having a charge transport property (Block copolymer 3) is obtained in the same manner as in Manufacturing Example 1 except that the radical polymerizable monomer (Illustrated Compound No. 54) having a charge transport property is changed to the illustrated compound No. 160A. Standard polystyrene conversion molecular weight of Block copolymer 3 based on gel permeation chromatography (GPC) is: Mn=17,200; Mw=75,000; Mw/Mn=4.36.

Example 1

An undercoating layer is formed by dipping an Al substrate (having an outer diameter of 30 mm) in the following liquid application for an undercoating layer by a dipping method such that the layer thickness after drying is 3.5 μm.

| Liquid Application for Undercoating Layer | |
|---|---|
| Alkyd resin (Beckozole 1307-60-EL, available from Dainippon Ink and Chemicals, Inc.) | 6 parts |
| Melamine resin (Super-beckamine, G-821-60, manufactured by Dainippon Ink and Chemicals, Inc.) | 4 parts |
| Titanium oxide (CR-EL, manufactured by Ishihara Sangyo Kaisha Ltd.) | 40 parts |
| Methylethylketone | 50 parts |

The resultant is dipped in a liquid application for charge generation layer containing a bisazo pigment having the following chemical structure followed by drying by heat to form a charge generation layer having a layer thickness of 0.2 μm on the undercoating layer.

-continued

| Liquid Application for Charge Generation Layer | |
|---|---|
| Bisazo pigment having the following chemical structure | 2.5 parts |

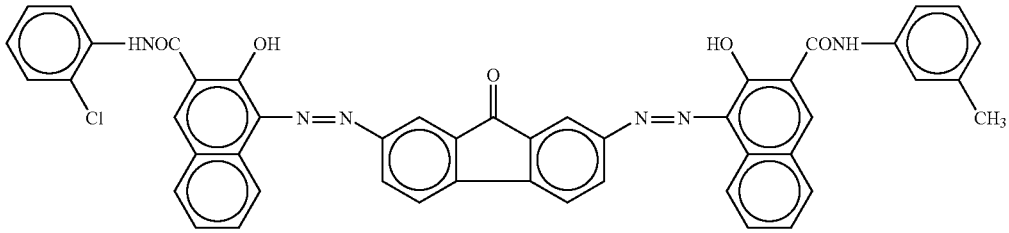

| | |
|---|---|
| Polyvinylbutyral (XYHL, manufactured by Union Carbide Corp.) | 0.5 parts |
| Cyclohexanone | 200 parts |
| Methylethylketone | 80 parts |

The resultant is dipped in a liquid application for charge transport layer having the following chemical structure followed by, drying by heat to form a charge transport layer having a layer thickness of 22 μm on the charge generation layer.

| Liquid application for Charge Transport Layer | |
|---|---|
| Bisphenol Z type polycarbonate | 10 parts |
| Charge transport material having a low molecular weight represented by the following chemical structure | 10 parts |

-continued

Liquid application for Charge Transport Layer

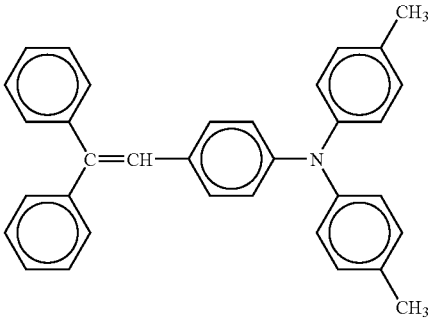

| | |
|---|---|
| Tetrahydrofuran | 80 parts |
| Tetrahydrofuran solution of 1% silicone oil (KF50-100CS, manufactured by Shin-Etsu Chemical Co., Ltd.) | 0.2 parts |

The liquid application for the cross-linking surface layer having the following recipe is applied to the charge transport layer by a spray coating method followed by irradiation by a metal halide lamp with an irradiation intensity of 500 mW/cm$^2$ and an irradiation time of 20 seconds. Furthermore, the resultant is dried at 130° C. for 30 minutes to form a cross-linking surface layer having a thickness of 4.0 μm. The photoreceptor of the present invention is thus obtained.

| Liquid Application for Cross-linking Surface Layer<br>Radical polymerizable monomer (I) having at least three functional groups without a charge transport structure (trimethylol propane triacrylate: KAYARAD TMPTA, manufactured by Nippon Kayaku Co., Ltd. Molecular weight: 382, Number of functional groups: 3, Molecular weight/number of functional groups = 99) | |
|---|---|
| Radical polymerizable monomer having a charge transport structure (Illustrated compound No. 54) | 9 parts |
| Optical polymerization initiator: 1-hydroxy-cyclohexyl-phenyl-ketone (IRGACURE 184, manufactured by Chiba Specialty Chemicals Co., Ltd.) | 1.8 parts |
| Polysiloxane-acryl block copolymer (Block copolymer 1) having a charge transport property | 1.8 parts |
| Tetrahydrofuran | 100 parts |

Example 2

The photoreceptor of Example 2 is manufactured in the same manner as in Example 1 except that Block copolymer 2 is used instead of Block copolymer 1 as the polysiloxane-acryl block copolymer having a charge transport property for liquid application for the cross-linking surface layer. The layer thickness of the cross-linking surface layer is 4.0 μm.

Example 3

The photoreceptor of Example 3 is manufactured in the same manner as in Example 1 except that Block copolymer 3 is used instead of Block copolymer 1 as the polysiloxane-acryl block copolymer having a charge transport property for liquid application for the cross-linking surface layer. The layer thickness of the cross-linking surface layer is 4.0 μm.

Example 4

The photoreceptor of Example 4 is manufactured in the same manner as in Example 1 except that the radical polymerizable monomer (Illustrated compound No. 54, 9 parts) having a charge transport structure for liquid application of the cross-linking surface layer of Example 1 is not used. The layer thickness of the cross-linking surface layer is 2.0 μm.

Example 5

The photoreceptor of Example 5 is manufactured in the same manner as in Example 2 except that the radical polymerizable monomer (Illustrated compound No. 54, 9 parts) having a charge transport structure for liquid application of the cross-linking surface layer of Example 2 is not used. The layer thickness of the cross-linking surface layer is 2.0 μm.

Example 6

The photoreceptor of Example 6 is manufactured in the same manner as in Example 3 except that the radical polymerizable monomer (Illustrated compound No. 54, 9 parts) having a charge transport structure for liquid application of the cross-linking surface layer of Example 3 is not used. The layer thickness of the cross-linking surface layer is 2.0 μm Example 7

The photoreceptor of Example 7 is manufactured in the same manner as in Example 1 except that the illustrated compound No. 160A is used as the radical polymerizable monomer having a charge transport structure for liquid application of the cross-linking surface layer. The layer thickness of the cross-linking surface layer is 4.0 μm.

Example 8

The photoreceptor of Example 8 is manufactured in the same manner as in Example 1 except that the illustrated compound No. 53 is used instead as the radical polymerizable monomer having a charge transport structure for liquid application of the cross-linking surface layer. The layer thickness of the cross-linking surface layer is 4.0 μm.

Example 9

The photoreceptor of Example 9 is manufactured in the same manner as in Example 1 except that the following recipe is used instead of those of Example 1 as the liquid application for the charge transport layer:

| | |
|---|---|
| Charge transport polymer represented by the following chemical structure | 20 parts |

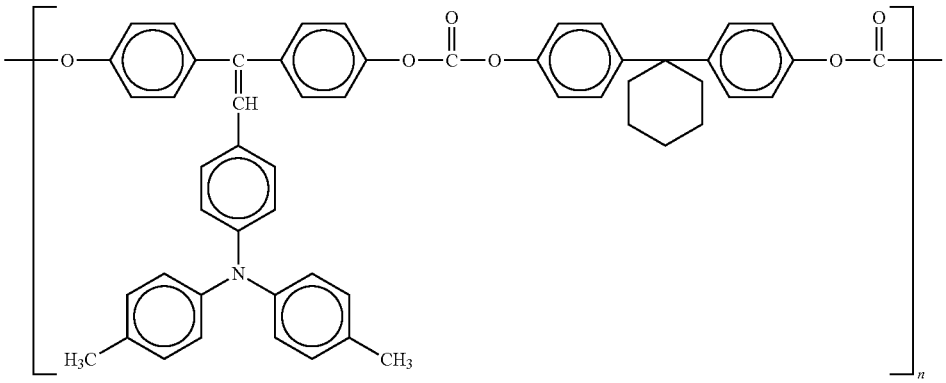

| | |
|---|---|
| Tetrahydrofuran | 100 parts |
| Tetrahydrofuran solution of 1% silicone oil (KF50-100CS, manufactured by Shin-Etsu Chemical Co., Ltd.) | 0.2 parts |

Example 10

The photoreceptor of Example 10 is manufactured in the same manner as in Example 1 except that the radical polymerizable monomer (I) having at least three functional groups without a charge transport structure contained in the liquid application for cross-linking surface layer of Example 1 is changed to the following monomer. The layer thickness of the cross-linking surface layer is 4.0 μm.

Radical polymerizable monomer (I) having at least three functional groups without a charge transport structure Caprolactone modified dipentaerythritol hexa acrylate (KARAYAD DPCA-60, manufactured by Nippon Kayaku Co., Ltd.) (Molecular weight: 1,263, Number of functional groups: 6 functional groups, molecular weight/number of functional groups=211)

Comparative Example 1

The photoreceptor of Comparative Example 1 is manufactured in the same manner as in Example 1 except that the polysiloxane-acryl block copolymer having a charge transport property contained in the liquid application for cross-linking surface layer in Example 1 is not added.

Comparative Example 2

The photoreceptor of Comparative Example 2 is manufactured in the same manner as in Example 1 except that the polysiloxane-acryl block copolymer having a charge transport property contained in the liquid application for cross-linking surface layer in Example 1 is changed to acryl modified polyorganosiloxane (CHARLINE R-170, manufactured by Nisshin Chemical Industry Co., Ltd.).

Comparative Example 3

The photoreceptor of Comparative Example 3 is manufactured in the same manner as in Example 1 except that the radical polymerizable monomer having at least three functional groups without a charge transport structure contained in the liquid application for cross-linking surface layer of Example 1 is not contained and the content of the radical polymerizable monomer having a charge transport structure is changed to 18 parts.

Comparative Example 4

The photoreceptor of Comparative Example 4 is manufactured in the same manner as in Example 1 except that the radical polymerizable monomer having a charge transport property in the liquid application for cross-linking surface layer of Example 1 is not contained and the content of the radical polymerizable monomer (I) having at least three functional groups without a charge transport structure is changed to 18 parts.

Comparative Example 5

The photoreceptor of Comparative Example 5 is manufactured in the same manner as in Example 1 except that the radical polymerizable monomer having a charge transport property in the liquid application for cross-linking surface layer of Example 1 is changed to the charge transport material having a low molecular weight for use in the liquid application for the charge transport layer in Example 1.

Comparative Example 6

The photoreceptor of Comparative Example 6 is manufactured in the same manner as in Example 1 except that the polysiloxane-acryl block copolymer having a charge transport property is changed to polysiloxane particulates (TORAYFIL R-902A, manufactured by Dow Corning Toray Co., Ltd.).

Comparative Example 7

The photoreceptor of Comparative Example 7 is manufactured in the same manner as in Example 1 except that the polysiloxane-acryl block copolymer having a charge transport property is changed to tetrafluoroethylene resin particles (Lubron L-2, manufactured by Diakin Industries, Ltd.).

Comparative Example 8

The photoreceptor of Comparative Example 8 is manufactured in the same manner as in Example 1 except that the polysiloxane-acryl block copolymer having a charge transport property is changed to reactive silicone (bi-terminal SIIAPLANE, FM7721, manufactured by Chisso Corporation.).

Test Method

Image Output Test

Machine: Color laser printer IPSiO SPC810, manufactured by Ricoh Co., Ltd.

Charging device: non-contact and vicinity type roller system

Irradiation device: 655 nm laser beam scanning system

Development device: ester elongation polymerization toner (two component development system) (toner obtained by the method described in Example 1 of JOP 2003-202701: Volume average particle diameter: 6.03 μm: Number average particle diameter: 5.52 μm: Dv/Dn=1.09: Circularity: 0.951)

Transfer device: Direct transfer system

Cleaning device: Blade cleaning system (using urethane rubber blade formed by polyurethane cross-linking)

The lubricant application mechanism is removed from the color laser printer described above and the photoreceptors manufactured in Examples 1 to 10 and Comparative Examples 1 to 8 are set in the process cartridge for the color laser printer by turns. A run length of 150,000 sheet (A4, My Paper, manufactured by NBS Ricoh Co., Ltd.) actual machine test with a starting charging voltage of −600 V) is performed for each photoreceptor to evaluate anti-abrasion property, the voltage in the machine and the images. The results are shown in Tables 1 to 3.

In Table 1, the layer thickness of the photoreceptors is measured at 10 points for the same places before and after image outputs by an eddy current contact type layer thickness meter and the average thereof is obtained. The difference in the layer thicknesses between before and after the image outputs is determined as the amount of abrasion of the photoreceptor. A large amount of abrasion represents a large scraped amount of the photoreceptor, meaning that the photoreceptor does not have a good abrasion property.

Table 2 is a table indicating the initial values of the charging voltage of the photoreceptors and variances every 50,000 sheets (until 150,000 sheets).

Table 3 represents the initial values of the image characteristics (image density and streaks on image) and status every 50,000 sheets (until 150,000 sheets).

TABLE 1

| | Amount of abrasion (μm) | | | |
|---|---|---|---|---|
| | 50,000th image | 100,000th image | 150,000th image | Memo |
| Example 1 | 0.41 | 0.82 | 1.24 | |
| Example 2 | 0.47 | 0.88 | 1.70 | |
| Example 3 | 0.51 | 1.05 | 1.68 | |
| Example 4 | 0.48 | 0.99 | 1.42 | |
| Example 5 | 0.62 | 1.21 | 1.88 | |
| Example 6 | 0.50 | 1.13 | 1.62 | |
| Example 7 | 0.63 | 1.28 | 2.13 | |
| Example 8 | 0.64 | 1.29 | 2.01 | |
| Example 9 | 0.49 | 1.00 | 1.53 | |

TABLE 1-continued

| | Amount of abrasion (μm) | | | |
|---|---|---|---|---|
| | 50,000th image | 100,000th image | 150,000th image | Memo |
| Example 10 | 0.53 | 0.90 | 1.59 | |
| Comparative Example 1 | 1.68 | — | — | Ceased due to bad cleaning performance |
| Comparative Example 2 | 2.96 | — | — | Ceased due to disappearance of surface layer |
| Comparative Example 3 | — | — | — | Ceased due to occurrence of images having streaks |
| Comparative Example 4 | — | — | — | Ceased due to large voltage at irradiation portion |
| Comparative Example 5 | 1.85 | 3.60 | — | Ceased due to disappearance of surface layer |
| Comparative Example 6 | — | — | — | Ceased due to bad cleaning performance |
| Comparative Example 7 | — | — | — | Ceased due to large voltage at irradiation portion |
| Comparative Example 8 | — | — | — | Ceased due to bad cleaning performance |

TABLE 2

| | Charging voltage (−V) | | | | | | | |
|---|---|---|---|---|---|---|---|---|
| | Initial | | 50,000th image | | 100,000th image | | 150,000th image | |
| | Dark | Light | Dark | Light | Dark | Light | Dark | Light |
| Example 1 | 600 | 60 | 605 | 65 | 600 | 65 | 595 | 60 |
| Example 2 | 600 | 50 | 600 | 70 | 595 | 80 | 590 | 85 |
| Example 3 | 600 | 55 | 600 | 60 | 595 | 65 | 600 | 65 |
| Example 4 | 600 | 40 | 605 | 55 | 600 | 60 | 610 | 70 |
| Example 5 | 600 | 70 | 600 | 75 | 605 | 80 | 605 | 85 |
| Example 6 | 600 | 55 | 595 | 55 | 600 | 65 | 595 | 70 |
| Example 7 | 600 | 60 | 600 | 65 | 605 | 70 | 600 | 75 |
| Example 8 | 600 | 75 | 605 | 75 | 605 | 80 | 605 | 85 |
| Example 9 | 600 | 70 | 590 | 75 | 600 | 80 | 600 | 90 |
| Example 10 | 600 | 80 | 615 | 85 | 610 | 85 | 610 | 90 |
| Comparative Example 1 | 600 | 45 | 595 | 60 | — | — | — | — |
| Comparative Example 2 | 600 | 60 | 600 | 90 | — | — | — | — |
| Comparative Example 3 | 600 | 30 | — | — | — | — | — | — |
| Comparative Example 4 | 600 | 200 | — | — | — | — | — | — |
| Comparative Example 5 | 600 | 50 | 595 | 60 | 600 | 60 | — | — |
| Comparative Example 6 | 600 | 70 | — | — | — | — | — | — |
| Comparative Example 7 | 600 | 250 | — | — | — | — | — | — |
| Comparative Example 8 | 600 | 60 | — | — | — | — | — | — |

TABLE 3

| | Image density | | | | Images with streaks | | | |
|---|---|---|---|---|---|---|---|---|
| | Initial | 50,000th image | 100,000th image | 150,000th image | Initial | 50,000th image | 100,000th image | 150,000th image |
| Example 1 | G | G | G | G | G | G | G | G |
| Example 2 | G | G | G | G | G | G | G | G |
| Example 3 | G | G | G | F | G | G | G | G |
| Example 4 | G | G | G | G | G | G | G | G |
| Example 5 | G | G | G | F | G | G | G | G |
| Example 6 | G | G | G | G | G | G | G | G |
| Example 7 | G | G | G | G | G | G | G | G |
| Example 8 | G | G | G | G | G | G | G | G |
| Example 9 | G | G | G | G | G | G | G | G |
| Example 10 | G | G | G | F | G | G | G | G |
| Comparative Example 1 | G | B | — | — | G | B | — | — |
| Comparative Example 2 | G | G | — | — | G | G | — | — |
| Comparative Example 3 | B | — | — | — | G | — | — | — |
| Comparative Example 4 | F | — | — | — | B | — | — | — |
| Comparative Example 5 | G | G | B | — | G | F | B | — |
| Comparative Example 6 | G | — | — | — | G | — | — | — |
| Comparative Example 7 | F | — | — | — | G | — | — | — |
| Comparative Example 8 | G | — | — | — | G | — | — | — |

Image with streaks
G: Good
F: Fair (streaks observed locally)
B: Bad (streaks all over the image)
Image density
G: Good
F: Fair (slightly deteriorated)
B: Bad (deteriorated)

Since Comparative Example 1 does not contain the polysiloxane-acryl block copolymer having a charge transport property for use in the present invention, the cleaning performance is bad, streaks are observed all over on the image on 50,000$^{th}$ sheet and the image density decreases.

Comparative Example 2 contains the polysiloxane-acryl block copolymer. However, since the compatibility with other cross-liking surface compositions is construed to be bad, the cross-linking density of the cross-linking layer obtained is low, which accounts for the large amount of abrasion.

The cross-linking surface layer of Comparative Example 3 has cracking all over the layer immediately after the layer is formed. Resultantly, streaks are observed all over the obtained images.

Comparative Examples 4 and 7 have large voltages for the irradiated portions from the start and the image density reduces.

Since Comparative Example 5 contains a non-reactive low molecular weight charge transport material in the cross-linking layer, the amount of abrasion is large.

Polysiloxane particulates, widely used as a lubricant, are added to the cross-linking layer in Comparative Example 6. However, since the particulates and the cross-linking layer resin do not have good compatibility, the cleaning performance deteriorates and streaks are observed all over the 50,000$^{th}$ image and the image density deteriorates.

The photoreceptor of Comparative Example 8 has a smooth surface. However, the reactive silicone does not have a structure compatible with the binder resin. Therefore, when the cross-liking surface layer is dried, the reactive silicone moves to the uppermost surface layer, thereby deficient in sustainable cleaning property.

As seen in Tables 1 to 3, it is found that since a polysiloxane-acryl block copolymer having a charge transport property is dispersed in the surface of the photoreceptor of the present invention and the surface layer is formed by curing at least radical polymerizable monomer having at least three functional groups without a charge transport structure and a radical polymerizable monomer having a charge transport property, the photoreceptor has a long working life while producing quality images with high performance for an extended period of time. It is also found that the image formation process, the image forming apparatus and the process cartridge therefor are of high performance and high reliability.

This document claims priority and contains subject matter related to Japanese Patent Application No. 2007-308988, filed on Nov. 29, 2008, the entire contents of which are incorporated herein by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. A photoreceptor comprising:

an electroconductive substrate; and a photosensitive layer located overlying the electroconductive substrate, the photosensitive layer including a cross-linking surface layer including a cross-linked copolymer of a radical polymerizable monomer (I) having at least three functional groups without a charge transport structure and a radical polymerizable monomer (II) having a charge transport structure, and a polysiloxane-acryl block copolymer having a charge transport property.

2. The photoreceptor according to claim 1, wherein the polysiloxane-acryl block copolymer is formed by using a radical polymerizable monomer (III) having a charge transport structure represented by the following chemical structure (1) or (2):

Chemical Structure (1)

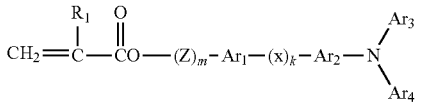

Chemical Structure (2)

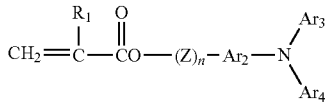

where $R_1$, represents hydrogen atom, a halogen atom, a substituted or non-substituted alkyl group, a substituted or non-substituted aralkyl group, a substituted or non-substituted aryl group, cyano group, nitro group or an alkoxy group, or —$COOR_7$ ($R_7$ represents hydrogen atom, a substituted or non-substituted alkyl group, a substituted or non-substituted aralkyl group, or a substituted or non-substituted aryl group); a halogenated carbonyl group or $CONR_8R_9$ ($R_8$ and $R_9$ each, independently, represent hydrogen atom, a halogen atom, a substituted or non-substituted alkyl group, a substituted or non-substituted aralkyl group, or a substituted or non-substituted aryl group); $Ar_1$ and $Ar_2$ each, independently, represent an arylene group; $Ar_3$ and $Ar_4$ each, independently, represent a substituted or unsubstituted aryl group; X represents an alkylene group, a cycloalkylene group, an alkylene ether group, oxygen atom, sulfur atom, or vinylene group; Z represents an alkylene group, an alkylene ether group, an alkyleneoxy carbonyl group or a phenyl alkylene group; k represents 0 or 1 and m and n each, independently, represent 0 or an integer of from 1 to 3.

3. The photoreceptor according to claim 2, wherein the polysiloxane-acryl block copolymer is formed by using a radical polymerizable monomer (IV) having a charge transport structure represented by the following chemical structure (3):

Chemical structure (3)

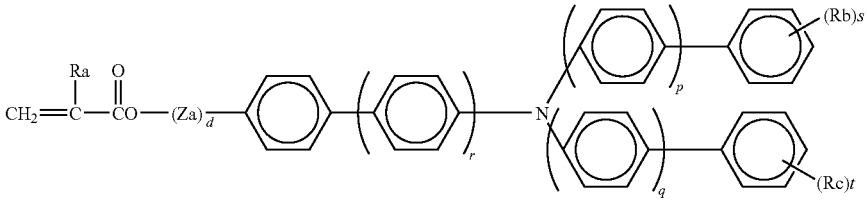

where d, r, p, q each, independently, represent 0 or 1, s and t each, independently, represent 0 or an integer of from 1 to 3, Ra represents hydrogen atom or methyl group, Rb and Rc each, independently, represent an alkyl group having 1 to 6 carbon atoms, and Za represents methylene group, ethylene group, —$CH_2CH_2O$—, —$CHCH_3CH_2O$—, or —$C_6H_5CH_2CH_2$—.

4. The photoreceptor according to claim 1, wherein the photosensitive layer has a laminar structure including a charge generation layer, a charge transport layer and the surface layer from the electroconductive substrate side.

5. An image formation method comprising:

forming a latent electrostatic image on the photoreceptor of claim 1;

developing the latent electrostatic image with toner to form a visualized image;

transferring the visualized image to a recording medium; and fixing the visualized image on the recording medium.

6. An image forming apparatus comprising:

the photoreceptor of claim 1;

a latent electrostatic image formation device configured to form a latent electrostatic image on the photoreceptor;

a development device configured to develop the latent electrostatic image with toner to form a visualized image;

a transfer device configured to transfer the visualized image to a recording medium; and a fixing device configured to fix the visualized image on the recording medium.

7. A process cartridge comprising:

the photoreceptor of claim 1; and at least one devices selected from the group consisting of a charging device, a development device, a transfer device, a cleaning device, and a discharging device, wherein the process cartridge is detachably attachable to an image forming apparatus.

* * * * *